US007723602B2

(12) United States Patent
Beckford

(10) Patent No.: US 7,723,602 B2
(45) Date of Patent: May 25, 2010

(54) SYSTEM, COMPUTER PROGRAM AND METHOD FOR QUANTIFYING AND ANALYZING MUSICAL INTELLECTUAL PROPERTY

(76) Inventor: David Joseph Beckford, 43 Mack Avenue, Toronto, Ontario (CA) M1L 1M4

( * ) Notice: Subject to any disclaimer, the term of this patent is extended or adjusted under 35 U.S.C. 154(b) by 1385 days.

(21) Appl. No.: 10/921,987

(22) Filed: Aug. 20, 2004

(65) Prior Publication Data

US 2008/0271592 A1 Nov. 6, 2008

(51) Int. Cl.
*A63H 5/00* (2006.01)

(52) U.S. Cl. ..... 84/609; 84/645; 84/649

(58) Field of Classification Search ..... 84/609, 84/645, 649

See application file for complete search history.

(56) References Cited

U.S. PATENT DOCUMENTS 4,945,804 A * 8/1990 Farrand ..... 84/462
5,119,711 A * 6/1992 Bell et al. ..... 84/622
5,396,828 A * 3/1995 Farrand ..... 84/462
5,451,709 A * 9/1995 Minamitaka ..... 84/609
5,532,425 A * 7/1996 Nakata et al. ..... 84/609
6,140,568 A * 10/2000 Kohler ..... 84/616
6,313,390 B1 * 11/2001 Adriaans et al. ..... 84/645
6,449,661 B1 * 9/2002 Fujishima ..... 710/5
6,658,309 B1 * 12/2003 Abrams et al. ..... 700/94
6,696,631 B2 * 2/2004 Smith et al. ..... 84/645
6,979,767 B2 * 12/2005 Georges et al. ..... 84/609
2003/0008646 A1 * 1/2003 Shanahan ..... 455/418
2003/0183065 A1 * 10/2003 Leach ..... 84/609
2004/0107821 A1 * 6/2004 Alcalde et al. ..... 84/608
2005/0005760 A1 * 1/2005 Hull et al. ..... 84/645

* cited by examiner

*Primary Examiner*—Walter Benson
*Assistant Examiner*—Kawing Chan

(57) ABSTRACT

A method is provided for converting one or more electronic music files into an electronic musical representation. A song framework is provided that includes a plurality of rules and associated processing steps for converting an electronic music file into a song framework output. The song framework output defines one or more framework elements; one or more performance elements; and a performance element collective. The rules and processing steps are applied to each instrument track included in one or more electronic music files, thereby: detecting the one or more performance elements; classifying the performance elements; and mapping the performance elements to the corresponding framework elements. A related method is also provide for preparing the electronic music files before applying the rules and associated processing steps of the song framework. The output of the method of the present invention is a song framework output file. A computer system and computer program is also provided for processing electronic music files in accordance with the method of the invention. One aspect of the computer system is an electronic music registry which includes a database where a plurality of song frame output files are stored. The computer program provides a comparison facility that is operable to compare the electronic musical representations of at least two different electronic music files and establish whether one electronic music file includes original elements of another electronic music file. The computer program also provides a reporting facility that is operable to generate originality reports in regard to one or more electronic music files selected by a user.

21 Claims, 127 Drawing Sheets

| Sample | Source | Index |
|---|---|---|
| | James Brown - Funky Drummer | 01:31 |

| | Verse – 8 Bars | | | | | | | |
|---|---|---|---|---|---|---|---|---|
| | Bar 1 | Bar 2 | Bar 3 | Bar 4 | Bar 5 | Bar 6 | Bar 7 | Bar 8 |
| Tempo | 120 | 120 | 120 | 120 | 120 | 120 | 120 | 120 |
| Time Signature | 4/4 | 4/4 | 4/4 | 4/4 | 4/4 | 4/4 | 4/4 | 4/4 |
| Key | C | C | C | C | C | C | C | C |

| | |
|---|---|
| C | R |

| | | |
|---|---|---|
| S | W | W |

| | |
|---|---|
| C | R |

| | | |
|---|---|---|
| S - C | W ? | W - R |

Figure 36
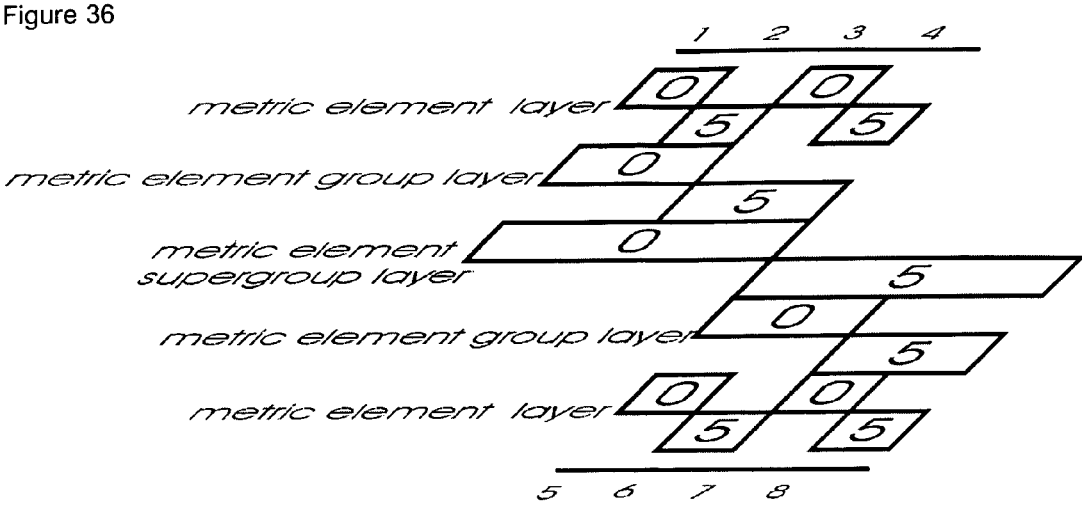
Figure 37
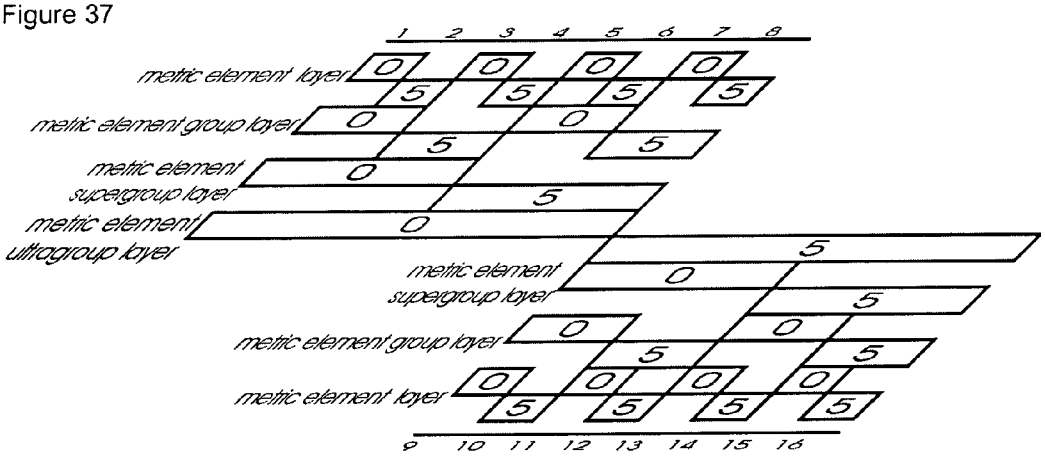
Figure 38
*7 Ttbb*
| | | | | | | |
|---|---|---|---|---|---|---|
| 0 | 0 | 0 | 3 | 3 | 6 | 6 |
| 0 | 3 | 6 | 0 | 5 | 0 | 5 |
| **1** | **2** | **3** | **4** | **5** | **6** | **7** |

*6 Btt*

| Linear Ordering | | | | | |
|---|---|---|---|---|---|
| 00 | 03 | 06 | 50 | 53 | 56 |
| 1 | 2 | 3 | 4 | 5 | 6 |

| Salient Ordering | metric position | Salient weight |
|---|---|---|
| 00 | 1 | 32 |
| 50 | 4 | 16 |
| 03 | 2 | 8 |
| 06 | 3 | 4 |
| 05 | 5 | 2 |
| 55 | 6 | 1 |
| Total Salient weight | | 63 |

*7 Ttbb*

| Linear Ordering | | | | | | |
|---|---|---|---|---|---|---|
| 00 | 03 | 06 | 30 | 35 | 60 | 65 |
| 1 | 2 | 3 | 4 | 5 | 6 | 7 |

| Salient Ordering | metric position | Salient weight |
|---|---|---|
| 00 | 1 | 64 |
| 30 | 4 | 32 |
| 60 | 6 | 16 |
| 03 | 2 | 8 |
| 06 | 3 | 4 |
| 35 | 5 | 2 |
| 65 | 7 | 1 |
| Total Salient weight | | 127 |

Heirarchy of Western Meter

Hierarchy of Western Music

4Bbb

*Carrier Structure*

*Linear Order*

| 1 | 2 | 3 | 4 |
|---|---|---|---|
| 00 | 05 | 50 | 55 |

*Salient Ordering*

| harmonic | position | weight |
|---|---|---|
| 00 | 1 | 8 |
| 50 | 3 | 4 |
| 05 | 2 | 2 |
| 55 | 4 | 1 |
| Salient Sum | | **15** |

8 B+BbbBbb

*Carrier Structure*

*Linear Order*

| 1 | 2 | 3 | 4 | 5 | 6 | 7 | 8 |
|---|---|---|---|---|---|---|---|
| 000 | 005 | 050 | 055 | 500 | 505 | 550 | 555 |

*Salient Ordering*

| harmonic | position | weight |
|---|---|---|
| 000 | 1 | 128 |
| 500 | 5 | 64 |
| 050 | 3 | 32 |
| 550 | 7 | 16 |
| 005 | 2 | 8 |
| 505 | 6 | 4 |
| 055 | 4 | 2 |
| 555 | 8 | 1 |
| Salient Sum | | **255** |

12 T+BbbBbbBBbb

*Carrier Structure*

*Linear Order*

| 1 | 2 | 3 | 4 | 5 | 6 | 7 | 8 | 9 | 10 | 11 | 12 |
|---|---|---|---|---|---|---|---|---|---|---|---|
| 000 | 005 | 050 | 055 | 300 | 305 | 350 | 355 | 600 | 605 | 650 | 655 |

*Salient Ordering*

| harmonic | position | weight |
|---|---|---|
| 000 | 1 | 2048 |
| 300 | 5 | 1024 |
| 600 | 9 | 512 |
| 050 | 3 | 256 |
| 350 | 7 | 128 |
| 650 | 11 | 64 |
| 005 | 2 | 32 |
| 035 | 6 | 16 |
| 605 | 10 | 8 |
| 055 | 4 | 4 |
| 355 | 8 | 2 |
| 655 | 12 | 1 |
| Salient Sum | | **4095** |

Figure 62 16 B++B+BbbBbbB+BbbBbb

*Carrier Structure*

*Linear Order*

| 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|
| 0000 | 0005 | 0050 | 0055 | 0500 | 0505 | 0550 | 0555 | 5000 | 5005 | 5050 | 5055 | 5500 | 5505 | 5550 | 5555 |

*Salient Ordering*

| harmonic | position | weight |
|---|---|---|
| 0000 | 1 | 32768 |
| 5000 | 9 | 16384 |
| 0500 | 5 | 8192 |
| 5500 | 13 | 4096 |
| 0050 | 3 | 2048 |
| 5050 | 11 | 1024 |
| 0550 | 7 | 512 |
| 5550 | 15 | 256 |
| 0005 | 2 | 128 |
| 5005 | 10 | 64 |
| 0505 | 6 | 32 |
| 5505 | 14 | 16 |
| 0055 | 4 | 8 |
| 5055 | 12 | 4 |
| 0555 | 8 | 2 |
| 5555 | 16 | 1 |
| Salient Sum | | **65535** |

5Bbt

*Carrier Structure*

*Linear Order*

| 1 | 2 | 3 | 4 | 5 |
|---|---|---|---|---|
| 00 | 05 | 50 | 53 | 56 |

*Salient Ordering*

| harmonic | position | weight |
|---|---|---|
| 00 | 1 | 16 |
| 50 | 3 | 8 |
| 53 | 4 | 4 |
| 05 | 2 | 2 |
| 56 | 5 | 1 |
| Salient Sum | | **31** |

5Btb

*Carrier Structure*

*Linear Order*

| 1 | 2 | 3 | 4 | 5 |
|---|---|---|---|---|
| 00 | 03 | 06 | 50 | 55 |

*Salient Ordering*

| harmonic | position | weight |
|---|---|---|
| 00 | 1 | 16 |
| 50 | 4 | 8 |
| 03 | 2 | 4 |
| 06 | 3 | 2 |
| 55 | 5 | 1 |
| Salient Sum | | **31** |

6Btt

*Carrier Structure*

*Linear Order*

| 1 | 2 | 3 | 4 | 5 | 6 |
|---|---|---|---|---|---|
| 00 | 03 | 06 | 50 | 53 | 56 |

*Salient Ordering*

| harmonic | position | weight |
|---|---|---|
| 00 | 1 | 32 |
| 50 | 4 | 16 |
| 03 | 2 | 8 |
| 53 | 5 | 4 |
| 06 | 3 | 2 |
| 56 | 6 | 1 |
| Salient Sum | | **63** |

6Tbbb

*Carrier Structure*

*Linear Order*

| 1 | 2 | 3 | 4 | 5 | 6 |
|---|---|---|---|---|---|
| 00 | 05 | 30 | 35 | 60 | 65 |

*Salient Ordering*

| harmonic | position | weight |
|---|---|---|
| 00 | 1 | 32 |
| 30 | 3 | 16 |
| 60 | 5 | 8 |
| 05 | 2 | 4 |
| 35 | 4 | 2 |
| 65 | 6 | 1 |
| Salient Sum | | **63** |

7 Tbbt

*Carrier Structure*

*Linear Order*

| 1 | 2 | 3 | 4 | 5 | 6 | 7 |
|---|---|---|---|---|---|---|
| 00 | 05 | 30 | 35 | 60 | 63 | 66 |

*Salient Ordering*

| harmonic | position | weight |
|---|---|---|
| 00 | 1 | 64 |
| 30 | 3 | 32 |
| 60 | 5 | 16 |
| 63 | 6 | 8 |
| 05 | 2 | 4 |
| 35 | 4 | 2 |
| 66 | 7 | 1 |
| Salient Sum | | **127** |

7 Tbtb

*Carrier Structure*

*Linear Order*

| 1 | 2 | 3 | 4 | 5 | 6 | 7 |
|---|---|---|---|---|---|---|
| 00 | 05 | 30 | 33 | 36 | 60 | 65 |

*Salient Ordering*

| harmonic | position | weight |
|---|---|---|
| 00 | 1 | 64 |
| 30 | 3 | 32 |
| 60 | 6 | 16 |
| 33 | 4 | 8 |
| 05 | 2 | 4 |
| 36 | 5 | 2 |
| 65 | 7 | 1 |
| Salient Sum | | **127** |

7 Ttbb

*Carrier Structure*

*Linear Order*

| 1 | 2 | 3 | 4 | 5 | 6 | 7 |
|---|---|---|---|---|---|---|
| 00 | 03 | 06 | 30 | 35 | 60 | 65 |

*Salient Ordering*

| harmonic | position | weight |
|---|---|---|
| 00 | 1 | 64 |
| 30 | 4 | 32 |
| 60 | 6 | 16 |
| 03 | 2 | 8 |
| 06 | 3 | 4 |
| 35 | 5 | 2 |
| 65 | 7 | 1 |
| Salient Sum | | **127** |

8 Tttb

*Carrier Structure*

*Linear Order*

| 1 | 2 | 3 | 4 | 5 | 6 | 7 | 8 |
|---|---|---|---|---|---|---|---|
| 00 | 03 | 06 | 30 | 33 | 36 | 60 | 65 |

*Salient Ordering*

| harmonic | position | weight |
|---|---|---|
| 00 | 1 | 128 |
| 30 | 4 | 64 |
| 60 | 7 | 32 |
| 03 | 2 | 16 |
| 33 | 5 | 8 |
| 06 | 3 | 4 |
| 36 | 6 | 2 |
| 65 | 8 | 1 |
| Salient Sum | | **255** |

8 Ttbt

*Carrier Structure*

*Linear Order*

| 1 | 2 | 3 | 4 | 5 | 6 | 7 | 8 |
|---|---|---|---|---|---|---|---|
| 00 | 03 | 06 | 30 | 35 | 60 | 63 | 66 |

*Salient Ordering*

| harmonic | position | weight |
|---|---|---|
| 00 | 1 | 128 |
| 30 | 4 | 64 |
| 60 | 6 | 32 |
| 03 | 2 | 16 |
| 63 | 7 | 8 |
| 06 | 3 | 4 |
| 35 | 5 | 2 |
| 66 | 8 | 1 |
| Salient Sum | | **255** |

8 Tbtt

*Carrier Structure*

*Linear Order*

| 1 | 2 | 3 | 4 | 5 | 6 | 7 | 8 |
|---|---|---|---|---|---|---|---|
| 00 | 05 | 30 | 33 | 36 | 60 | 63 | 66 |

*Salient Ordering*

| harmonic | position | weight |
|---|---|---|
| 00 | 1 | 128 |
| 30 | 3 | 64 |
| 60 | 6 | 32 |
| 33 | 4 | 16 |
| 63 | 7 | 8 |
| 05 | 2 | 4 |
| 36 | 5 | 2 |
| 66 | 8 | 1 |
| Salient Sum | | **255** |

9 Tttt

*Carrier Structure*

*Linear Order*

| 1 | 2 | 3 | 4 | 5 | 6 | 7 | 8 | 9 |
|---|---|---|---|---|---|---|---|---|
| 00 | 03 | 06 | 30 | 33 | 36 | 60 | 63 | 66 |

*Salient Ordering*

| harmonic | position | weight |
|---|---|---|
| 00 | 1 | 256 |
| 30 | 4 | 128 |
| 60 | 7 | 64 |
| 03 | 2 | 32 |
| 33 | 5 | 16 |
| 63 | 8 | 8 |
| 06 | 3 | 4 |
| 36 | 6 | 2 |
| 66 | 9 | 1 |
| Salient Sum | | **511** |

9 B+BbtBbb

*Carrier Structure*

*Linear Order*

| 1 | 2 | 3 | 4 | 5 | 6 | 7 | 8 | 9 |
|---|---|---|---|---|---|---|---|---|
| 000 | 005 | 050 | 053 | 056 | 500 | 505 | 550 | 555 |

*Salient Ordering*

| harmonic | position | weight |
|---|---|---|
| 000 | 1 | 256 |
| 500 | 6 | 128 |
| 050 | 3 | 64 |
| 550 | 8 | 32 |
| 053 | 4 | 16 |
| 005 | 2 | 8 |
| 505 | 7 | 4 |
| 056 | 5 | 2 |
| 555 | 9 | 1 |
| Salient Sum | | **511** |

9 B+BtbBbb

*Carrier Structure*

*Linear Order*

| 1 | 2 | 3 | 4 | 5 | 6 | 7 | 8 | 9 |
|---|---|---|---|---|---|---|---|---|
| 000 | 003 | 006 | 050 | 055 | 500 | 505 | 550 | 555 |

*Salient Ordering*

| harmonic | position | weight |
|---|---|---|
| 000 | 1 | 256 |
| 500 | 6 | 128 |
| 050 | 4 | 64 |
| 550 | 8 | 32 |
| 003 | 2 | 16 |
| 006 | 3 | 8 |
| 505 | 7 | 4 |
| 055 | 5 | 2 |
| 555 | 9 | 1 |
| Salient Sum | | **511** |

9 B+BbbBbt

*Carrier Structure*

*Linear Order*

| 1 | 2 | 3 | 4 | 5 | 6 | 7 | 8 | 9 |
|---|---|---|---|---|---|---|---|---|
| 000 | 005 | 050 | 055 | 500 | 505 | 550 | 553 | 556 |

*Salient Ordering*

| harmonic | position | weight |
|---|---|---|
| 000 | 1 | 256 |
| 500 | 5 | 128 |
| 050 | 3 | 64 |
| 550 | 7 | 32 |
| 553 | 8 | 16 |
| 005 | 2 | 8 |
| 505 | 6 | 4 |
| 055 | 4 | 2 |
| 556 | 9 | 1 |
| Salient Sum | | **511** |

9 B+BbbBtb

*Carrier Structure*

*Linear Order*

| 1 | 2 | 3 | 4 | 5 | 6 | 7 | 8 | 9 |
|---|---|---|---|---|---|---|---|---|
| 000 | 005 | 050 | 055 | 500 | 503 | 506 | 550 | 555 |

*Salient Ordering*

| harmonic | position | weight |
|---|---|---|
| 000 | 1 | 256 |
| 500 | 5 | 128 |
| 050 | 3 | 64 |
| 550 | 8 | 32 |
| 503 | 6 | 16 |
| 005 | 2 | 8 |
| 506 | 7 | 4 |
| 055 | 4 | 2 |
| 555 | 9 | 1 |
| Salient Sum | | **511** |

10 B+TbbbBbb

*Carrier Structure*

*Linear Order*

| 1 | 2 | 3 | 4 | 5 | 6 | 7 | 8 | 9 | 10 |
|---|---|---|---|---|---|---|---|---|---|
| 000 | 005 | 030 | 035 | 060 | 065 | 500 | 505 | 550 | 555 |

*Salient Ordering*

| harmonic | position | weight |
|---|---|---|
| 000 | 1 | 512 |
| 500 | 7 | 256 |
| 030 | 3 | 128 |
| 060 | 5 | 64 |
| 550 | 9 | 32 |
| 005 | 2 | 16 |
| 505 | 8 | 8 |
| 035 | 4 | 4 |
| 065 | 6 | 2 |
| 555 | 10 | 1 |
| Salient Sum | | **1023** |

10 B+BbbTbbb

*Carrier Structure*

*Linear Order*

| 1 | 2 | 3 | 4 | 5 | 6 | 7 | 8 | 9 | 10 |
|---|---|---|---|---|---|---|---|---|---|
| 000 | 005 | 050 | 055 | 500 | 505 | 530 | 535 | 560 | 565 |

*Salient Ordering*

| harmonic | position | weight |
|---|---|---|
| 000 | 1 | 512 |
| 500 | 5 | 256 |
| 530 | 7 | 128 |
| 050 | 3 | 64 |
| 560 | 9 | 32 |
| 005 | 2 | 16 |
| 505 | 6 | 8 |
| 535 | 8 | 4 |
| 055 | 4 | 2 |
| 565 | 10 | 1 |
| Salient Sum | | **1023** |

10 B+BbbBtt

*Carrier Structure*

*Linear Order*

| 1 | 2 | 3 | 4 | 5 | 6 | 7 | 8 | 9 | 10 |
|---|---|---|---|---|---|---|---|---|---|
| 000 | 005 | 050 | 055 | 500 | 503 | 506 | 550 | 553 | 556 |

*Salient Ordering*

| harmonic | position | weight |
|---|---|---|
| 000 | 1 | 512 |
| 500 | 5 | 256 |
| 050 | 3 | 128 |
| 550 | 8 | 64 |
| 503 | 6 | 32 |
| 553 | 9 | 16 |
| 005 | 2 | 8 |
| 506 | 7 | 4 |
| 055 | 4 | 2 |
| 556 | 10 | 1 |
| Salient Sum | | **1023** |

10 B+BttBbb

*Carrier Structure*

10 B+BbtBbt

*Carrier Structure*

*Linear Order*

| 1 | 2 | 3 | 4 | 5 | 6 | 7 | 8 | 9 | 10 |
|---|---|---|---|---|---|---|---|---|---|
| 000 | 005 | 050 | 053 | 056 | 500 | 505 | 550 | 553 | 556 |

*Salient Ordering*

| harmonic | position | weight |
|---|---|---|
| 000 | 1 | 512 |
| 500 | 6 | 256 |
| 050 | 3 | 128 |
| 550 | 8 | 64 |
| 053 | 4 | 32 |
| 553 | 9 | 16 |
| 005 | 2 | 8 |
| 505 | 7 | 4 |
| 056 | 5 | 2 |
| 556 | 10 | 1 |
| Salient Sum | | **1023** |

10 B+BbtBtb

*Carrier Structure*

*Linear Order*

| 1 | 2 | 3 | 4 | 5 | 6 | 7 | 8 | 9 | 10 |
|---|---|---|---|---|---|---|---|---|---|
| 000 | 005 | 050 | 053 | 056 | 500 | 503 | 506 | 550 | 555 |

*Salient Ordering*

| harmonic | position | weight |
|---|---|---|
| 000 | 1 | 512 |
| 500 | 6 | 256 |
| 050 | 3 | 128 |
| 550 | 9 | 64 |
| 503 | 7 | 32 |
| 053 | 4 | 16 |
| 005 | 2 | 8 |
| 506 | 8 | 4 |
| 056 | 5 | 2 |
| 555 | 10 | 1 |
| Salient Sum | | **1023** |

10 B+BtbBbt

*Carrier Structure*

*Linear Order*

| 1 | 2 | 3 | 4 | 5 | 6 | 7 | 8 | 9 | 10 |
|---|---|---|---|---|---|---|---|---|---|
| 000 | 003 | 006 | 050 | 055 | 500 | 505 | 550 | 553 | 556 |

*Salient Ordering*

| harmonic | position | weight |
|---|---|---|
| 000 | 1 | 512 |
| 500 | 6 | 256 |
| 050 | 4 | 128 |
| 550 | 8 | 64 |
| 003 | 2 | 32 |
| 553 | 9 | 16 |
| 006 | 3 | 8 |
| 505 | 7 | 4 |
| 055 | 5 | 2 |
| 556 | 10 | 1 |
| Salient Sum | | **1023** |

10 B+BtbBtb

*Carrier Structure*

*Linear Order*

| 1 | 2 | 3 | 4 | 5 | 6 | 7 | 8 | 9 | 10 |
|---|---|---|---|---|---|---|---|---|---|
| 000 | 003 | 006 | 050 | 055 | 500 | 503 | 506 | 550 | 555 |

*Salient Ordering*

| harmonic | position | weight |
|---|---|---|
| 000 | 1 | 512 |
| 500 | 6 | 256 |
| 050 | 4 | 128 |
| 550 | 9 | 64 |
| 003 | 2 | 32 |
| 503 | 7 | 16 |
| 006 | 3 | 8 |
| 506 | 8 | 4 |
| 055 | 5 | 2 |
| 555 | 10 | 1 |
| Salient Sum | | **1023** |

11 B+BbtBtt

*Carrier Structure*

*Linear Order*

| 1 | 2 | 3 | 4 | 5 | 6 | 7 | 8 | 9 | 10 | 11 |
|---|---|---|---|---|---|---|---|---|---|---|
| 000 | 005 | 050 | 053 | 056 | 500 | 503 | 506 | 550 | 553 | 556 |

*Salient Ordering*

| harmonic | position | weight |
|---|---|---|
| 000 | 1 | 1024 |
| 500 | 6 | 512 |
| 050 | 3 | 256 |
| 550 | 9 | 128 |
| 503 | 7 | 64 |
| 053 | 4 | 32 |
| 553 | 10 | 16 |
| 005 | 2 | 8 |
| 506 | 8 | 4 |
| 056 | 5 | 2 |
| 556 | 11 | 1 |
| Salient Sum | | **2047** |

11 B+BbtTbbb

*Carrier Structure*

*Linear Order*

| 1 | 2 | 3 | 4 | 5 | 6 | 7 | 8 | 9 | 10 | 11 |
|---|---|---|---|---|---|---|---|---|---|---|
| 000 | 005 | 050 | 053 | 056 | 500 | 505 | 530 | 535 | 560 | 565 |

*Salient Ordering*

| harmonic | position | weight |
|---|---|---|
| 000 | 1 | 1024 |
| 500 | 6 | 512 |
| 530 | 8 | 256 |
| 050 | 3 | 128 |
| 560 | 10 | 64 |
| 053 | 4 | 32 |
| 005 | 2 | 16 |
| 505 | 7 | 8 |
| 535 | 9 | 4 |
| 056 | 5 | 2 |
| 565 | 11 | 1 |
| Salient Sum | | **2047** |

11 B+BbtBtt

*Carrier Structure*

*Linear Order*

| 1 | 2 | 3 | 4 | 5 | 6 | 7 | 8 | 9 | 10 | 11 |
|---|---|---|---|---|---|---|---|---|---|---|
| 000 | 005 | 050 | 053 | 056 | 500 | 503 | 506 | 550 | 553 | 556 |

*Salient Ordering*

| harmonic | position | weight |
|---|---|---|
| 000 | 1 | 1024 |
| 500 | 6 | 512 |
| 050 | 3 | 256 |
| 550 | 9 | 128 |
| 503 | 7 | 64 |
| 053 | 4 | 32 |
| 553 | 10 | 16 |
| 005 | 2 | 8 |
| 506 | 8 | 4 |
| 056 | 5 | 2 |
| 556 | 11 | 1 |
| Salient Sum | | **2047** |

11 B+BtbBtt

*Carrier Structure*

*Linear Order*

| 1 | 2 | 3 | 4 | 5 | 6 | 7 | 8 | 9 | 10 | 11 |
|---|---|---|---|---|---|---|---|---|---|---|
| 000 | 003 | 006 | 050 | 055 | 500 | 503 | 506 | 550 | 553 | 556 |

*Salient Ordering*

| harmonic | position | weight |
|---|---|---|
| 000 | 1 | 1024 |
| 500 | 6 | 512 |
| 050 | 4 | 256 |
| 550 | 9 | 128 |
| 003 | 2 | 64 |
| 503 | 7 | 32 |
| 553 | 10 | 16 |
| 006 | 3 | 8 |
| 506 | 8 | 4 |
| 055 | 5 | 2 |
| 556 | 11 | 1 |
| Salient Sum | | **2047** |

11 B+BtbTbbb

*Carrier Structure*

*Linear Order*

| 1 | 2 | 3 | 4 | 5 | 6 | 7 | 8 | 9 | 10 | 11 |
|---|---|---|---|---|---|---|---|---|---|---|
| 000 | 003 | 006 | 050 | 055 | 500 | 505 | 530 | 535 | 560 | 565 |

*Salient Ordering*

| harmonic | position | weight |
|---|---|---|
| 000 | 1 | 1024 |
| 500 | 6 | 512 |
| 530 | 8 | 256 |
| 050 | 4 | 128 |
| 560 | 10 | 64 |
| 003 | 2 | 32 |
| 006 | 3 | 16 |
| 505 | 7 | 8 |
| 535 | 9 | 4 |
| 055 | 5 | 2 |
| 565 | 1 | 1 |
| Salient Sum | | **2047** |

11 B+BttBbt

*Carrier Structure*

*Linear Order*

| 1 | 2 | 3 | 4 | 5 | 6 | 7 | 8 | 9 | 10 | 11 |
|---|---|---|---|---|---|---|---|---|---|---|
| 000 | 003 | 006 | 050 | 053 | 056 | 500 | 505 | 550 | 553 | 556 |

*Salient Ordering*

| harmonic | position | weight |
|---|---|---|
| 000 | 1 | 1024 |
| 500 | 7 | 512 |
| 050 | 4 | 256 |
| 550 | 9 | 128 |
| 003 | 2 | 64 |
| 053 | 5 | 32 |
| 553 | 10 | 16 |
| 006 | 3 | 8 |
| 505 | 8 | 4 |
| 056 | 6 | 2 |
| 556 | 11 | 1 |
| Salient Sum | | **2047** |

11 B+BttBtb

*Carrier Structure*

*Linear Order*

| 1 | 2 | 3 | 4 | 5 | 6 | 7 | 8 | 9 | 10 | 11 |
|---|---|---|---|---|---|---|---|---|---|---|
| 000 | 003 | 006 | 050 | 053 | 056 | 500 | 503 | 506 | 550 | 555 |

*Salient Ordering*

| harmonic | position | weight |
|---|---|---|
| 000 | 1 | 1024 |
| 500 | 7 | 512 |
| 050 | 4 | 256 |
| 550 | 10 | 128 |
| 003 | 2 | 64 |
| 503 | 8 | 32 |
| 053 | 5 | 16 |
| 006 | 3 | 8 |
| 506 | 9 | 4 |
| 056 | 6 | 2 |
| 555 | 11 | 1 |
| Salient Sum | | **2047** |

11 B+TbbbBbt

*Carrier Structure*

*Linear Order*

| 1 | 2 | 3 | 4 | 5 | 6 | 7 | 8 | 9 | 10 | 11 |
|---|---|---|---|---|---|---|---|---|---|---|
| 000 | 005 | 030 | 035 | 060 | 065 | 500 | 505 | 550 | 553 | 556 |

*Salient Ordering*

| harmonic | position | weight |
|---|---|---|
| 000 | 1 | 1024 |
| 500 | 7 | 512 |
| 030 | 3 | 256 |
| 060 | 5 | 128 |
| 550 | 9 | 64 |
| 553 | 10 | 32 |
| 005 | 2 | 16 |
| 505 | 8 | 8 |
| 035 | 4 | 4 |
| 065 | 6 | 2 |
| 556 | 11 | 1 |
| Salient Sum | | **2047** |

11 B+TbbbBtb

*Carrier Structure*

*Linear Order*

| 1 | 2 | 3 | 4 | 5 | 6 | 7 | 8 | 9 | 10 | 11 |
|---|---|---|---|---|---|---|---|---|---|---|
| 000 | 005 | 030 | 035 | 060 | 065 | 500 | 503 | 506 | 550 | 555 |

*Salient Ordering*

| harmonic | position | weight |
|---|---|---|
| 000 | 1 | 1024 |
| 500 | 7 | 512 |
| 030 | 3 | 256 |
| 060 | 5 | 128 |
| 550 | 10 | 64 |
| 503 | 8 | 32 |
| 005 | 2 | 16 |
| 506 | 9 | 8 |
| 035 | 4 | 4 |
| 065 | 6 | 2 |
| 555 | 11 | 1 |
| Salient Sum | | **2047** |

12 B+BttBtt

*Carrier Structure*

*Linear Order*

| 1 | 2 | 3 | 4 | 5 | 6 | 7 | 8 | 9 | 10 | 11 | 12 |
|---|---|---|---|---|---|---|---|---|---|---|---|
| 000 | 003 | 006 | 050 | 053 | 056 | 500 | 503 | 506 | 550 | 553 | 556 |

*Salient Ordering*

| harmonic | position | weight |
|---|---|---|
| 000 | 1 | 2048 |
| 500 | 7 | 1024 |
| 050 | 4 | 512 |
| 550 | 10 | 256 |
| 003 | 2 | 128 |
| 503 | 8 | 64 |
| 053 | 5 | 32 |
| 553 | 11 | 16 |
| 006 | 3 | 8 |
| 506 | 9 | 4 |
| 056 | 6 | 2 |
| 556 | 12 | 1 |
| Salient Sum | | **4095** |

12 B+TbbbTbbb

*Carrier Structure*

*Linear Order*

| 1 | 2 | 3 | 4 | 5 | 6 | 7 | 8 | 9 | 10 | 11 | 12 |
|---|---|---|---|---|---|---|---|---|---|---|---|
| 000 | 005 | 030 | 035 | 060 | 065 | 500 | 505 | 530 | 535 | 560 | 565 |

*Salient Ordering*

| harmonic | position | weight |
|---|---|---|
| 000 | 1 | 2048 |
| 500 | 7 | 1024 |
| 030 | 3 | 512 |
| 530 | 9 | 256 |
| 060 | 5 | 128 |
| 560 | 11 | 64 |
| 005 | 2 | 32 |
| 505 | 8 | 16 |
| 035 | 4 | 8 |
| 535 | 10 | 4 |
| 065 | 6 | 2 |
| 565 | 12 | 1 |
| Salient Sum | | **4095** |

12 B+BttTbbb

*Carrier Structure*

*Linear Order*

| 1 | 2 | 3 | 4 | 5 | 6 | 7 | 8 | 9 | 10 | 11 | 12 |
|---|---|---|---|---|---|---|---|---|---|---|---|
| 000 | 003 | 006 | 050 | 053 | 056 | 500 | 505 | 530 | 535 | 560 | 565 |

*Salient Ordering*

| harmonic | position | weight |
|---|---|---|
| 000 | 1 | 2048 |
| 500 | 7 | 1024 |
| 530 | 9 | 512 |
| 050 | 4 | 256 |
| 560 | 11 | 128 |
| 003 | 2 | 64 |
| 053 | 5 | 32 |
| 006 | 3 | 16 |
| 505 | 8 | 8 |
| 535 | 10 | 4 |
| 056 | 6 | 2 |
| 565 | 12 | 1 |
| Salient Sum | | **4095** |

12 B+TbbbBtt

*Carrier Structure*

*Linear Order*

| 1 | 2 | 3 | 4 | 5 | 6 | 7 | 8 | 9 | 10 | 11 | 12 |
|---|---|---|---|---|---|---|---|---|---|---|---|
| 000 | 005 | 030 | 035 | 060 | 065 | 500 | 503 | 506 | 550 | 553 | 556 |

*Salient Ordering*

| harmonic | position | weight |
|---|---|---|
| 000 | 1 | 2048 |
| 500 | 7 | 1024 |
| 030 | 3 | 512 |
| 060 | 5 | 256 |
| 550 | 10 | 128 |
| 503 | 8 | 64 |
| 553 | 11 | 32 |
| 005 | 2 | 16 |
| 506 | 9 | 8 |
| 035 | 4 | 4 |
| 065 | 6 | 2 |
| 556 | 12 | 1 |
| Salient Sum | | **4095** |

Thru Nanoform

*Carrier Structure*

2 b Nanoform

*Carrier Structure*

*2 b Linear*

| | |
|---|---|
| 1 | 2 |
| 0 | 5 |

*2 b Salient Ordering*

| harmonic | position | weight |
|---|---|---|
| 0 | 1 | 2 |
| 5 | 2 | 1 |
| Salient Sum | | **3** |

3 t Nanoform

*Carrier Structure*

*3 t Linear*

| | | |
|---|---|---|
| 1 | 2 | 3 |
| 0 | 3 | 6 |

*3 t Salient Ordering*

| harmonic | position | weight |
|---|---|---|
| 0 | 1 | 4 |
| 3 | 2 | 2 |
| 6 | 3 | 1 |
| Salient Sum | | **7** |

4 Bbb Nanoform

*Carrier Structure*

*4 Bbb Linear*

| 1 | 2 | 3 | 4 |
|---|---|---|---|
| 00 | 05 | 50 | 55 |

*4 Bbb Salient Ordering*

| harmonic | position | weight |
|---|---|---|
| 00 | 1 | 8 |
| 50 | 3 | 4 |
| 05 | 2 | 2 |
| 55 | 4 | 1 |
| Salient Sum | | **15** |

6 Btt Nanoform

*Carrier Structure*

*6 Btt Linear Order*

| 1 | 2 | 3 | 4 | 5 | 6 |
|---|---|---|---|---|---|
| 00 | 03 | 06 | 50 | 53 | 56 |

*6 Btt Salient Ordering*

| harmonic | position | weight |
|---|---|---|
| 00 | 1 | 32 |
| 50 | 4 | 16 |
| 03 | 2 | 8 |
| 53 | 5 | 4 |
| 06 | 3 | 2 |
| 56 | 6 | 1 |
| Salient Sum | | **63** |

5 Bbt Nanoform

*Carrier Structure*

*5 Bbt Linear*

| 1 | 2 | 3 | 4 | 5 |
|---|---|---|---|---|
| 00 | 05 | 50 | 55 | 56 |

*5 Bbt Salient Ordering*

| harmonic | position | weight |
|---|---|---|
| 00 | 1 | 16 |
| 50 | 3 | 8 |
| 53 | 4 | 4 |
| 05 | 2 | 2 |
| 56 | 5 | 1 |
| Salient Sum | | **31** |

5 Btb Nanoform

*Carrier Structure*

*5 Btb Linear*

| 1 | 2 | 3 | 4 | 5 |
|---|---|---|---|---|
| 00 | 05 | 50 | 55 | 56 |

*5 Btb Salient Ordering*

| harmonic | position | weight |
|---|---|---|
| 00 | 1 | 16 |
| 50 | 3 | 8 |
| 03 | 2 | 4 |
| 06 | 4 | 2 |
| 55 | 5 | 1 |
| Salient Sum | | **31** |

8 B+BbbBbb Nanoform

*Carrier Structure*

*8 B+BbbBbb Linear Order*

| 1 | 2 | 3 | 4 | 5 | 6 | 7 | 8 |
|---|---|---|---|---|---|---|---|
| 000 | 005 | 050 | 055 | 500 | 505 | 550 | 555 |

*8 B+BbbBbb Salient Ordering*

| harmonic | position | weight |
|---|---|---|
| 000 | 1 | 128 |
| 500 | 5 | 64 |
| 050 | 3 | 32 |
| 550 | 7 | 16 |
| 005 | 2 | 8 |
| 505 | 6 | 4 |
| 055 | 4 | 2 |
| 555 | 8 | 1 |
| Salient Sum | | **255** |

Figure 125

| Tick Offset | Capture Address | Thru | 2 b | 3 t | 4 Bbb | 6 Btt | 5 Bbt | 5 Btb |
|---|---|---|---|---|---|---|---|---|
| -39 - 0 | 1 | 0 - | 0 - | 0 - | 00 - | 00- | 00 - | 00- |
| 1 - 40 | 2 | 0 + | 0 + | 0 + | 00+ | 00+ | 00+ | 00+ |
| 41 - 80 | 3 | | | | | 03- | | 03- |
| 81 - 120 | 4 | | | | 05- | 03+ | 05- | 03+ |
| 121-160 | 5 | | | 3 - | 05+ | 06- | 05+ | 06- |
| 161 - 200 | 6 | | | 3 + | | 06+ | | 06+ |
| 201 - 240 | 7 | | 5 - | | 50- | 50- | 50- | 50- |
| 241 - 280 | 8 | | 5 + | | 50+ | 50+ | 50+ | 50+ |
| 281 - 320 | 9 | | | 6 - | | 53- | 53- | |
| 321- 360 | 10 | | | 6 + | 55- | 53+ | 53+ | 55- |
| 361 - 400 | 11 | | | | 55+ | 56- | 56- | 55+ |
| 401 - 440 | 12 | | | | | 56+ | 56+ | |

Figure 126

| Capture Address | Active | 3 t | 4 Bbb | 6 Btt | 5 Bbt | 5 Btb |
|---|---|---|---|---|---|---|
| 1 | | 0 - | 00 - | 00- | 00 - | 00- |
| 2 | x | 0 + | 00+ | 00+ | 00+ | 00+ |
| 3 | | | | 03- | | 03- |
| 4 | | | 05- | 03+ | 05- | 03+ |
| 5 | x | 3 - | 05+ | 06- | 05+ | 06- |
| 6 | | 3 + | | 06+ | | 06+ |
| 7 | | | 50- | 50- | 50- | 50- |
| 8 | | | 50+ | 50+ | 50+ | 50+ |
| 9 | | 6 - | | 53- | 53- | |
| 10 | x | 6 + | 55- | 53+ | 53+ | 55- |
| 11 | | | 55+ | 56- | 56- | 55+ |
| 12 | | | | 56+ | 56+ | |

Figure 127

| 3 t | | |
|---|---|---|
| HSN | salience | 1.0 |
| 0 | 4 | x |
| 3 | 2 | x |
| 6 | 1 | x |
| | | 7/7 |

| 4 Bbb | | |
|---|---|---|
| HSN | salience | 0.73 |
| 00 | 8 | x |
| 50 | 4 | |
| 05 | 2 | x |
| 55 | 1 | x |
| | | 11/15 |

| 5 Bbt | | |
|---|---|---|
| HSN | salience | 0.71 |
| 00 | 16 | x |
| 50 | 8 | |
| 53 | 4 | x |
| 05 | 2 | x |
| 56 | 1 | |
| | | 22/31 |

| 5 Btb | | |
|---|---|---|
| HSN | salience | 0.61 |
| 00 | 16 | x |
| 50 | 8 | |
| 03 | 4 | |
| 06 | 2 | x |
| 55 | 1 | x |
| | | 19/31 |

| 6 Btt | | |
|---|---|---|
| HSN | salience | 0.60 |
| 00 | 32 | x |
| 50 | 16 | |
| 03 | 8 | |
| 53 | 4 | x |
| 06 | 2 | x |
| 56 | 1 | |
| | | 38/63 |

Figure 128

| 8 Tttb | | | | |
|---|---|---|---|---|
| HSN | active | nano mult | salience | actual |
| 00 | x | 1 | 128 | 128 |
| 30 | x | 1 | 64 | 64 |
| 60 | x | 1 | 32 | 32 |
| 03 | | | 16 | |
| 33 | | | 8 | |
| 06 | | | 4 | |
| 36 | | | 2 | |
| 65 | x | 0.33 | 1 | 0.33 |
| | | | | 224.33 |

| 8 Ttbt | | | | |
|---|---|---|---|---|
| HSN | active | nano mult | salience | actual |
| 00 | x | 1 | 128 | 128 |
| 30 | x | 1 | 64 | 64 |
| 60 | | | 32 | |
| 03 | | | 16 | |
| 63 | x | 1 | 8 | 8 |
| 06 | | | 4 | |
| 35 | | | 2 | |
| 66 | x | 0.33 | 1 | 0.33 |
| | | | | 200.33 |

| 8 B+BbbBbb | | | | |
|---|---|---|---|---|
| HSN | active | nano mult | salience | actual |
| 000 | x | 1 | 128 | 128 |
| 500 | | | 64 | |
| 050 | | | 32 | |
| 550 | x | 1 | 16 | 16 |
| 005 | | | 8 | |
| 505 | | | 4 | |
| 055 | x | 1 | 2 | |
| 555 | x | 0.33 | 1 | 0.33 |
| | | | | 146.33 |

| 8 Tbtt | | | | |
|---|---|---|---|---|
| HSN | active | nano mult | salience | actual |
| 00 | x | 1 | 128 | 128 |
| 30 | | | 64 | |
| 60 | | | 32 | |
| 33 | x | 1 | 16 | 16 |
| 63 | x | 1 | 8 | 8 |
| 05 | | | 4 | |
| 36 | | | 2 | |
| 66 | x | 0.33 | 1 | 0.33 |
| | | | | 152.33 |

Figure 129

| 8 Microform class salience ambiguities | | | | | | | |
|---|---|---|---|---|---|---|---|
| index | all on | all off | top on | all but top | bottom | all but bottom | middle |
| 1 | x | | x | | | x | |
| 2 | x | | | x | | x | x |
| 3 | x | | | x | | x | x |
| 4 | x | | | x | | x | x |
| 5 | x | | | x | | x | x |
| 6 | x | | | x | | x | x |
| 7 | x | | | x | | x | x |
| 8 | x | | | x | x | | |

| Performance Element | Song Module references |
|---|---|
| UC1 | 20 |
| *UM1.1* | 1 |
| *UM1.2* | 3 |
| *UM1.3* | 2 |
| *UM1.4* | 0 |
| UC20 | 30 |
| *UM20.3* | 3 |
| *UM20.7* | 2 |
| *UM20.9* | 0 |
| . . . | . . . |

| Song Module Commonalities | |
|---|---|
| 1 Performance Element | 200 |
| 2 Performance Element | 100 |
| 3 Performance Element | 60 |
| 4 Performance Element | 16 |
| . . . | . . . |

SYSTEM, COMPUTER PROGRAM AND METHOD FOR QUANTIFYING AND ANALYZING MUSICAL INTELLECTUAL PROPERTY

FIELD OF INVENTION

This invention relates generally to a methodology for representing a multi-track audio recording for analysis thereof. This invention further relates to a system and computer program for creating a digital representation of a multi-track audio recording in accordance with the methodology provided. This invention further relates to a system, computer program and method for quantifying musical intellectual property. This invention still further relates to a system, computer program and method for enabling analysis of musical intellectual property.

BACKGROUND TO INVENTION

The worldwide music industry generated $33.1 billion in revenue in 2001 according to the RIAA. The American music industry alone generated approximately $14 billion in 2001 (RIAA). Over 250,000 new songs are registered with ASCAP each year in the United States. According to Studiofinder-.com, approximately 10,000 recording studios are active in the domestic US market. In reference to publisher back catalogs, EMI Music Publishing, for example, has over one million songs in their back catalog.

The revenue of the music industry depends on the protection of musical intellectual property. Digital music files, however, are relatively easy to copy or plagiarize. This represents a well-publicized threat to the ability of the music industry to generate revenue from the sale of music.

Various methods for representing music are known. The most common methods are "standard notation", MIDI data, and digital waveform visualizations.

Standard musical notation originated in the 11th century, and was optimized for the symphony orchestra approximately 200 years ago. The discrete events of standard notation are individual notes.

Another method is known as "MIDI", which stands for Musical Instrument Digital Interface. MIDI is the communication standard of electronic musical instruments to reproduce musical performances. MIDI, developed in 1983, is well known to people who are skilled in the art. The applications that are able to visualize MIDI data consist of the known software utilities such as MIDI sequencing programs, notation programs, and digital audio workstation software.

The discrete events of MIDI are MIDI events. Digital waveforms are a visual representation of digital audio data. CD audio data can be represented at accuracy ratios of up to 1/44100 of a second. The discrete events of digital waveforms are individual samples.

Compositional infringement of music occurs when the compositional intent of a song is plagiarized (melody or accompanying parts) from another composition. The scope of infringement may be as small as one measure of music, or may consist of the complete copying of the entire piece. Mechanical infringement occurs when a portion of another recorded song is incorporated into a new song without permission. The technology required for mechanical infringement, such as samplers or computer audio workstations, is widespread because of legitimate uses. Depending on the length of the recording the infringing party may also be liable for compositional infringement as well.

Intellectual property protection in regard to musical works and performances exists by virtue of the creation thereof in most jurisdictions. Registration of copyright or rights in a sound recording represents means for improving the ability of rights holders to enforce their rights in regard to their musical intellectual property.

It is also common to mail a musical work to oneself via registered mail as a means to prove date of authorship and fixation of a particular musical work.

Also, many songwriter associations offer a registration and mailing service for musical works. However, proving that infringement of musical intellectual property has occurred is a relatively complicated and expensive process, as outlined below. This represents a significant barrier to enforcement of musical intellectual property, which in turn means that violation of musical intellectual property rights is relatively common.

In musical infringement, it is first generally determined whether the plaintiff owns a valid copyright or performance right in the material allegedly infringed. This is generally established by reference to the two layers of music/lyrics of a musical work or a sound recording. If the plaintiff owns a valid copyright or performance right, the next step is generally to establish whether the defendant has infringed the work or performance. This is usually decided on the basis of "substantial similarity".

FIG. 1 shows a comparative analysis of two scored melodies by an expert witness musicologist.

In the United States, it is generally a jury who decides the issue of mechanical substantial similarity. The jury listens to the sample and the alleged source material and determines if the sample is substantially similar to the source.

Many shortfalls in individual music representations exist, such as the lack of representation in the analysis layer of music (motif, phrase, and sentence). There is generally no standardized method for a song to communicate its elements. Standard notation cannot generally communicate all elements accurately of electronic and recorded music. The following table illustrates a few of the shortfalls that standard notation has vs. electronic/recorded music.

| Musical Expression | Standard Notation | Electronic/Recorded Music |
|---|---|---|
| Rhythm | | |
| Positional divisions/beat | 64 divisions/beat | 1000 divisions/beat |
| Durational quantize | 64 divisions/beat | 1000 divisions/beat |
| Pitch | | |
| Coarse pitch range | 12 semitones/octave | 12 semitones/octave |
| # Of discrete tunings between semitones | 0 | 100 |

-continued

| Musical Expression | Standard Notation | Electronic/Recorded Music |
|---|---|---|
| Pitch variance within a note | 1 pitch per note event | Pitch variance can be communicated 1000 times/beat |
| Articulation | Legato, Staccato, accent | Articulation envelopes can be modulated in real time |
| Dynamics | 12 (subjective) divisions ppppp - fffff | 127 discrete points |
| Stereo panning | None | 64 points left<br>64 points right |
| Instrument specific control | None | Electronic instruments support performance automation of any parameter |

In a MIDI file, mechanical data and compositional data are indistinguishable from each other. Metric context is not inherently associated with the stream of events, as MIDI timing is communicated as delta ticks between MIDI events.

The digital waveform display lacks of musical significance. Musical data (such as pitch, meter, polyphony) is undetectable to the human eye in a waveform display.

Prior art representations of music therefore pose a number of shortfalls. One such shortfall arises from the linearity of music, since all musical representations are based on a stream of data. There is nothing to identify one point in musical time from another. Prior art music environments are generally optimized for the linear recording and playback of a musician's performance, not for the analysis of discrete musical elements.

Another shortfall arises from absolute pitch. Absolute pitch is somewhat ineffective for the visual and auditory comparison of music in disparate keys. Western music has twelve tonal centers or keys. In order for a melody to be performed by a person or a musical device, the melody must be resolved to one of the twelve keys. The difficulty that this poses in a comparison exercise is that a single relative melody can have any of twelve visualizations, in standard notation, or twelve numeric offsets in MIDI note numbers. In order for melodies to be effectively compared (a necessary exercise in determining copyright infringement), the melodies need to be rendered to the same tonal center. FIG. 2 shows a single melody expressed in a variety of keys.

A number of limitations to current musical representations arise from their use in the context of enforcement of musical intellectual property. Few universally recognized standards exist for testing substantial similarity, or fair use in the music industry. There is also usually no standardized basis of establishing remuneration for sampled content. The test for infringement is generally auditory; the original content owner must have auditory access to an infringing song, and be able to recognize the infringed content in the new recording. Finally, the U.S. Copyright office, for example, does not compare deposited works for similarities, advise on possible copyright infringement, or consult on prosecution of copyright violations.

There is a need therefore for a musical representation system that relies on a relative pitch system rather than an absolute pitch. This in order to assist in the comparison of melodies. There is also a need for a musical representation system that enables the capture and comparison of most mechanical nuances of a recorded or electronic performance, as required for determining mechanical infringement.

There is a further need for a musical representation system that is capable of separating the compositional (theoretical) layer from the mechanical (performed layer) in order to determine compositional and/or mechanical infringement. This representation would need to identify what characteristics of the musical unit change from instance to instance, and what characteristics are shared across instances. Communicating tick accuracy and context within the entire meter would be useful to outline the metric framework of a song.

Preparation of Multi-track Audio for Analysis

Prior art technology allows for the effective conversion of an audio signal into various control signals that can be converted into an intermediate file. There are a number of 3rd party applications that can provide this functionality.

MIDI (referred to earlier) is best understood as a protocol designed for recording and playing back music on digital synthesizers that is supported by many makes of personal computer sound cards. Originally intended to control one keyboard from another, it was quickly adopted for use on a personal computer. Rather than representing musical sound directly, it transmits information about how music is produced. The command set includes note-on's, note-off's, key velocity, pitch bend and other methods of controlling a synthesizer. (From WHATIS.COM)

The following inputs and preparation are required to perform a correct audio to MIDI conversion. The process begins with the digital audio multi-track. FIG. 3 illustrates a collection of instrument multi-track audio files (2). Each instrument track is digitized to a single continuous wave file of consistent length, with an audio marker at bar 0. FIG. 4 shows a representation of a click track multi-track audio file (4) aligned with the instrument multi-track audio files (2). The audio click track audio file usually is required to be of the same length as the instrument tracks. It also requires the audio marker be positioned at bar 0. Then, a compressed audio format (i.e. mp3) of the two-track master is required for verification.

As a next step, a compressed audio format of all of the samples (i.e. mp3) used in the multi-track recording must then be disclosed. The source and time index of the sampled material are also required (see FIG. 5).

Song environment data must be compiled to continue the analysis. The following environment data is generally required:

Track sheet to indicate the naming of the instrument tracks;

Total number of bars in song;

Song Structure with bar lengths. Every bar of the song must be included in a single song structure section (Verse—16 bars, Chorus—16 bars, etc.);

Type and location of time signature changes within the song;

Type and location of tempo changes within a song; and

Type and location of key changes within a song.

Before audio tracks can be analyzed, the environment track must be defined. The environment track consists of the following: tempo, Microform family (time signature), key, and song structure.

The method of verifying the tempo will be to measure the "click" track supplied with the multi-track. Tempo values will carry over to subsequent bars if a new tempo value is not assigned. If tempo is out of alignment with the click track, the tempo usually can be manually compensated. FIG. 6 illustrates bar indicators (6) being aligned to a click track multi-track audio file (4). Current state-of-the-art digital audio workstations, such as Digidesign's Pro Tools, include tempo marker alignment as a standard feature.

Time signature changes are customarily supplied by the artist, and are manually entered for every bar where a change in time signature has occurred. All time signatures are notated as to the number of 8th notes in a bar. For example, 4/4 will be represented as 8/8. Time signature values will carry over to subsequent bars if a new time signature value is not assigned.

Key changes are supplied by the artist, and are manually entered for every bar where a change in key has occurred. In case there is a lack of tonal data to measure the key by, the default key shall be C. Key values will carry over to subsequent bars if a new key value is not assigned.

Song structure tags define both section name and section length. Song structure markers are supplied by the artist and are manually entered for at every bar where a structure change has occurred. Structure Marker carry over the number of bars that is assigned in the section length. All musical bars of a song must belong to a song structure section.

At the end of the environment track definition, every environment bar will indicate tempo, key, time signature and, ultimately, belong to a song structure. FIG. 7 shows the final result of a song section as defined in the Environment Track.

After the environment track is defined, each track must be classified to determine the proper analysis process the instrument tracks can be classified as follows:

Monophonic (pitched), which includes single voice instrument, such as a trumpet.

Monophonic (pitched), which includes vocals, such as a solo vocal.

Polyphonic (pitched), which includes multi-voice instrument, such as a piano, guitar, chords.

Polyphonic (pitched vocal), which includes multiple vocals singing different harmonic lines.

Non-pitched (percussion) such as "simple" drum loops, where no pitch information is available and individual percussion instruments.

Complex, such as full program loops and sound effects.

FIG. 8 illustrates the process to generate (7) MIDI data (8) from an audio file (2), resulting in MIDI note data (10), and MIDI controller data (12).

The classifications A) through F) listed above are discussed in the following section, and are visualized in FIGS. 9-14.

The following data can be extracted from Audio-to-Control Signal Conversion: coarse pitch, duration, pitch bend data, volume, brightness, and note position.

Analysis Results for Various Track Classifications

| | Monophonic Analysis | Polyphonic Analysis | Percussion Analysis | Complex wave Analysis |
|---|---|---|---|---|
| Coarse Pitch | x | | | |
| Pitch bend data | x | | | |
| Note Position | x | x | X | x |
| Volume | x | x | X | x |
| Brightness | x | x | X | x |
| Duration | x | x | X | x |

Monophonic Audio-to-MIDI Analysis includes:

pitch bend data, duration, volume, brightness, coarse pitch, and note position.

Polyphonic Audio-to-MIDI Analysis includes volume, duration, brightness, and note position.

Percussion-to-MIDI Analysis includes:

volume, duration, brightness, and note position.

Complex Audio-to-MIDI Analysis includes:

volume, duration, brightness, and note position.

Generated events and user input data are combined in various track classifications.

A. Monophonic—Pitched.

FIG. 9 illustrates the process to generate (7) MIDI data (8) from an audio file (2). The user enters input metadata (12) that is specific to the Monophonic Pitched track classification.

| | |
|---|---|
| Generated Events | Monophonic Audio-to-MIDI Analysis Data |
| User input events | Timbre<br>Significant timbral changes can be noted with MIDI text event |

B. Monophonic—Pitched Vocal

FIG. 10 illustrates the process to generate MIDI data from an audio file (7) resulting in generated MIDI data (8). The user enters input metadata (12) that is specific to the Monophonic Pitched Vocal track classification.

| | |
|---|---|
| Generated Events | Monophonic Audio-to-MIDI Analysis Data |
| User input events | Lyric<br>Lyric Syllables can be attached to Note events with MIDI text event |

C. Polyphonic Pitched

FIG. 11 illustrates the process to generate (7) MIDI data (8) from an audio file (2). The user enters input metadata (12) that is specific to the Polyphonic Pitched track classification.

| | |
|---|---|
| Generated Events | Polyphonic Audio-to-MIDI Analysis Data |
| User input events | Coarse Pitch<br>User enters coarse pitch for simultaneous notes<br>Timbre<br>Significant timbral changes can be noted with MIDI text event |

D. Polyphonic Pitched—Vocal

FIG. 12 illustrates the process to generate (7) MIDI data (8) from an audio file (2). The user enters input metadata (12) that is specific to the Polyphonic Pitched Vocal track classification.

| | |
|---|---|
| Generated Events | Polyphonic Audio-to-MIDI Analysis Data |
| User input events | Coarse Pitch<br>User enters coarse pitch for simultaneous notes<br>Lyric<br>Lyric Syllables can be attached to Note events with MIDI text event |

E. Non-Pitched, Percussion

FIG. 13 illustrates the process to generate (7) MIDI data (8) from an audio file (2). The user enters input metadata (12) that is specific to the Non-Pitched Percussion track classification.

| | |
|---|---|
| Generated Events | Percussion, Non Pitched Audio-to-MIDI Analysis |
| User input events | Timbre<br>User assigns timbres per note on<br>Generic percussion timbres can be mapped to reserved MIDI note on ranges |

F. Complex Wave

FIG. 14 illustrates the process to generate (7) MIDI data (8) from an audio file (2). The user enters input metadata (12) that is specific to the Complex Wave track classification.

| | |
|---|---|
| Generated Events | Complex Audio-to-MIDI Analysis |
| User input events | Sample ID<br>Reference to Source and time index) can be noted with text event |

There are generally two audio conversion workflows. The first is the local processing workflow. The second is the remote processing workflow.

FIG. 15 illustrates the local processing workflow. The local processing workflow consists of multi-track audio (2) loaded (21) into a conversion workstation (20) by an upload technician (18). The conversion workstation is generally a known computer device including a microprocessor, such as for example a personal computer. Next, MIDI performance data (8) is generated (7) from the multi-track audio files (2). After the content owner (16) has entered (23) the input metadata (14) for all of the multi-track audio files (2), the input metadata (14) is combined (25) with the generated MIDI data (8) to form a resulting MIDI file (26).

FIG. 16 illustrates the remote processing workflow. The remote processing workflow consists of multi-track audio (2) loaded (21) into the conversion workstation (20) by the upload technician (18). The upload technician (18) then generally forwards (27) a particular multi-track audio file (2) to an analysis specialist (24). Next, MIDI performance data (8) is generated (7) from the multi-track audio file (2) on the remote conversion workstation (20). At this point, the analysis specialist (24) enters (23) the input metadata (14) into the user input facility of the remote conversion workstation (20). After the analysis specialist (24) has entered (23) the input metadata (14) for the multi-track audio file (2), the input metadata (14) is combined (25) with the generated MIDI data (8) to form a resulting partial MIDI file (28). The partial MIDI file (28) is then combined (29) with the original MIDI file (26) from the local processing workflow.

In order to MIDI encode the environment track, tempo, key, and time signature are all encoded with their respective Midi Meta Events. Song structure markers will be encoded as a MIDI Marker Event. MIDI Encoding for track name and classification is encoded as MIDI Text events. MIDI encoding for control streams and user data from tracks is illustrated in following table.

Table of MIDI Translations

| | |
|---|---|
| Coarse Pitch | MIDI Note Number |
| Pitch Bend | Pitch Wheel Control |
| Volume | Volume Control 7 |
| Brightness | Sound Brightness Control 74 |
| Duration and timing | Note On + Note Off |
| Lyric and Timbre | MIDI Text |

FIG. 17 illustrates the package that is delivered to the server (in a particular implementation of this type of prior art system where the conversion workstation (20) is linked to a server) for analysis. The analysis package consists of the following:

- formatted MIDI file;
- mp3 of 2 track master;
- mp3 of isolated sample files, with sources and time indexes;
- Artist particulars, song title, creation date etc.; and
- Upload studio particulars and ID from machine used in upload.

SUMMARY OF INVENTION

One aspect of the present invention is a methodology for representing music, in a way that is optimized for analysis thereof.

Another aspect of the present invention is a method for converting music files to a song framework. The song framework comprises a collection of rules and associated processing steps that convert a music file such as a prepared MIDI file into a song framework output. The song framework output constitutes an improved musical representation. The song framework enables the creation of a song framework output that generally consists of a plurality of framework elements, and performance elements. Framework elements are constructed from environmental parameters in a prepared music file, such as a MIDI file, including parameters such as time signature, tempo, key, and song structure. For every instrument track in the prepared MIDI file, the performance elements are detected, classified, and mapped to the appropriate framework element.

Yet another aspect of the present invention is a song framework repository. The song framework repository takes a framework output for a music file under analysis and normalizes its performance elements against a universal performance element collective, provided in accordance with the invention. The song framework repository also re-maps and inserts the framework elements of the music file under analysis into a master framework output store.

In accordance with another aspect of the present invention, a music representation system and computer program product is provided to enable the creation of a song framework output based on a music file.

Yet another aspect of the present invention is a reporting facility that enables generation of a plurality of reports to provide a detailed comparison of song framework outputs in the song framework repository.

A still other aspect of the present invention is a music registry system that utilizes the music representation system of the present invention.

Another aspect of the present invention is a music analysis engine that utilizes the music representation system of the present invention.

The proprietary musical representation of the current invention is capable of performing an analysis on a multi-track audio recording of a musical composition. The purpose of this process is to identify all of the unique discrete musical elements that constitute the composition, and the usage of those elements within the structure of the song.

The musical representation of the current invention has a hierarchal metric addressing system that communicates tick accuracy, as well as context within the entire metric hierarchy of a song. The musical representation of the current invention also determines the relative strength of positions within a metric structure. The musical representation of the current invention relies on a relative pitch system rather than absolute pitch. The musical representation of the current invention captures all of the nuances of a recorded performance and separates this data into discrete compositional (theoretical) and mechanical (performed) layers.

BRIEF DESCRIPTION OF DRAWINGS

Reference will now be made by way of example, to the accompanying drawings, which show preferred aspects of the present invention, and in which:

FIG. 36 illustrates the metric element hierarchy at the metric element supergroup.

FIG. 37 illustrates the metric element hierarchy at the metric element ultra group.

FIG. 38 illustrates the harmonic layers of the 7Ttbb Carrier structure.

FIG. 119 is a diagram of a Framework sequence created by song structure markers.

FIG. 120 illustrates the creation of a Macroform and Microform Class from MIDI data.

FIG. 121 illustrates the creation of an Environment track and Instrument Performance from MIDI data.

FIG. 122 is a diagram of the Performance Element creation process.

FIG. 123 illustrates the Microform class setting capture range on MIDI data.

FIG. 124 illustrates the capture detection algorithm.

FIG. 125 illustrates the capture range to Nanoform allocation table.

FIG. 126 illustrates Candidate Nanoforms compared in Carrier construction.

FIG. 127 illustrates the salient weight of active capture addresses in each Nanoform.

FIG. 128 illustrates the Salient weight of nodes in various Microform carriers.

FIG. 129 illustrates the Microform salience ambiguity examples.

FIG. 130 illustrates the note-on detection algorithm.

Figure 131:
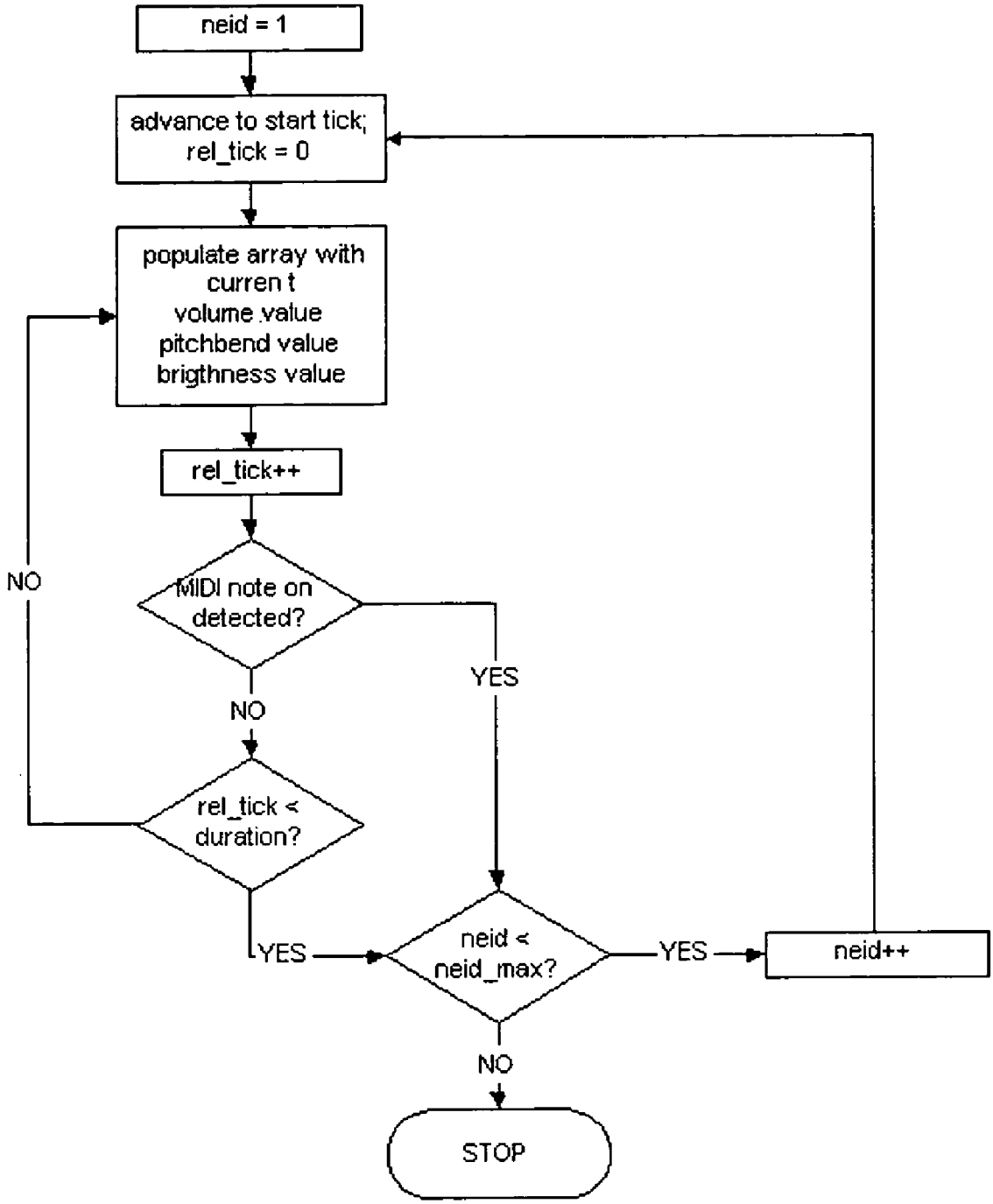

FIG. 131 illustrates the control stream detection algorithm.

FIG. 132 illustrates control streams association with note events.

Figure 133:
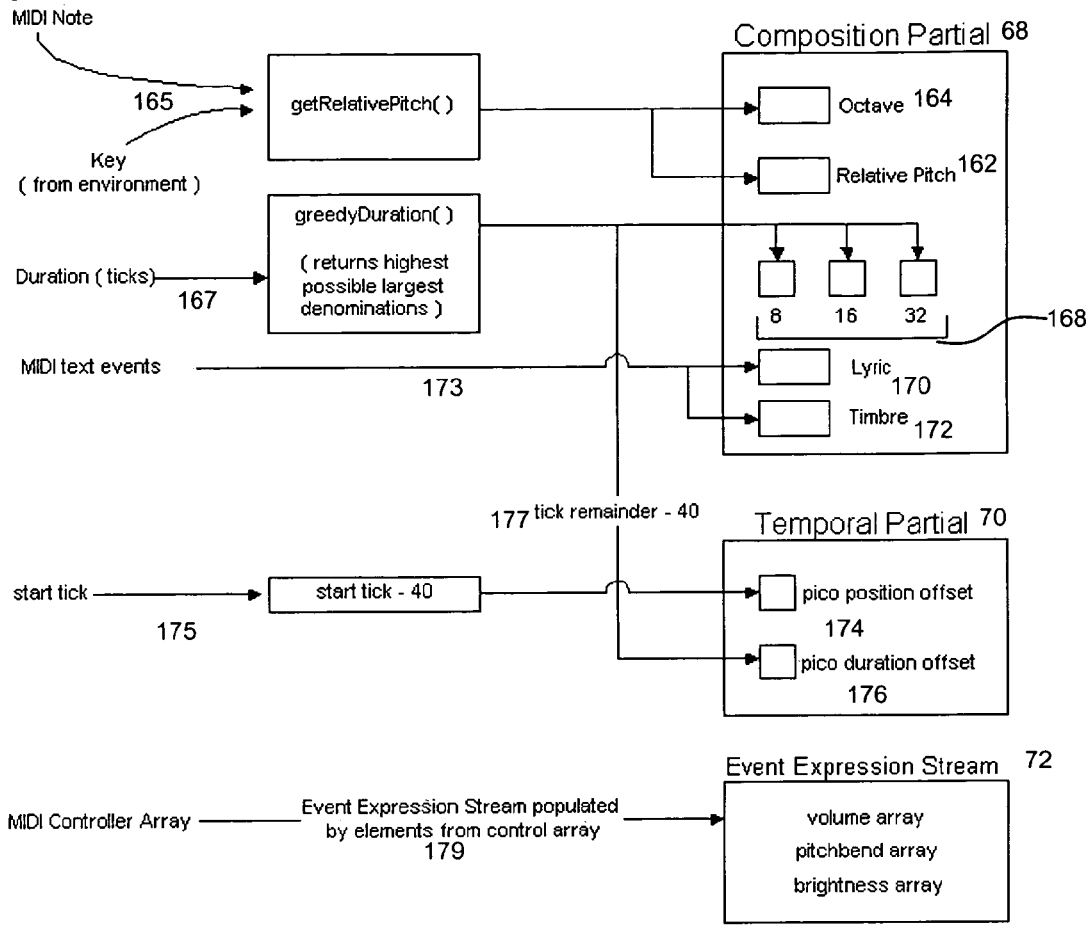

FIG. 133 illustrates Modulator construction from detected note-ons and controller events.

Figure 134:
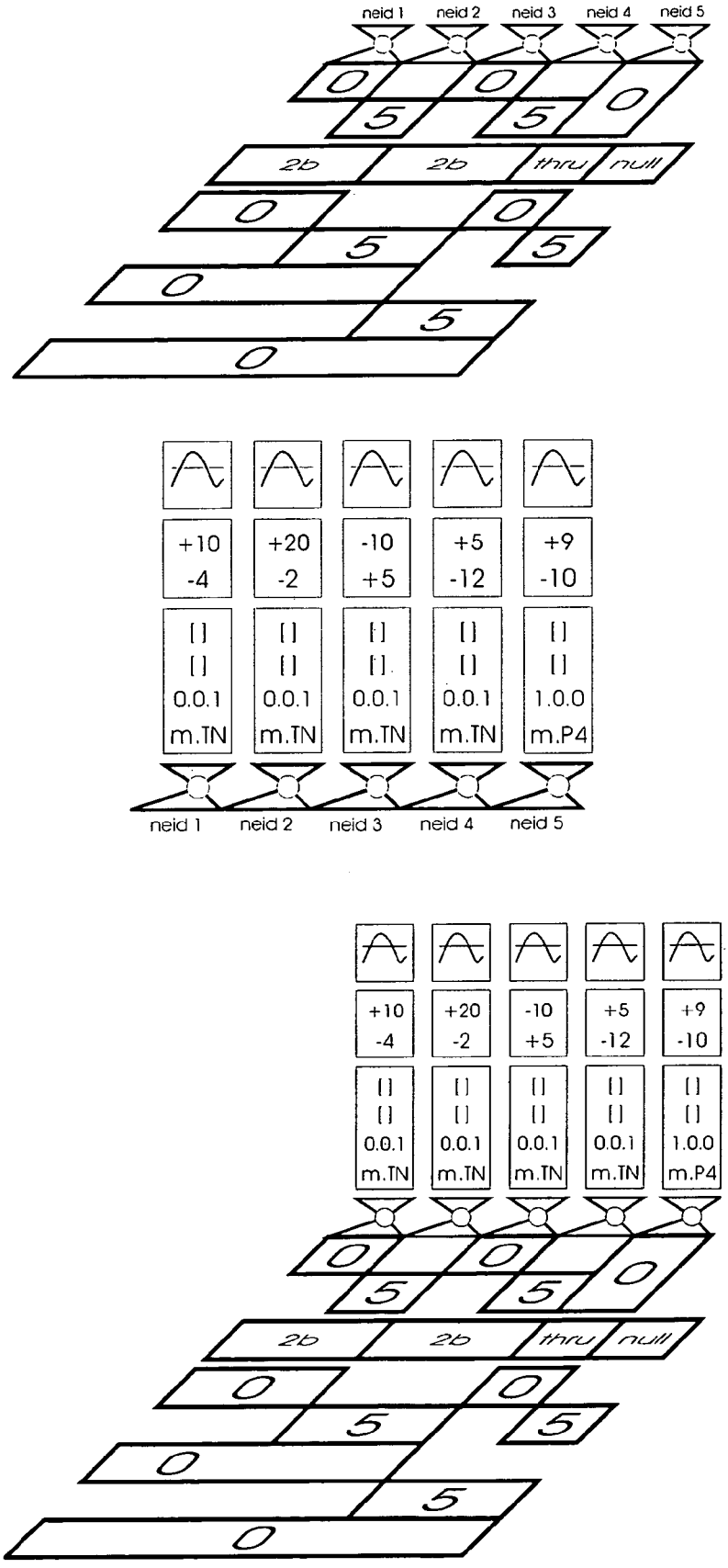

FIG. 134 illustrates Carrier detection result, Modulator detection result, and association for a Performance Element.

Figure 135:
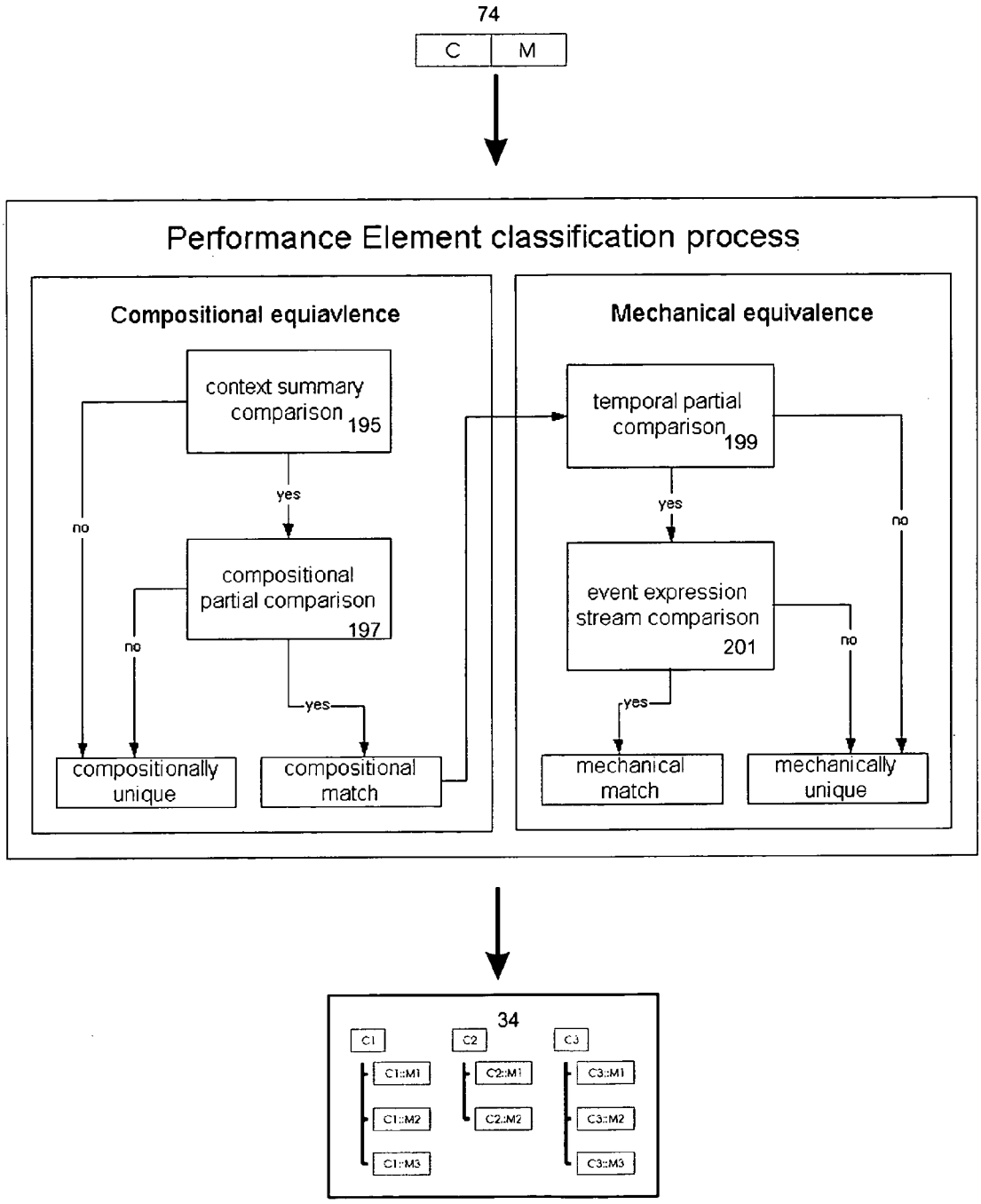

FIG. 135 is a diagram of the Performance Element Collective equivalence tests.

Figure 136:
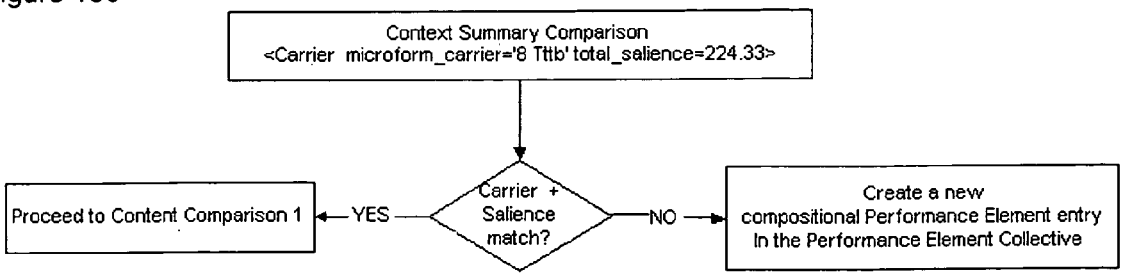

FIG. 136 illustrates the context summary comparison flowchart.

Figure 137:
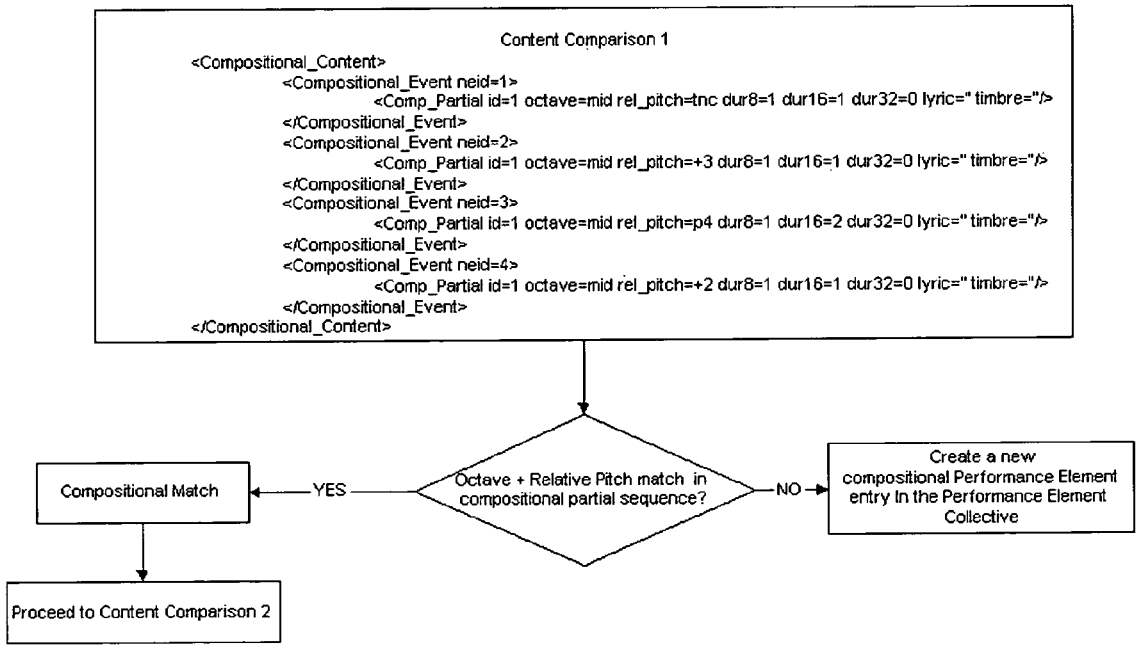

FIG. 137 illustrates the compositional partial comparison flowchart.

Figure 138:
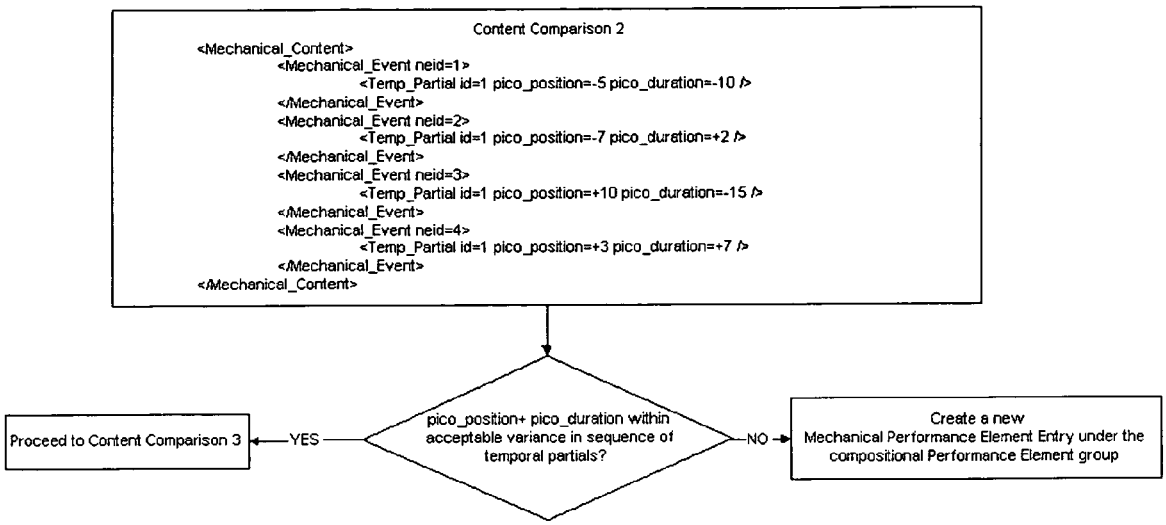

FIG. 138 illustrates the temporal partial comparison flowchart.

Figure 139:
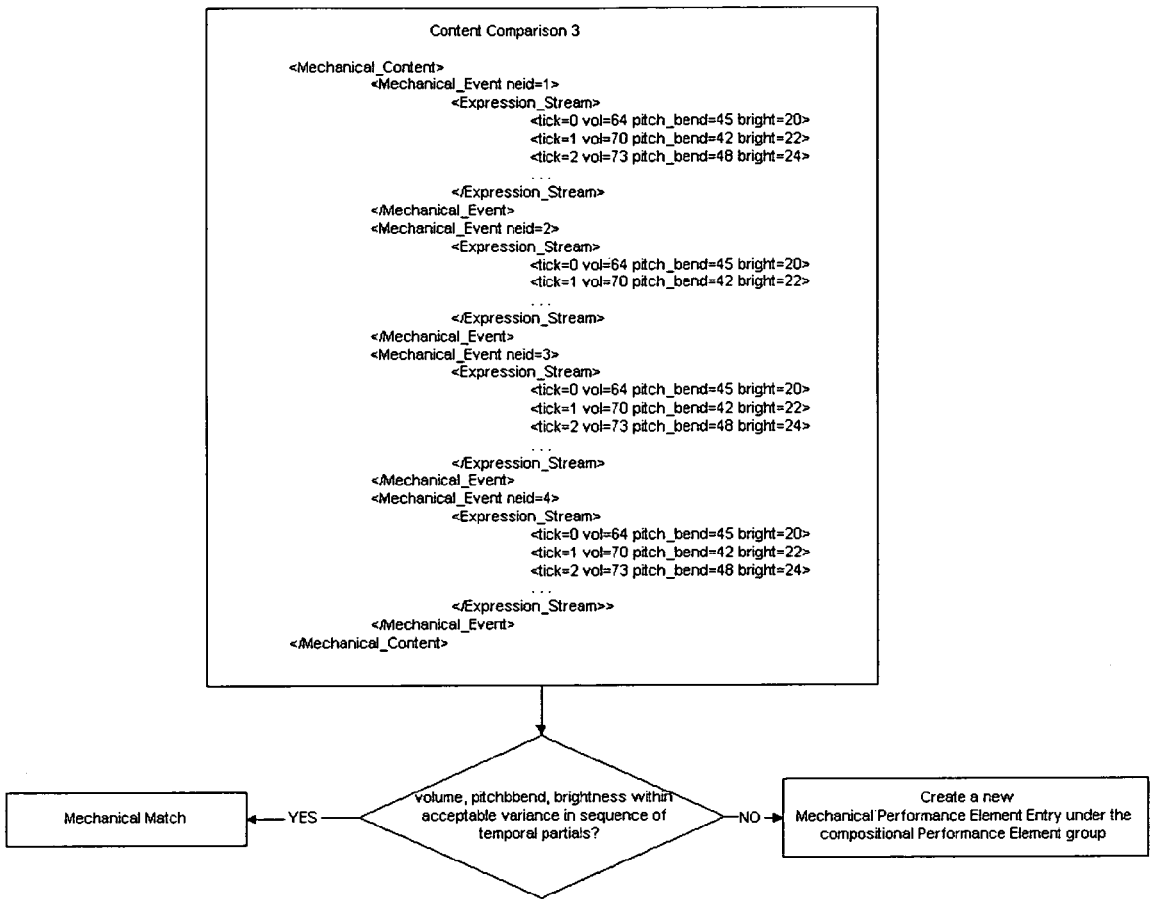

FIG. 139 illustrates the event expression stream comparison flowchart.

Figure 140:
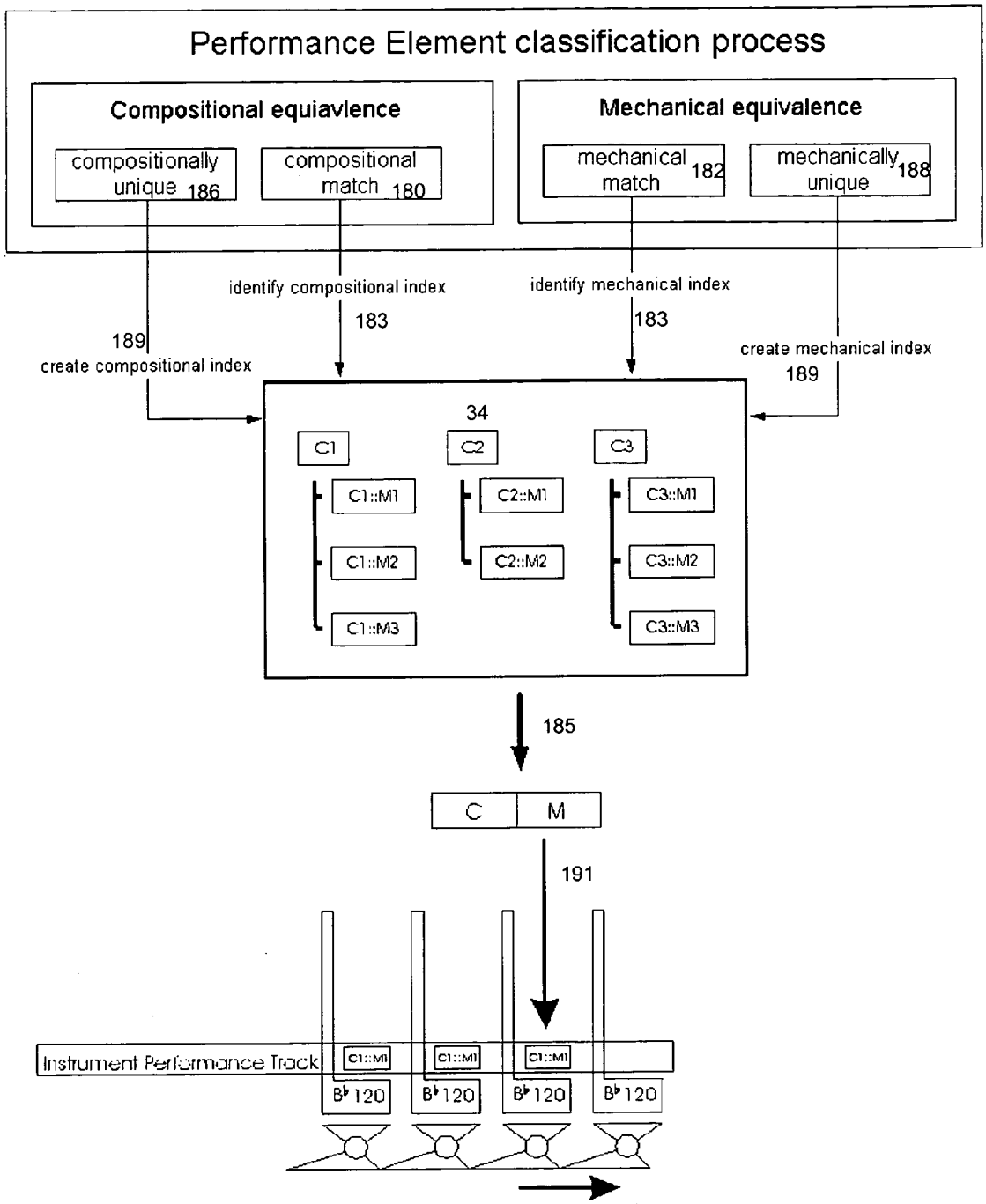

FIG. 140 illustrates Performance Element indexes mapped to Instrument Performance Track.

Figure 141:
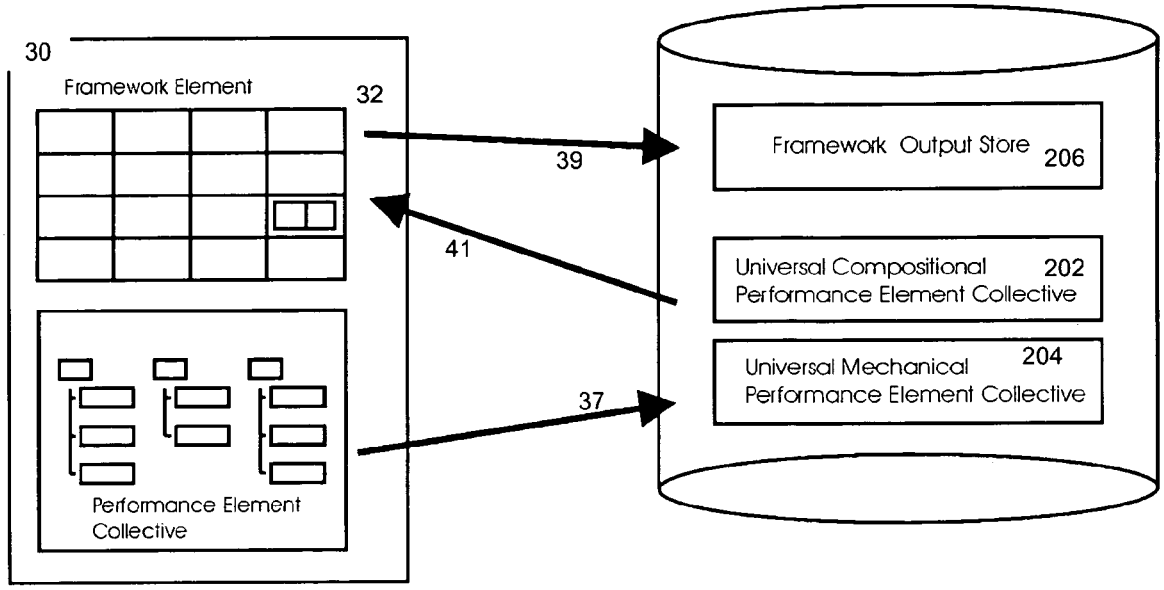

FIG. 141 is diagram of the Song Module Repository normalization and insertion process.

Figure 142:
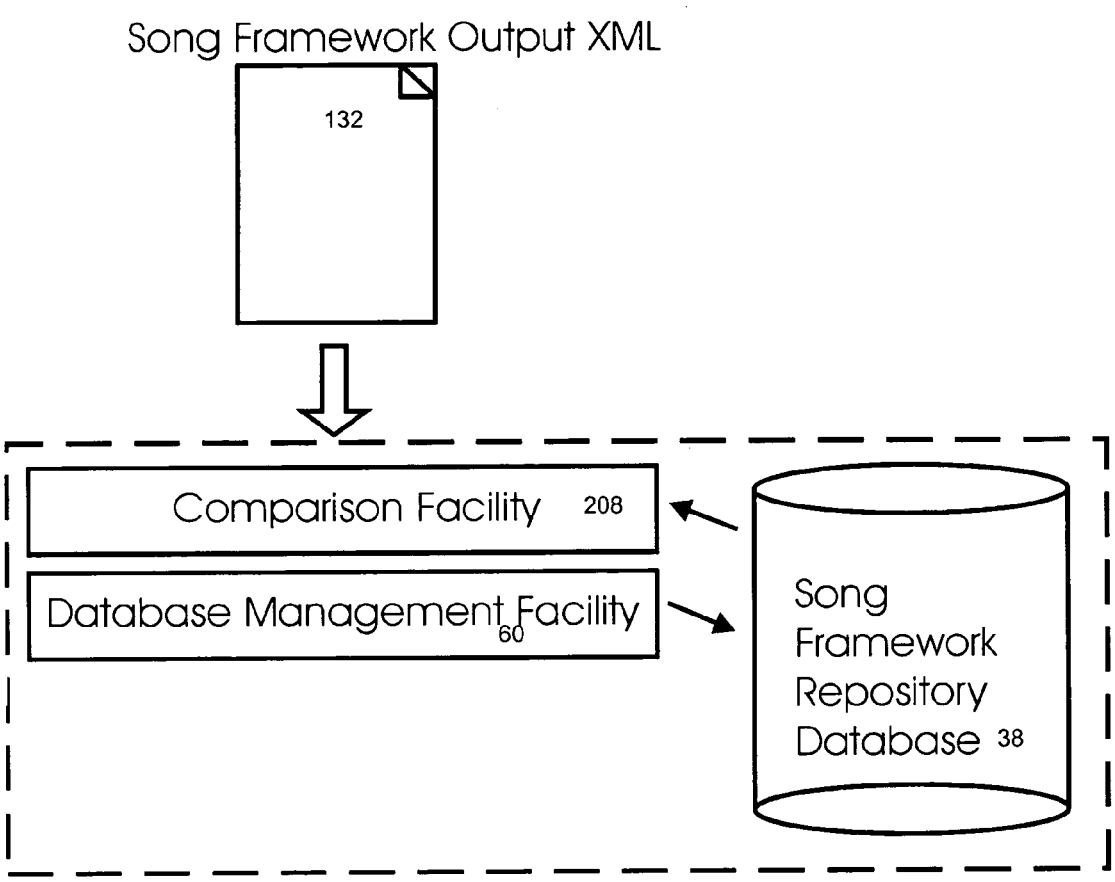

FIG. 142 is diagram of the Song Module Repository facilities.

Figure 143:
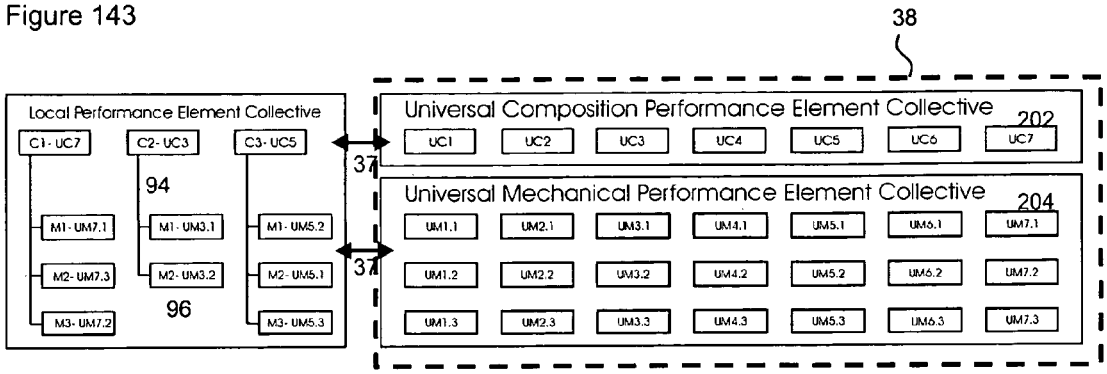

FIG. 143 illustrates the re-classification of local Performance Elements.

Figure 144:
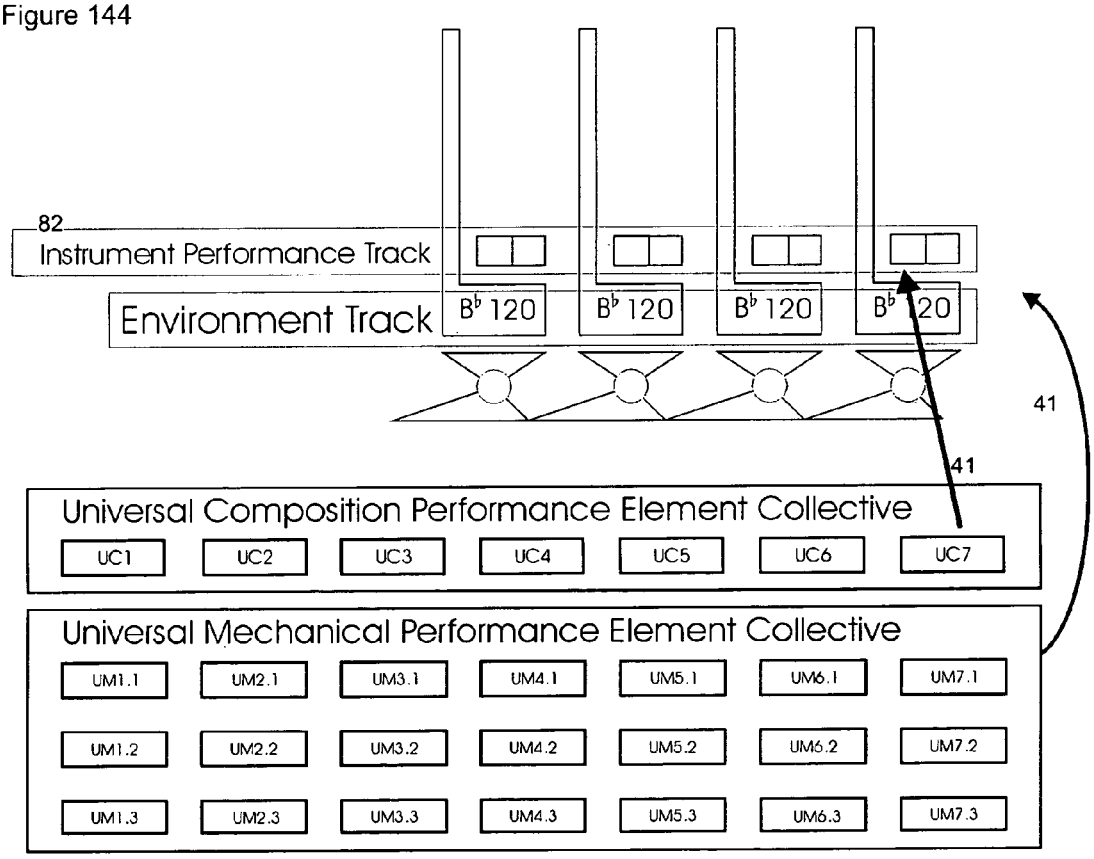

FIG. 144 illustrates Instrument Performance Track re-mapping.

Figure 145:
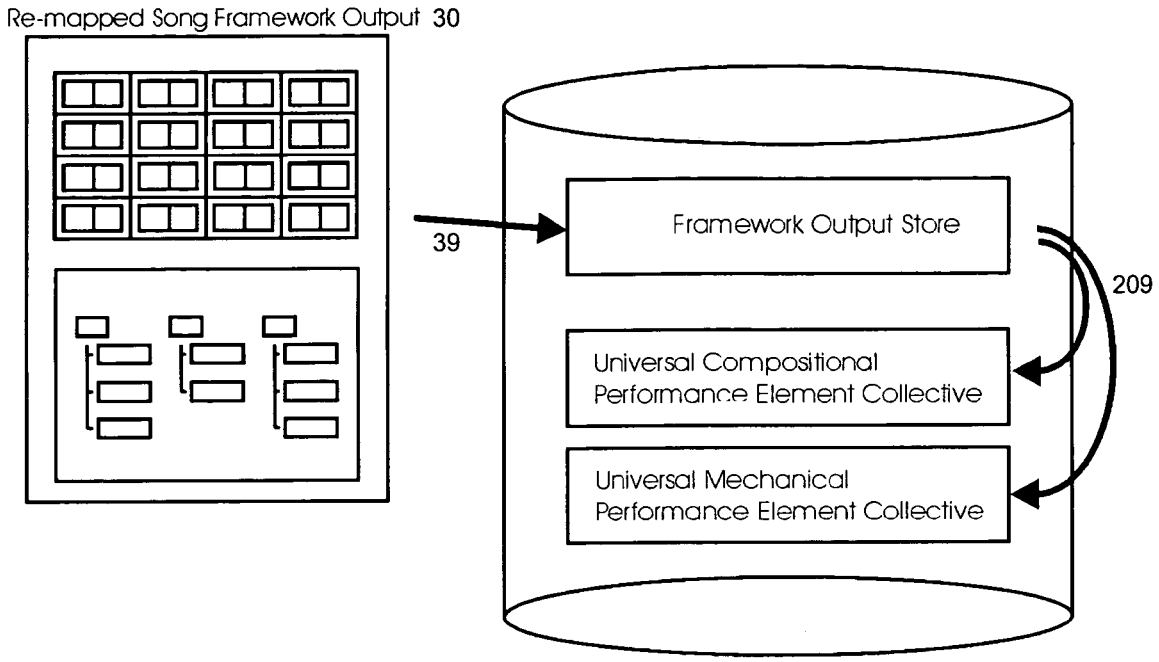

FIG. 145 illustrates Song Module insertion and referencing.

Figures 146, 147:
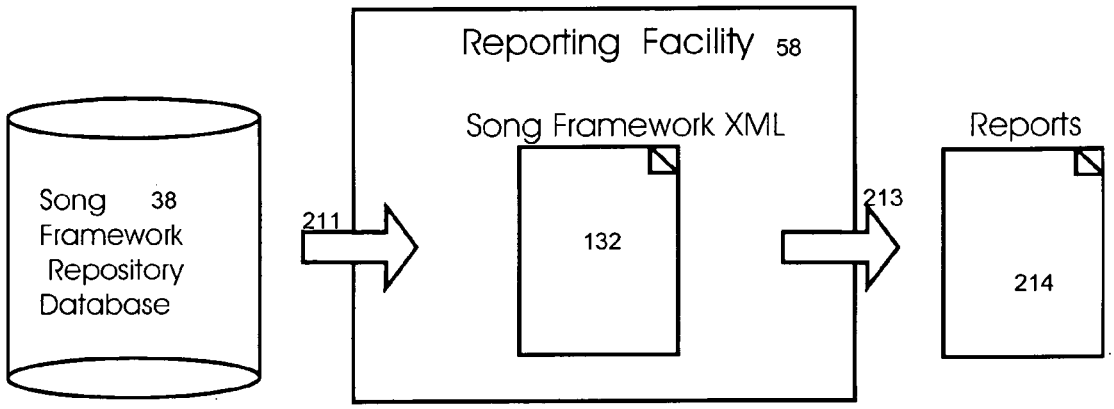

FIG. 146 is diagram of the system reporting facilities.

FIG. 147 illustrates an originality Report.

Figure 148:
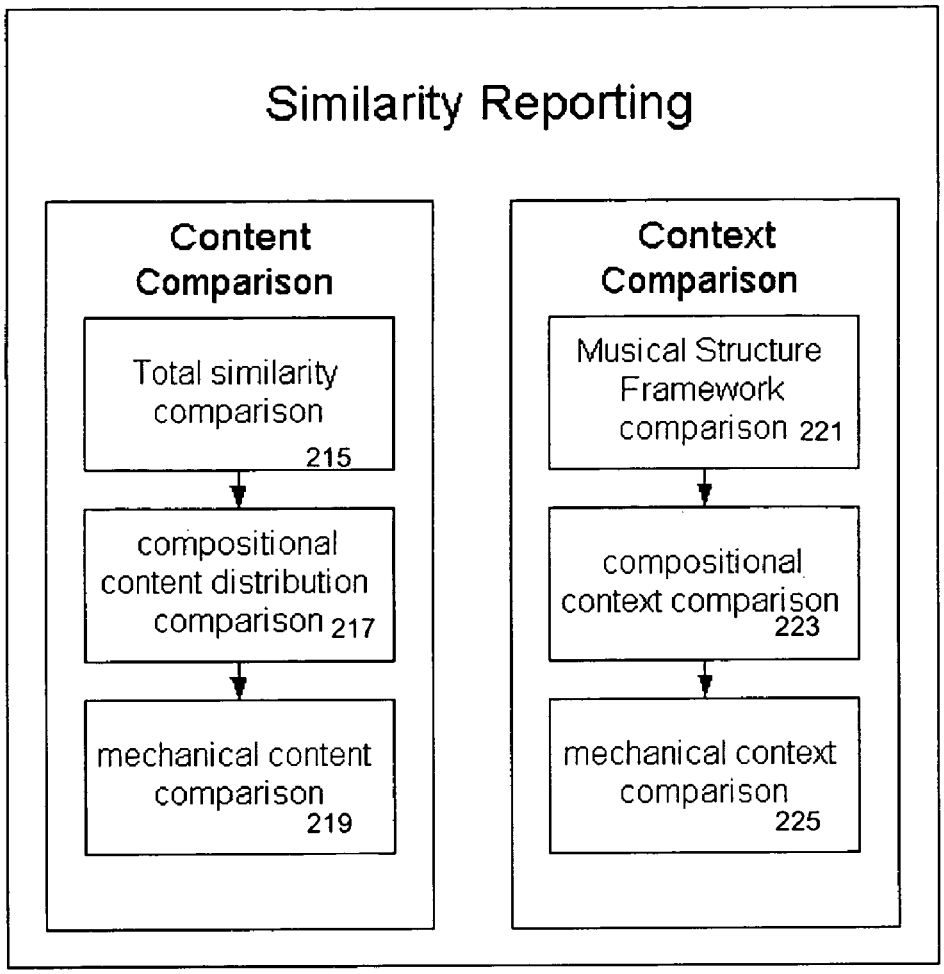

FIG. 148 illustrates the Similarity reporting process.

Figure 149:
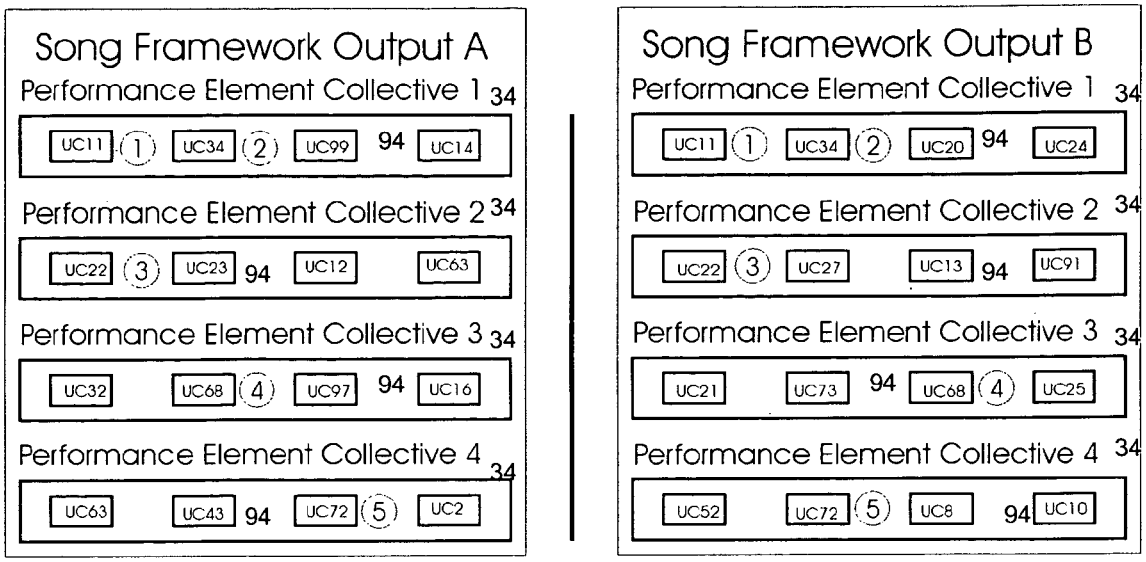

FIG. 149 illustrates compositionally similar Performance Elements in Performance Element Collectives.

Figure 150:
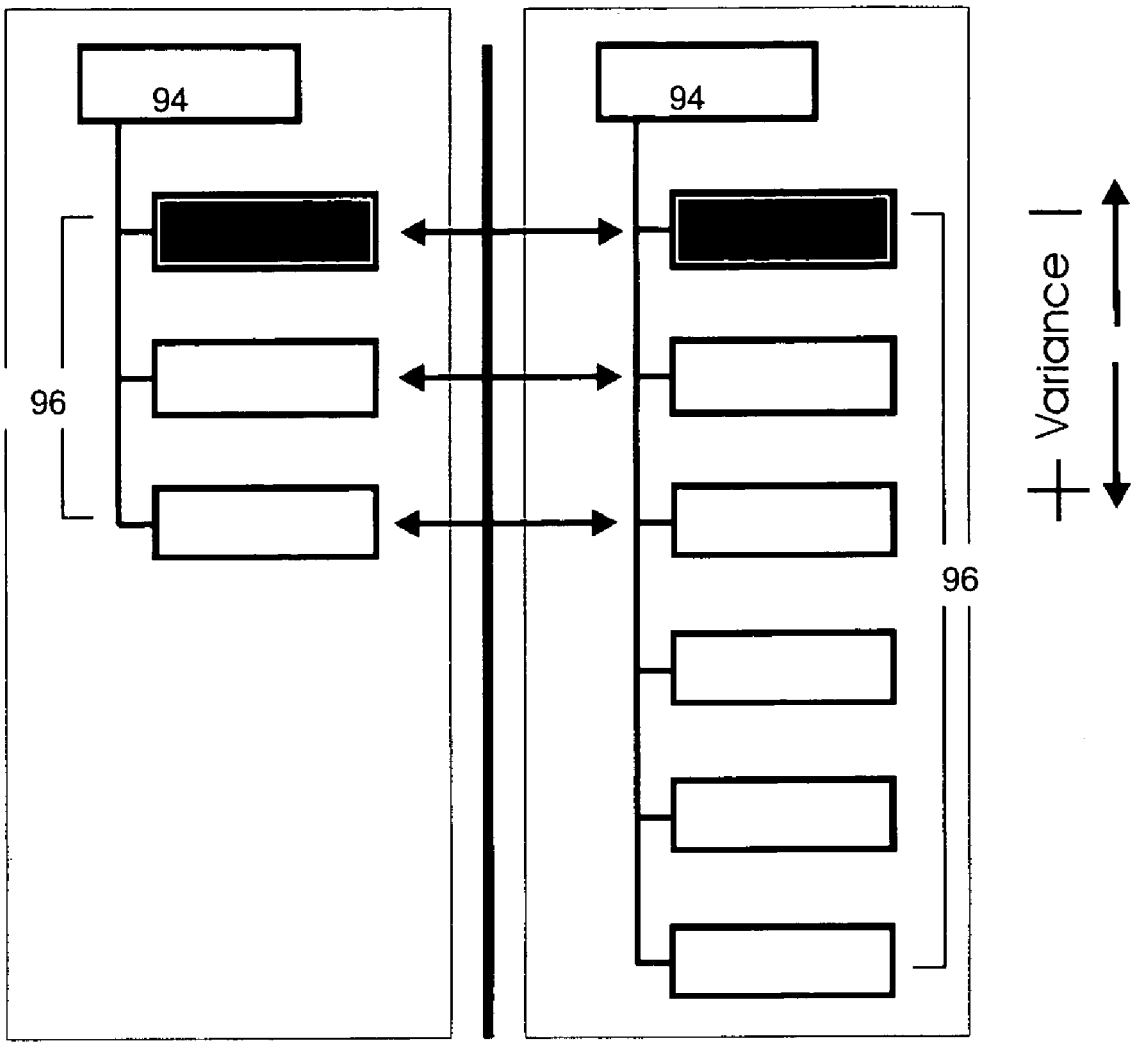

FIG. 150 illustrates the comparison of mechanical Performance Elements.

Figure 151:
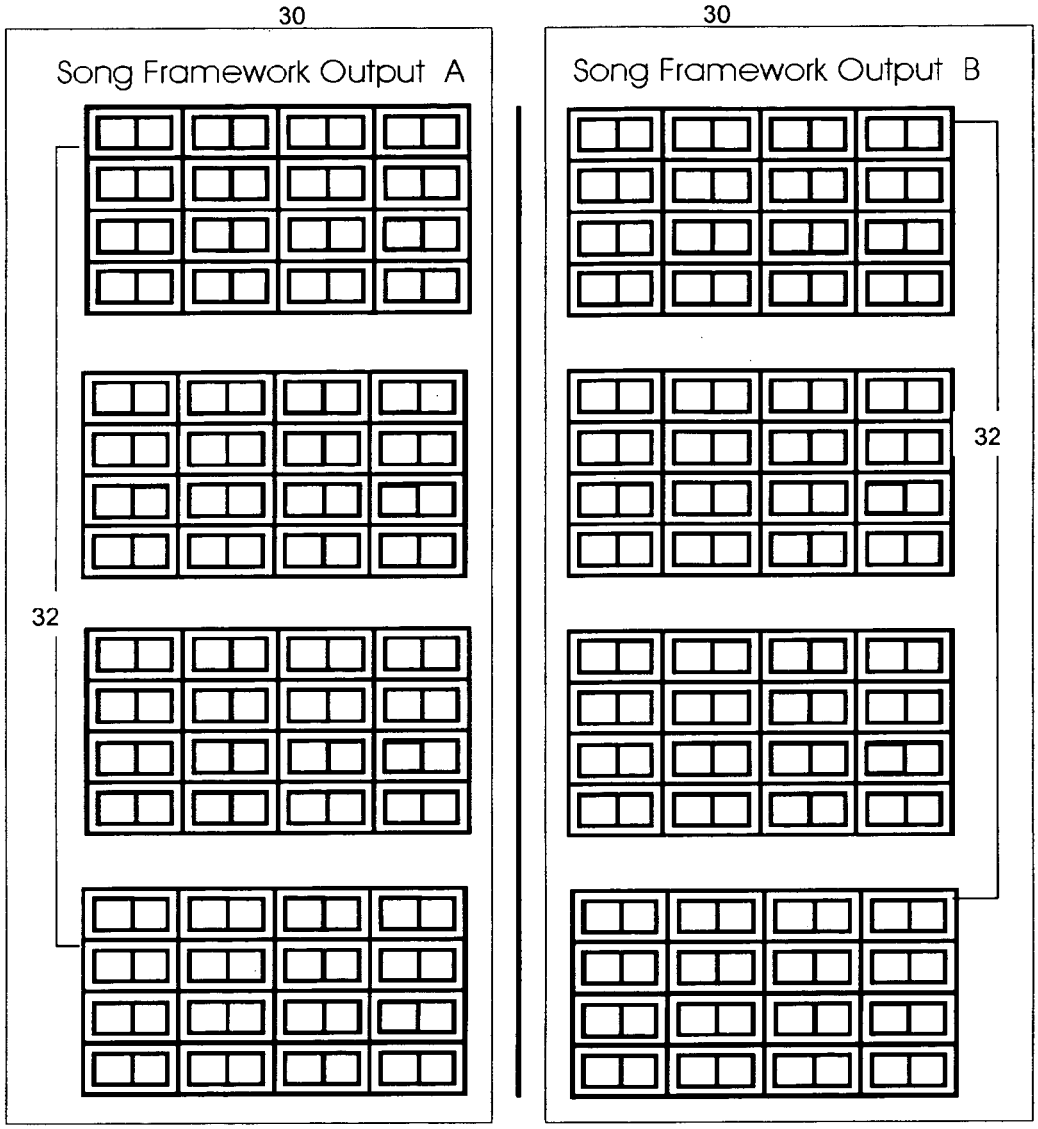

FIG. 151 illustrates a full Musical Structure Framework comparison.

Figure 152:
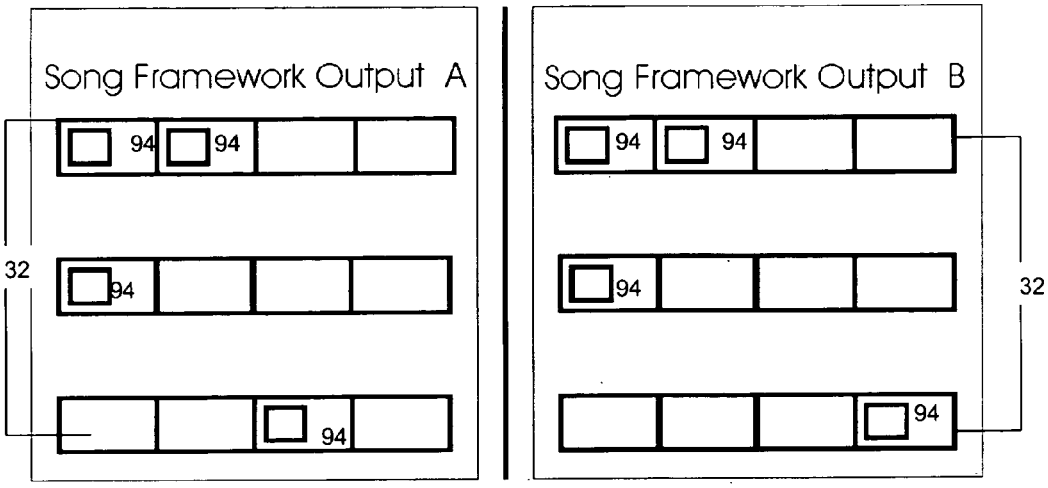

FIG. 152 illustrates a distribution of compositionally similar Performance Elements in the Musical Structure Frameworks.

Figure 153:
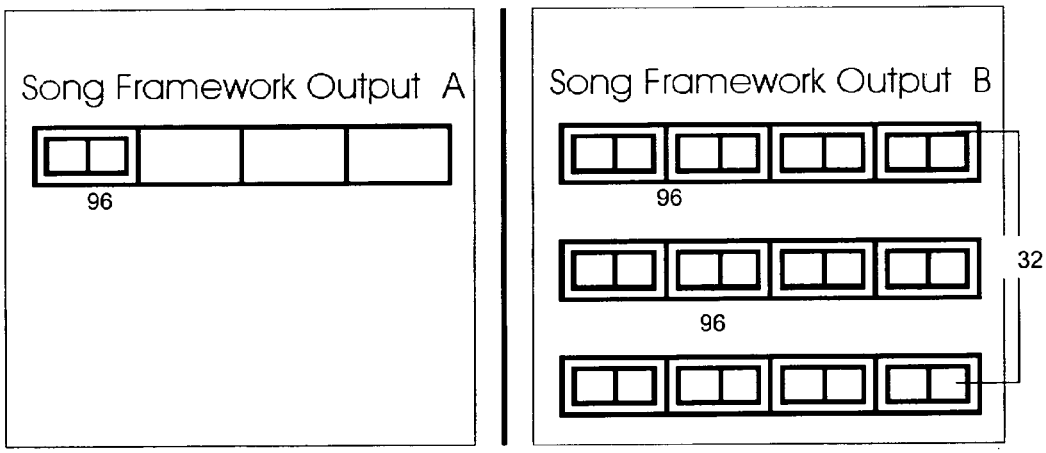

FIG. 153 illustrates a distribution of mechanically similar Performance Elements in the Musical Structure Frameworks.

Figure 154:
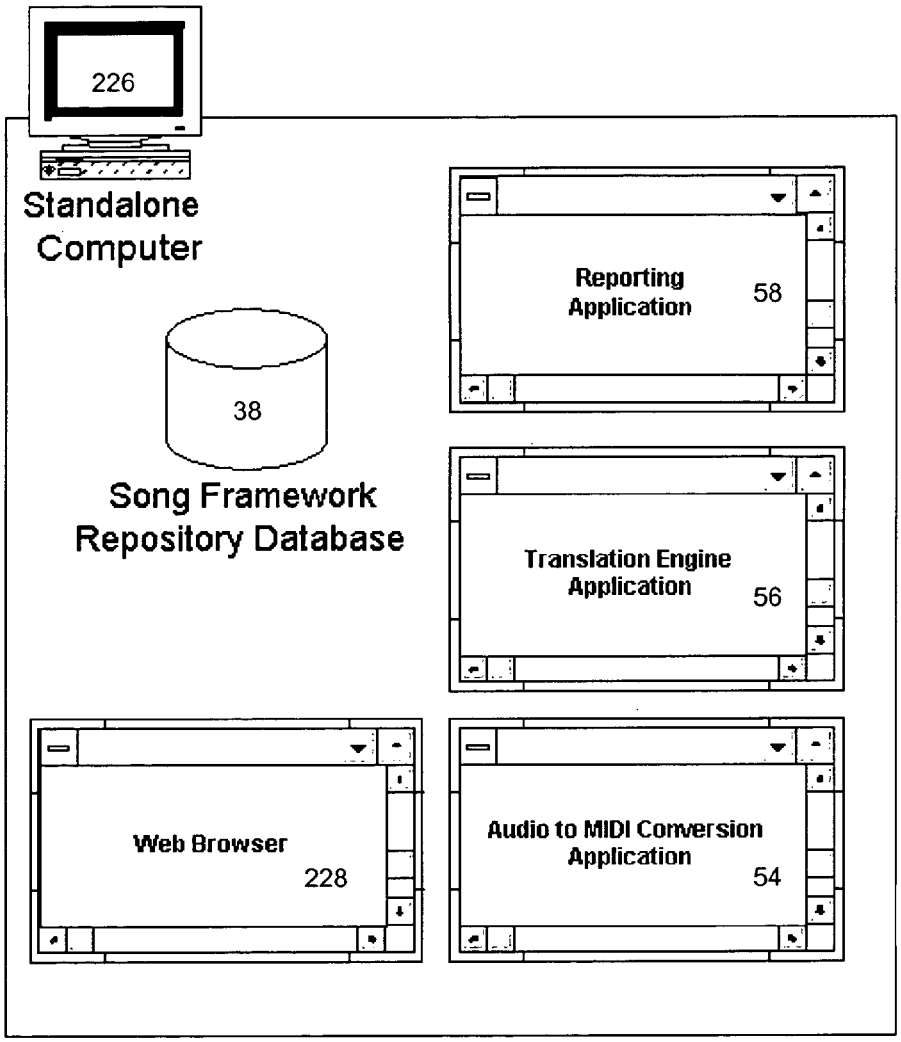

FIG. 154 illustrates a standalone computer deployment of the system components.

Figure 155:
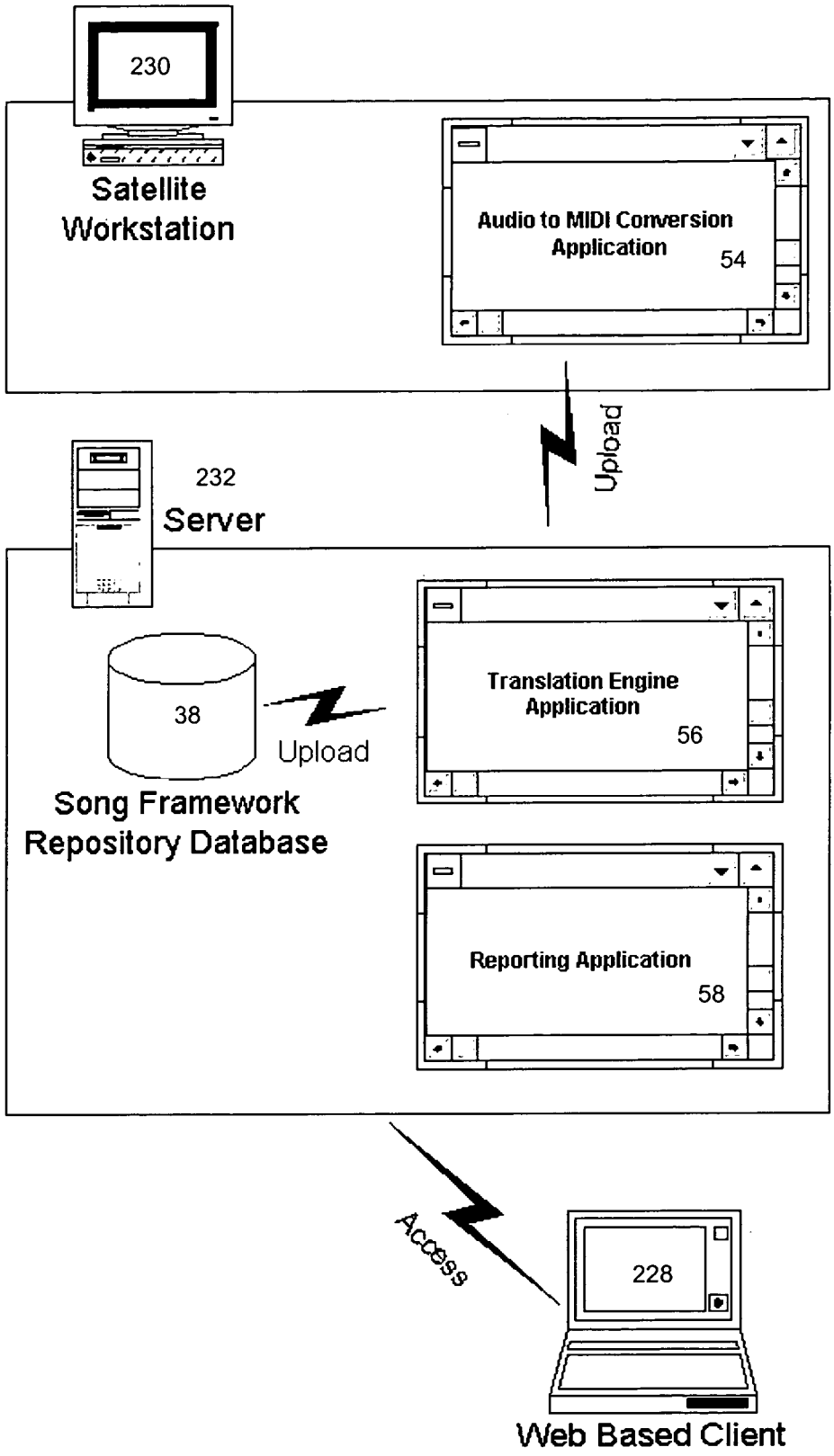

FIG. 155 illustrates a client/server deployment of the system components.

Figure 156:
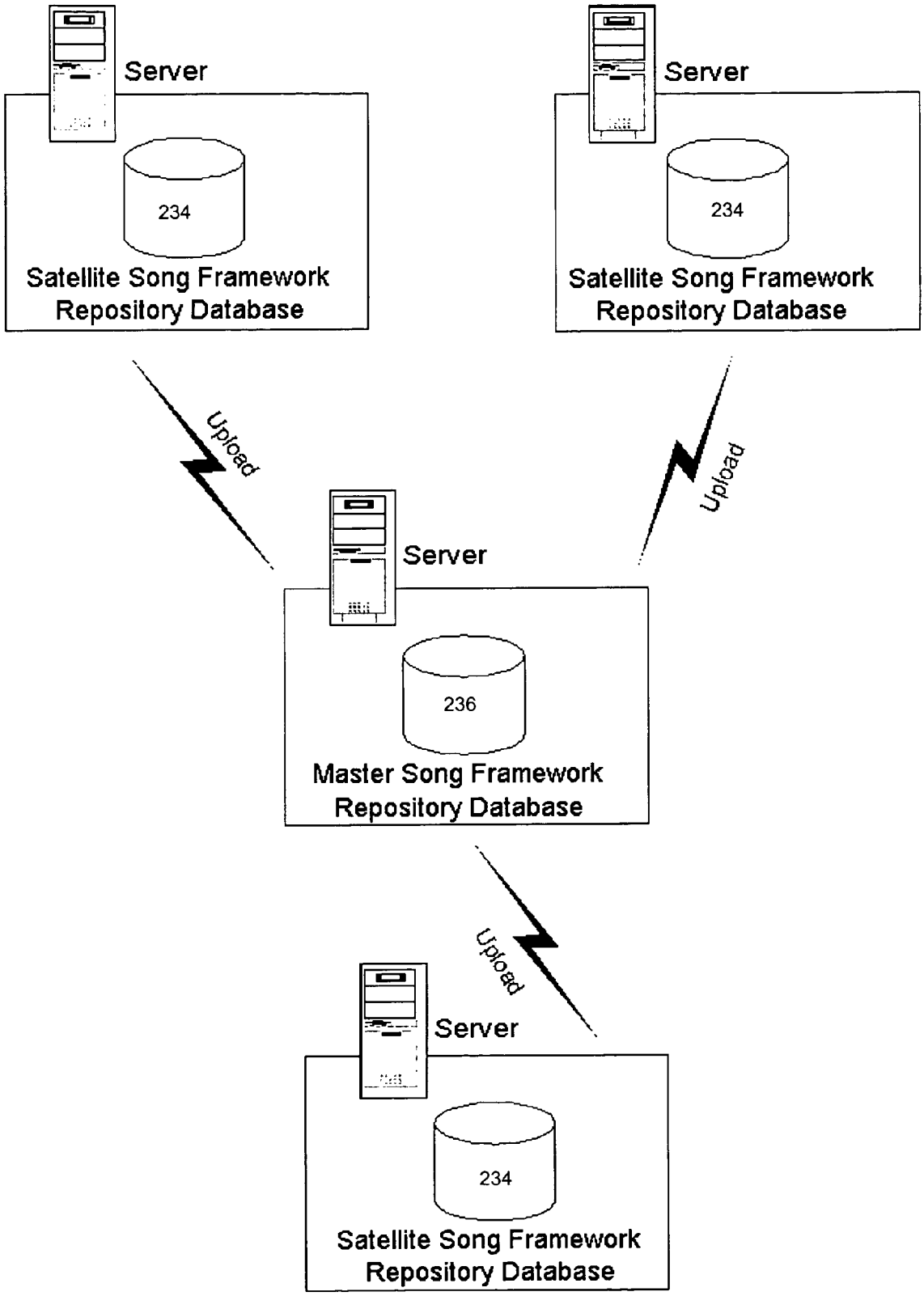

FIG. 156 illustrates a client/server deployment of satellite Song Module Repositories and a Master Song Module Repository.

Figure 157:
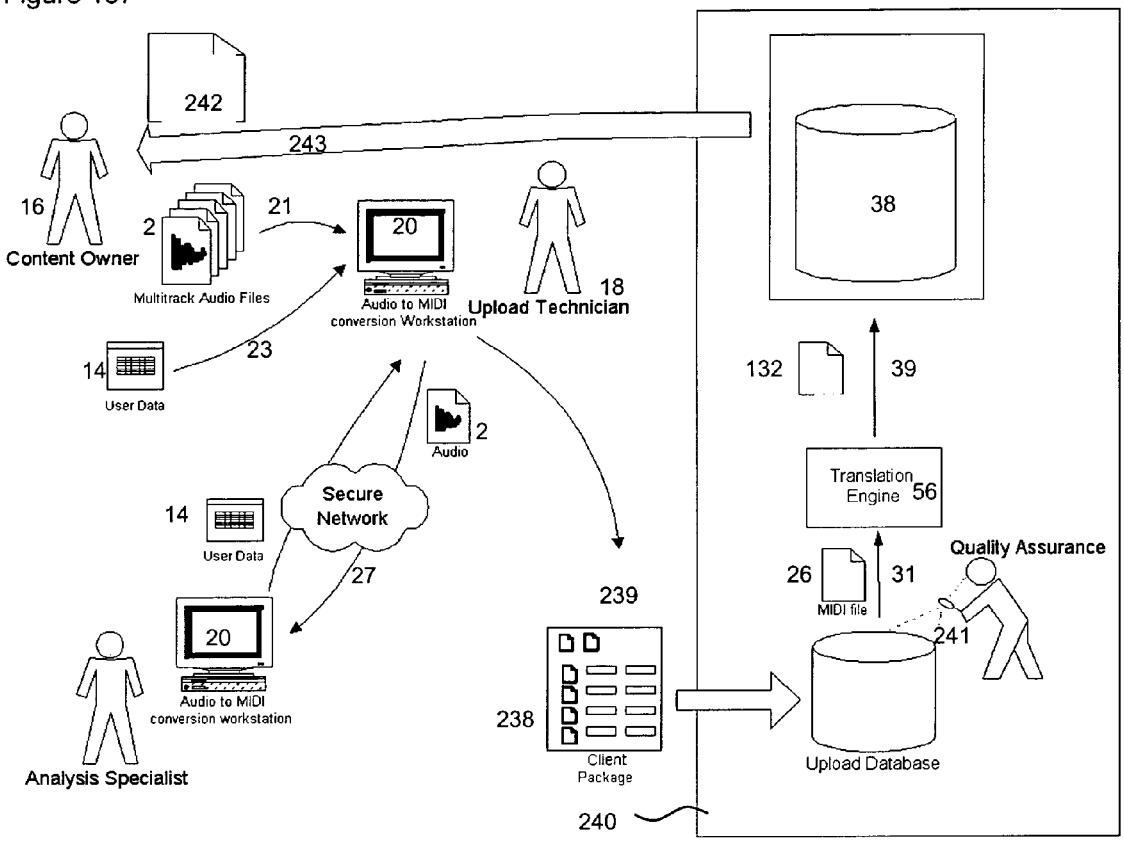

FIG. 157 is diagram of the small-scale registry process.

Figure 158:
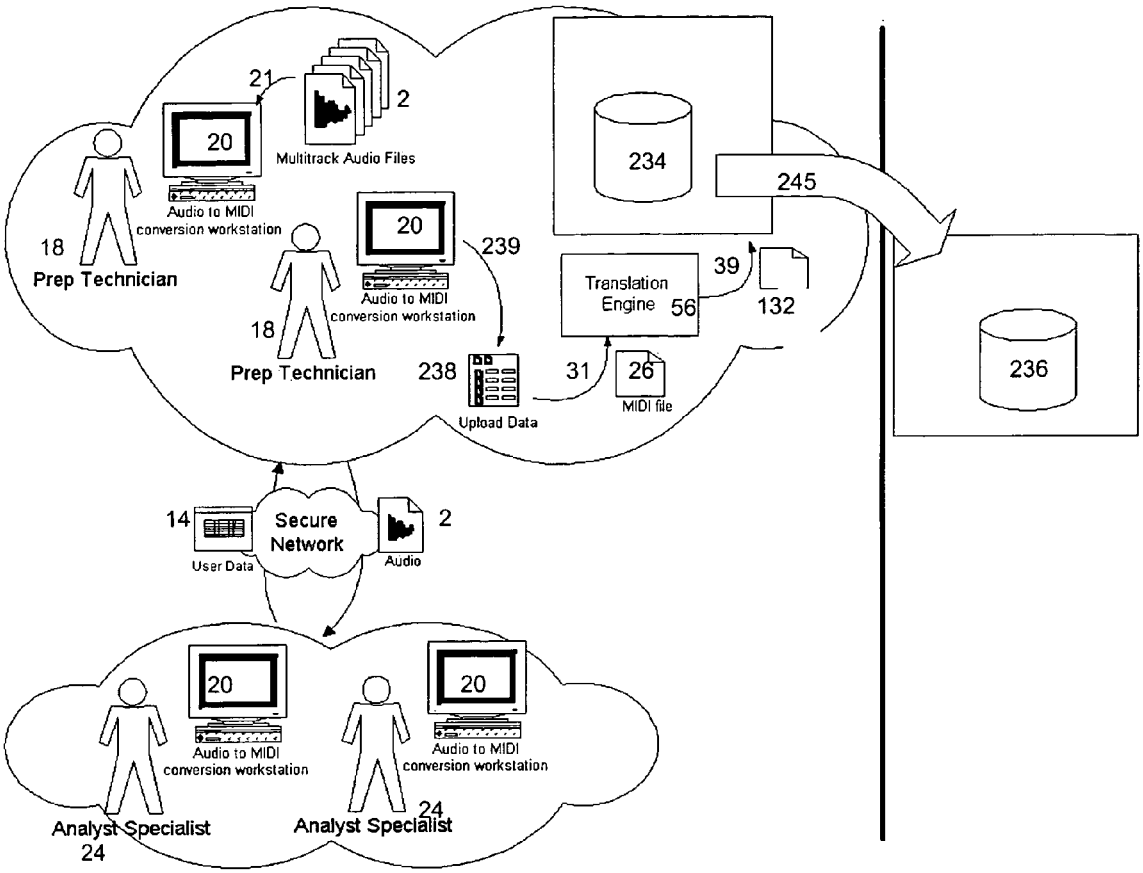

FIG. 158 is diagram of the enterprise registry process.

Figure 159:
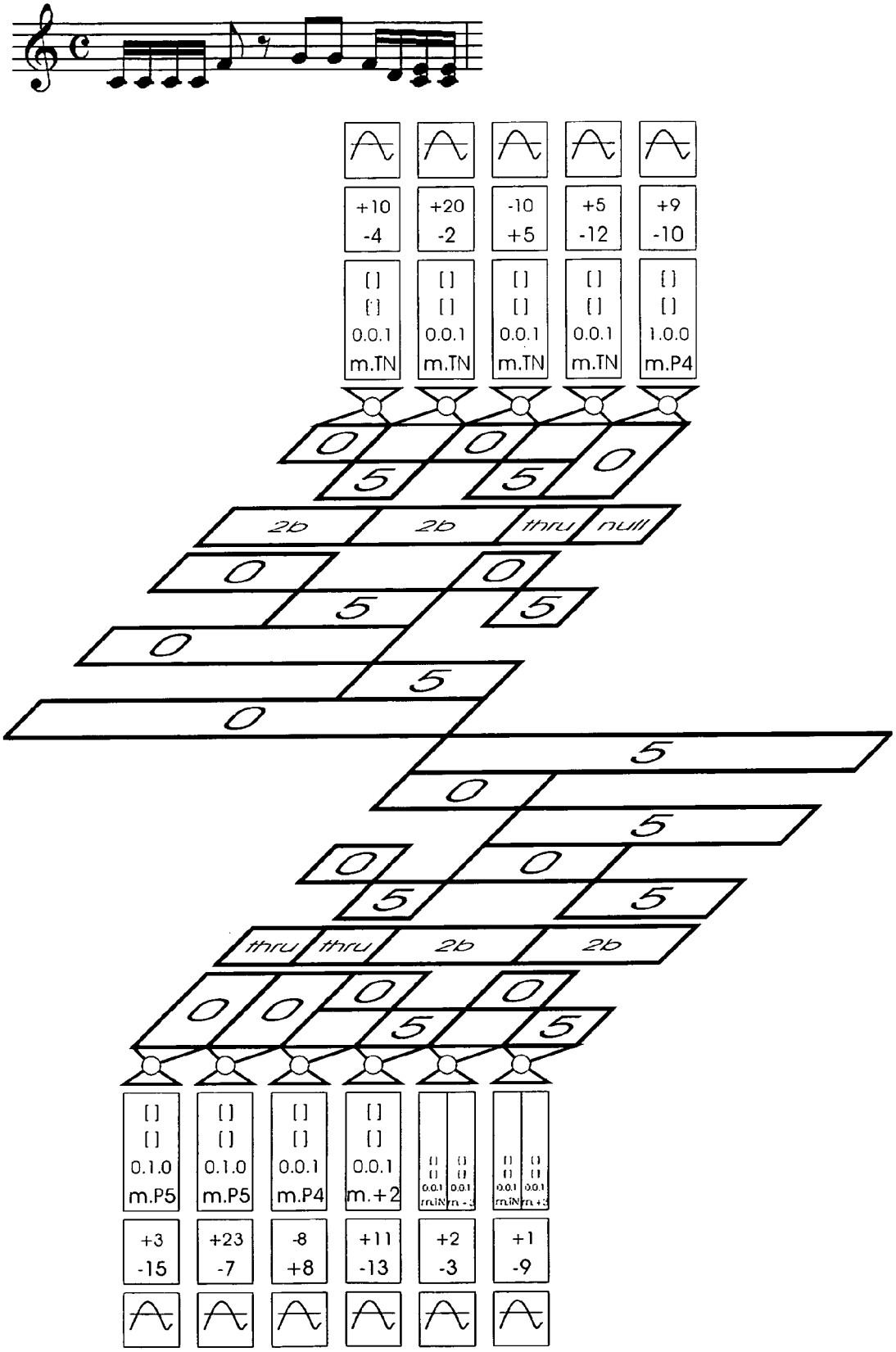

FIG. 159 illustrates a comparison of Standard Notation vs. the Musical representation of the current system.

Figure 160:
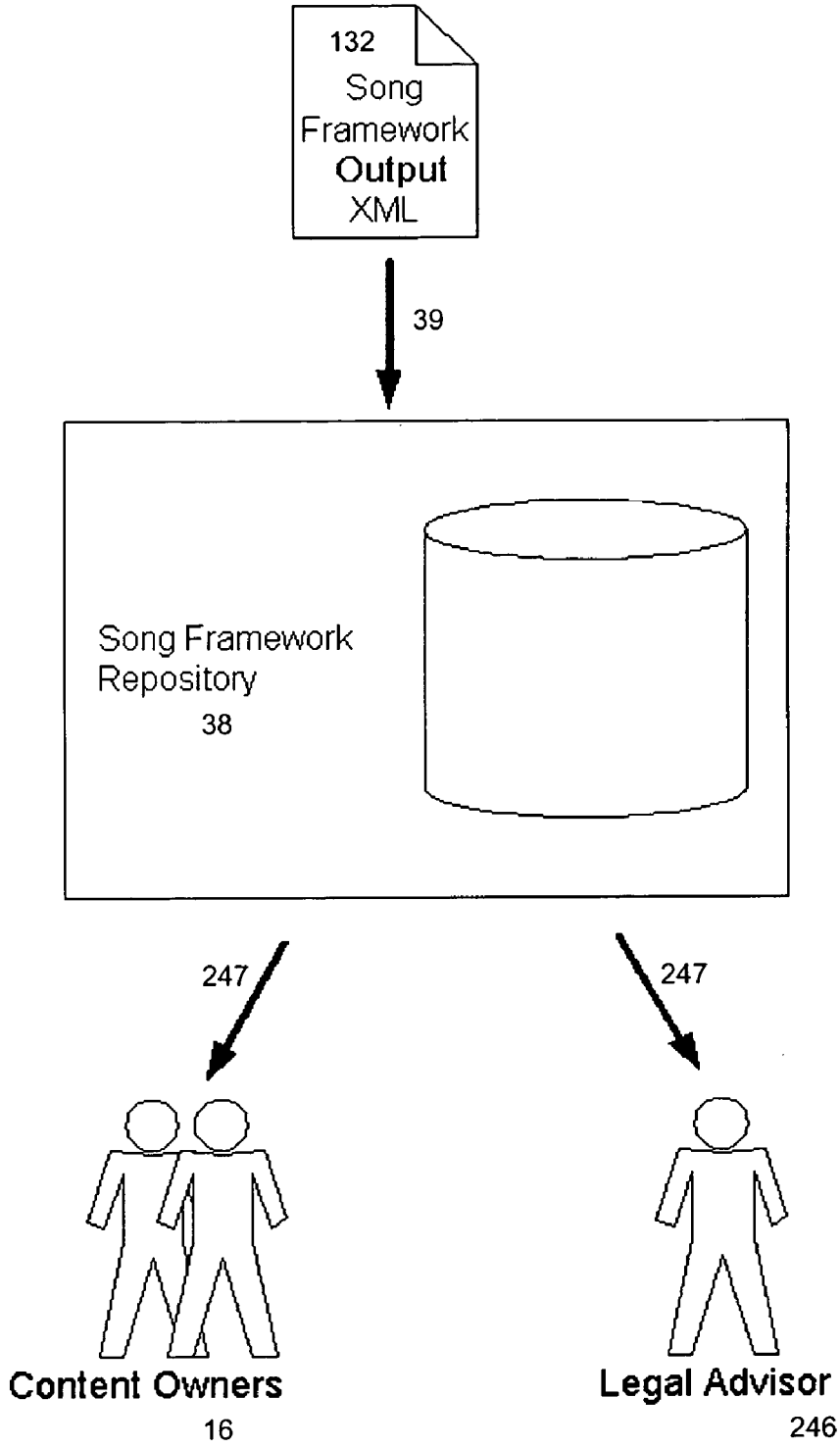

FIG. 160 illustrates the automated potential infringement notification process.

Figure 161:
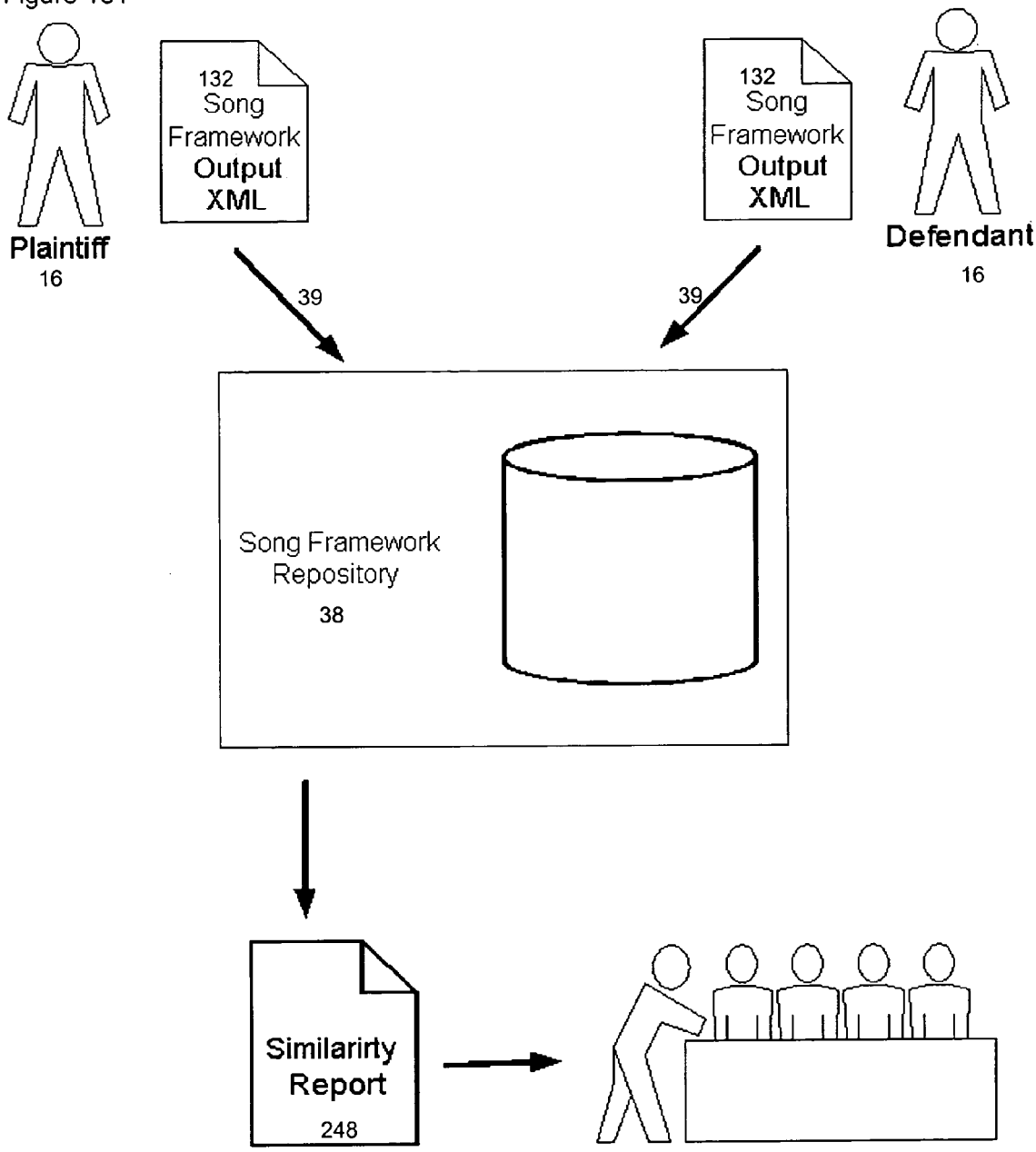

FIG. 161 illustrates the similarity reporting process.

Figure 162:
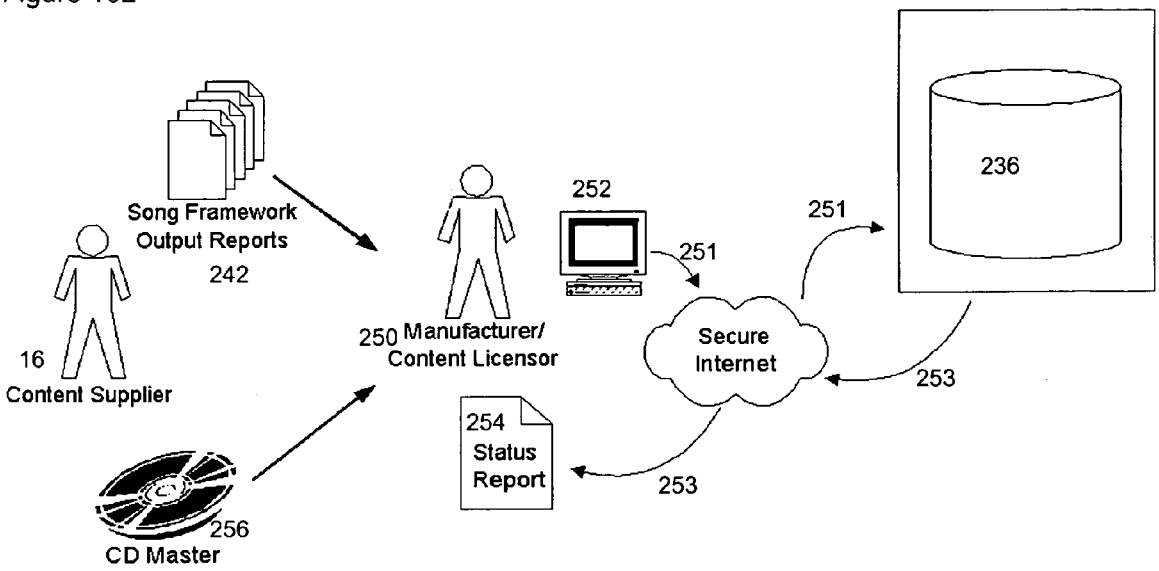

FIG. 162 illustrates the Content Verification Process.

DETAILED DESCRIPTION

The detailed description details one or more embodiments of some of the aspects of the present invention.

The detailed description is divided into the following headings and sub-headings:

(1) "Theoretical Concepts"—which describes generally the theoretical concepts that comprise the music representation method of the present invention. "Theoretical Concepts" consists of "Carrier Theory" and "Modulator Theory" sections.

(2) "Theoretical Implementation"—which describes generally the implementation of the music representation method of the present invention. "Theoretical Implementation" consists of "Performance Element", "Performance Element Collective" and "Framework Element" sections (3) "Song Framework Functionality"—which describes the operation of the song framework functionality of the present invention whereby performance data from a MIDI file is translated into the music representation method of the present invention. "Song Framework Functionality" consists of "Process to create Framework Elements and Instrument Performance Tracks from MIDI file data", "Process to create a Performance Element from a bar of MIDI data", and "Classification and mapping of Performance Elements" sections.

(4) "Framework Repository Functionality"—which describes generally the database implementation of the present invention.

(5) "Applications" which describes generally a plurality of system and computer product implementations of the present invention.

Theoretical Concepts

The music representation methodology of the present invention is best understood by reference to base theoretical concepts for analyzing music.

The American Heritage Dictionary defines "music" as the following, "Vocal or instrumental sounds possessing a degree of melody, harmony, or rhythm."

Figure 1:
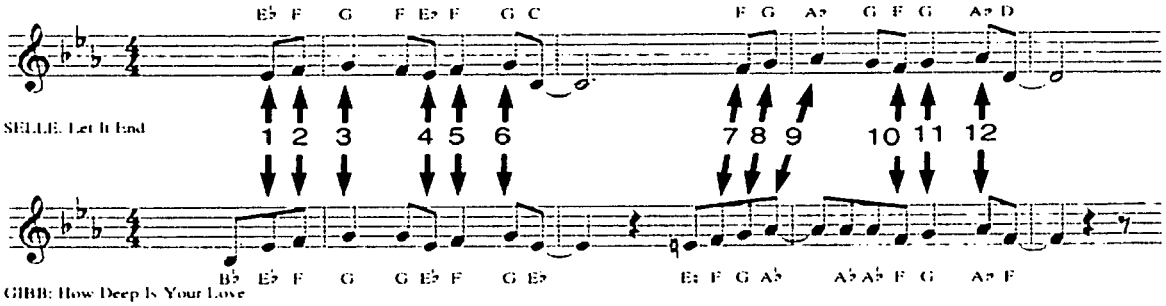
FIG. 1 illustrates a comparison of notated melodies.
Figure 2:
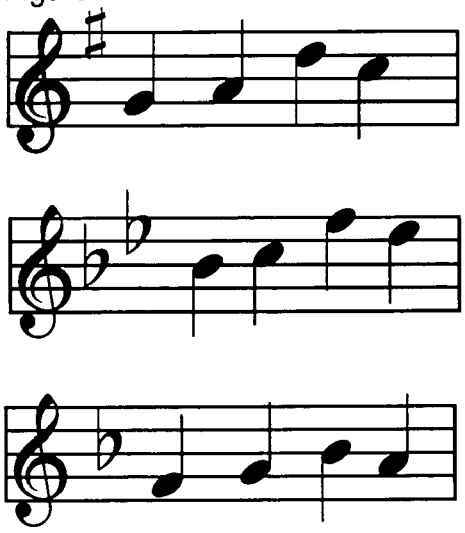
FIG. 2 illustrates a single melody in various keys.
Figure 3:
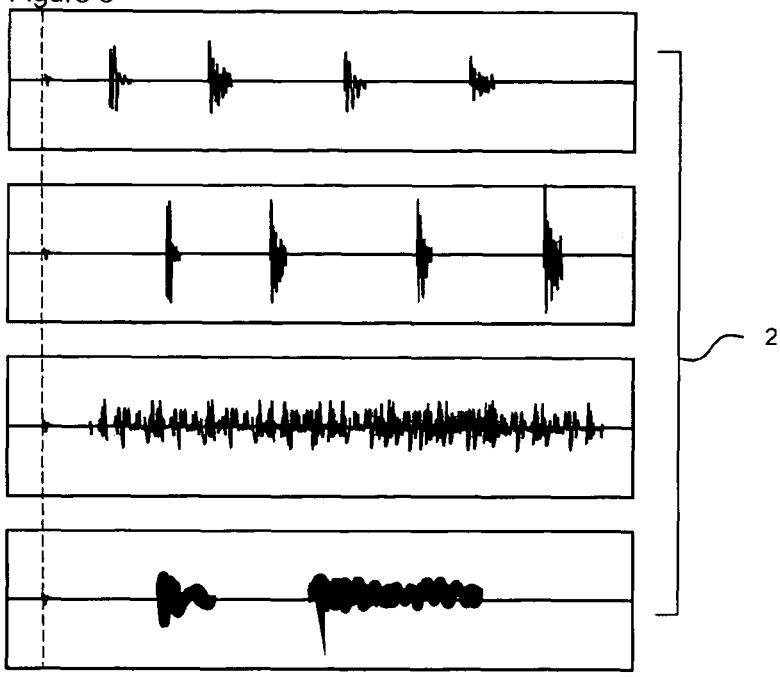
FIG. 3 is a diagram of multitrack Audio Files.
Figure 4:
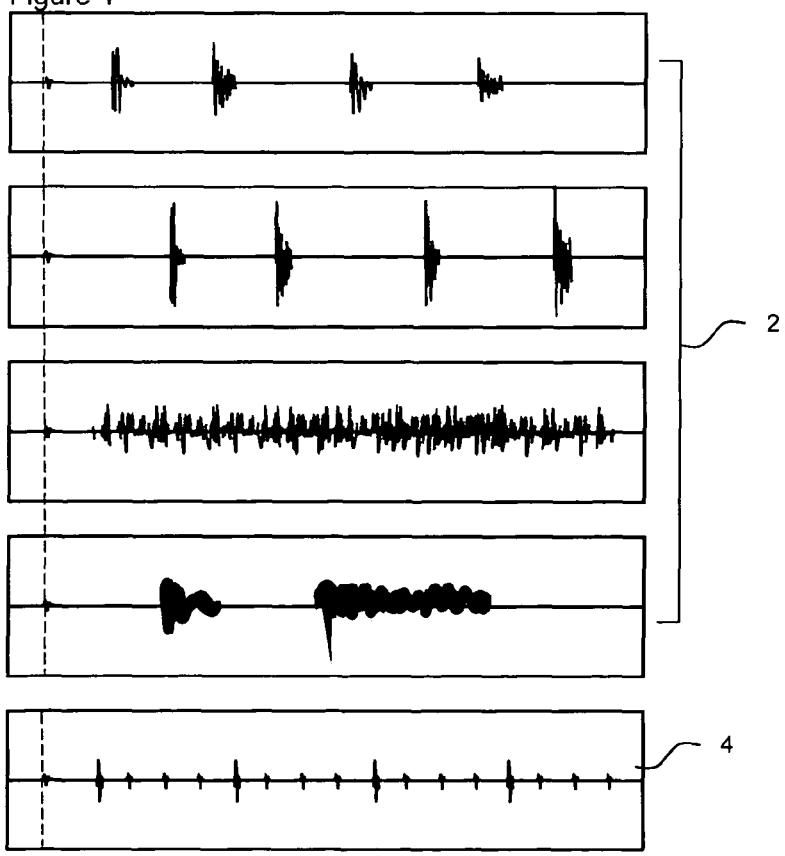
FIG. 4 is a diagram of audio Files with Click Track.
Figures 5, 6, 7:
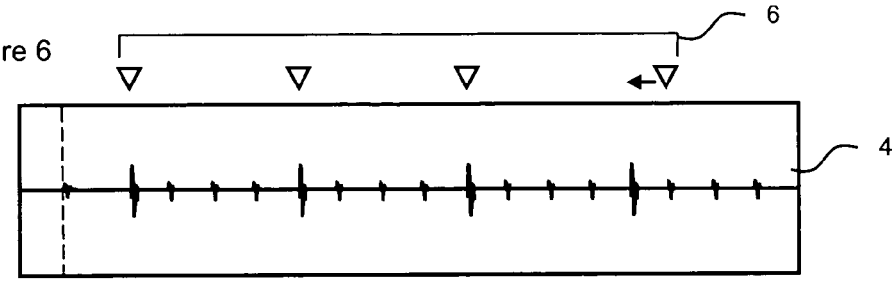
FIG. 5 illustrates an example of sample file, index and source.
FIG. 6 illustrates tempo alignment to click track.
FIG. 7 illustrates the song Section of an environment track.
Figure 8:
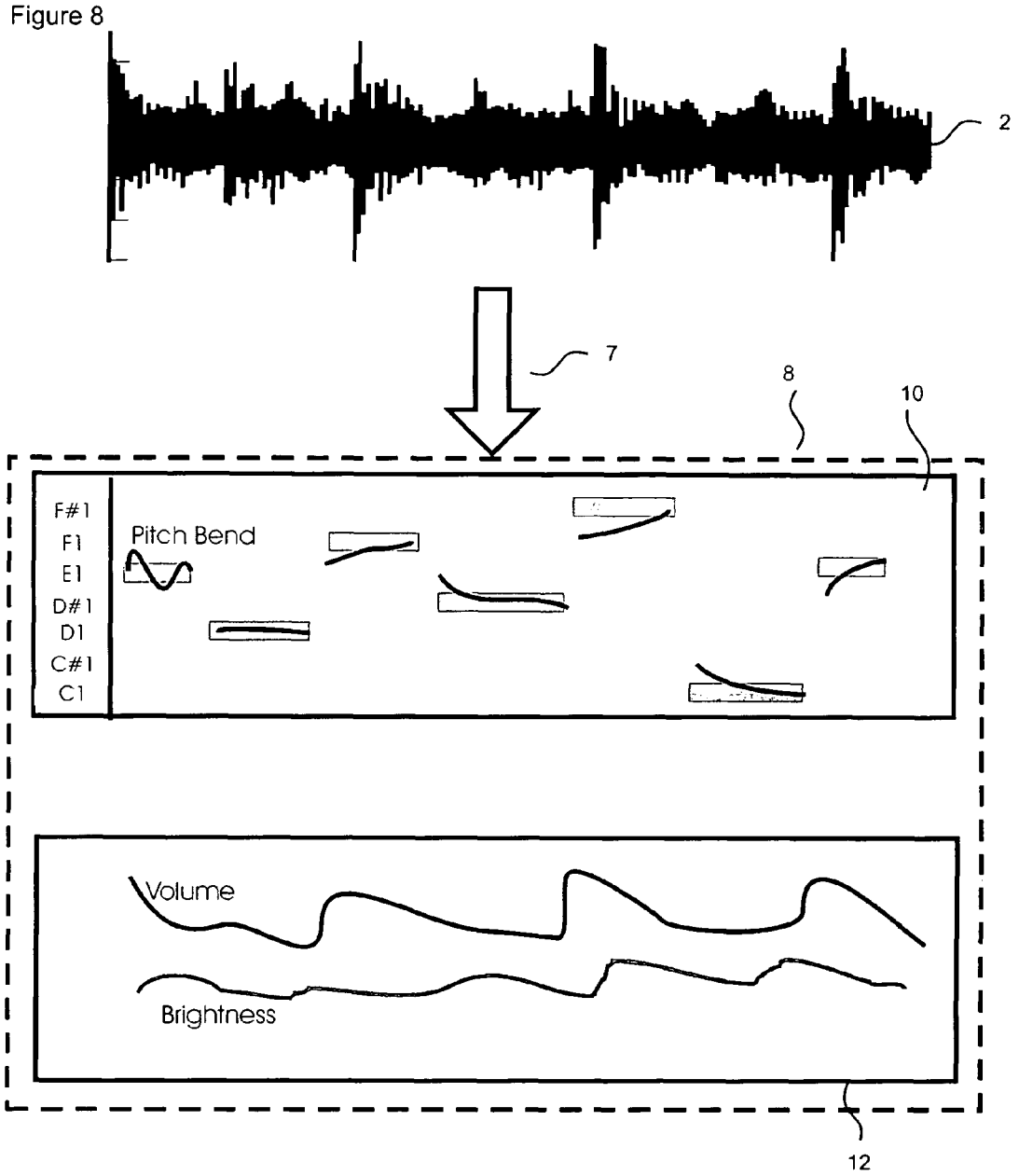
FIG. 8 illustrates the audio to Control Signal Conversion process.
Figure 9:
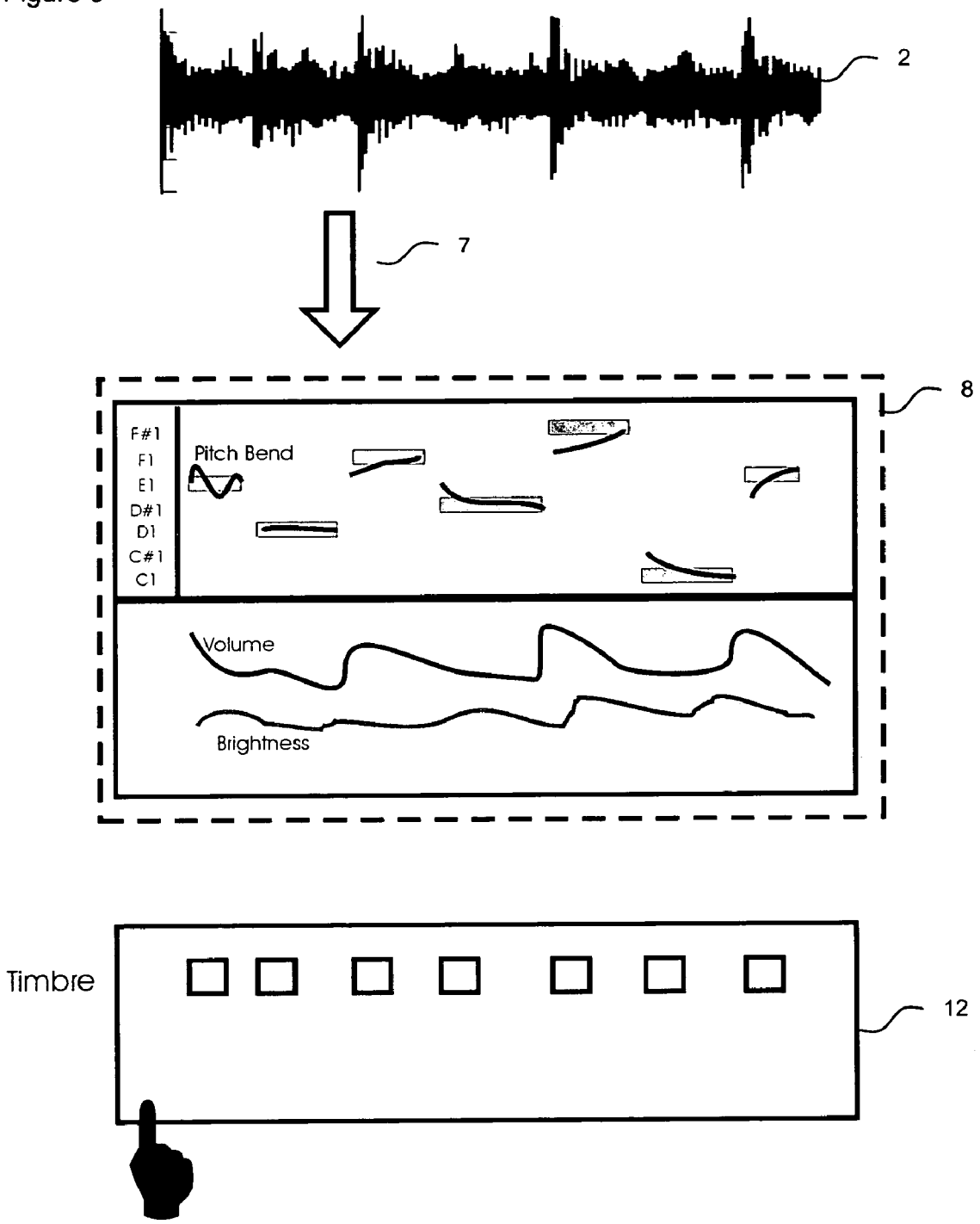
FIG. 9 illustrates the Monophonic Pitched classification inputs.
Figure 10:
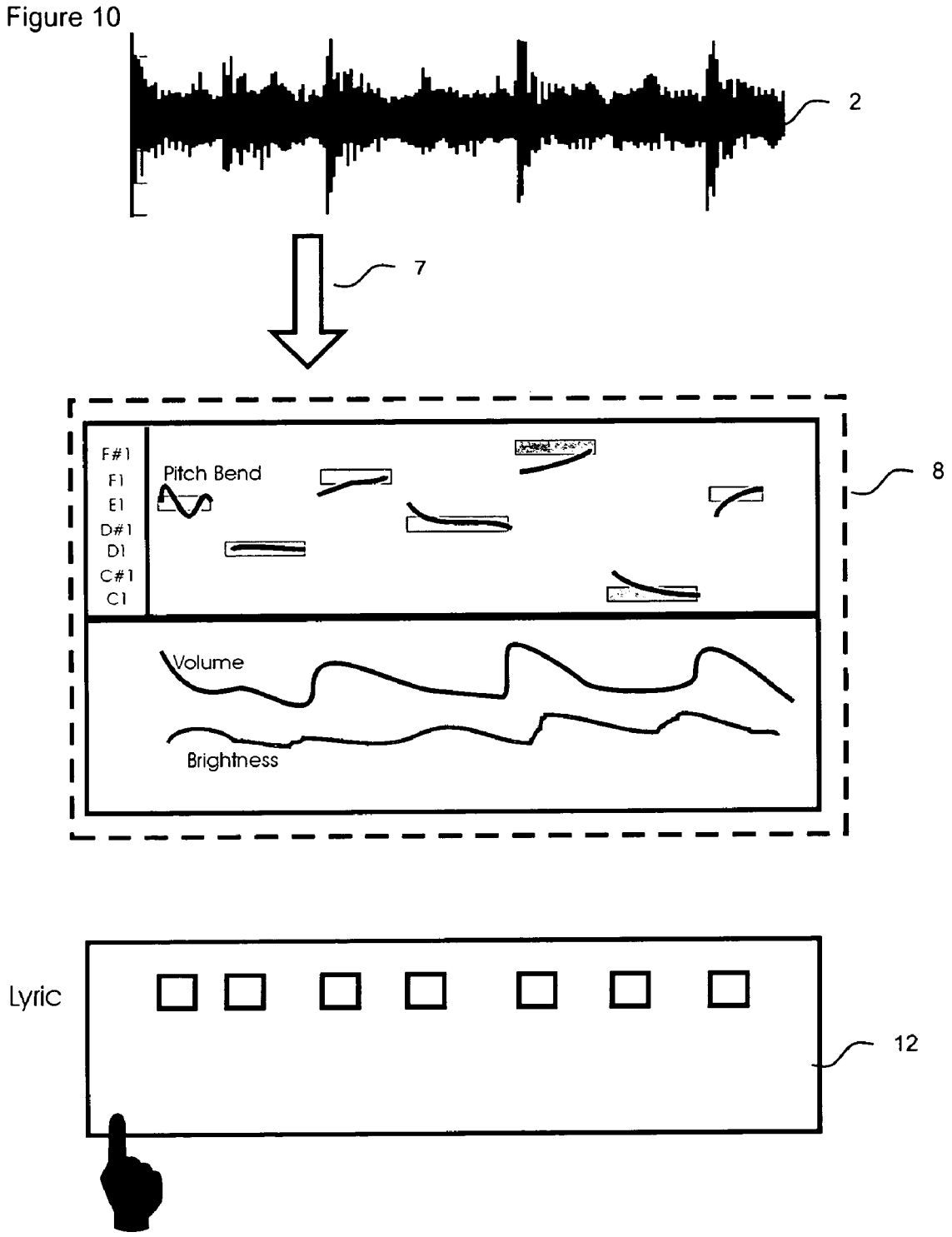
FIG. 10 illustrates the Monophonic Pitched Vocal classification.
Figure 11:
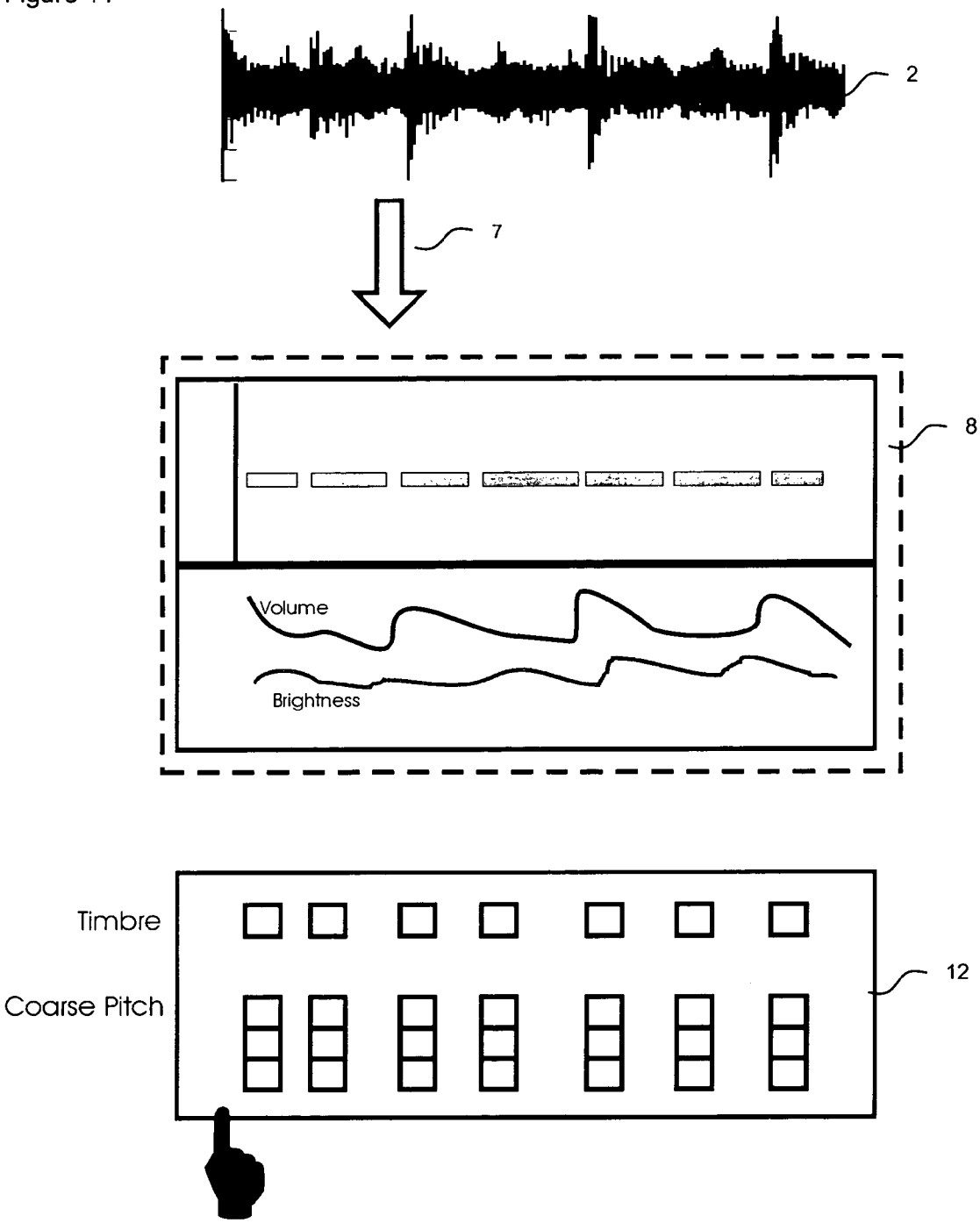
FIG. 11 illustrates the Polyphonic Pitched classification.
Figure 12:
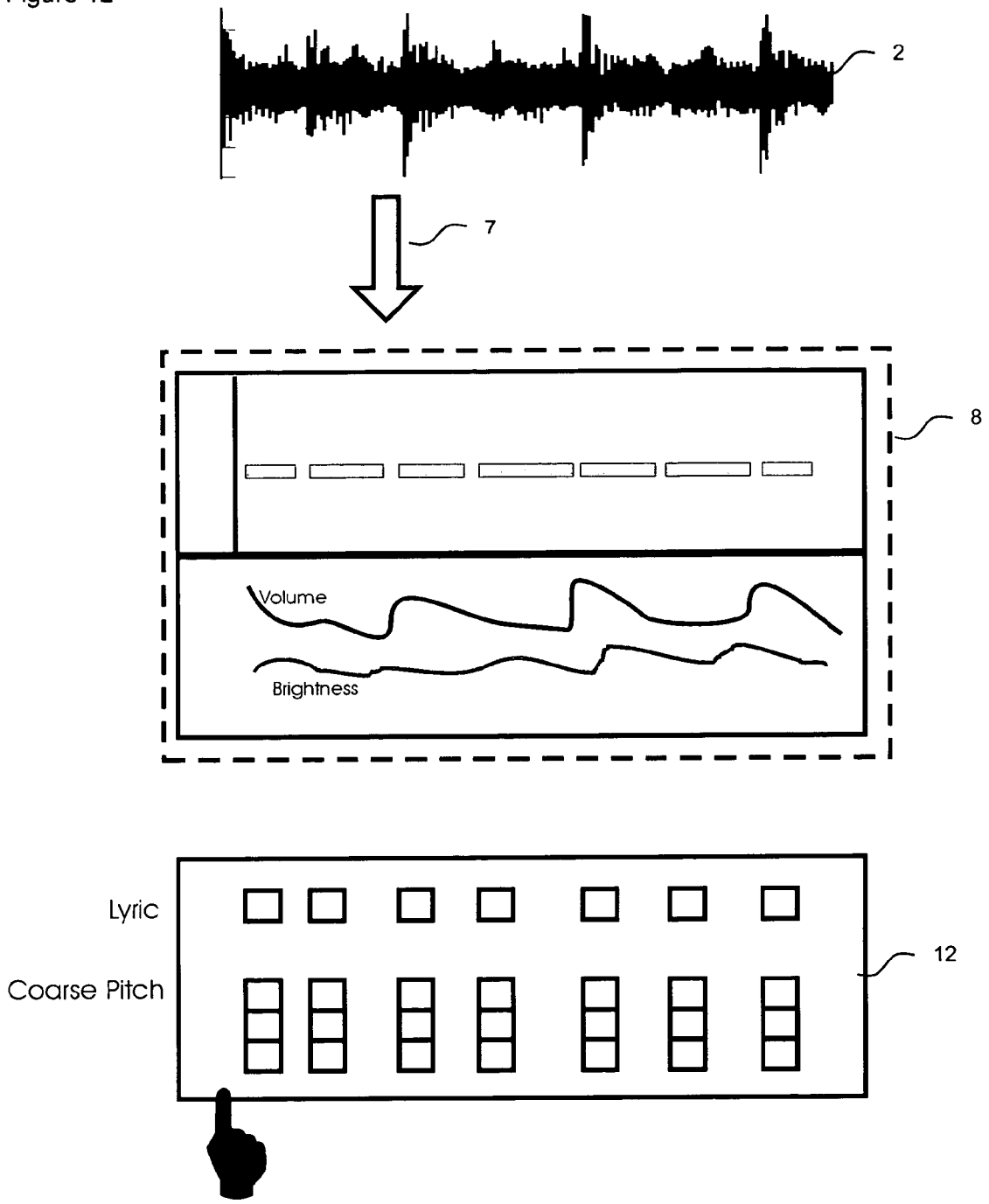
FIG. 12 illustrates the Polyphonic Pitched Vocal classification.
Figure 13:
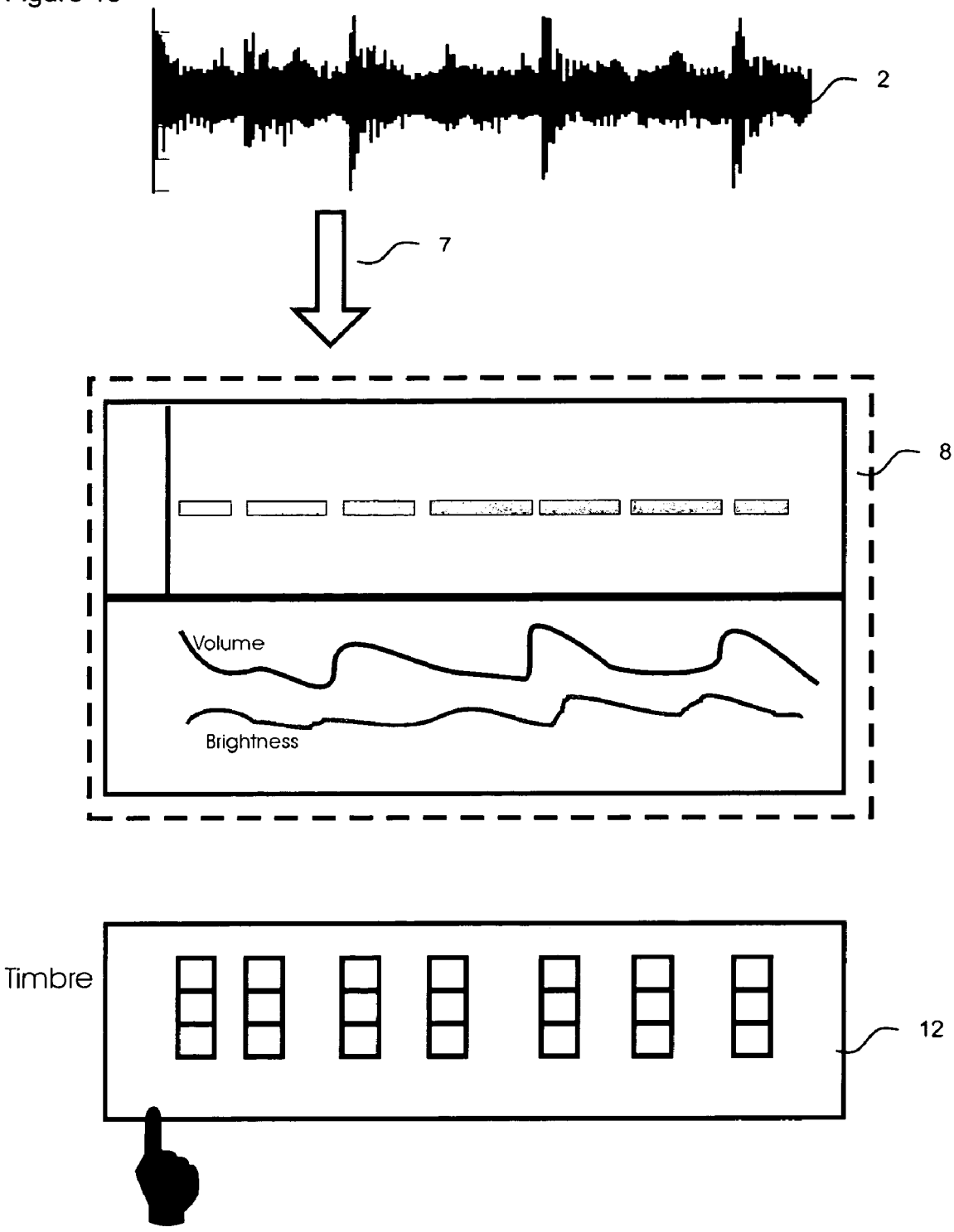
FIG. 13 illustrates the Non-Pitched Percussion classification.
Figure 14:
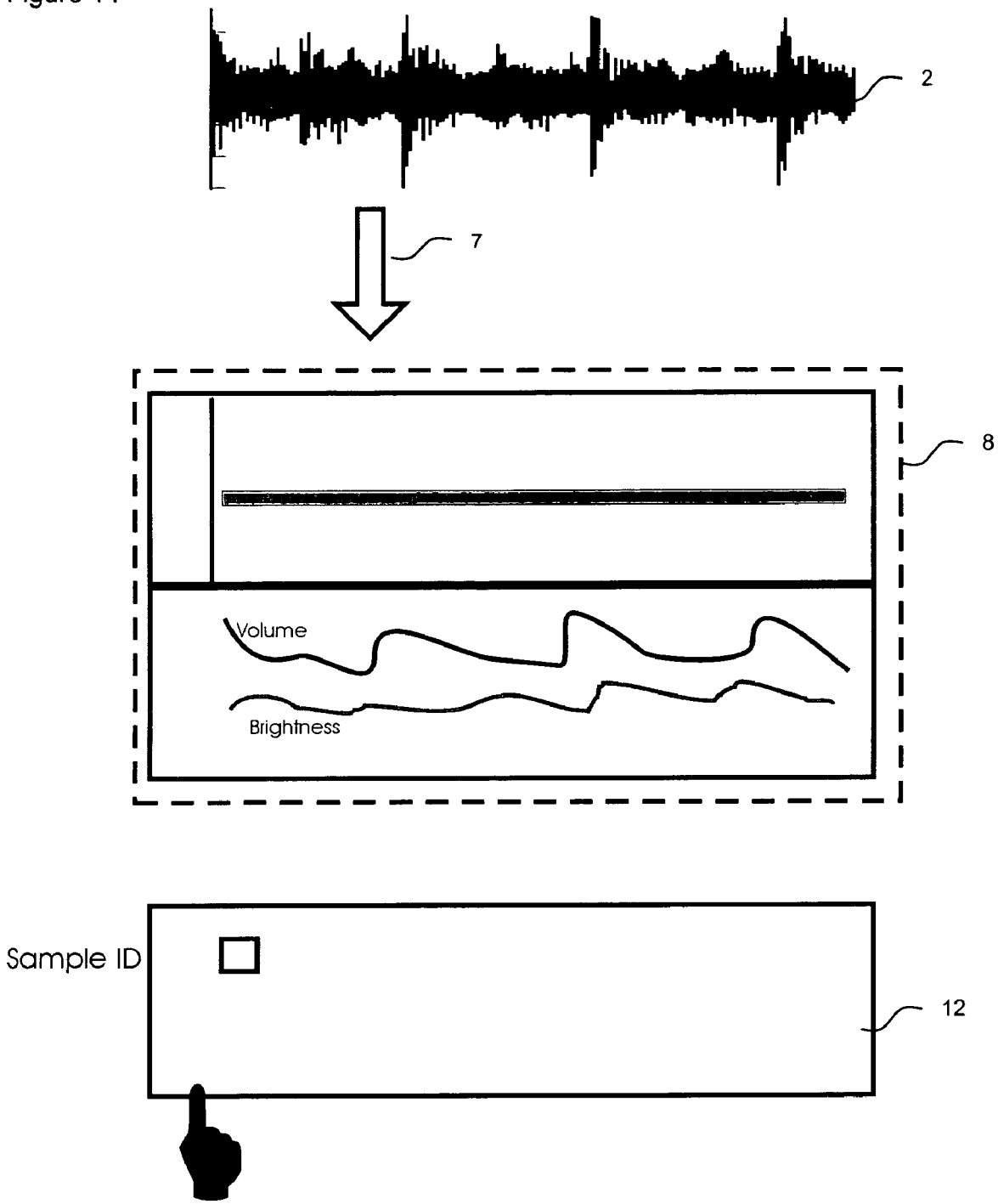
FIG. 14 illustrates the Complex wave classification.
Figure 15:
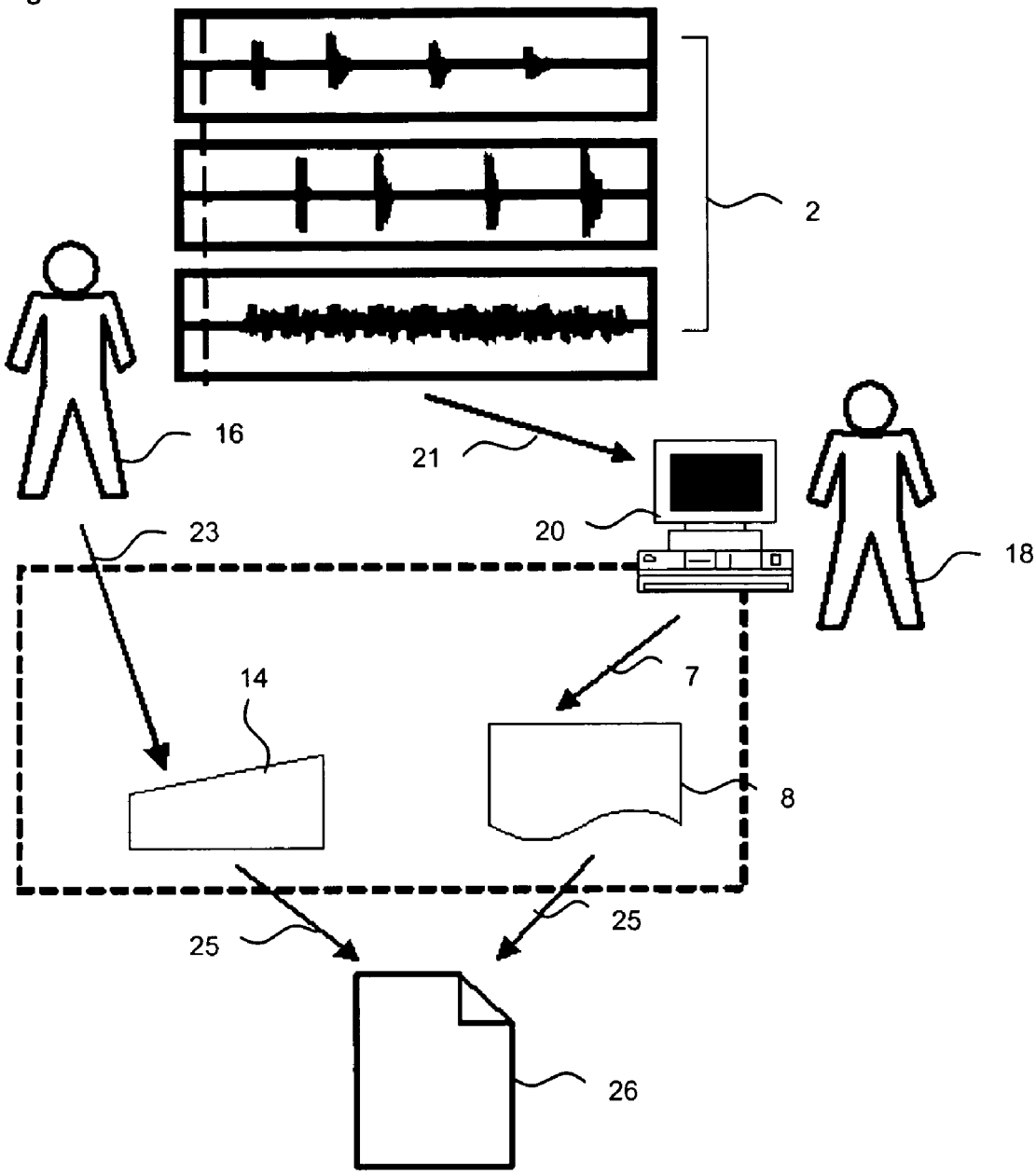
FIG. 15 is a diagram of a local audio to MIDI processing workflow.
Figure 16:
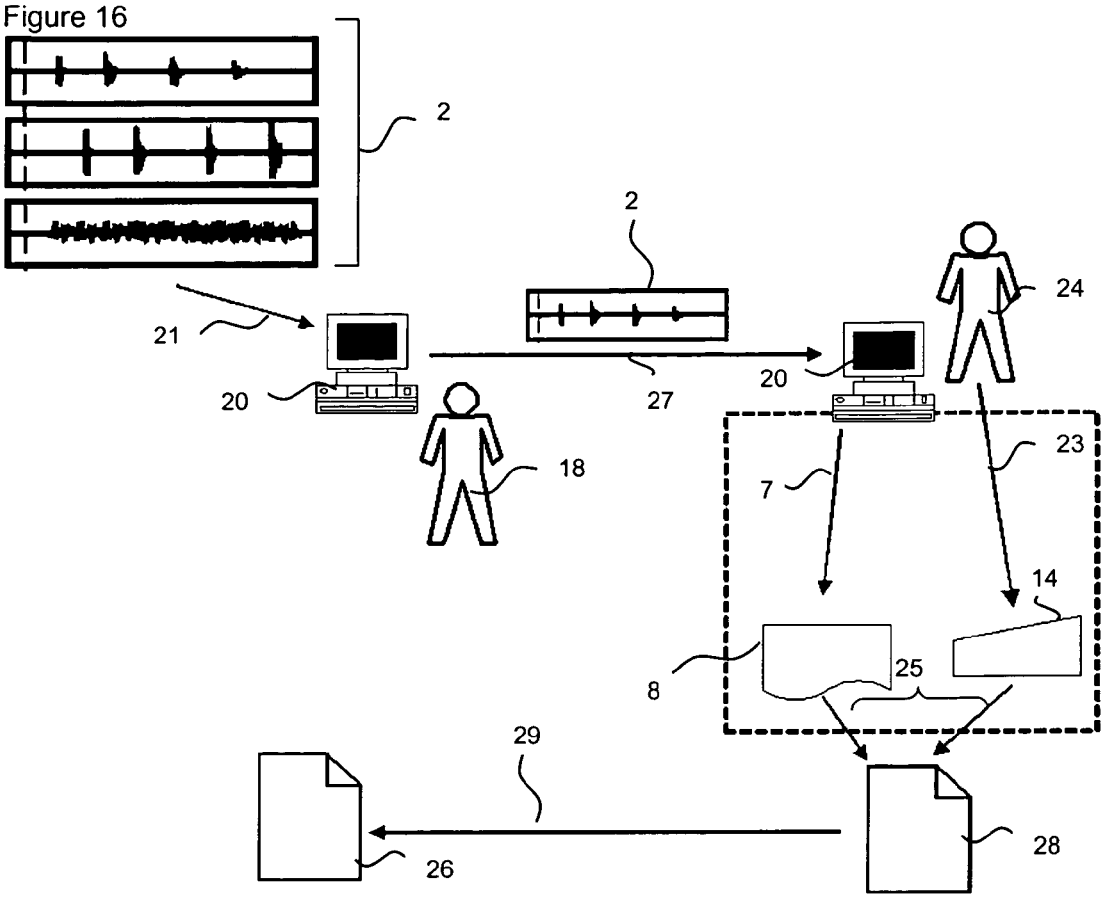
FIG. 16 is a diagram of local and remote audio to MIDI Processing workflows.
Figure 17:
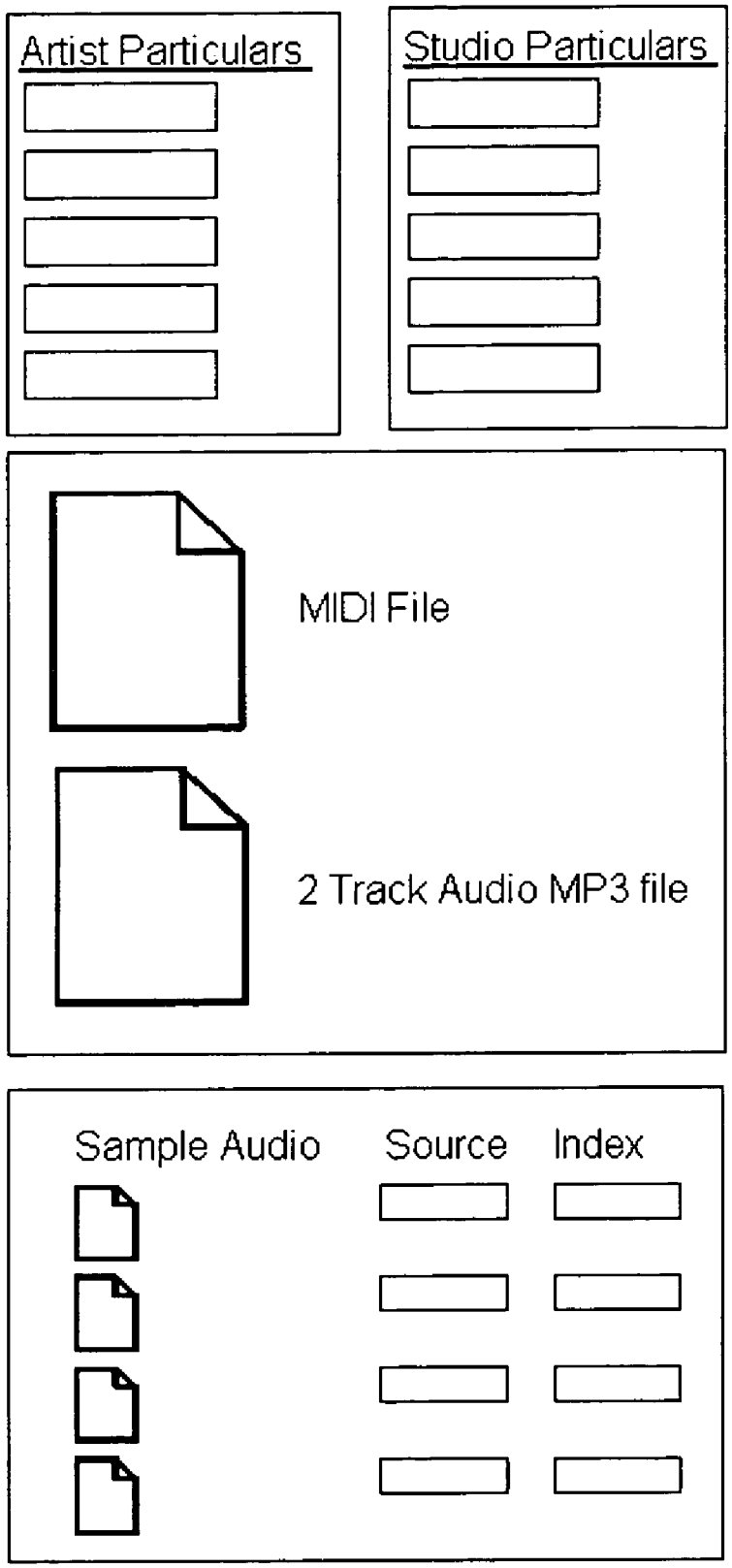
FIG. 17 illustrates an example of an upload page.
Figure 18:
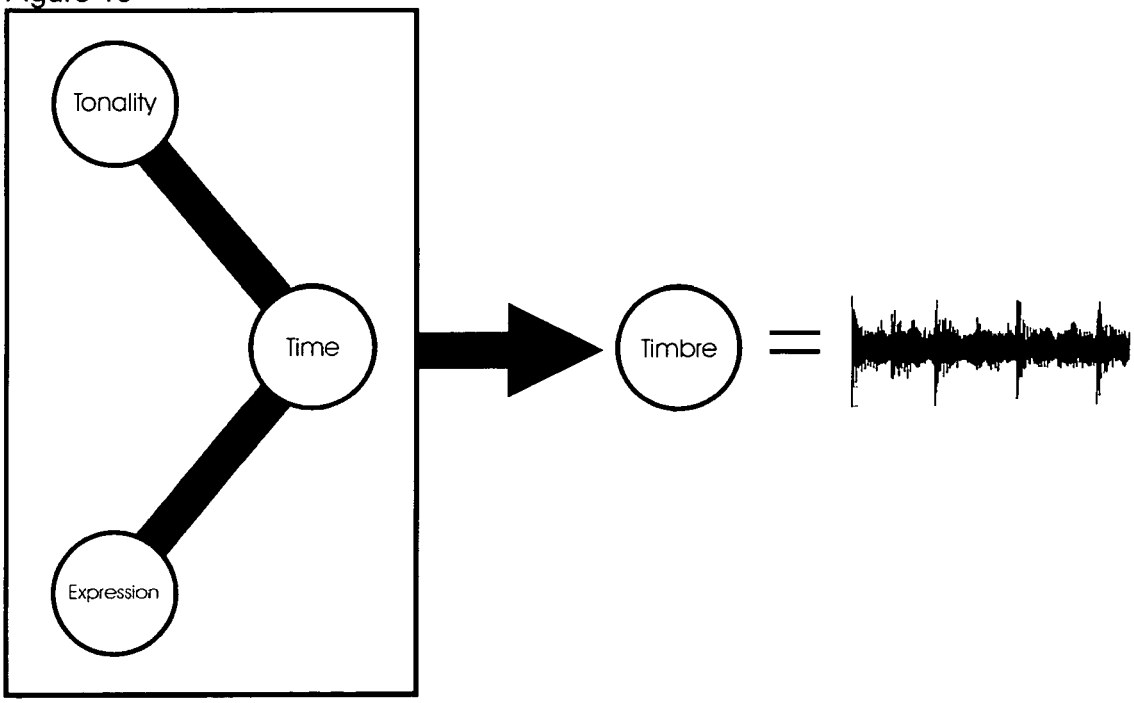
FIG. 18 illustrates the time, tonality, expression, and timbre relationship.

Western Music is, essentially, a collocation of tonal and expressive parameters within a metric framework. This information is passed to an instrument, either manually or electronically and a "musical sound wave" is produced. FIG. 18 shows the relationship between time, tonality, expression, timbre and a sound waveform.

Figure 19:
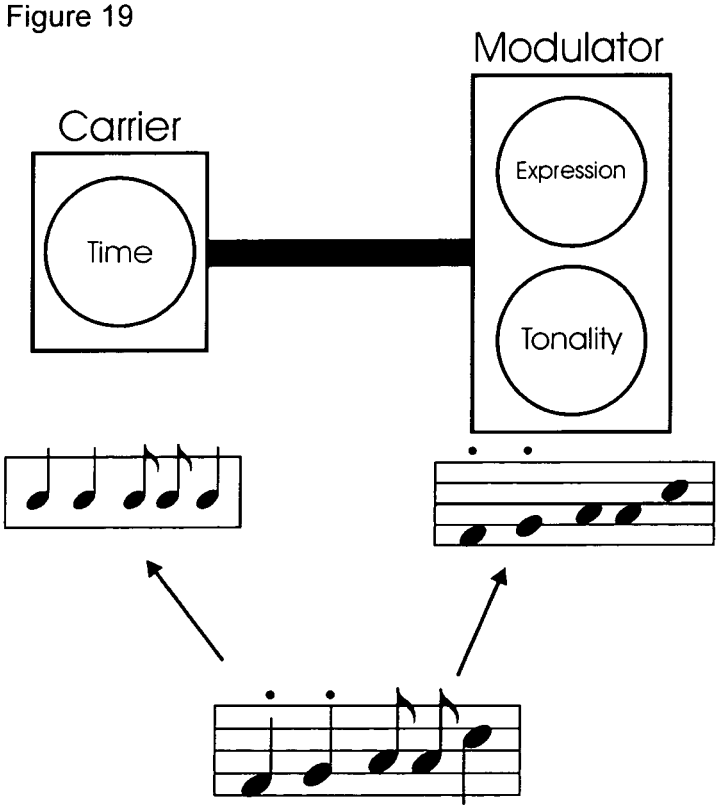
FIG. 19 illustrates carrier and modulator concepts related to standard notation.

Music representation focuses on the relationship between tonality, expression, and meter. A fundamental concept of the musical representation of the current invention is to view this as a carrier/modulator relationship. Meter is a carrier wave that is modulated by tonality and expression. FIG. 19 illustrates the carrier/modulator relationship and shows how the concepts can be expressed in terms of standard notation.

Figure 20:
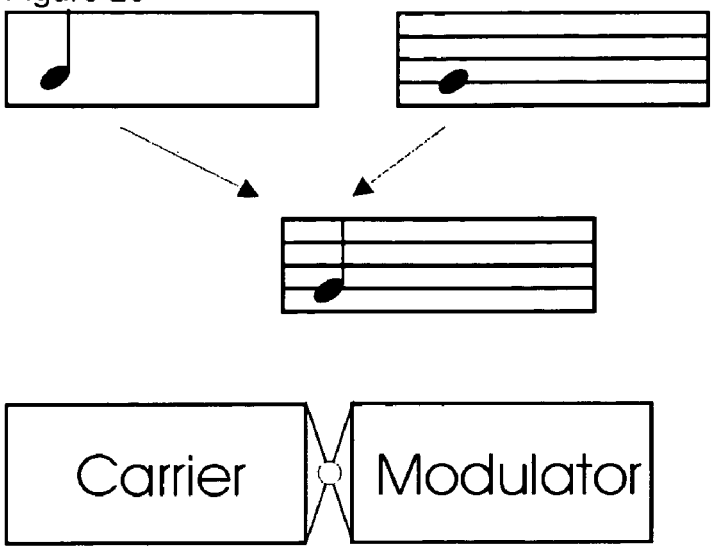
FIG. 20 illustrates a Note Event, which is a Carrier Modulator transaction.

The musical representation of the current invention defines a "note event" as a transaction between a specific carrier point and a modulator. FIG. 20 illustrates this concept.

The carrier concept is further discussed in the "Carrier Theory" section (below), and the modulator concept is further discussed in the "Modulator Theory" section (also below).

Carrier Theory

Carrier wave—"a . . . wave that can be modulated . . . to transmit a signal."

This section explains the background justification for carrier theory, an introduction to carrier theory notation, carrier salience, and finally carrier hierarchy.

In order to communicate the carrier concepts adequately, supporting theory must first be reviewed. The background theory for carrier concepts involves a discussion of harmonic series, sound waves, and western meter structures.

Figure 21:
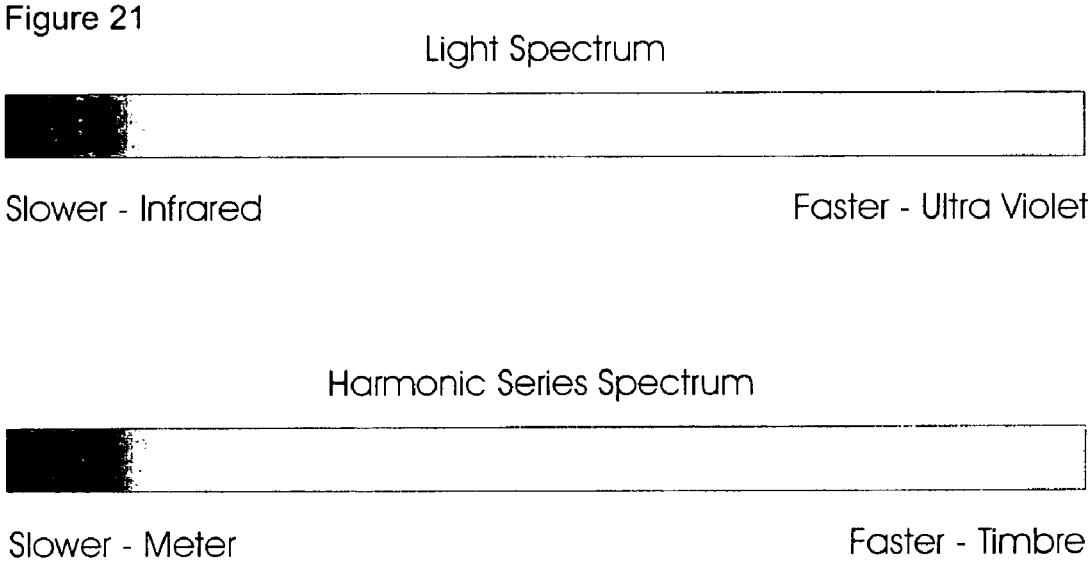
FIG. 21 illustrates the harmonic series applied to timbre, harmony, and meter.

FIG. 21 compares the spectrum of light to a "spectrum" of harmonic series. Just as light ranges from infrared to ultraviolet, incarnations of the harmonic series range from meter at the slow end of the spectrum to timbre at the fast end of the spectrum.

Figure 22:
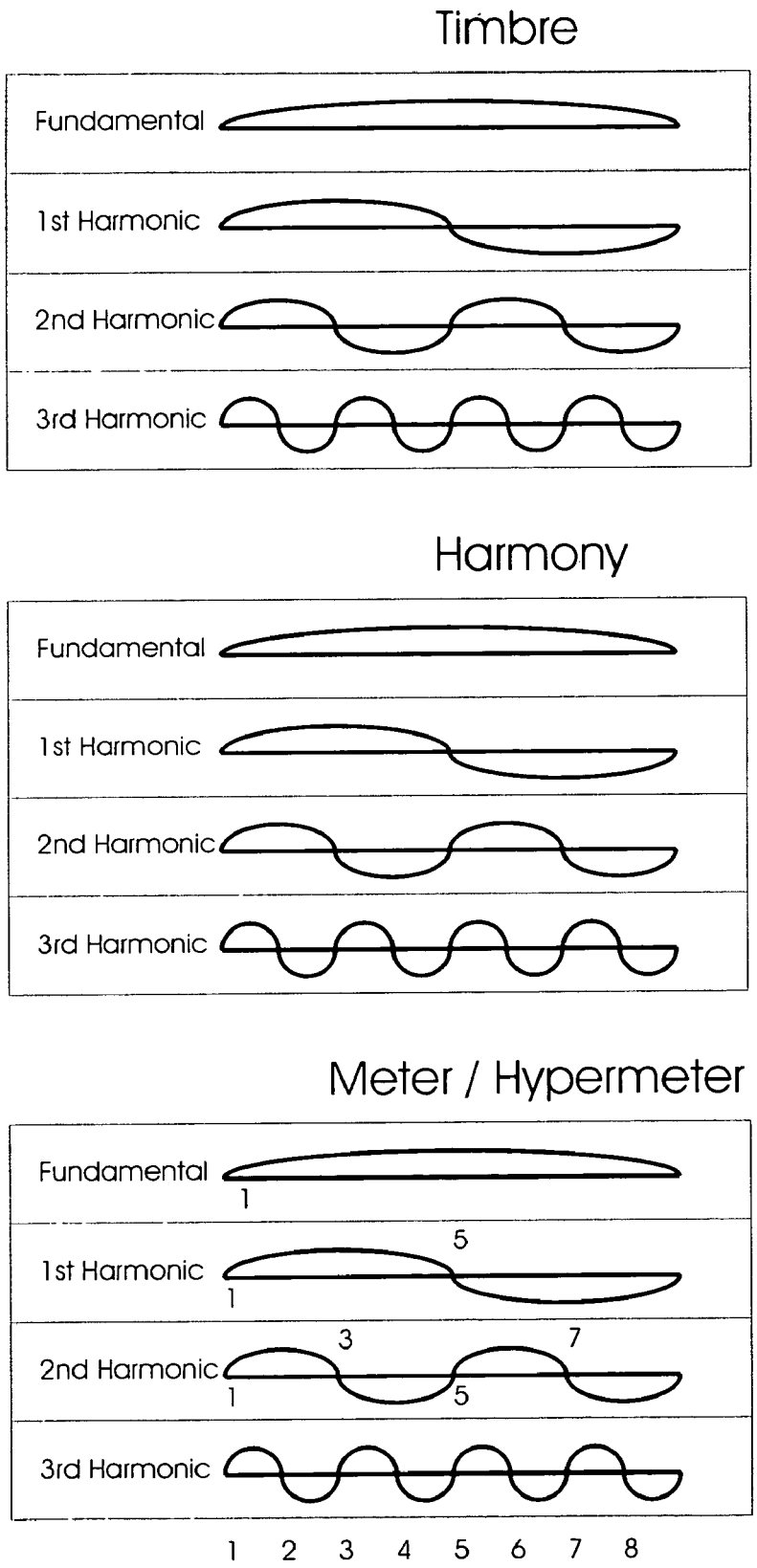
FIG. 22 illustrates a spectrum comparison between light and the harmonic series.

Timbre, Harmony and Meter can all be expressed in terms of a harmonic series. FIG. 22 illustrates the various spectrums of the harmonic series. In the "timbral" spectrum of the harmonic series, the fundamental tone defines the base pitch of a sound, and harmonic overtones combine at different amplitudes to produce the quality of a sound. In the "harmonic"

spectrum of the harmonic series, the fundamental defines the root of a key, and the harmonics define the intervallic relationships that appear in a chord or melody. Finally, in the "meter/hypermeter" spectrum of the harmonic series, the fundamental defines the "whole" under consideration, and the harmonics define metrical divisions of that "whole".

The following are some key terms and quotes from various sources that support the spectrum of harmonic series concept:

Harmonic

Figure 23:
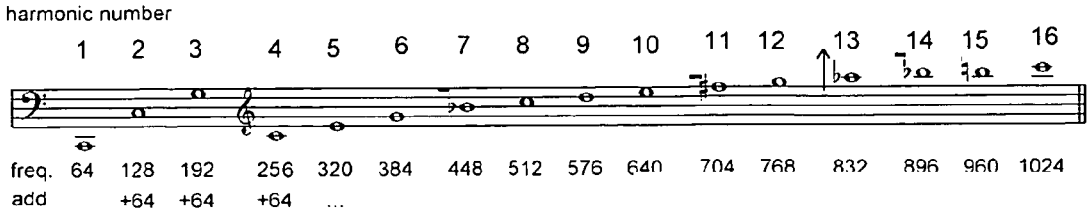
FIG. 23 illustrates the harmonic series.

A tone [or wavelength] whose frequency is an integral multiple of the fundamental frequency Harmonic Series The harmonic series is an infinite series of numbers constructed by the addition of numbers in a harmonic progression The harmonics series is also a series of overtones or partials above a given pitch (see FIG. 23)

Meter

Zuckerkandl views meter as a series of "waves," of continuous cyclical motions, away from one downbeat and towards the next. As such, meter is an active force: a tone acquires its special rhythmic quality from its place in the cycle of the wave, from "the direction of its kinetic impulse."

University of Indiana—Rhythm and Meter in Tonal Music

Hypermeter

Hypermeter is Meter at levels above the notated measures, That is the sense of measures or groups of measures organize into hypermeasures, analogous to the way that beats organize into measures. William Rothstein defines hypermeter as the combination of measures according to a metrical scheme, including both the recurrence of equal sized measure groups and a definite pattern of alteration between strong and weak measures.

University of Indiana—Rhythm and Meter in Tonal Music

Timbre

"Most sounds with definite pitches (for example, those other than drums) have a timbre which is based on the presence of harmonic overtones."

Joseph L. Monzo—Harmonic Series, Definition of Tuning Terms

Harmony

"Because Euro-centric (Western) harmonic practice has tended to emphasize or follow the types of intervallic structures embedded in the lower parts of the harmonic series, it has often been assumed as a paradigm or template for harmony."

Joseph L. Monzo—Harmonic Series, Definition of Tuning Terms

Interconnection Between Harmony and Meter

"Harmony and Rhythm are really the same thing, happening at 2 different speeds. By slowing harmony down to the point where pitches become pulses, I have observed that only the most consonant harmonic intervals become regularly repeating rhythms, and the more consonant the interval, the more repeating the rhythm. Looking at rhythm the opposite way, by speeding it up, reveals identical physical processes involved in the creation of both. Harmony is very fast rhythm."

Steven Jay—The Theory of Harmonic Rhythm

Sound waves are longitudinal, alternating between compression and rarefaction. Also, sound waves can be reduced to show compression/rarefaction happening at different harmonic levels.

Figure 24:
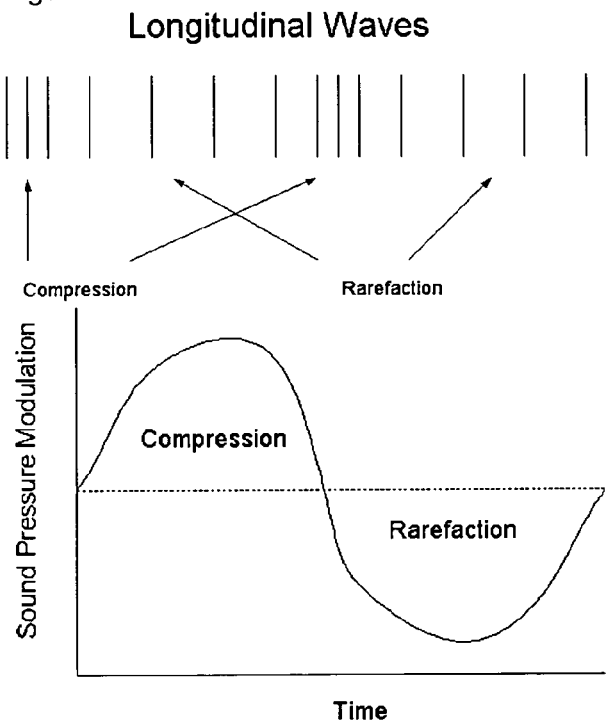
FIG. 24 is a diagram of various sound wave views.
Figure 25:
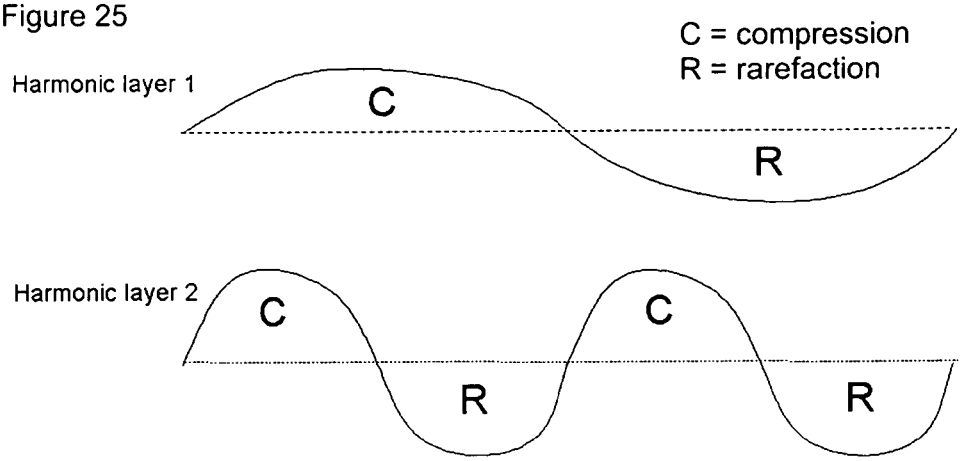
FIG. 25 illustrates compression and rarefaction at various harmonics.

FIG. 24 shows a longitudinal and graphic view of sound pressure oscillating to make a sound wave. FIG. 25 shows compression/rarefaction occurring at various harmonics within a complex sound wave.

Everything in western meter is reduced to a grouping of 2 or 3.

| | |
|---|---|
| Binary: | Strong-weak |
| Ternary: | Strong-weak-weak |

These binary and ternary groupings assemble sequentially and hierarchically to form meter in western music.

| | |
|---|---|
| 4 = 2 + 2 | Binary grouping of binary elements |
| 6 = 2 + 2 + 2 | Ternary grouping of binary elements |
| 7 = 2 + 2 + 3 | Ternary grouping of binary and ternary elements |

Figure 26:
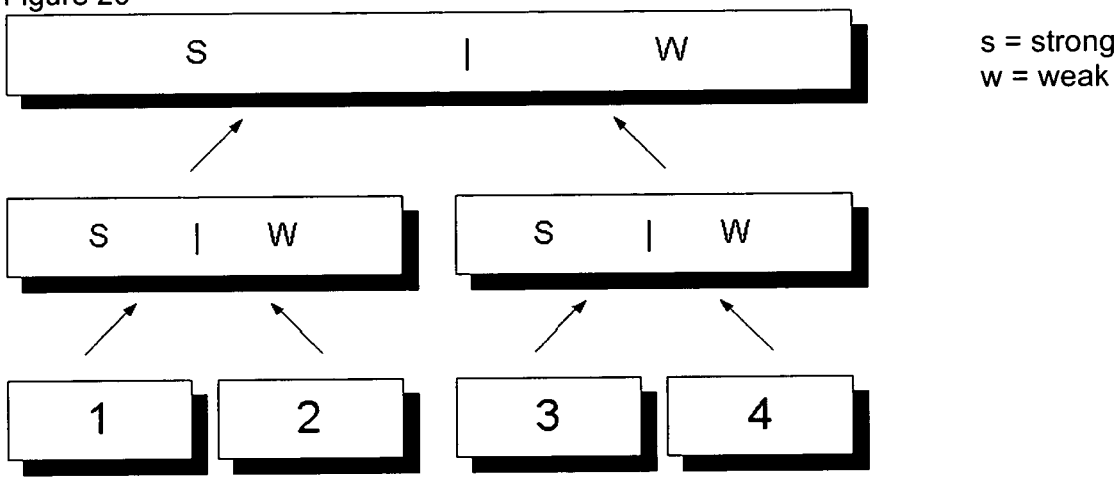
FIG. 26 illustrates the 4=2+2 metric hierarchy

FIG. 26 visualizes the 4=2+2 metric hierarchy.

The following are some key terms and quotes from various sources that support the metric hierarchy concept:

Architectonic

Rhythm is organized hierarchically and is thus "an organic process in which smaller rhythmic motives also function as integral parts of the larger rhythmic organization".

University of Indiana—Rhythm and Meter in Tonal Music

Metrical Structure

Metrical structure is the psychological extrapolation of evenly spaced beats at a number of hierarchal levels. Fundamental to the idea of meter is the notion of periodic alternation between strong and weak beats for beats to be strong or weak there must exist a metrical hierarchy. If a beat is felt to be strong at a particular level, it is also a beat at the next larger level.

Lerhdahl & Jackenhoff

Figure 27:
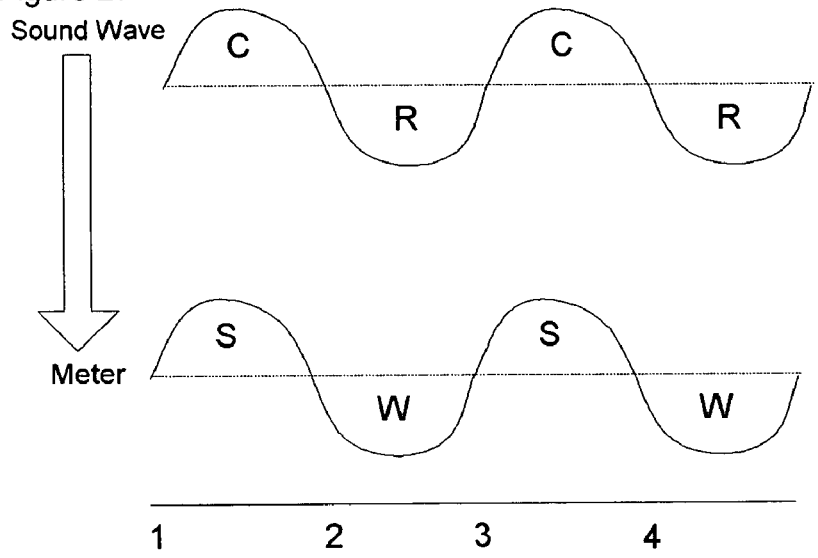
FIG. 27 illustrates a wave to meter comparison
Figure 28:
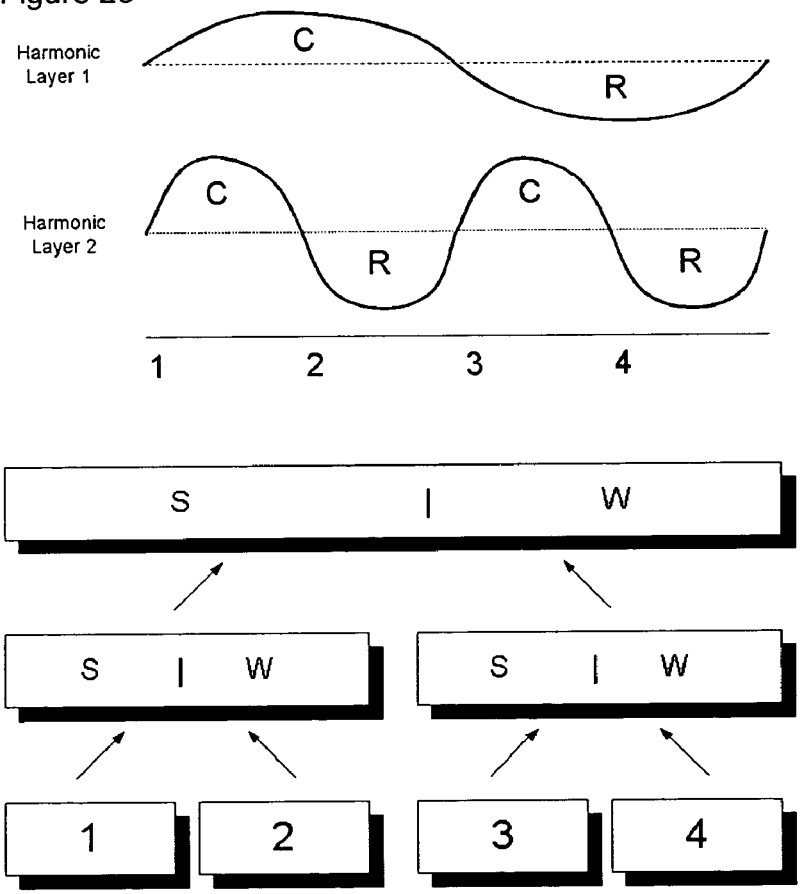
FIG. 28 illustrates a Metric hierarchy to harmonics comparison

Conceptually, the wave states of compression/rarefaction can map to the meter states of strong/weak. FIG. 27 illustrates the comparison. Hierarchal metrical layers can also map conceptually to harmonic layers, as illustrated by FIG. 28.

Figures 29, 30, 31:
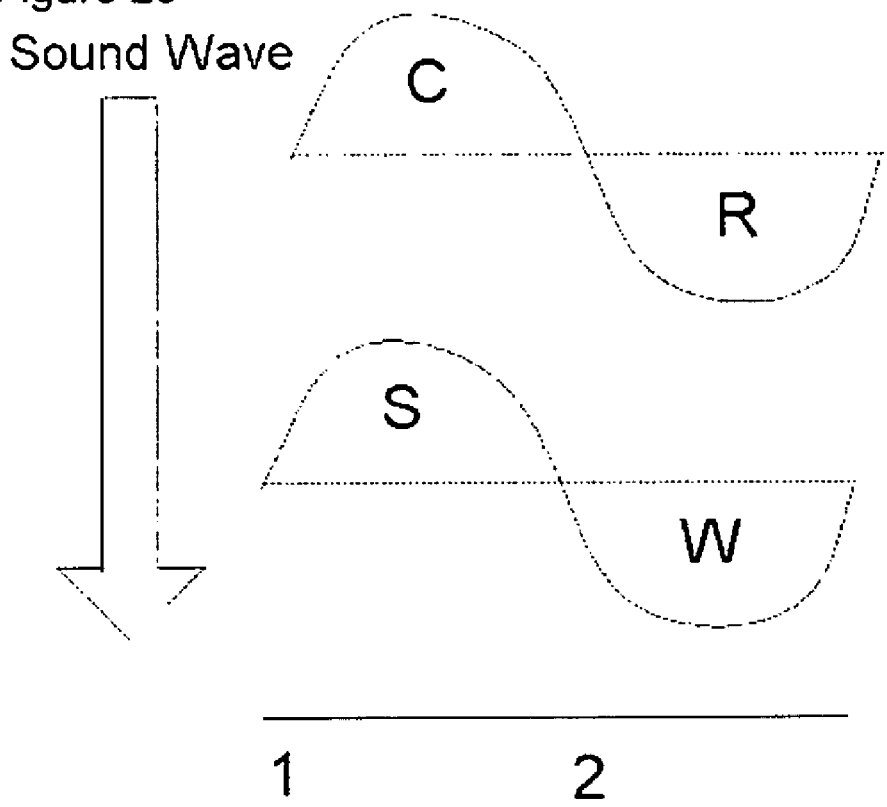
FIG. 29 illustrates compression and rarefaction mapping to binary
FIG. 30 illustrates compression and rarefaction mapping to ternary problem 1.
FIG. 31 illustrates Compression and rarefaction mapping to ternary problem 2

The mapping of compression/rarefaction states to the binary form is self evident, as FIG. 29 indicates.

Figure 32:
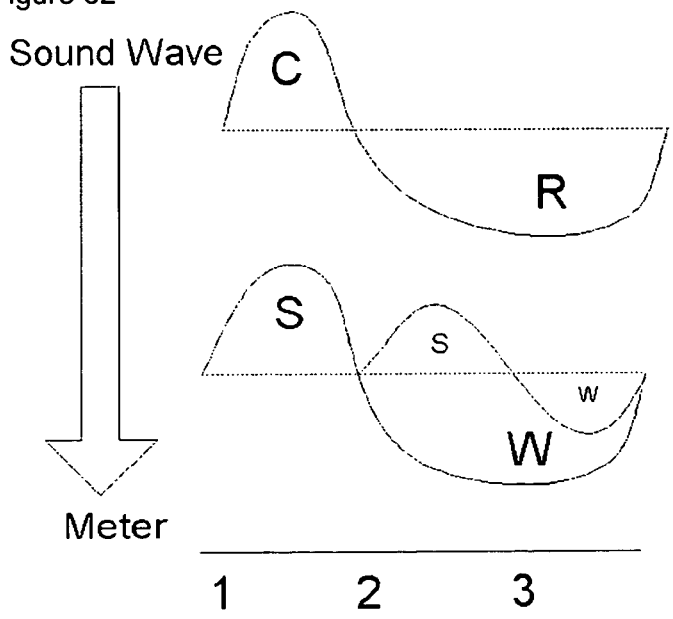
FIG. 32 illustrates the compression and rarefaction mapping to ternary solution.

The mapping of compression/rarefaction states to the ternary form is not as straightforward because of differing number of states. This is illustrated in FIG. 30. The compression state maps to the first form state, and the rarefaction state maps to the last form state. FIG. 31 illustrates that the middle form state is a point of ambiguity. The proposed solution, illustrated by FIG. 32 is to assign compression to the first element only, and make the rarefaction compound, spread over the $2^{nd}$ and $3^{rd}$ elements.

The Carrier theory notation discussion involves harmonic state notation, Carrier Signature formats, and the metric element hierarchy used to construct carrier structures.

A decimal-based notation system is proposed to notate the various states of binary and ternary meter. Specifically:

| | |
|---|---|
| 0 | Compression (common for binary & ternary) |
| 5 | Binary rarefaction |
| 3 | Ternary initial rarefaction |
| 6 | Ternary final rarefaction |

Figure 33:
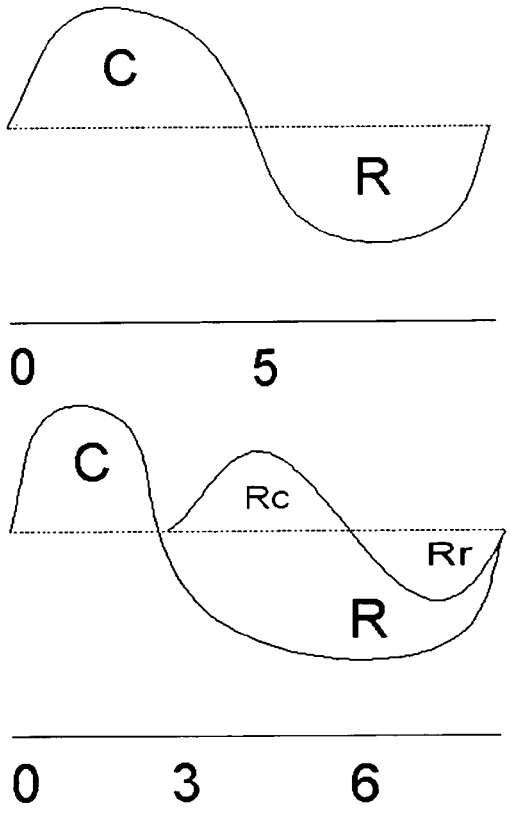
FIG. 33 visualizes harmonic state notation.

FIG. 33 shows the harmonic state allocation for binary and ternary meter.

The harmonic state "vocabulary" therefore as stated above is: 0, 3, 5, and 6.

These harmonic states are also grouped into metric elements.

| | |
|---|---|
| 0 5 | |
| binary metric element | 2 carrier nodes |
| 0 3 6 | |
| ternary metric element | 3 carrier nodes |

The following table illustrates the concept of a Carrier Signature and its component elements:

Carrier Signature elements

| Symbol | Name | Definition | Harmonic state location (big endian) |
|---|---|---|---|
| # | — | total number of nodes in the carrier | |
| b | Binary metric element | a structure consisting of 2 carrier nodes | 0000 |
| t | Ternary metric element | a structure consisting of 3 carrier nodes | |
| B | Binary metric element group | a container consisting of 2 metric elements | 0000 |
| T | Ternary metric element group | a container consisting of 3 metric elements | |
| B+ | Binary metric element supergroup | a container consisting of 2 metric element groups | 0000 |
| T+ | Ternary metric element supergroup | a container consisting of 3 metric element groups | |
| B++ | Binary metric element ultragroup | a container consisting of 2 metric element supergroups | 0000 |

The following table illustrates the hierarchal arrangement of metric elements

Figure 34:
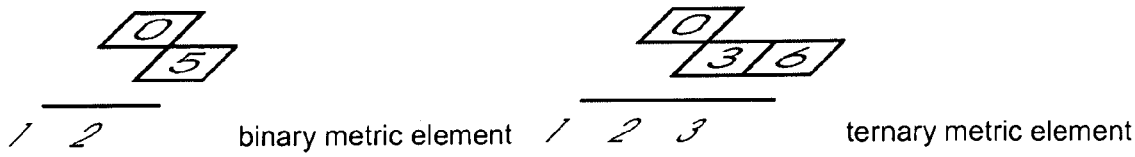
FIG. 34 illustrates the metric element hierarchy at the metric element.
Figure 35:
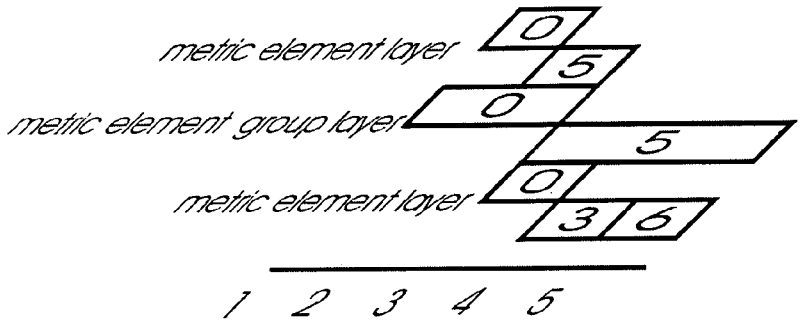
FIG. 35 illustrates the metric element hierarchy at the metric element group.

| | |
|---|---|
| Metric element | metric elements form sequences of metric units. FIG. 34 visualizes binary and ternarymetric elements |
| Metric element group | metric element groups contain metric elements. A metric element group can contain any combination of metric elements. FIG. 35 visualizes a metric element group |
| Metric element supergroup | metric element supergroups contain binary or ternary metric element groups inclusively. FIG. 36 visualizes a metric element supergroup |
| Metric element ultragroup | metric element ultragroups contain metric element supergroups inclusively. FIG. 37 visualizes a metric element ultragroup |

The following table illustrates a metric element group carrier (see FIG. 35 for visualization).

Carrier Signature 5 Bbt

| Metric Element group | Metric Element | meter pos | harmonic state notation |
|---|---|---|---|
| 0 | 0 | 1 | 00 |
| | 5 | 2 | 05 |
| 5 | 0 | 3 | 50 |
| | 3 | 4 | 53 |
| | 6 | 5 | 56 |

The following table illustrates a metric element supergroup carrier (see FIG. 36 for visualization)

Carrier Signature 8 B+BbbBbb

| Metric element supergroup | Metric Element group | Metric Element | meter pos | harmonic state notation |
|---|---|---|---|---|
| 0 | 0 | 0 | 1 | 000 |
| | | 5 | 2 | 005 |
| | 5 | 0 | 3 | 050 |
| | | 5 | 4 | 055 |
| 5 | 0 | 0 | 5 | 500 |
| | | 5 | 6 | 505 |
| | 5 | 0 | 7 | 550 |
| | | 5 | 8 | 555 |

The following table illustrates a metric element ultragroup carrier (see FIG. 37 for visualization).

| Carrier Signature 16 B++B+BbbBbbB+BbbBbb | | | | | |
|---|---|---|---|---|---|
| Metric element ultragroup | metric element supergroup | metric element group | metric element | meter pos | harmonic state notation |
| 0 | 0 | 0 | 0 | 1 | 0000 |
| | | | 5 | 2 | 0005 |
| | | 5 | 0 | 3 | 0050 |
| | | | 5 | 4 | 0055 |
| | 5 | 0 | 0 | 5 | 0500 |
| | | | 5 | 6 | 0505 |
| | | 5 | 0 | 7 | 0550 |
| | | | 5 | 8 | 0555 |
| 5 | 0 | 0 | 0 | 9 | 5000 |
| | | | 5 | 10 | 5005 |
| | | 5 | 0 | 11 | 5050 |
| | | | 5 | 12 | 5055 |
| | 5 | 0 | 0 | 13 | 5500 |
| | | | 5 | 14 | 5505 |
| | | 5 | 0 | 15 | 5550 |
| | | | 5 | 16 | 5555 |

The carrier salience discussion involves introducing the concept of carrier salience, the process to determine the salient ordering of carrier nodes, and the method of weighting the salient order.

The following term is relevant to the carrier salience discussion is defined as follows Salience:

perceptual importance; the probability that an event or pattern will be noticed.

Every carrier position participates in a harmonic state at multiple levels. Since the "cross section" of states is unique for each position, a salient ordering of the positional elements can be determined by comparing these harmonic "cross sections". FIG. 38 shows the multiple harmonic states for the Carrier 7Ttbb.

The process to determine the salient order of carrier nodes is as follows

1) Convert from big endian to little endian representation

| Position | big endian | little endian |
|---|---|---|
| 1 | 00 -> | 00 |
| 2 | 03 -> | 30 |
| 3 | 06 -> | 60 |
| 4 | 30 -> | 03 |
| 5 | 35 -> | 50 |
| 6 | 60 -> | 06 |
| 7 | 65 -> | 56 |

2) Assign a Lexicographic weighting to the harmonic states based on a ternary system

| Harmonic state | ternary weighting | potential energy |
|---|---|---|
| 0 | 2 | V |
| 3 | 1 | |
| 5 | 0 | V |
| 6 | 0 | |
| | | V |
| | | V |
| | | ↓ |

The weighting is based on the potential energy of the harmonic state within a metric element.

The lexicographic weighting is derived from the little endian harmonic states.

| Position | big endian | little endian | lexicographic weighting |
|---|---|---|---|
| 1 | 00 -> | 00 -> | 22 |
| 2 | 03 -> | 30 -> | 12 |
| 3 | 06 -> | 60 -> | 02 |
| 4 | 30 -> | 03 -> | 21 |
| 5 | 35 -> | 53 -> | 01 |
| 6 | 60 -> | 06 -> | 20 |
| 7 | 65 -> | 56 -> | 00 |

3) Perform a descending order lexicographical sort of the ternary values

| Position | big endian | little endian | lexicographic weighting |
|---|---|---|---|
| 1 | 00 -> | 00 -> | 22 |
| 4 | 30 -> | 03 -> | 21 |
| 6 | 60 -> | 06 -> | 20 |
| 2 | 03 -> | 30 -> | 12 |
| 3 | 06 -> | 60 -> | 02 |
| 5 | 35 -> | 53 -> | 01 |
| 7 | 65 -> | 56 -> | 00 |

The salient ordering process yields the following results for this metrical structure.

| Harmonic | position |
|---|---|
| 00 | 1 |
| 30 | 4 |
| 60 | 6 |
| 03 | 2 |
| 06 | 3 |
| 35 | 5 |
| 65 | 7 |

Once a salient ordering for a metric structure is determined, it is possible to provide a weighting from the most to the least salient elements.

Figures 39, 40:
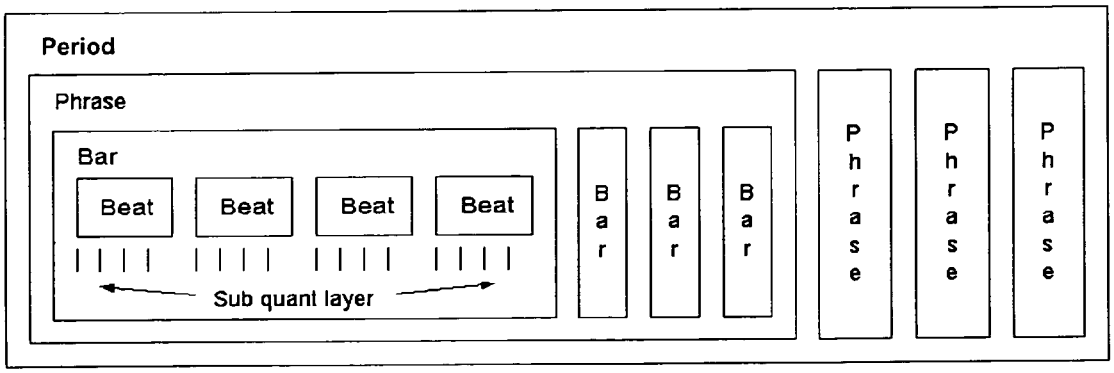
FIG. 39 illustrates the linear and salient ordering of two Carrier Structures.
FIG. 40 illustrates the western meter hierarchy.

Salient weighting is based on a geometric series where:

r=2 n=# metric elements $S_n=r^0+r^1+r^2+r^3+r^4 \ldots r^{n-1}$ salient weight of a metric position $n=r^{n-1}$ total salient weight of a metric structure$=(r^n-r^0)/(r-r^0)$ FIG. 39 shows linear and salient ordering of two carrier forms.

The carrier hierarchy discussion involves the presentation of the existing western meter hierarchy as, the introduction of the metric hierarchy of the musical representation of the current invention, and the combination of the metric levels of the musical representation of the current system.

FIG. 40 shows western meter hierarchy as it exists currently. A Sentence is composed of multiple phrases, phrases are composed of multiple bars, and finally bars are composed of a number of beats The concept of a time signature is relevant to the carrier hierarchy discussion and is defined as follows:

The top number indicates the number of beats in a bar

The bottom number indicates the type of beat

For the example "4/4", there are 4 beats in the bar and the beat is a quarter note.

Therefore the carrier hierarchy of the musical representation methodology of the current invention is illustrated in the following tables:

Macroform Carrier 0000.000.000

| | |
|---|---|
| Scope | approximates the period/phrase level of western meter |
| Structure | Macroform Elements<br>elements are not of uniform size. Actual structure is determined by the Microforms that are mapped to the Macroform node. |

Microform Carrier 0000.000.000

| | |
|---|---|
| Scope | bar level of western meter |
| Structure | Microform Elements<br>elements are of uniform size<br>Microforms have a universal/8. All/4 time signature are restated in/8<br>i.e.) 3/4 -> 6/8, 4/4 -> 8/8 |

Nanoform Carrier 0000.000.000

| | |
|---|---|
| Scope | Contained within beat level of western meter |
| Structure | Nanoform Elements<br>Positional elements can alter in size, but all event combinations must add up to a constant length of a beat<br>Nanoform Layers<br>null<br>No note events<br>0<br>Thru - Note event on Microform node<br>I<br>2-3 Note event positions within beat ($16^{th}/24^{th}$ note equivalent)<br>II<br>4-6 Note event positions within beat ($32^{nd}/48^{th}$ note equivalent)<br>III*<br>8 divisions of a beat ($64^{th}$ note equivalent)<br>*not used for analysis application |

It is important to understand that the combinations of these carrier waves define an "address" for every possible point in musical time. The Macroform is extended by the Microform, and the Nanoform extends the Microform. Every point in time can be measured in power/potential against any other point in time. The following examples illustrate the harmonic state notation of the carrier hierarchy of the musical representation of the current invention.

Macroform.Microform.Nanoform 0000.000.000

| | |
|---|---|
| Carrier Signatures | [8 B+BbbBbb].[7/8 Tbbt].[2 b] |
| Harmonic state Notation | 000.05.5 |

$1^{st}$ of 8 element Macroform
$2^{nd}$ of 7 element Microform
$2^{nd}$ of 2 element Nanoform

| | |
|---|---|
| Carrier Signatures | [7 Ttbb].[6/8 Btt].[3 t] |
| Harmonic state Notation | 0-550.35.3 |

Figure 41:
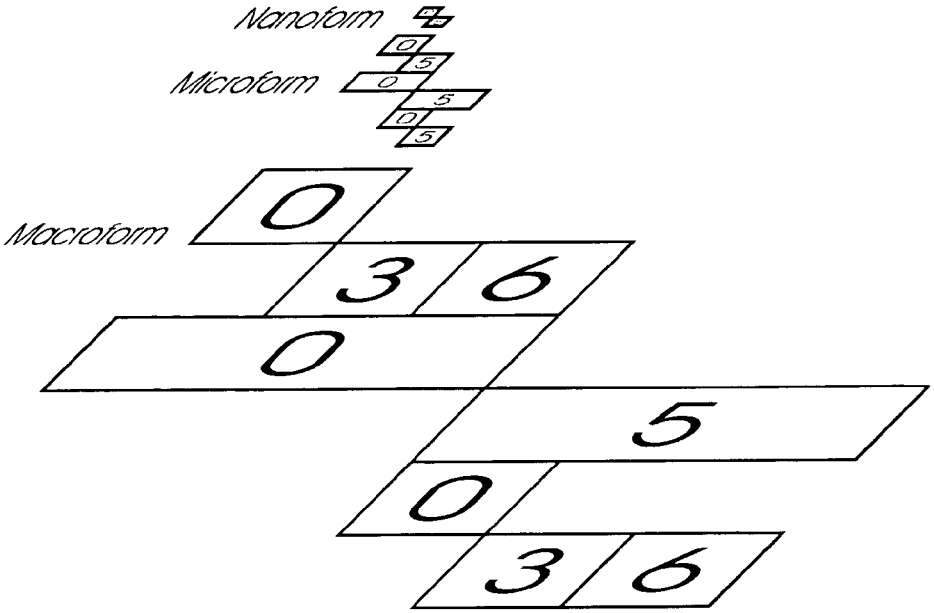
FIG. 41 illustrates the Carrier hierarchy.

$7^{th}$ of 8 element Macroform
$4^{th}$ of 6 element Microform
$2^{nd}$ of 3 element Nanoform FIG. 41 visualizes the carrier hierarchy for the musical representation of the current invention.

Modulator Theory

Figure 42:
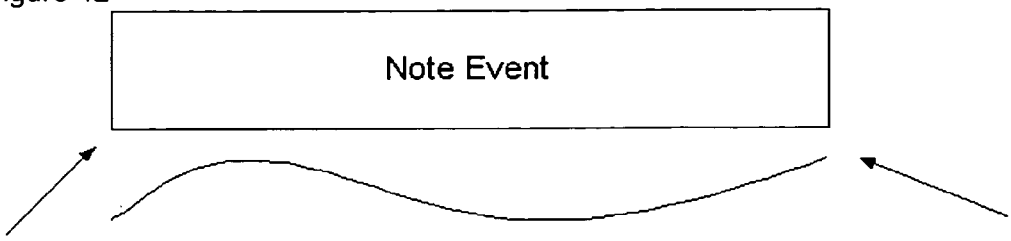
FIG. 42 illustrates the Note Event concept.

Within a single note event there are multiple parameters that can be modulated at the start or over the duration of the note event to produce a musical effect. FIG. 42 illustrates this concept.

The following performance metadata parameters must be defined for a note to sound: pitch, duration, volume, position, and instrument specific data.

Figure 43:
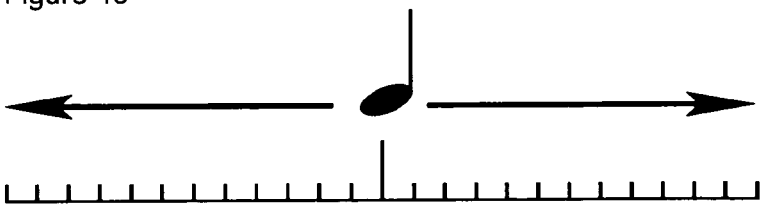
FIG. 43 illustrates the tick offset of a "coarse" position.

| | |
|---|---|
| Pitch | what is the coarse "pitch" of a note (what note was played)?<br>what is the fine "pitch" or tuning of a note?<br>does that tuning change over the duration of the note? |
| Duration | what is the coarse duration of a note?<br>(quarter note, eighth note, etc . . . )<br>what is the "fine" duration offset of a note? |
| Volume | what is the initial volume of the note?<br>does the volume change over the duration of the note? |
| Position | a note is considered to occur at a specific position if it falls within a tick offset range of the coarse position<br>what is the fine position of the note? see FIG. 43 |
| Instrument specific | instrument specific parameters can also be modulated over the duration of a note event to produce a musical effect.<br>i.e.) stereo panning, effect level, etc. |

The following terms are relevant to the Modulator Theory disclosure:

Modulator a device that can be used to modulate a wave

Vector a one dimensional array

The term "vector" is used to describe performance metadata parameters because they are of a finite range, and most of them are ordered.

Figure 44:
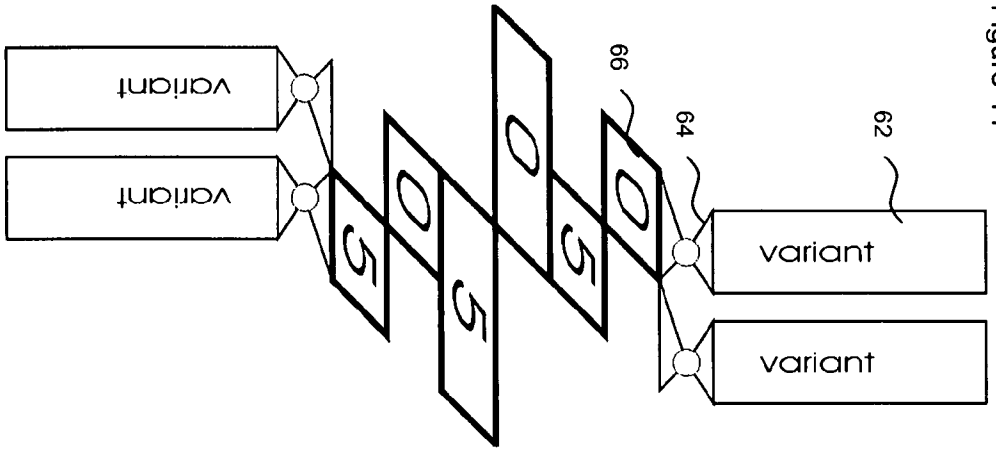
FIG. 44 is a diagram of modulators on carrier nodes.

The musical representation methodology of the current invention aggregates the multiple vectors that affect a note event into a note variant. FIG. 44 illustrates Note Variants (62) that participate in a Note Event (64) "transaction" that modulates the metric position or carrier node (66) that they are attached to.

A feature of the modulator theory is that it addresses the concept of compositional and mechanical "layers" in music—the two aspects of music that are protected under copyright law.

Figure 45:
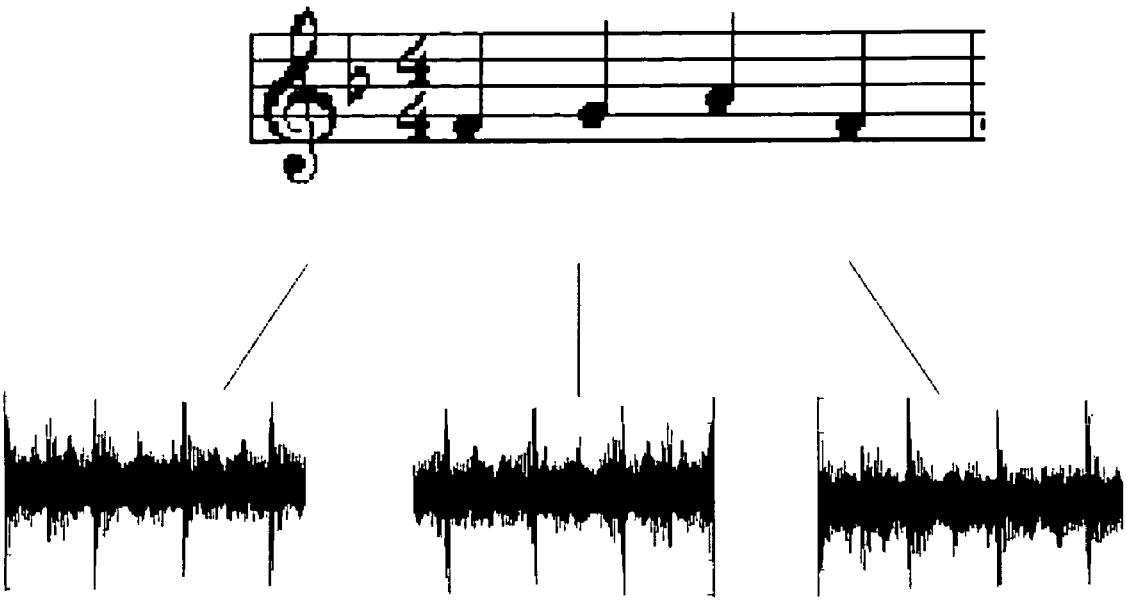
FIG. 45 illustrates the compositional and Mechanical Layers in Music.

The compositional layer represents a sequence of musical events and accompanying lyrics, which can be communicated by a musical score. An example of the compositional layer would be a musical score of the Beatles song "Yesterday". The second layer in music is the mechanical layer. The mechanical layer represents a concrete performance of a composition. An example of the mechanical layer would be a specific performance of the "Yesterday" score. FIG. 45 illustrates that a piece of music can be rendered in various performances that are compositionally equivalent but mechanically unique.

The compositional layer in the musical representation of the current system defines general parameters that can be communicated through multiple performance instances. The mechanical layer in the musical representation of the current system defines parameters that are localized to a specific performance of a score. Parameter definitions at the "mechanical" layer differentiate one performance from another.

Figure 46:
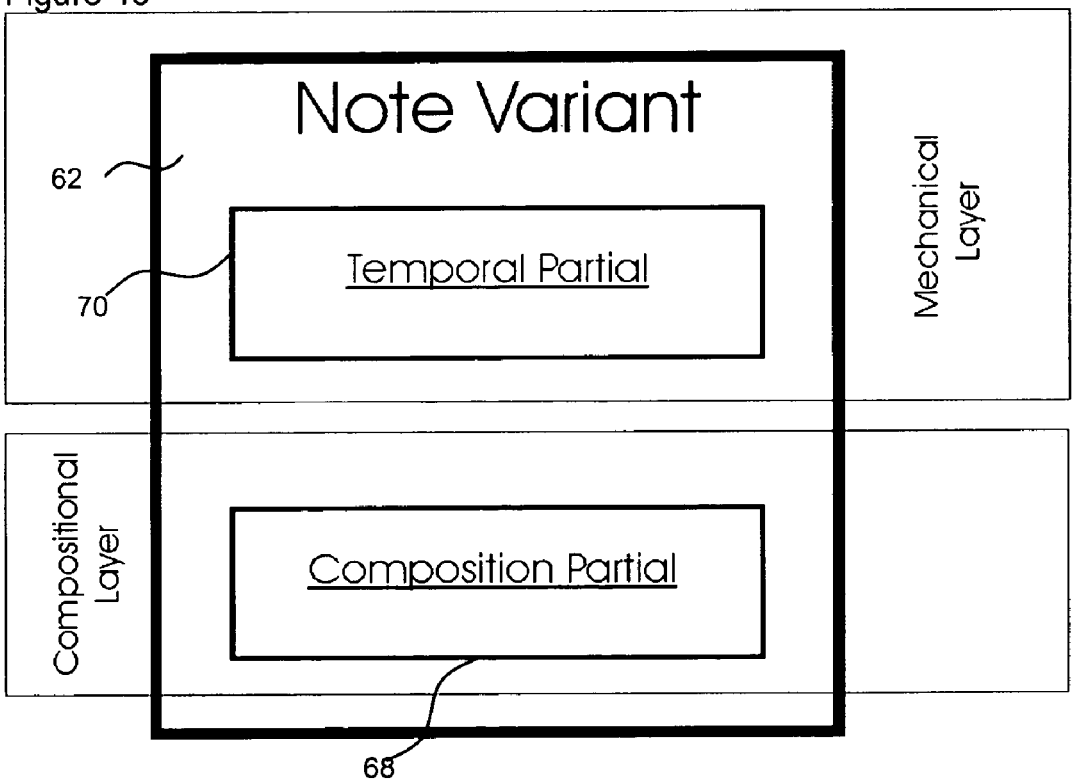
FIG. 46 is a diagram of a compositional and mechanical Note Variant.

The following modulator concepts illustrate various implementations of compositional and mechanical layers in the musical representation of the current invention:

The Note Variant contains a compositional and mechanical layer. FIG. 46 illustrates the compositional and mechanical layers of a Note Variant (62). The vectors in the compositional partial (68) (pitch, coarse duration, lyrics) do not change across multiple performances of the note variant. The Vectors in the temporal partial (70) (fine position offset, fine duration offset) are localized to a particular Note Variant (62).

Figure 47:
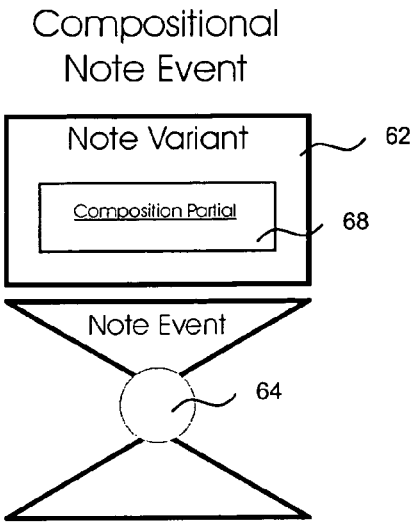
FIG. 47 is a diagram of a compositional note event.
Figure 48:
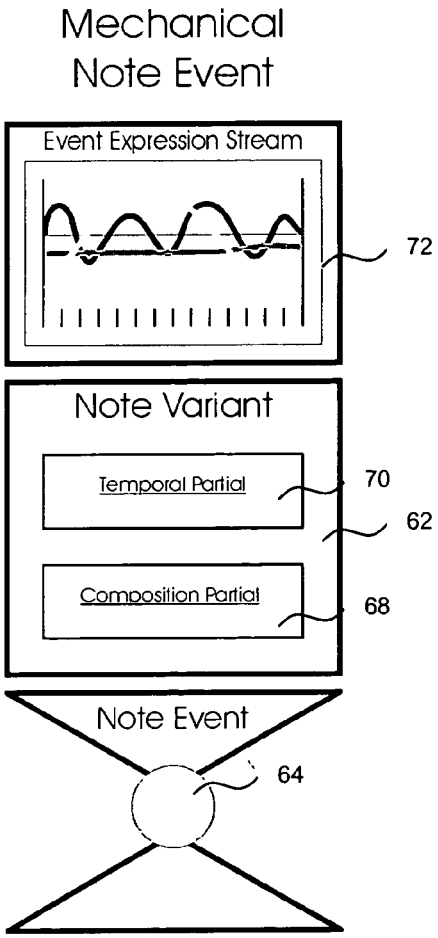
FIG. 48 is a diagram of a mechanical note event.

The Note Event connects carrier nodes to Note Variants. Multiple Note Variants can map to a single Note Event (this creates polyphony). FIG. 47 illustrates a compositional Note Event (64). Compositional Note Events (64) can contain multiple Note Variants (62) that have a compositional partial (68) only. FIG. 48 illustrates a Mechanical Note Event (64). Mechanical Note Events (64) can contain multiple Note Variants (62) that have both compositional (68) and temporal partials (70). Mechanical Note Events (64) also have an associated event expression stream (72). The event expression stream (72) contains all of the vectors (volume, brightness, and fine-tuning) whose values can vary over the duration of the Note Event (64). The event expression stream (72) is shared by all of the Note Variants (62) that participate the Note Event (64).

Figure 49:
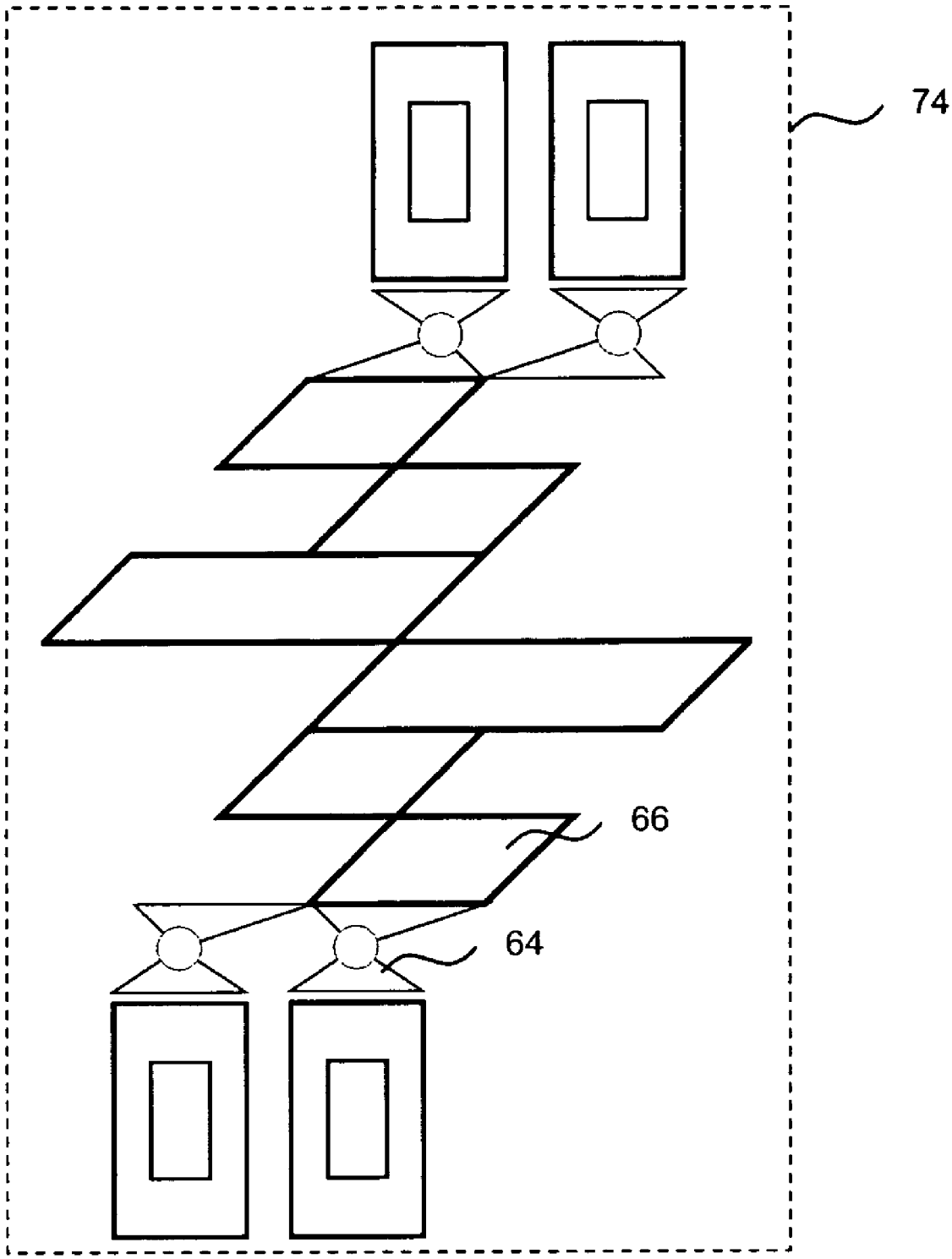
FIG. 49 is a diagram of a compositional Performance Element.
Figure 50:
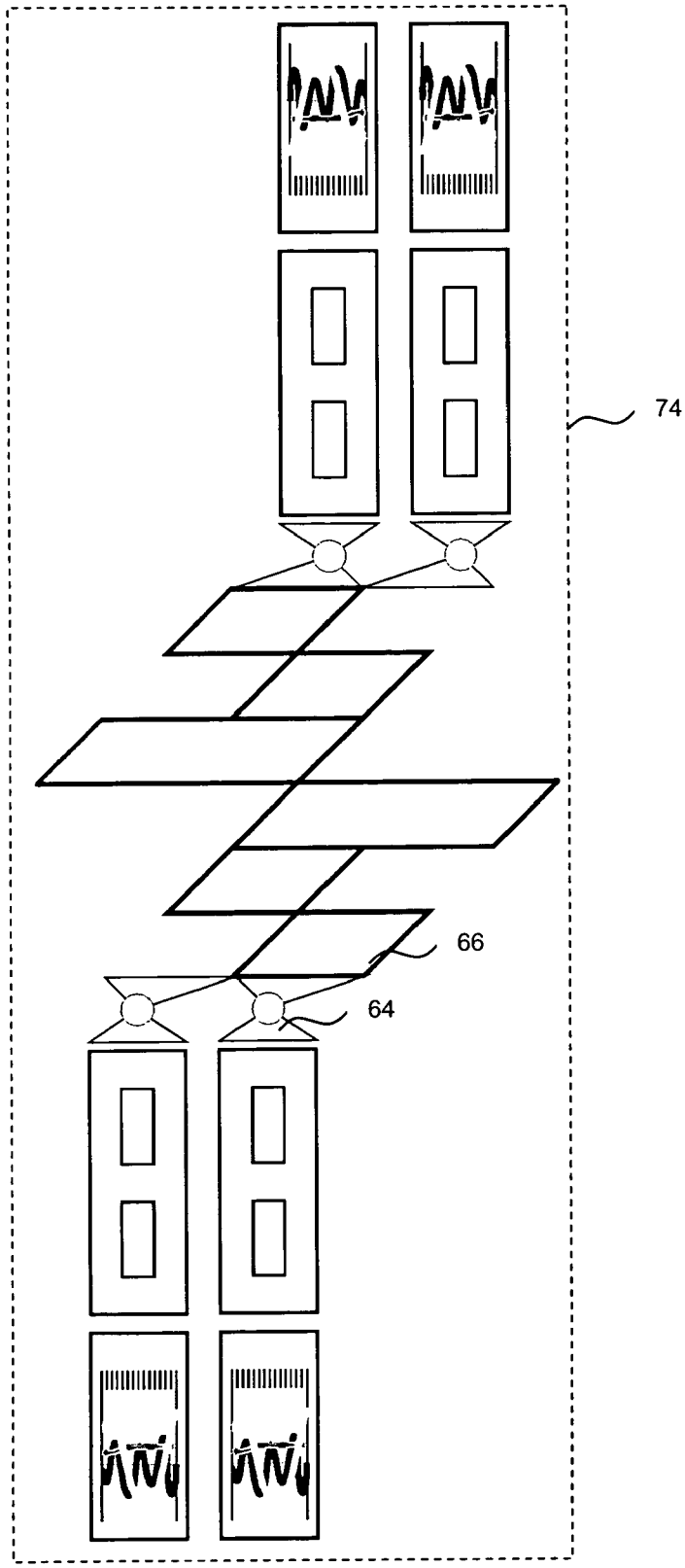
FIG. 50 is a diagram of a mechanical Performance Element.

The Performance Element is a sequence of note events that is mapped to a Microform Carrier. It equates to single bar of music in Standard Notation. The Performance Element can be compositional or mechanical. FIG. 49 illustrates a Compositional Performance Element (74). The Compositional Performance Element (74) maps compositional Note Events (64) to carrier nodes (66). It is also used for abstract grouping purposes. The Compositional Performance Element (74) is similar to the "class" concept in "Object Oriented Programming". FIG. 50 illustrates a Mechanical Performance Element (74). The Mechanical Performance Element (74) maps mechanical Note Events (64) to carrier nodes (66). The Mechanical Performance Element (74) is similar to the "object instance" concept in Object Oriented Programming, in that an object is an individual realization of a class.

Theoretical Implementation

Figure 51:
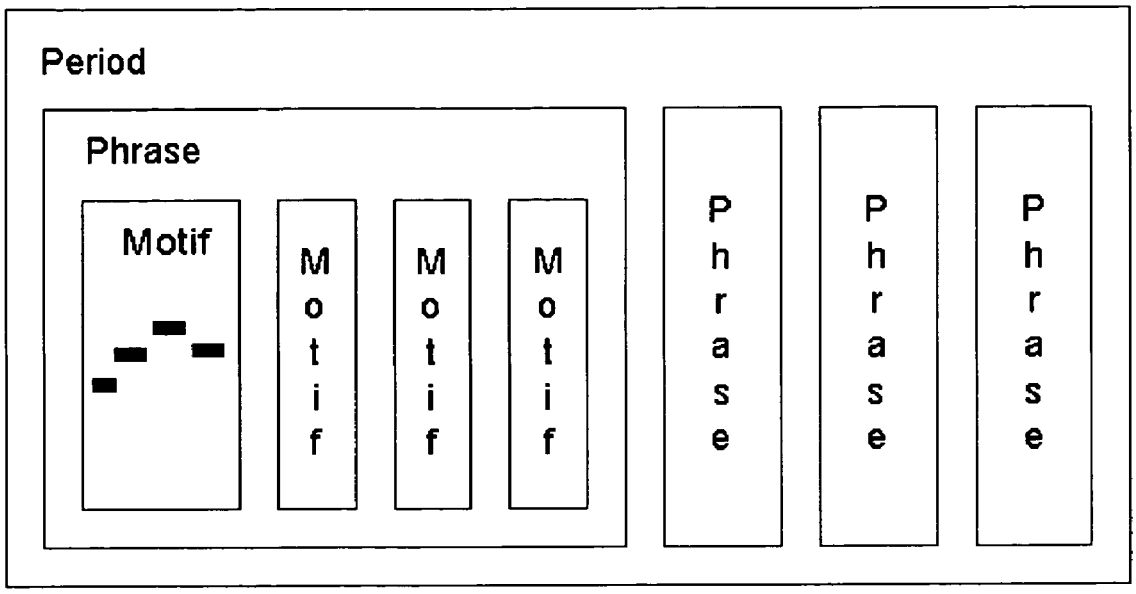
FIG. 51 illustrates the western music hierarchy.

The hierarchy of western music is composed of motives, phrases, and periods. A motif is a short melodic (rhythmic) fragment used as a constructional element. The motif can be as short as two notes, and it is rarely longer than six or seven notes. A phrase is a grouping of motives into a complete musical thought. The phrase is the shortest passage of music which having reached a point of relative repose, has expressed a more or less complete musical thought. There is no infallible guide by which every phrase can be recognized with certainty. A period is a grouping structure consisting of phrases. The period is a musical statement, made up of two or more phrases, and a cadence. FIG. 51 illustrates the western music hierarchy.

Figure 52:
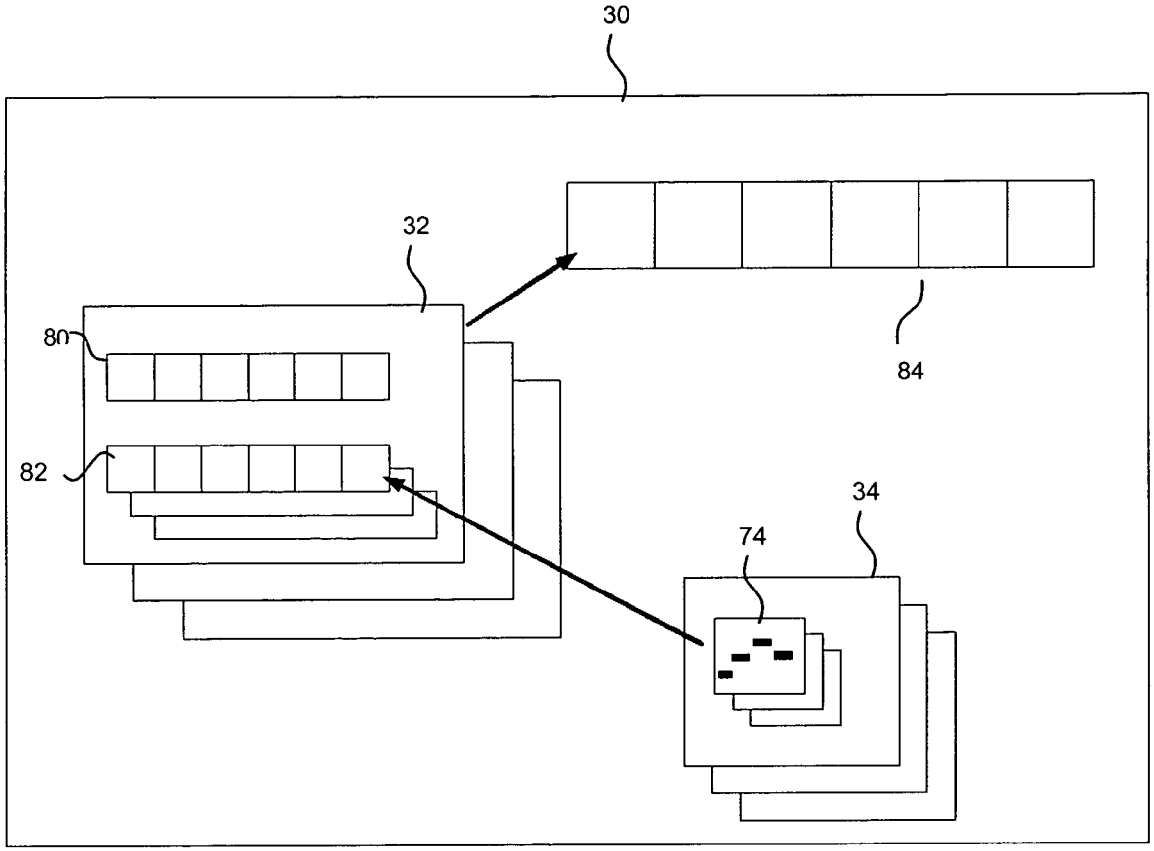
FIG. 52 illustrates the musical hierarchy of the music representation of the current system.

FIG. 52 illustrates the hierarchy of the musical representation of the current system. The Performance Element (74) is an intersection of Carrier and Modulator data required to represent a bar of music. The Performance Element Collective (34) is a container of Performance Elements (74) that are autilized within the Song Framework Output. How the Performance Element Collective (34) is derived is explained further below.

The Framework Element (32) defines the metric and tonal context for a musical section within a song. The Framework Element is composed of a Macroform Carrier structure together with Environment Track (80) and Instrument Performance Tracks (82).

The Environment Track (80) is a Master "Track" that supplies tempo and tonality information for all of the Macroform Nodes. Every Performance Element (74) that is mapped to a Macroform Node "inherits" the tempo and tonality properties defined for that Macroform Node. All Macroforms in the Framework Element (32) will generally have a complete Environment Track (80) before Instrument Performance tracks (82) can be defined. The Instrument Performance Track (82) is an "interface track" that connects Performance Elements (74) from a single Performance Element Collective (34) to the Framework Element (32).

Continuing up the hierarchy, the Framework Sequence (84) is a user defined, abstract, top level form to outline the basic song structure. An example Framework Sequence would be:

Intro|Verse 1|Chorus 1|Verse 2|Bridge|Chorus 3|Chorus 4

Each Framework Sequence node is placeholder for a full Framework Element (32). The Framework Elements (32) are sequenced end to end to form the entire linear structure for a song. Finally, the Song Framework Output (30) is the top-level container in the hierarchy of the musical representation of the current system.

Performance Element

The first structure to be discussed in this "Theory Implementation" section is the "Performance Element". The Performance Element has Carrier implementation and Modulator implementation.

Figure 53:
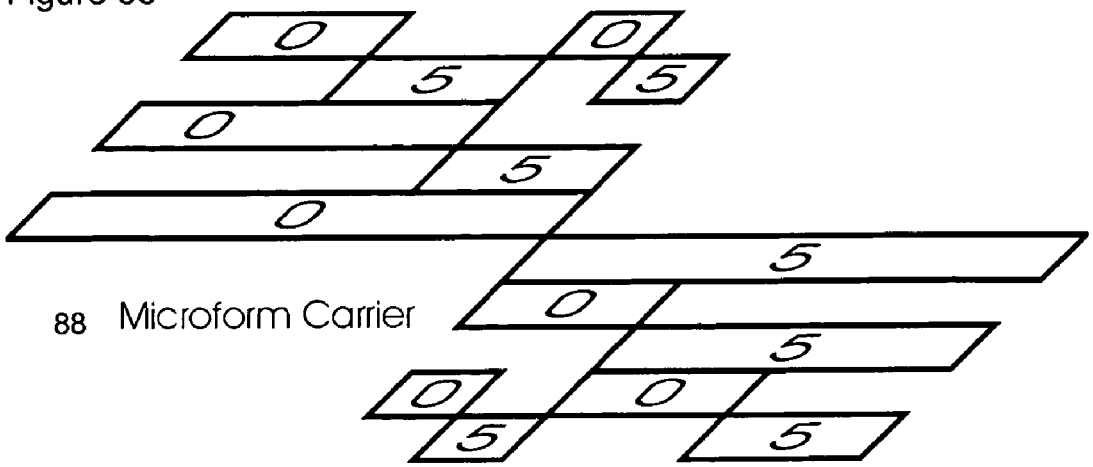
FIG. 53 is a diagram of a Microform Carrier.
Figure 54:
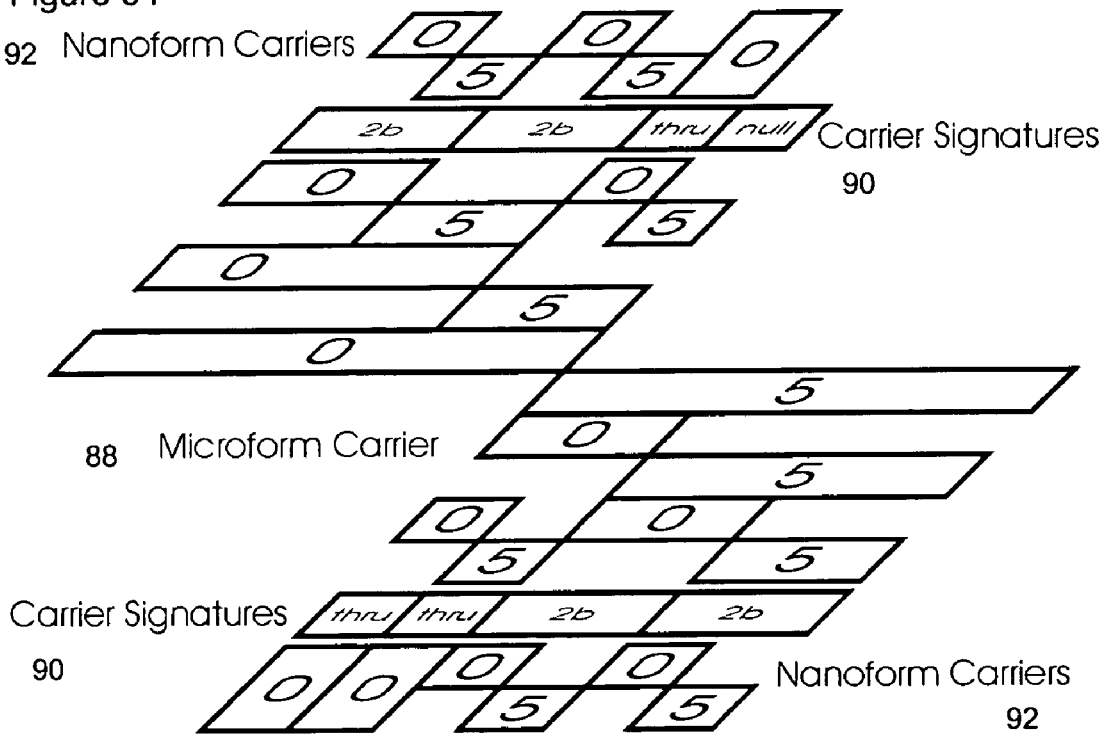
FIG. 54 is a diagram of a Microform Carrier, Nanoform Carrier Signatures with Nanoform Carriers.
Figure 55:
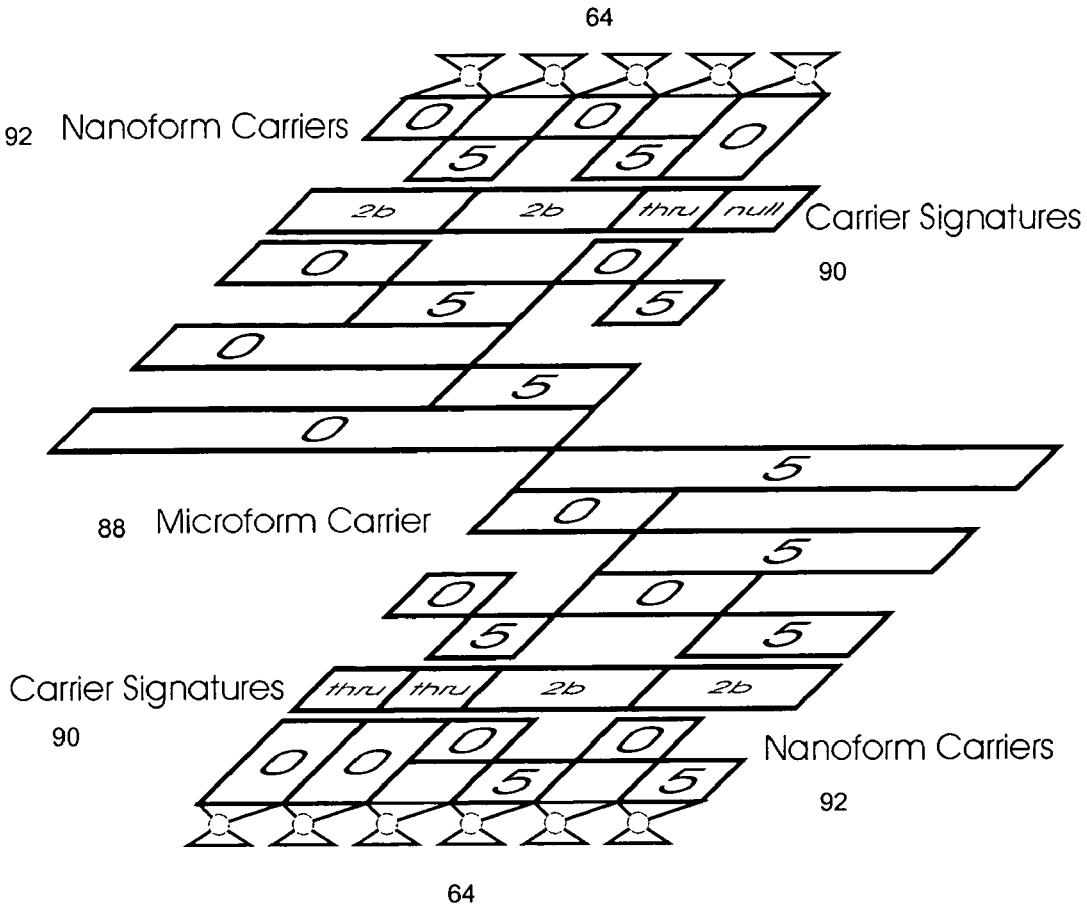
FIG. 55 is a diagram of a Note Events bound to Nanoform nodes.

The Performance Element Carrier is composed of a Microform, Nanoform Carrier Signatures, and Nanoforms. Microform nodes do not participate directly with note events, rather a Nanoform Carrier Signature is selected, and Note Events are mapped to the Nanoform nodes. FIG. 53 illustrates a Microform Carrier; FIG. 54 illustrates Microform Carrier (88) with Nanoform Carrier Signatures (90) and Nanoform Carrier nodes (92), and FIG. 55 shows Note Events (64) bound to Nanoform Carrier nodes (92).

The following is an ordered index of Microform Carrier structures that can be used in Performance Element construction:

8 B+BbbBbb
12 B+BttBtt
4 Bbb
6 Btt
6 Tbbb
12 B+TbbbTbbb
9 Tttt
12 T+BbbBbbBbb
12 B+BttTbbb
12 B+TbbbBtt
10 B+BbbTbbb
10 B+TbbbBbb
9 B+BbbBbt
9 B+BbbBtb
9 B+BbtBbb
9 B+BtbBbb
11 B+BttBtb
11 B+BttBbt
11 B+TbbbBbt
11 B+TbbbBtb
11 B+BbtBtt
11 B+BtbBtt
11 B+BbtTbbb
11 B+BtbTbbb
10 B+BbbBtt
10 B+BttBbb
10 B+BbtBbt
10 B+BtbBtb
10 B+BbtBtb
10 B+BtbBbt
5 Bbt
5 Btb
7 Tbbt
7 Tbtb
7 Ttbb
8 Tttb
8 Ttbt
8 Tbti The following is an Index of Nanoform Carrier structures at various quantize levels that are used in Performance Element construction:

| | |
|---|---|
| Null | — |
| $N^0$ $8^{th}$ note equivalent | (Microform node thru) |
| $N^{-1}$ $16^{th}/24^{th}$ note equivalent | 2 b |
| | 3 t |
| $N^{-2}$ $32^{nd}/48^{th}$ note equivalent | 4 Bbb |
| | 6 Btt |
| | 5 Bbt |
| | 5 Btb |
| $N^{-3}64^{th}$ note equivalent | 8 B+BbbBbb |

Figure 56:
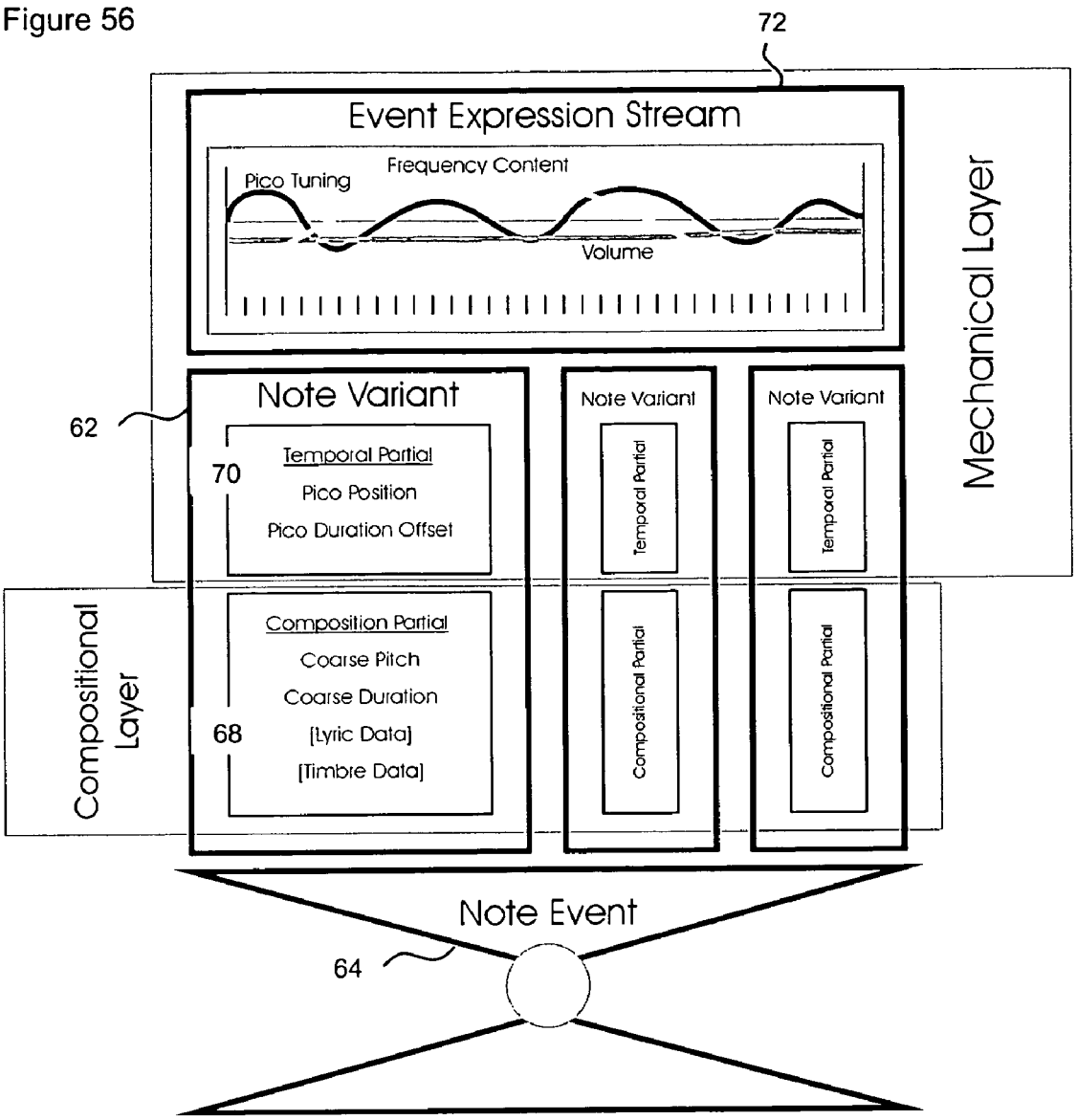
FIG. 56 is a diagram of a Performance Element Modulator.

FIG. 56 illustrates a complete Performance Element Modulator. The Performance Element Modulator is composed of compositional partials (68) and temporal partials (70) grouped into Note Variants (62) and an event expression stream (72). Multiple Note Variants attached to a single Note Event denotes polyphony.

The compositional partial contains coarse pitch and coarse duration vectors, along with optional lyric, timbre, and sample ID data. The temporal partial contains pico position offset, and pico duration offset vectors. The event expression stream is shared across all Note Variants that participate in a Note Event. The event expression stream contains volume, pico tuning, and brightness vectors.

The following are the ranges of the Modulator vectors that can be used in a Performance Element construction:

Coarse Pitch

| TNC | P5 | +3 | -7 | +7 | X4 | -2 | -3 | +2 | -6 | +6 | +4 |
|---|---|---|---|---|---|---|---|---|---|---|---|

Reinforces Key ← Neutral → Pulls away from Key

| Coarse Duration Denominations | | |
|---|---|---|
| $8^{th}$ | $16^{th}$ | $32^{nd}$ |

| Pico Duration Offset |
|---|
| −60 ticks <-> +60 ticks |

| Pico Position offset |
|---|
| −40 ticks <-> +40 ticks |

Expression Controllers (Volume, Pico Tuning, Brightness)

All Controller Vectors have a range of 0-127 with an optional extra precision controller.

Figure 57:
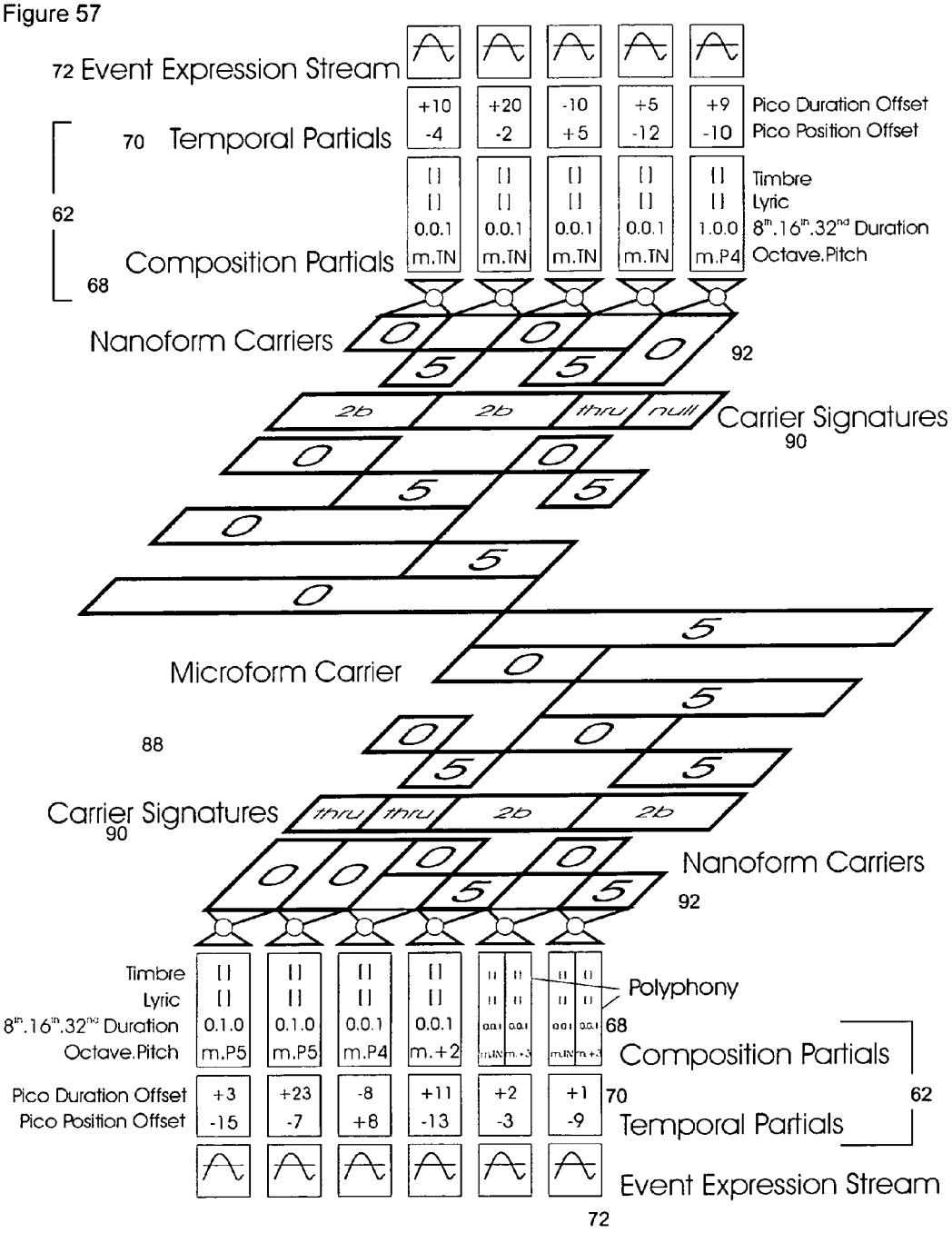
FIG. 57 is a diagram of a Performance Element from a Carrier focus.
Figure 58:
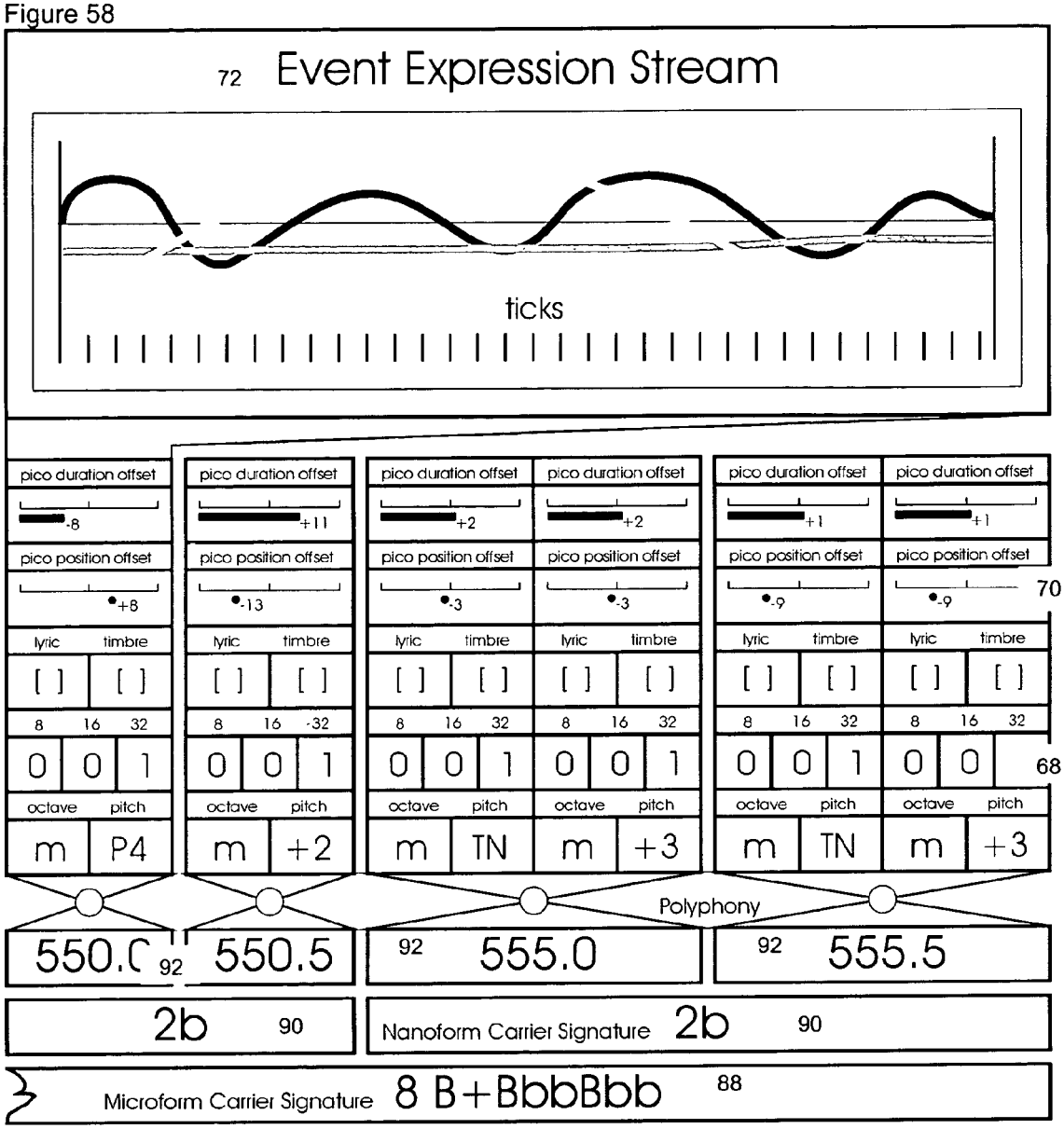
FIG. 58 is a diagram of a Performance Element from Modulator focus.

FIG. 57 visualizes a complete Performance Element from a Carrier Focus. FIG. 58 partially visualizes a Performance Element from a Modulator Focus.

For both FIG. 57 and FIG. 58, the Carrier consists of a Microform (88), Nanoform Carrier Signatures (90), and Nanoform carrier nodes (92). Note events connect the carrier and modulator components of the Performance Element. The Modulator consists of an event expression stream (72) and Note Variants, (62) that containing compositional partials (68) and mechanical partials (70).

The Carrier focus view of the Performance Element highlights the Carrier Portion of the Performance Element, and reduces the event expression stream to a symbolic representation. The Modulator focus highlights the full details of the event expression stream, while reducing the Carrier component down to harmonic state notation.

Figure 59:
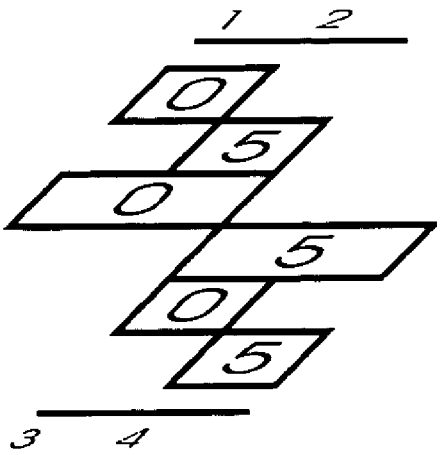
FIG. 59 illustrates the 4 Bbb Carrier with linear, salient and metric element views.

FIGS. 59-106 illustrates the carrier structure, linear order and salient ordering corresponding to the various Carrier Structures. More particularly:

FIG. 59 shows the Visualization, Linear Ordering, and Salient Ordering of Carrier Structure 4 Bbb.

Figure 60:
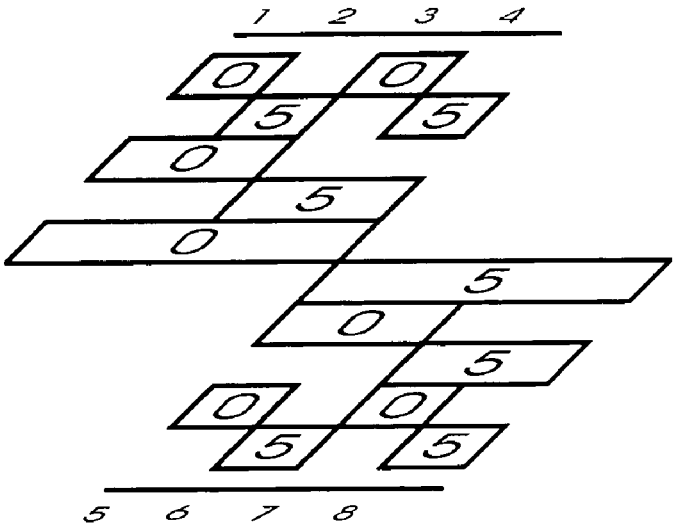
FIG. 60 illustrates the 8 B+BbbBbb Carrier with linear, salient and metric element views.

FIG. 60 shows the Visualization, Linear Ordering, and Salient Ordering of Carrier Structure 8 B+BbbBbb.

Figure 61:
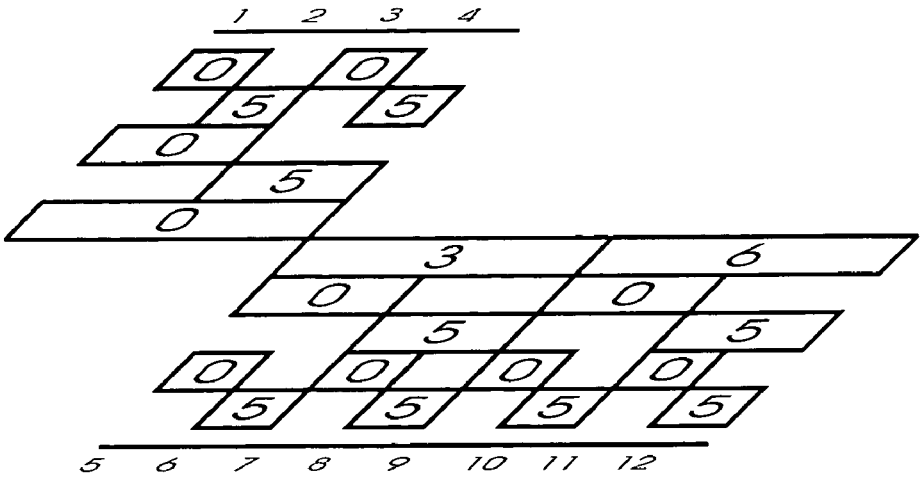
FIG. 61 illustrates the 12 T+BbbBbbBbb Carrier with linear, salient and metric element views.

FIG. 61 shows the Visualization, Linear Ordering, and Salient Ordering of Carrier Structure 12 T+BbbBbbBbb.

Figure 62:
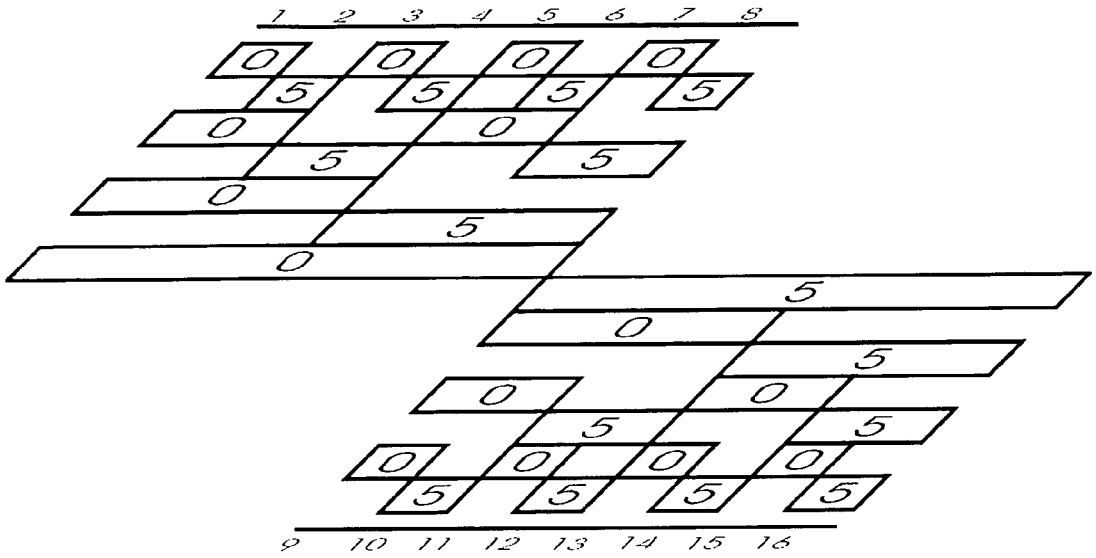
FIG. 62 illustrates the 16 B++B+BbbBbbB+BbbBbb Carrier with linear, salient and metric element views.

FIG. 62 shows the Visualization, Linear Ordering, and Salient Ordering of Carrier Structure 16 B++B+BbbBbbB+BbbBbb.

Figure 63:
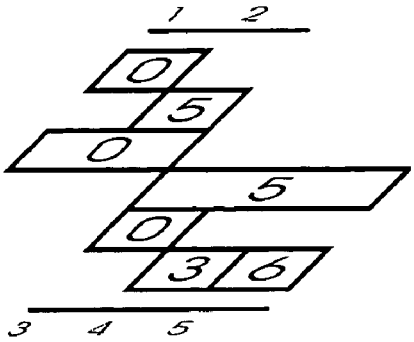
FIG. 63 illustrates the 5 Bbt Carrier with linear, salient and metric element views.

FIG. 63 shows the Visualization, Linear Ordering, and Salient Ordering of Carrier Structure 5 Bbt.

Figure 64:
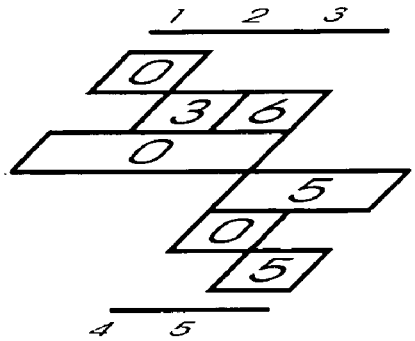
FIG. 64 illustrates the 5 Btb Carrier with linear, salient and metric element views.

FIG. 64 shows the Visualization, Linear Ordering, and Salient Ordering of Carrier Structure 5 Btb.

Figure 65:
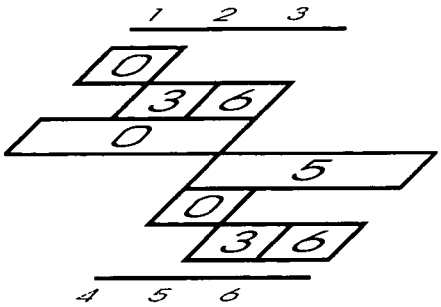
FIG. 65 illustrates the 6 Btt Carrier with linear, salient and metric element views.

FIG. 65 shows the Visualization, Linear Ordering, and Salient Ordering of Carrier Structure 6 Btt.

Figure 66:
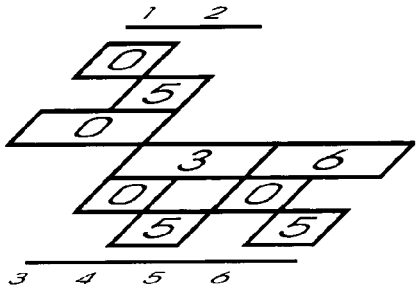
FIG. 66 illustrates the 6 Tbbb Carrier with linear, salient and metric element views.

FIG. 66 shows the Visualization, Linear Ordering, and Salient Ordering of Carrier Structure 6 Tbbb.

Figure 67:
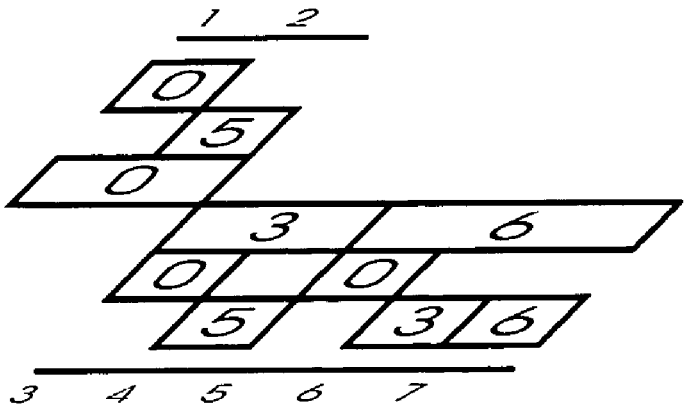
FIG. 67 illustrates the 7 Tbbt Carrier with linear, salient and metric element views.

FIG. 67 shows the Visualization, Linear Ordering, and Salient Ordering of Carrier Structure 7 Tbbt.

Figure 68:
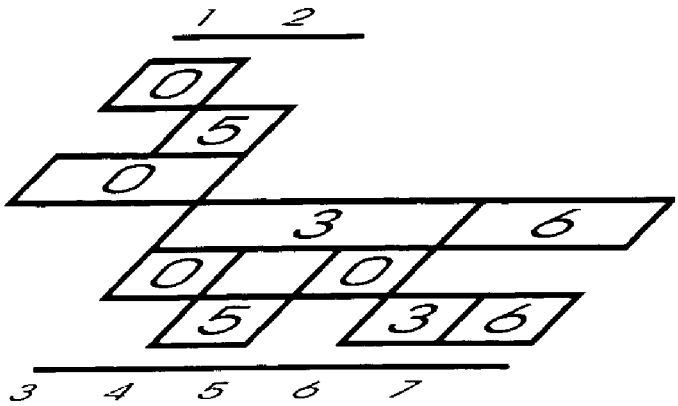
FIG. 68 illustrates the 7 Tbtb Carrier with linear, salient and metric element views.

FIG. 68 shows the Visualization, Linear Ordering, and Salient Ordering of Carrier Structure 7 Tbtb.

Figure 69:
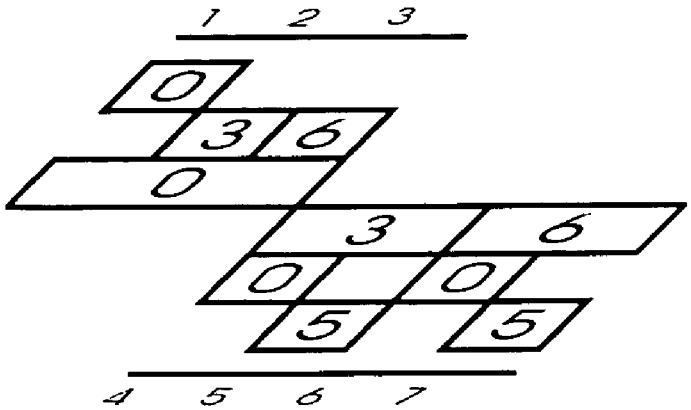
FIG. 69 illustrates the 7 Ttbb Carrier with linear, salient and metric element views.

FIG. 69 shows the Visualization, Linear Ordering, and Salient Ordering of Carrier Structure 7 Ttbb.

Figure 70:
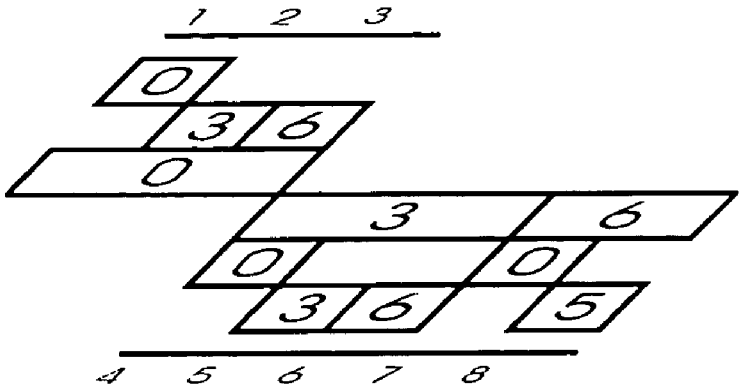
FIG. 70 illustrates the 8 Tttb Carrier with linear, salient and metric element views.

FIG. 70 shows the Visualization, Linear Ordering, and Salient Ordering of Carrier Structure 8 Tttb.

Figure 71:
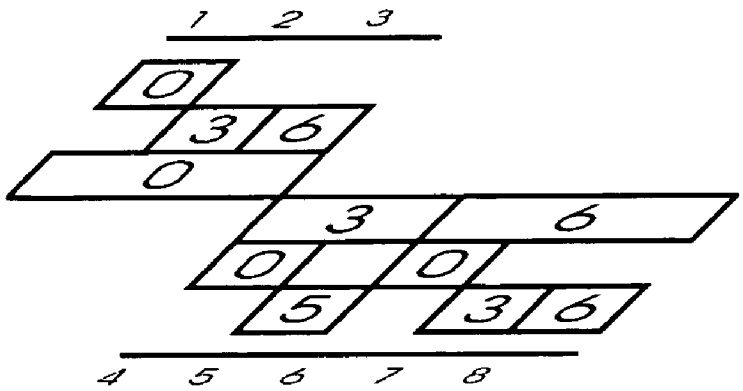
FIG. 71 illustrates the 8 Ttbt Carrier with linear, salient and metric element views.

FIG. 71 shows the Visualization, Linear Ordering, and Salient Ordering of Carrier Structure 8 Ttbt.

Figure 72:
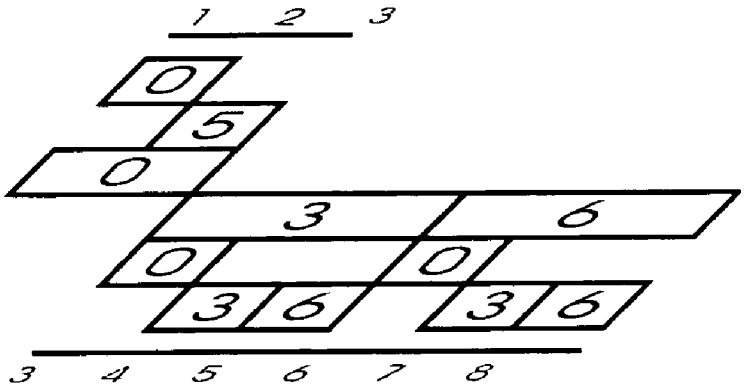
FIG. 72 illustrates the 8 Tbtt Carrier with linear, salient and metric element views.

FIG. 72 shows the Visualization, Linear Ordering, and Salient Ordering of Carrier Structure 8 Tbtt.

Figure 73:
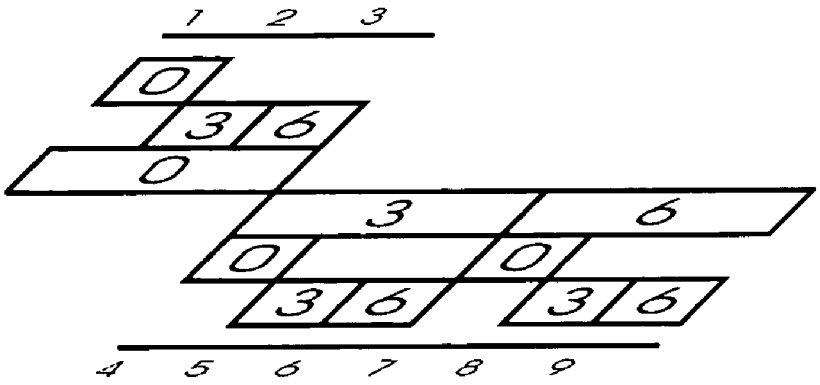
FIG. 73 illustrates the 9 Tttt Carrier with linear, salient and metric element views.

FIG. 73 shows the Visualization, Linear Ordering, and Salient Ordering of Carrier Structure 9 Tttt.

Figure 74:
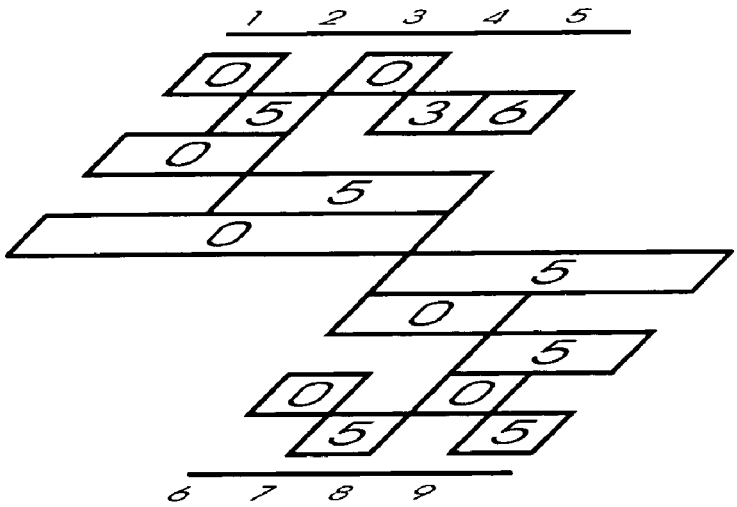
FIG. 74 illustrates the 9 B+BbtBbb Carrier with linear, salient and metric element views.

FIG. 74 shows the Visualization, Linear Ordering, and Salient Ordering of Carrier Structure 9 B+BbtBbb.

Figure 75:
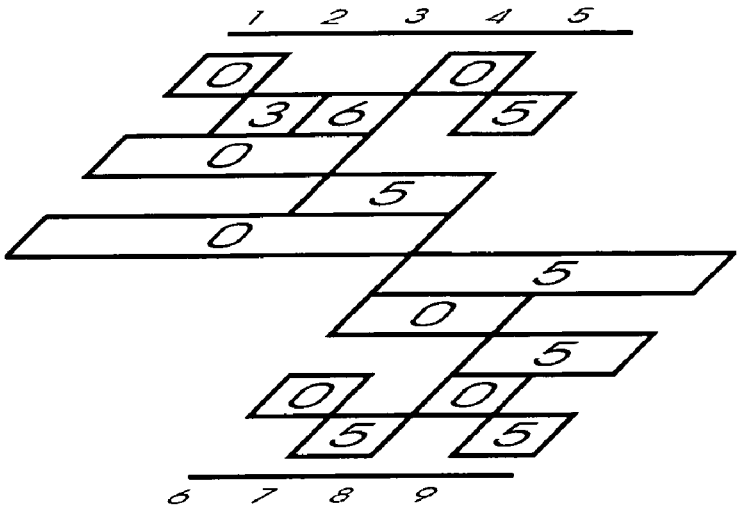
FIG. 75 illustrates the 9 B+BtbBbb Carrier with linear, salient and metric element views.

FIG. 75 shows the Visualization, Linear Ordering, and Salient Ordering of Carrier Structure 9 B+BtbBbb.

Figure 76:
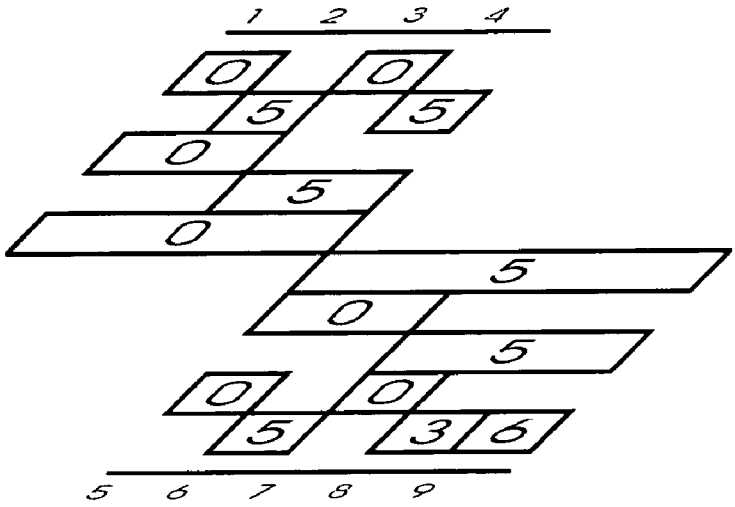
FIG. 76 illustrates the 9 B+BbbBbt Carrier with linear, salient and metric element views.

FIG. 76 shows the Visualization, Linear Ordering, and Salient Ordering of Carrier Structure 9 B+BbbBbt.

Figure 77:
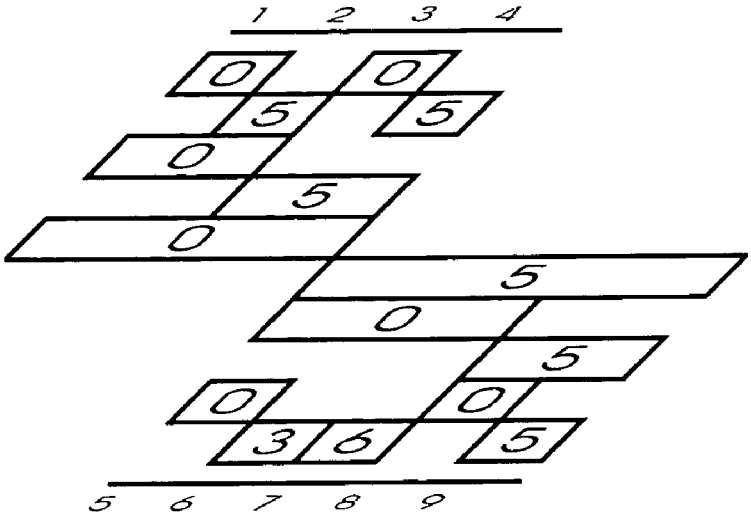
FIG. 77 illustrates the 9 B+BbbBtb Carrier with linear, salient and metric element views.

FIG. 77 shows the Visualization, Linear Ordering, and Salient Ordering of Carrier Structure 9 B+BbbBtb.

Figure 78:
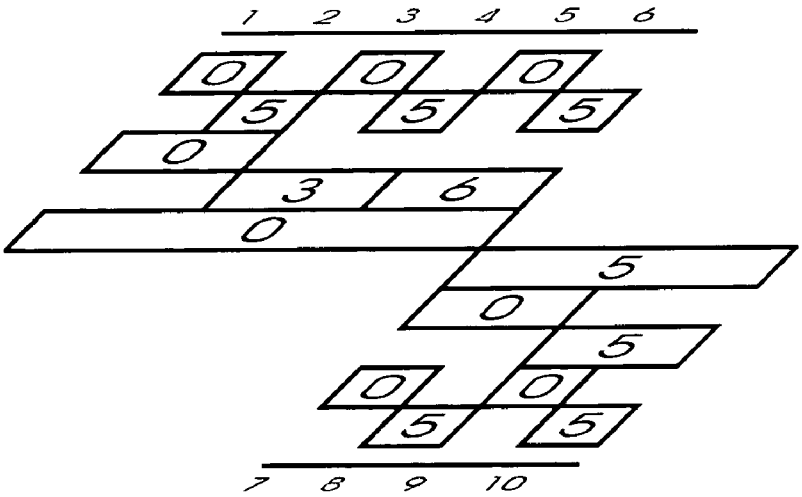
FIG. 78 illustrates the 10 B+TbbbBbb Carrier with linear, salient and metric element views.

FIG. 78 shows the Visualization, Linear Ordering, and Salient Ordering of Carrier Structure 10 B+TbbbBbb.

Figure 79:
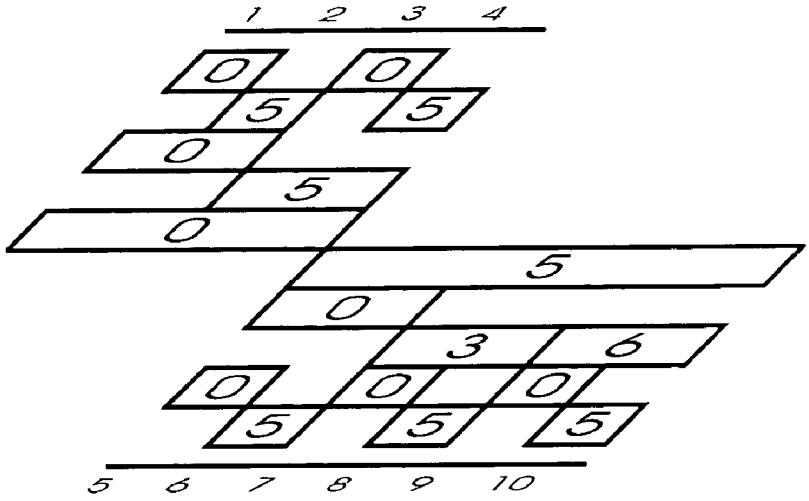
FIG. 79 illustrates the 10 B+BbbTbbb Carrier with linear, salient and metric element views.

FIG. 79 shows the Visualization, Linear Ordering, and Salient Ordering of Carrier Structure 10 B+BbbTbbb.

Figure 80:
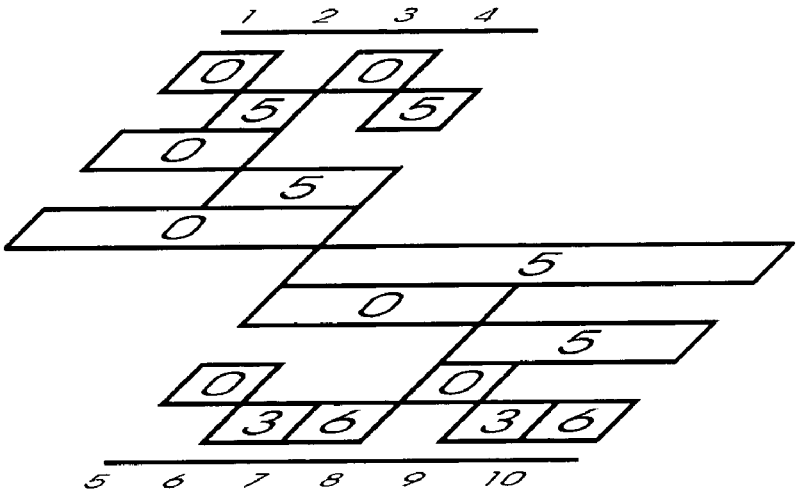
FIG. 80 illustrates the 10 B+BbbBtt Carrier with linear, salient and metric element views.

FIG. 80 shows the Visualization, Linear Ordering, and Salient Ordering of Carrier Structure 10 B+BbbBtt.

Figure 81:
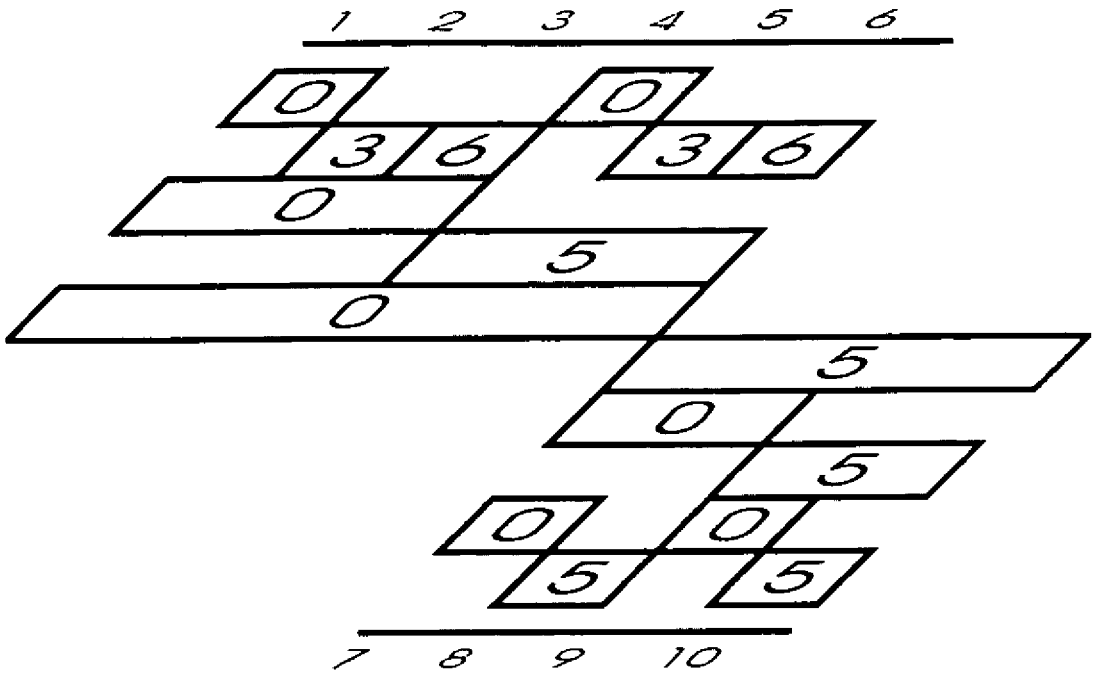
FIG. 81 illustrates the 10 B+BttBbb Carrier with linear, salient and metric element views.

FIG. 81 shows the Visualization, Linear Ordering, and Salient Ordering of Carrier Structure 10 B+BttBbb.

Figure 82:
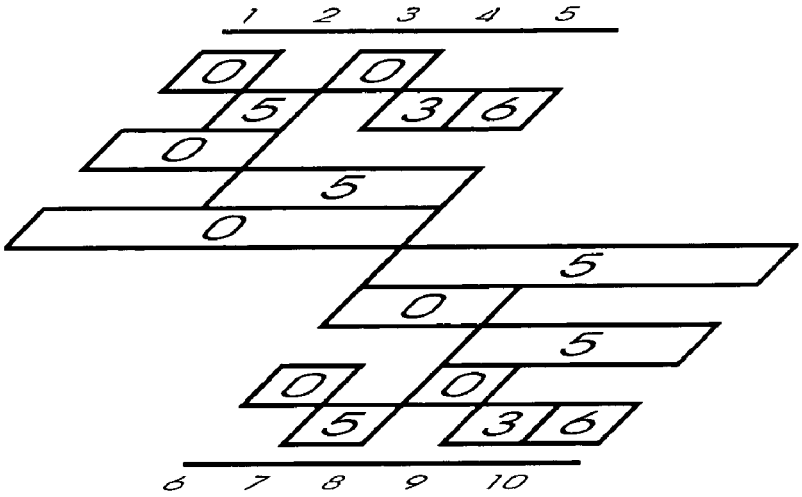
FIG. 82 illustrates the 10 B+BbtBbt Carrier with linear, salient and metric element views.

FIG. 82 shows the Visualization, Linear Ordering, and Salient Ordering of Carrier Structure 10 B+BbtBbt.

Figure 83:
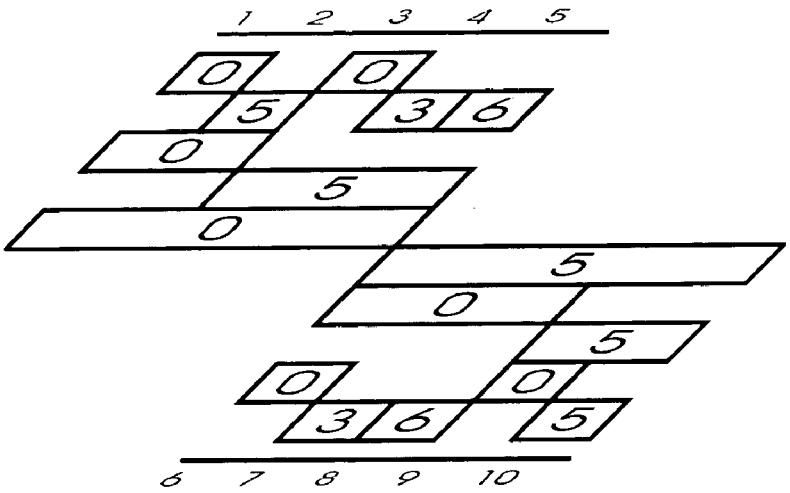
FIG. 83 illustrates the 10 B+BbtBtb Carrier with linear, salient and metric element views.

FIG. 83 shows the Visualization, Linear Ordering, and Salient Ordering of Carrier Structure 10 B+BbtBtb.

Figure 84:
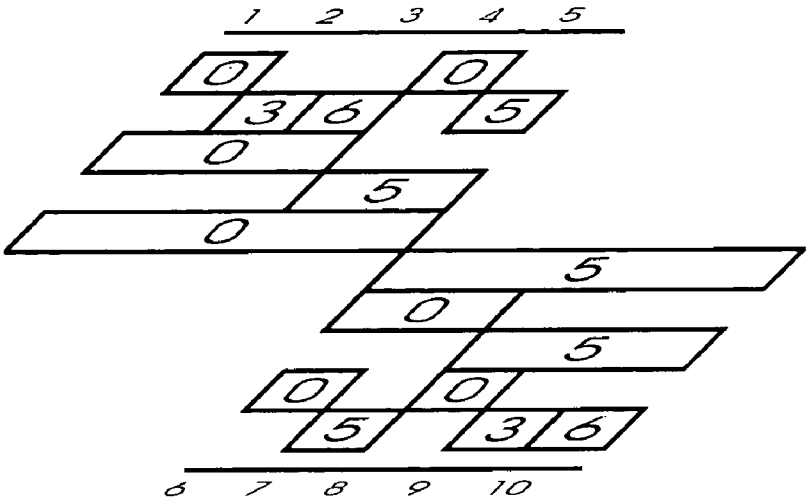
FIG. 84 illustrates the 10 B+BtbBbt Carrier with linear, salient and metric element views.

FIG. 84 shows the Visualization, Linear Ordering, and Salient Ordering of Carrier Structure 10 B+BtbBbt.

Figure 85:
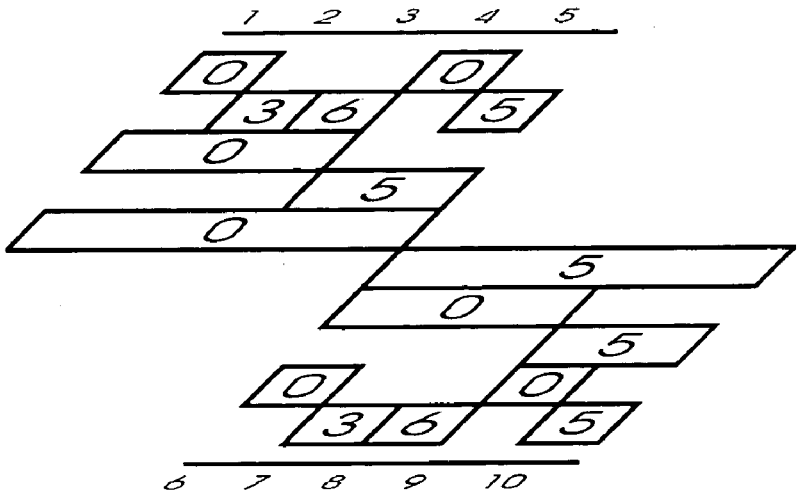
FIG. 85 illustrates the 10 B+BtbBtb Carrier with linear, salient and metric element views.

FIG. 85 shows the Visualization, Linear Ordering, and Salient Ordering of Carrier Structure 10 B+BtbBtb.

Figure 86:
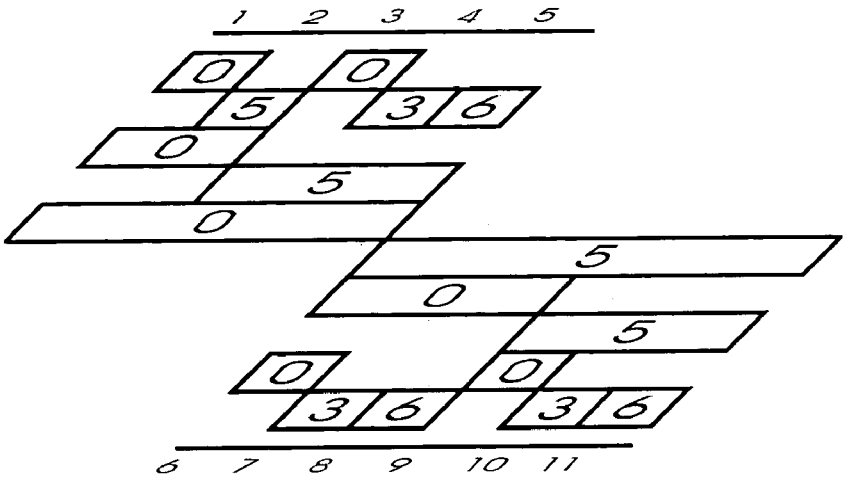
FIG. 86 illustrates the 11 B+BbtBtt Carrier with linear, salient and metric element views.

FIG. 86 shows the Visualization, Linear Ordering, and Salient Ordering of Carrier Structure 11 B+BbtBtt.

Figure 87:
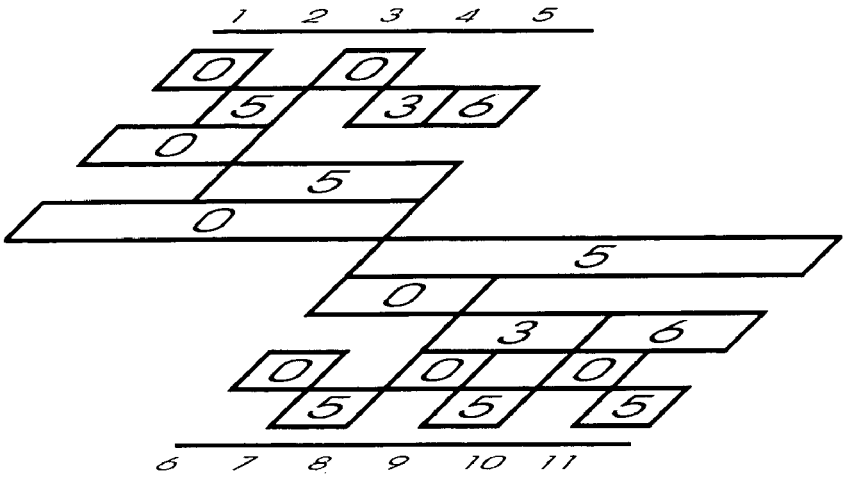
FIG. 87 illustrates the 11 B+BbtTbbb Carrier with linear, salient and metric element views.

FIG. 87 shows the Visualization, Linear Ordering, and Salient Ordering of Carrier Structure 11 B+BbtTbbb.

Figure 88:
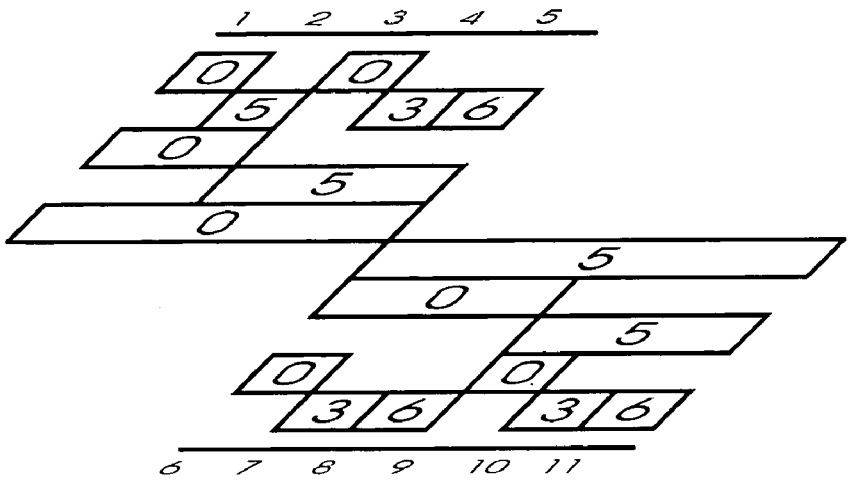
FIG. 88 illustrates the 11 B+BbtBtt Carrier with linear, salient and metric element views.

FIG. 88 shows the Visualization, Linear Ordering, and Salient Ordering of Carrier Structure 11 B+BbtBtt.

Figure 89:
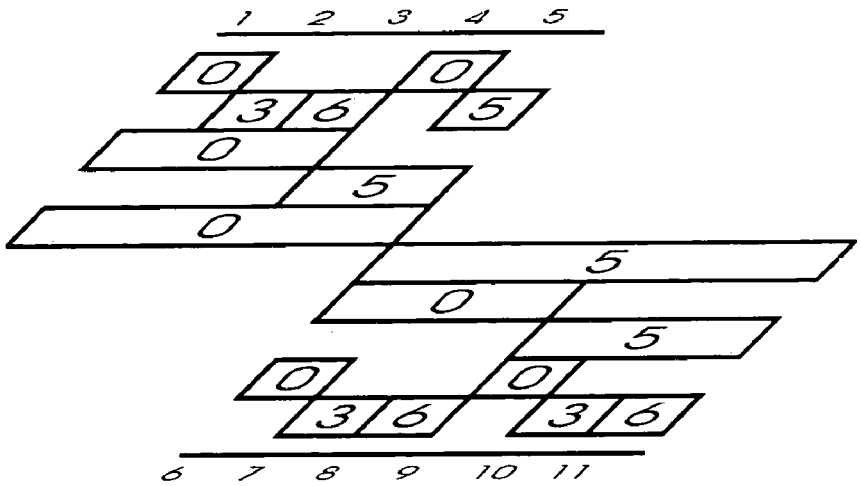
FIG. 89 illustrates the 11 B+BtbBtt Carrier with linear, salient and metric element views.

FIG. 89 shows the Visualization, Linear Ordering, and Salient Ordering of Carrier Structure 11 B+BtbBtt.

Figure 90:
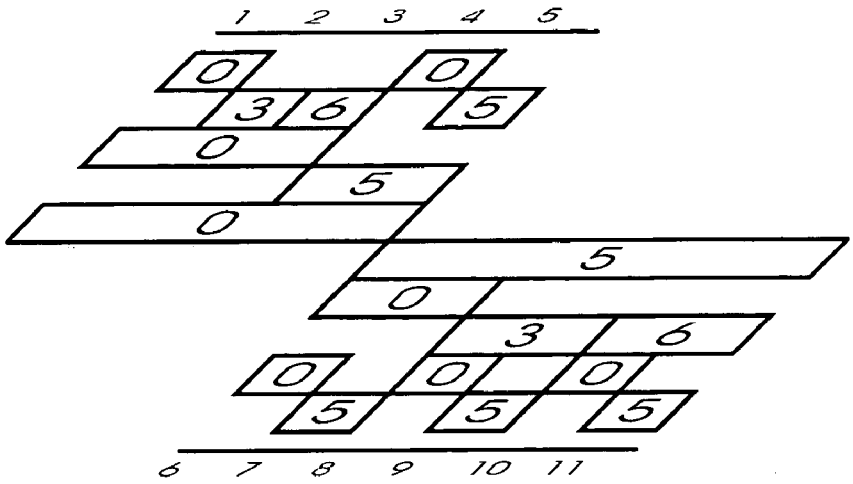
FIG. 90 illustrates the 11 B+BtbTbbb Carrier with linear, salient and metric element views.

FIG. 90 shows the Visualization, Linear Ordering, and Salient Ordering of Carrier Structure 11 B+BtbTbbb.

Figure 91:
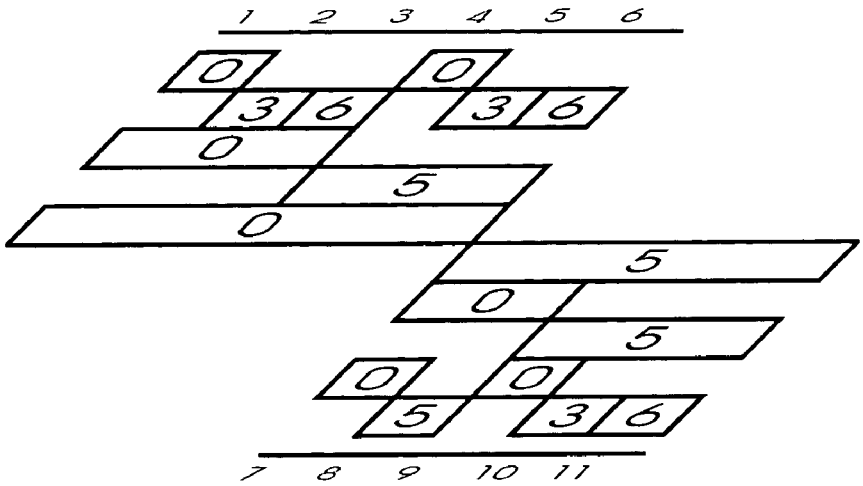
FIG. 91 illustrates the 11 B+BttBbt Carrier with linear, salient and metric element views.

FIG. 91 shows the Visualization, Linear Ordering, and Salient Ordering of Carrier Structure 11 B+BttBbt.

Figure 92:
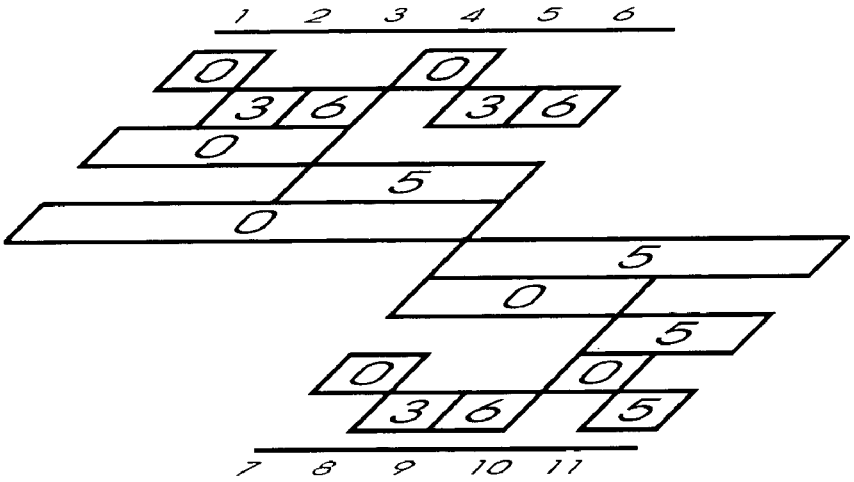
FIG. 92 illustrates the 11 B+BttBtb Carrier with linear, salient and metric element views.

FIG. 92 shows the Visualization, Linear Ordering, and Salient Ordering of Carrier Structure 11 B+BttBtb.

Figure 93:
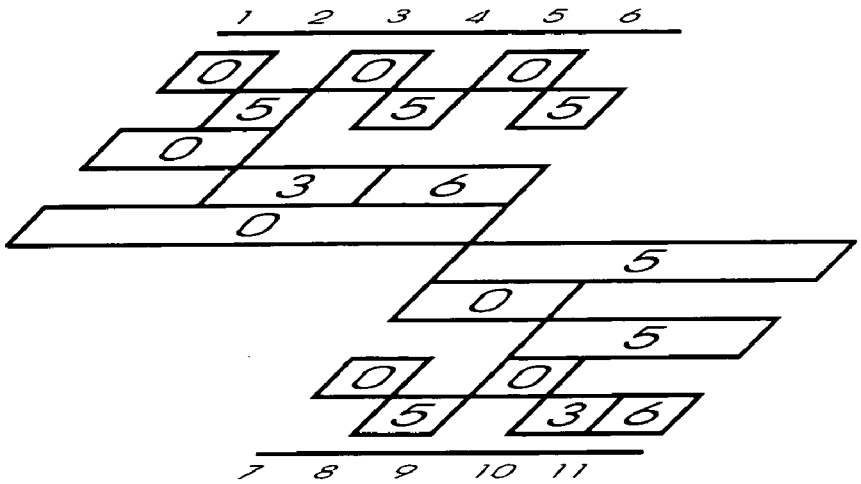
FIG. 93 illustrates the 11 B+TbbbBbt Carrier with linear, salient and metric element views.

FIG. 93 shows the Visualization, Linear Ordering, and Salient Ordering of Carrier Structure 11 B+TbbbBbt.

Figure 94:
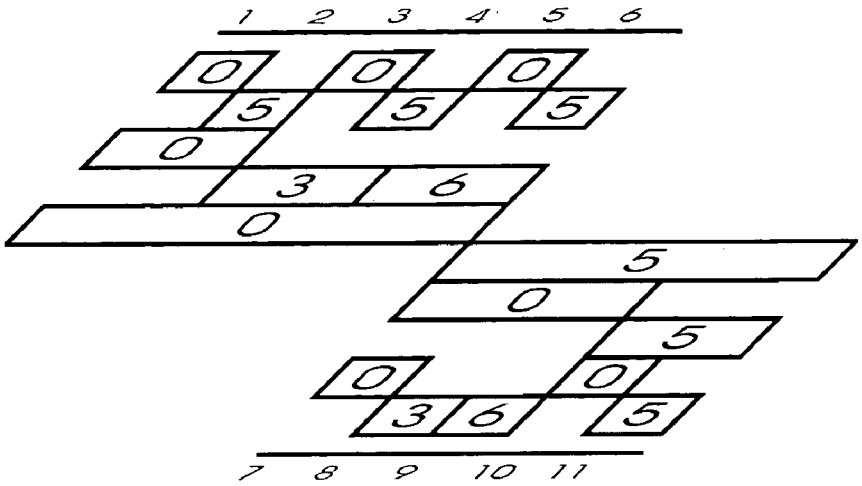
FIG. 94 illustrates the 11 B+TbbbBtb Carrier with linear, salient and metric element views.

FIG. 94 shows the Visualization, Linear Ordering, and Salient Ordering of Carrier Structure 11 B+TbbbBtb.

Figure 95:
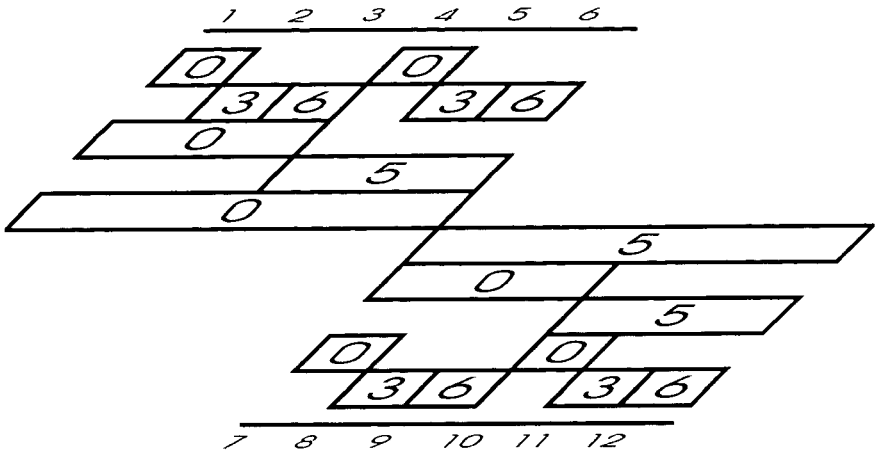
FIG. 95 illustrates the 12 B+BttBtt Carrier with linear, salient and metric element views.

FIG. 95 shows the Visualization, Linear Ordering, and Salient Ordering of Carrier Structure 12 B+BttBtt.

Figure 96:
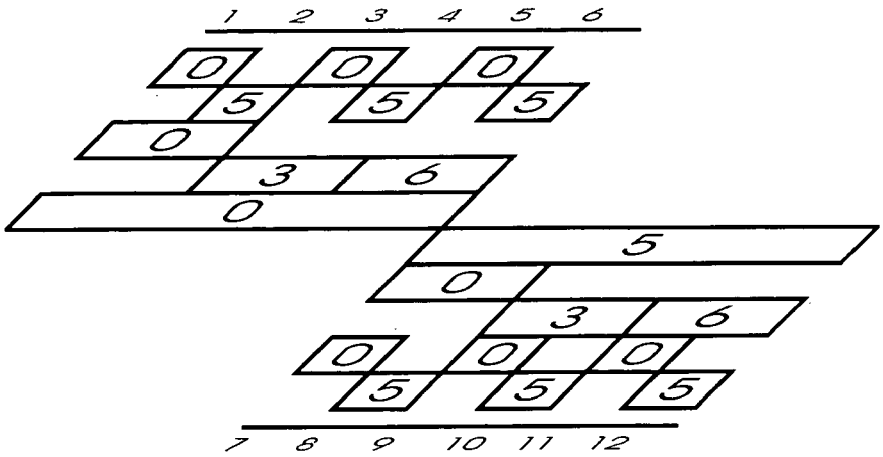
FIG. 96 illustrates the 12 B+TbbbTbbb Carrier with linear, salient and metric element views.

FIG. 96 shows the Visualization, Linear Ordering, and Salient Ordering of Carrier Structure 12 B+TbbbTbbb.

Figure 97:
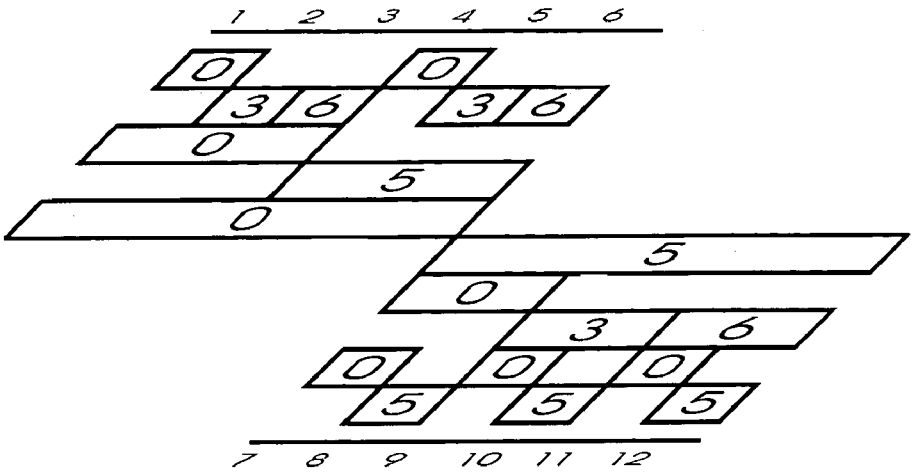
FIG. 97 illustrates the 12 B+BttTbbb Carrier with linear, salient and metric element views.

FIG. 97 shows the Visualization, Linear Ordering, and Salient Ordering of Carrier Structure 12 B+BttTbbb.

Figure 98:
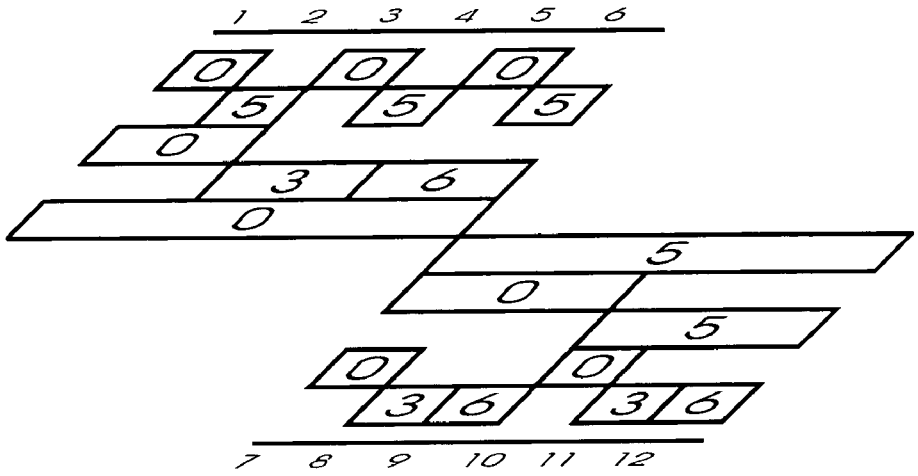
FIG. 98 illustrates the 12 B+TbbbBtt Carrier with linear, salient and metric element views.

FIG. 98 shows the Visualization, Linear Ordering, and Salient Ordering of Carrier Structure 12 B+TbbbBtt.

Figure 99:
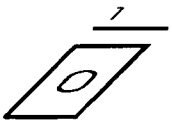
FIG. 99 illustrates the Thru Nanoform Carrier with linear, salient and metric element views.

FIG. 99 shows the Visualization of Nanoform Carrier Structure Thru.

Figure 100:
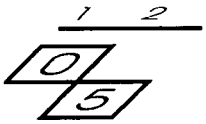
FIG. 100 illustrates the 2 b Nanoform Carrier with linear, salient and metric element views.

FIG. 100 shows the Visualization, Linear Ordering, and Salient Ordering of Nanoform Carrier Structure 2 b.

Figure 101:
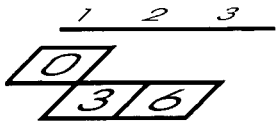
FIG. 101 illustrates the 3 t Nanoform Carrier with linear, salient and metric element views.

FIG. 101 shows the Visualization, Linear Ordering, and Salient Ordering of Nanoform Carrier Structure 3 t.

Figure 102:
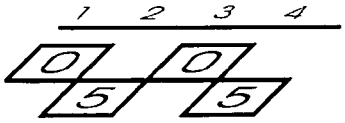
FIG. 102 illustrates the 4 Bbb Nanoform Carrier with linear, salient and metric element views.

FIG. 102 shows the Visualization, Linear Ordering, and Salient Ordering of Nanoform Carrier Structure 4 Bbb.

Figure 103:
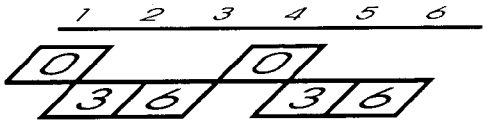
FIG. 103 illustrates the 6 Btt Nanoform Carrier with linear, salient and metric element views.

FIG. 103 shows the Visualization, Linear Ordering, and Salient Ordering of Nanoform Carrier Structure 6 Btt.

Figure 104:
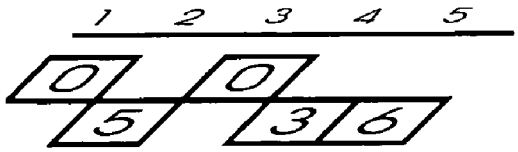
FIG. 104 illustrates the 5 Bbt Nanoform Carrier with linear, salient and metric element views.

FIG. 104 shows the Visualization, Linear Ordering, and Salient Ordering of Nanoform Carrier Structure 5 Bbt.

Figure 105:
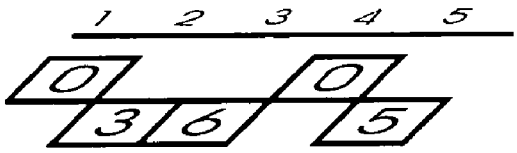
FIG. 105 illustrates the 5 Btb Nanoform Carrier with linear, salient and metric element views.

FIG. 105 shows the Visualization, Linear Ordering, and Salient Ordering of Nanoform Carrier Structure 5 Btb.

Figure 106:
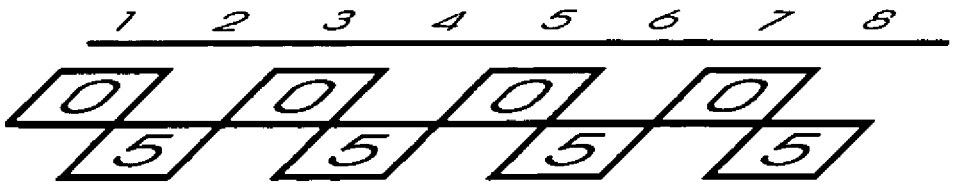
FIG. 106 illustrates the 8 B+BbbBbb Nanoform Carrier with linear, salient and metric element views.

FIG. 106 shows the Visualization, Linear Ordering, and Salient Ordering of Nanoform Carrier Structure 8 B+BbbBbb.

Performance Element Collective

Figure 107:
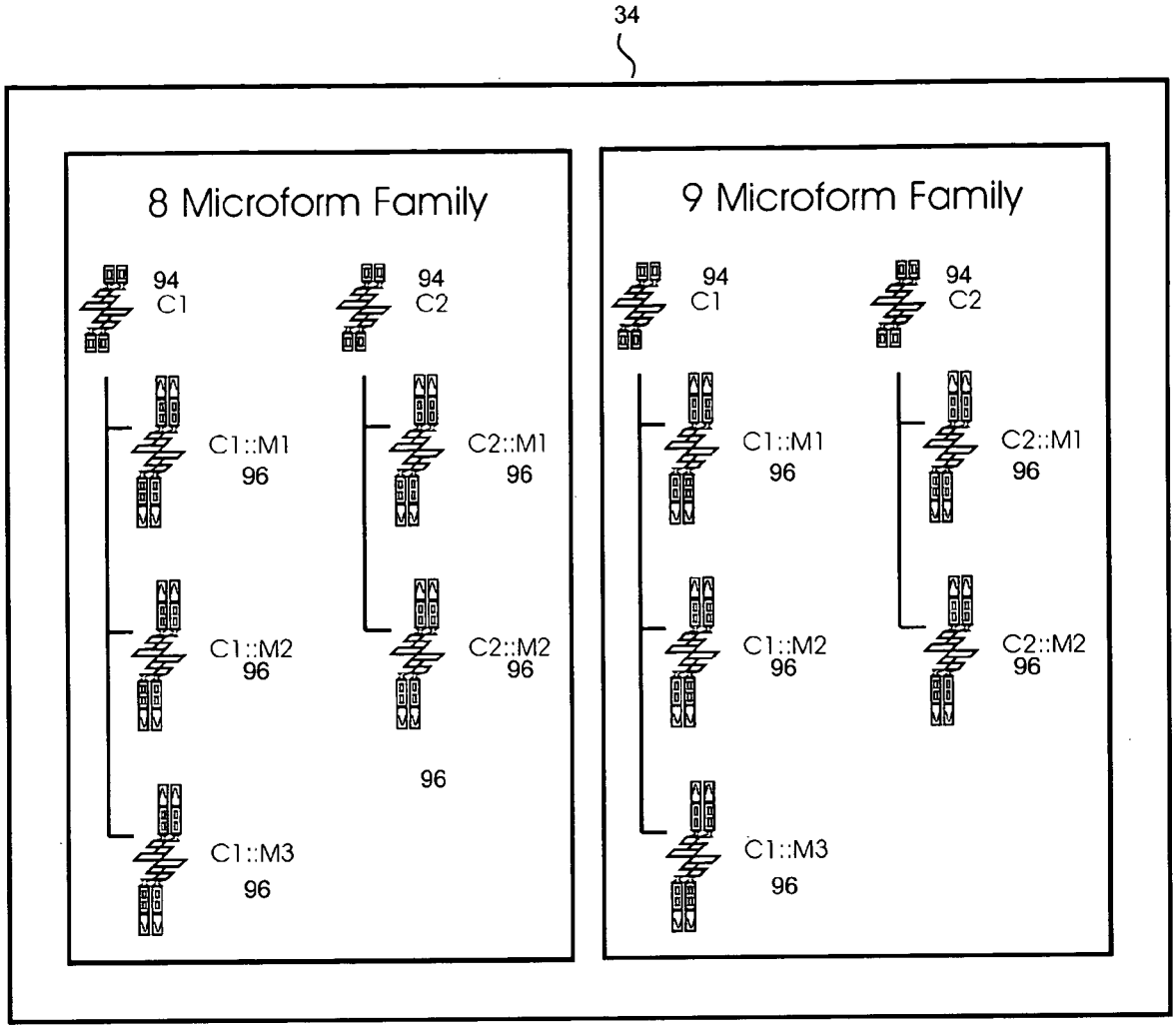
FIG. 107 is diagram of a Performance Element Collective.

The second structure to be discussed in this "Theory Implementation" section is the Performance Element Collective. A Performance Element Collective contains all of the unique Performance Elements that occur within the Song Framework Output. The allocation of Performance Elements to a particular Performance Element Collective is explored in the "Classification and mapping of Performance Elements" section. The Performance Element Collective initially associates internal Performance Elements by Microform Family compatibility. For example, all of the 8 family of Microforms are compatible. Within the Microform family association, the Performance Element Collective also provides a hierarchical group of such Performance Elements according to compositional equivalence. FIG. 107 visualizes a Performance Element Collective (34), which associates compositional Performance Elements (94) by metric equivalence. Compositional Performance Elements (94) act as grouping structures for mechanical Performance Elements (96) in the Performance Element Collective (34).

Framework Element

The third structure to be discussed in this section is the Framework Element. The Framework Element has Carrier implementation and Modulator implementation.

Figure 108:
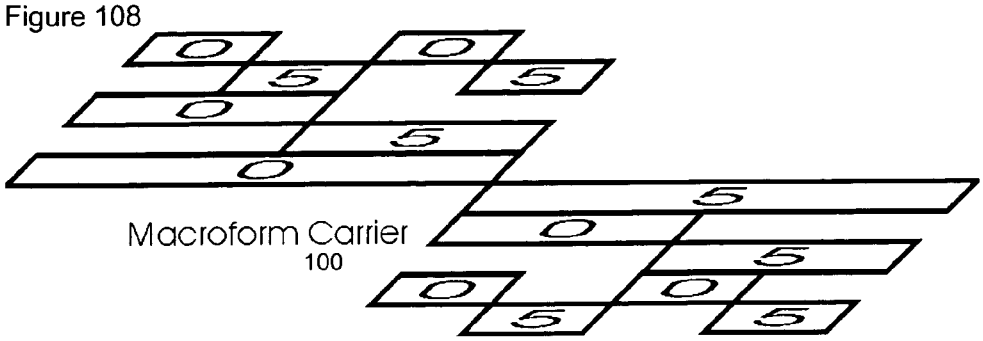
FIG. 108 is a diagram of a Macroform.

The Framework Element's Carrier is composed of a Macroform, and Microform Carrier class assignments. The Macroform provides the structural framework for a section of music (i.e. Chorus). FIG. 108 Shows a Macroform Structure (100).

Another aspect of the Framework Element Carrier is the Microform Carrier family. The Microform Carrier family restricts Performance Event participation only to those Performance Elements that have Microforms within the Microform Carrier class.

I.E.) 8 Microform Carrier class

| |
|---|
| 8 B+BbbBbb |
| 8 Tttb |
| 8 Ttbt |
| 8 Tbtt |

Figure 109:
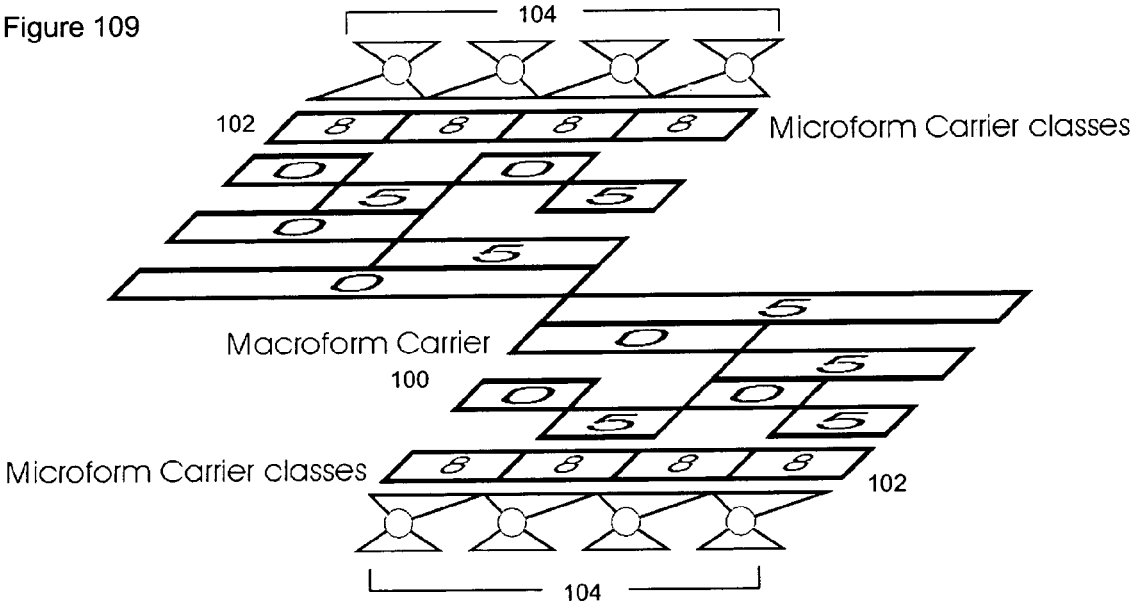
FIG. 109 is a diagram of a Macroform with Microform class and Performance Events.

A Microform Carrier class must be assigned to every Macroform Node. FIG. 109 shows a Macroform (100) with Microform Carrier classes (102) and Performance Events (104).

A Performance Event is added to every Macroform node (measure) within the Framework Element. The Performance Event brokers the carrier extension of the Framework Element by Performance Elements for a particular Macroform node within the Framework Element. Only Performance Elements that conform to the Microform Family specified at the Performance Event's Macroform node can participate in the Performance Event. Performance Elements that participate in the Performance Event also inherit the defined key and tempo values in the Framework Element Modulator at the Performance Event's Macroform node.

Figure 110:
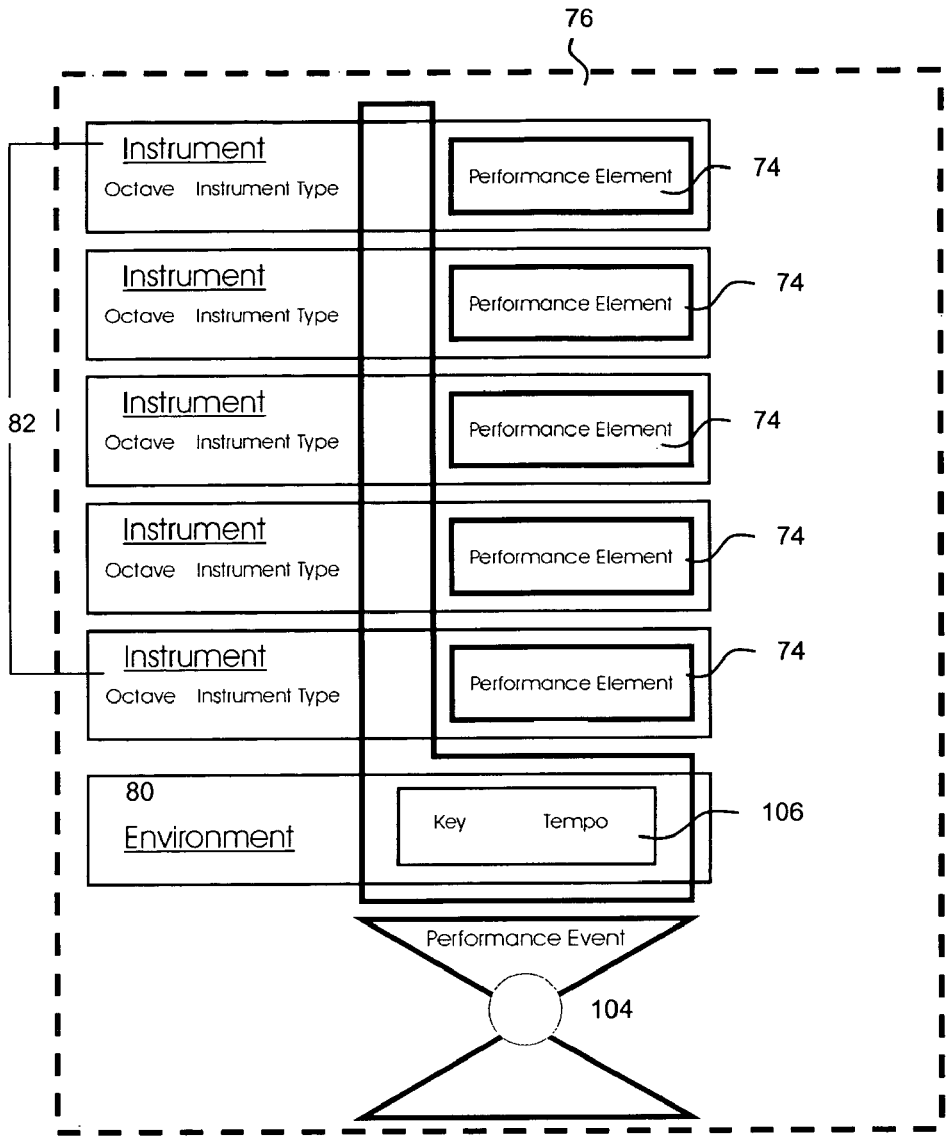
FIG. 110 is a diagram of a Musical Structure Framework Modulator.

The following is an index of Macroform Carrier Structures that can be used in defining a Song Framework:

4 Bbb
8 B+BbbBbb
12 T+BbbBbbBbb
16 B++B+BbbBbbB+BbbBbb
5 Bbt
5 Btb
6 Btt
6 Tbbb
7 Tbbt
7 Tbtb
7 Ttbb
8 Tttb
8 Ttbt
8 Tbtt
9 Tttt
9 B+BbtBbb
9 B+BtbBbb
9 B+BbbBbt
9 B+BbbBtb
10 B+TbbbBbb
10 B+BbbTbbb
10 B+BbbBtt
10 B+BttBbb
10 B+BbtBbt
10 B+BbtBtb
10 B+BtbBbt
10 B+BtbBtb
11 B+BbtBtt
11 B+BbtTbbb
11 B+BbtBtt
11 B+BtbBtt
11 B+BtbTbbb
11 B+BttBbt
11 B+BttBtb
11 B+TbbbBbt
11 B+TbbbBtb
12 B+BttBtt
12 B+TbbbTbbb
12 B+BttTbbb
12 B+TbbbBtt FIG. 110 visualizes a Framework Element Modulator (76). The Framework Element Modulator (76) is composed of the environment partial (106) and Performance Elements (74). The Framework Element Modulator (32) is intersected by multiple Instrument Performance Tracks (82). The Performance Element (74) participates in both the environment partial (106) and an Instrument Performance Track (82). The Framework Element Modulator (32) is attached to the Performance Event (104).

Figure 111:
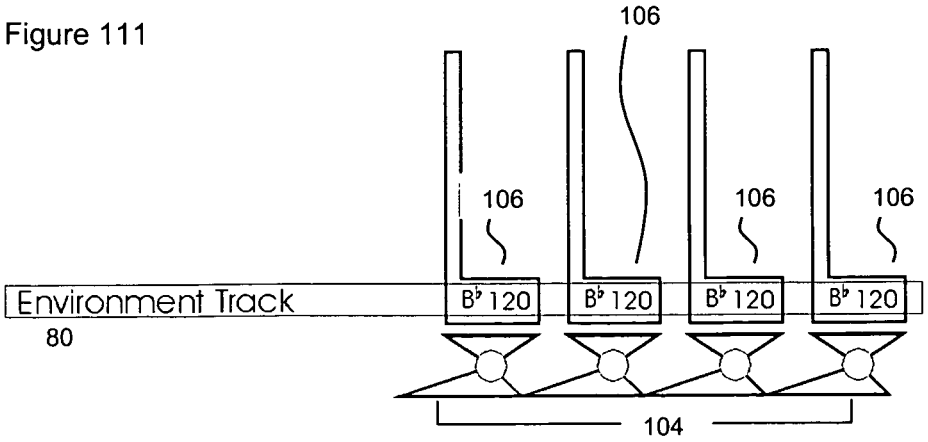
FIG. 111 is a diagram of an Environment Track.

FIG. 111 visualizes an environment track (80). The environment track (80) is a sequence of all environment partials (106) mapped across the Performance Events (104) for a particular Framework Element. These environment partials (106) are generally part of a MIDI or other music file, or otherwise are compiled in a manner known to those skilled in the art. The environment partial defines the contextual data for a particular Performance Event. This data is applied to every Performance Element that participates in the Performance Event. The environment partial contains tempo and key vectors.

Figure 112:
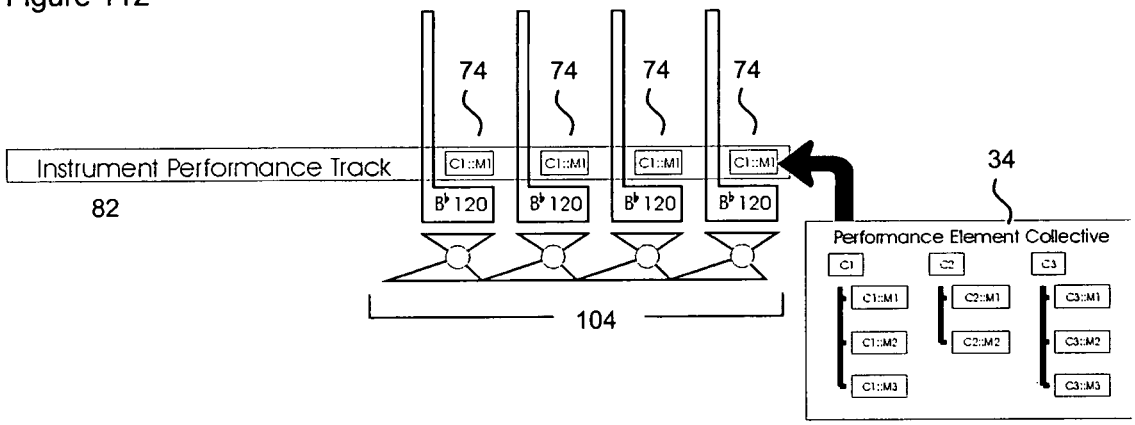
FIG. 112 is a diagram of an Instrument Performance Track with mapped Performance Element.

FIG. 112 visualizes an Instrument Performance Track (82). The Instrument Performance Track (82) is an instrument-specific modulation space that spans across all of the Performance Events (104) for a particular Framework Element. Performance Elements (74) are mapped to the Instrument Performance Track (82) from the Performance Element Collective (34).

The associated instrument defines the Instrument Performance Track's timbral qualities. Currently, the instrument contains octave and instrument family vectors. Performance Elements mapped to a particular Instrument Performance Track inherit the Instrument Performance Track's timbral qualities.

The following tables define the ranges of the modulator vectors that are used in the environment partial:

Tempo

| |
|---|
| 30 BPM <-> 240 BPM |

Key

| Gb | Db | Ab | Eb | Bb | F | C | G | D | E | A | B | F# |
|---|---|---|---|---|---|---|---|---|---|---|---|---|
| 6b | 5b | 4b | 3b | 2b | 1b | 0 | 1# | 1# | 1# | 1# | 1# | 1# |

The following tables define the ranges of the modulator vectors that are used for each instrument Octave (Fundamental Frequency)

| LO4 | LO3 | LO2 | LO1 | MID | HI1 | HI2 | HI3 | HI4 |
|---|---|---|---|---|---|---|---|---|
| 32 Hz | 64 Hz | 128 Hz | 256 Hz | 512 Hz | 1024 Hz | 2048 Hz | 4096 Hz | 8192 Hz |

Instrument Family

| Organ | bass | Keys | bow | Pluck | reed | wind | voice | brass | bell | synth | Non periodic |
|---|---|---|---|---|---|---|---|---|---|---|---|

Figure 113:
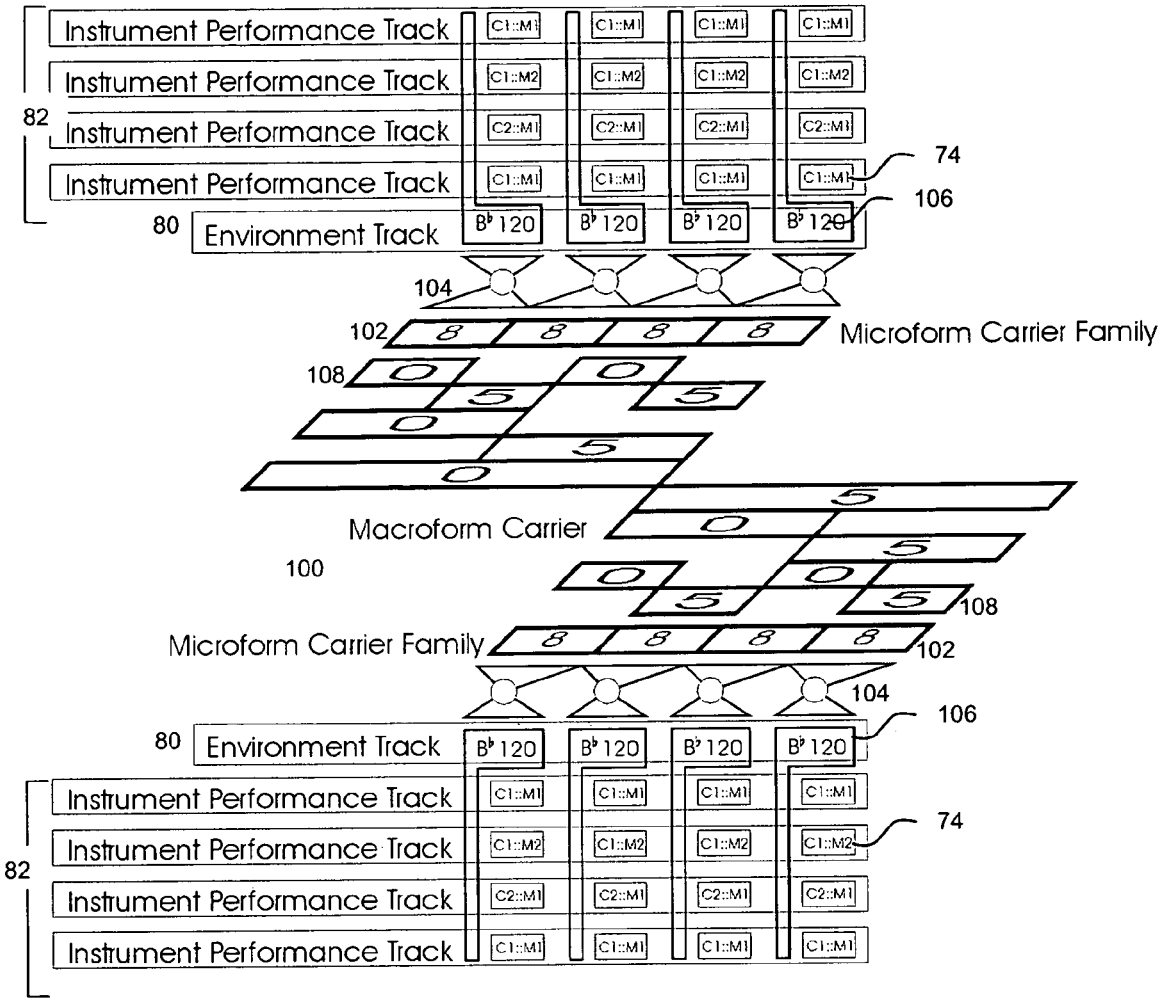
FIG. 113 is a diagram of a Musical Structure Framework from a Carrier Focus.

FIG. 113 represents a complete Framework Element from a Carrier Focus.

Figure 114:
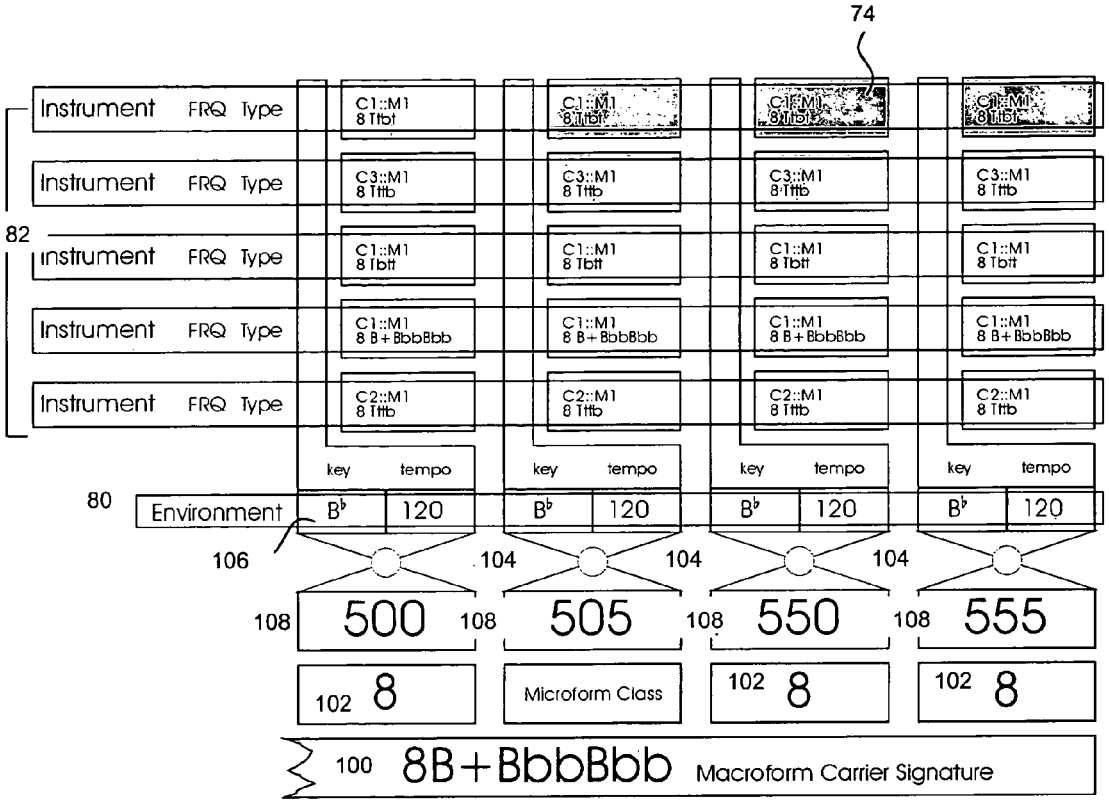
FIG. 114 is a diagram of a Musical Structure Framework from a Modulator Focus.

FIG. 114 partially visualizes a Framework Element from a Modulator Focus.

In both FIG. 113 and FIG. 114, the Carrier section consists of a Macroform (100), Microform Carrier classes (102), and Macroform Carrier Nodes (108). Performance Events (104) connect the Carrier and Modulator components of the Framework Element. The Modulator section consists of an environment track (80) containing environment partials (106) and Instrument Performance Tracks (82) that contain and route Performance Elements (74) to specific Instruments.

The Carrier focus view of the Framework Element highlights the Carrier portion of the Framework Element, and reduces Modulator detail. The Modulator focus highlights additional Modulator detail, while reducing the Carrier component down to harmonic state notation.

Figure 115:
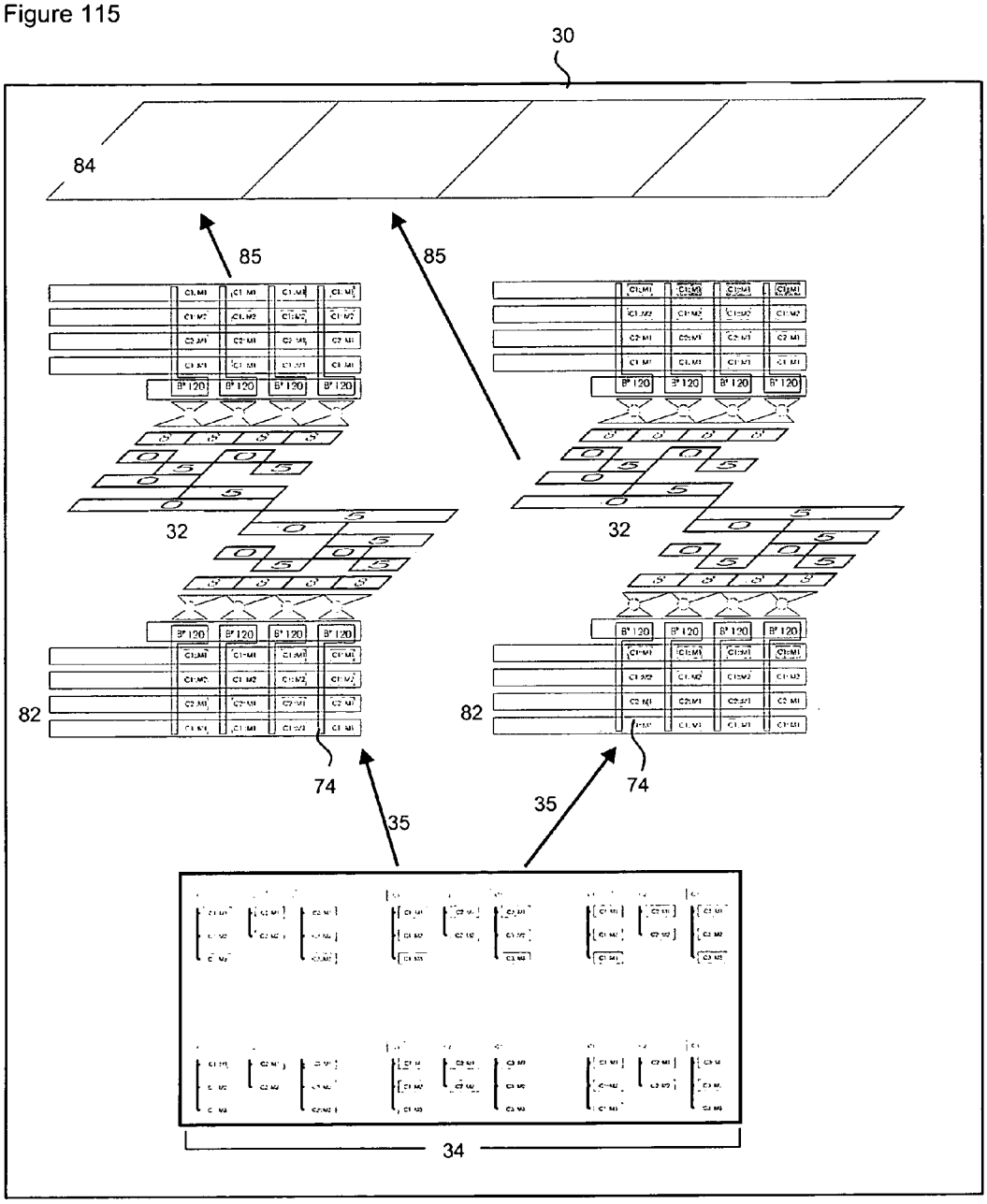
FIG. 115 is a diagram of the Song Module Anatomy.

FIG. 115 summarizes the Song Framework Output (30) anatomy, and thereby explains the operation of the Song Framework of the present invention. A Framework Sequence (84) outlines the top-level song structure (Intro, verse 1, chorus 1 etc. . . . ). Framework Elements (32) are mapped (85) to nodes of the Framework Sequence (84), in order to define the detailed content for every song section. Framework Elements (32) define the metric structure environment parameters, and participating instruments for a particular song structure section. Instrument Performance Tracks (82) within the Framework Element (32) are mapped (35) with Performance Elements (74) from the Performance Element Collective (34). Instrument Performance Tracks (82) across multiple Framework Elements (32) can share the same Performance Element Collective (34). For example, all of the "bass guitar" Instrument Performance Tracks, will be mapped by Performance Elements from the "bass guitar" Performance Element Collective. FIG. 115 is best understood by referring also to the description of the "Song Framework Functionality" set out below.

Song Framework Functionality

Figure 116:
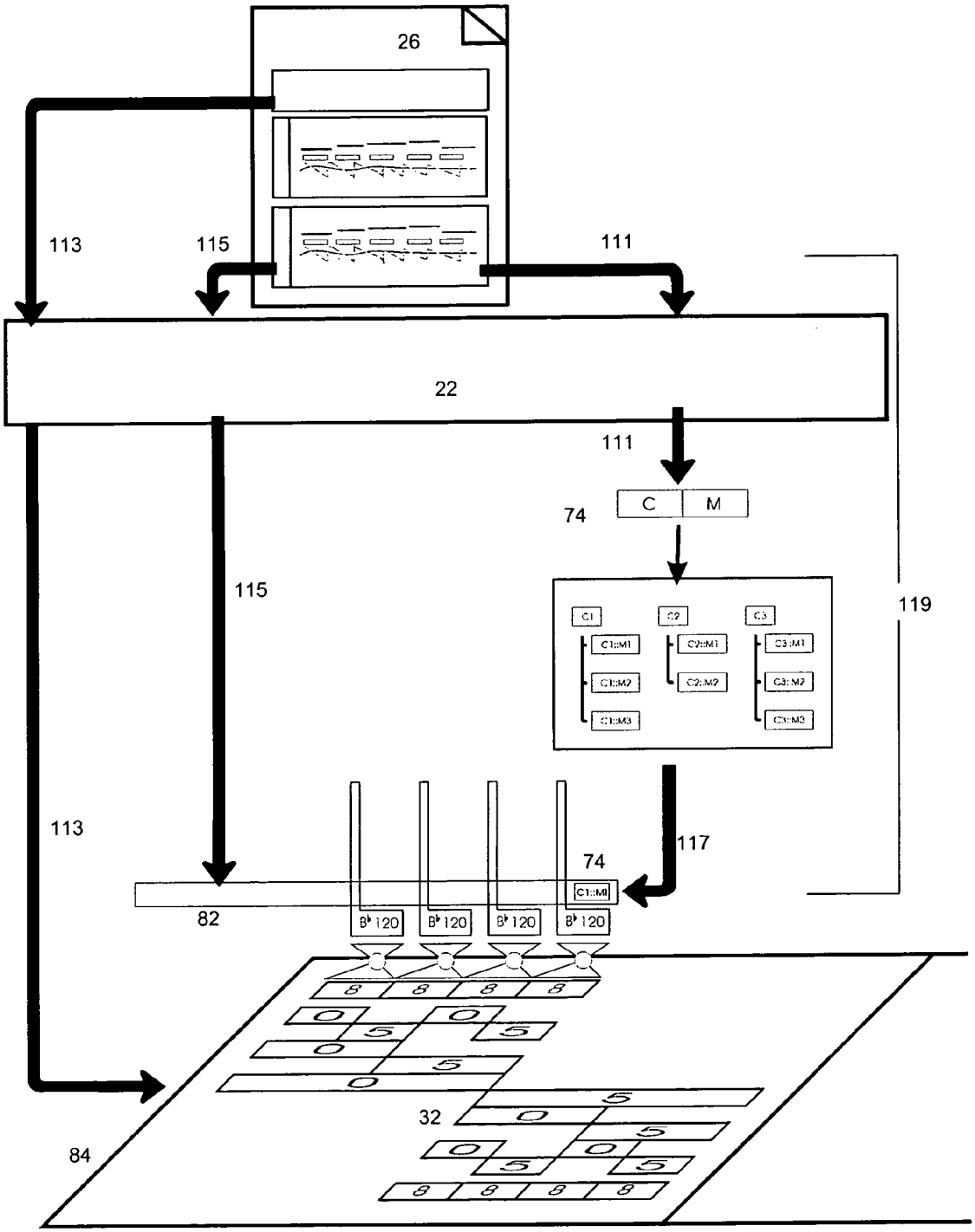
FIG. 116 is a diagram of the top level MIDI to Song Module translation process.

FIG. 116 illustrates the high-level functionality of the Song Framework. The purpose of the Song framework is to analyze a music file such as a prepared MIDI file (26) ("preparation" explained in the background above) and convert its constituent elements into a Song Framework Output file (30), in accordance with the method described. This in turn enables the Reporting Functionality of the Song Framework Output (30) in accordance with the processes described below.

In order to translate a prepared MIDI file into a Song Framework Output file, the Song Framework must employ the following main functionalities.

The first top-level function of the Song Framework (22) is to construct (113) a Framework Sequence (84) and a plurality of Framework Elements (32) as required. The second top-level function of the Song Framework (22) is the definition (115) of Instrument Performance Tracks (82) for all of the Framework Elements (32) (as explained below). The third top-level function of the Song Framework (22) is a performance analysis (119). The performance analysis (19), constructs (111) Performance Elements (74) from an instrument MIDI track, and maps (117) Performance Elements indexes (74) onto Instrument Performance Tracks (82).

This process consists generally of mapping the various elements of a MIDI file defining a song so as to establish a series of Framework Elements (32), in accordance with the method described. In accordance with the invention, the Framework Elements (32) are based on a common musical content structure defined above. The creation of the Framework Elements (32) consists of translating the data included in the MIDI file to a format corresponding with this common musical content structure. This in turn enables the analysis of the various Framework Elements (32) to enable the various processes described below.

The Framework Sequence is used to define the main sections of the song at an abstract level, for example "verse", "chorus", "bridge". Next, Framework Elements are created to define the structural and environmental features of each song section. The Framework Element's Macroform Container and Macroform combinations define the length and "phrasing" of each of the song sections. Also, the Framework Element's environment track identifies the environmental parameters (such as key, tempo and time signature) for every structural node in the newly created Framework Element. Framework Element creation is further discussed in the "Process to create Framework Elements and Instrument Performance Tracks from MIDI file data" section.

For each recorded instrument, a corresponding Instrument Performance Track is created within each Framework Element. The Instrument Performance Track is populated using the performance analysis process (described below). Instrument Performance Track creation is further discussed in the "Process to create Framework Elements and Instrument Performance Tracks from MIDI file data" section.

In order to populate the Instrument Performance Track, the performance analysis process examines an instrument's MIDI track on a bar by bar basis to determine the identity of Performance Elements at a specific location. The resulting compositional and mechanical Performance Element index values are then mapped to the current analysis location on the Framework Element. Performance Element index mapping is further discussed in the "Classification and mapping of Performance Elements" section below.

In the performance analysis process described, at least one Performance Element is identified based on the analysis of the MIDI Data; a Performance Element Collective classification is also derived from the MIDI Data. The Performance Element Collective classification identifies the compositional and mechanical uniqueness of the newly detected Performance Element. Performance analysis is further discussed in the "Process to create a Performance Element from a bar of MIDI data" section. Performance Element Collective classification is further discussed in the "Classification and mapping of Performance Elements" section.

"Song Framework Functionality" utilizes the functionality of the audio to MIDI conversion application to prepare the MIDI file according to the process outlined in "Preparation of Multi-track Audio for Analysis", and the Translation Engine to convert the prepared MIDI file into a Song Framework Output file.

One aspect of the computer program product of the present invention is a conversion or translation computer program that is provided in a manner that is known and includes a Translation Engine. In one aspect thereof, the Translation Engine enables audio to MIDI conversion. The conversion computer program (54) of FIG. 117, in one particular embodiment thereof, consists of a Graphical User Interface (GUI) application used to extract Music Instrument Digital Interface (MIDI) data from multi-track audio files. It is also used to collect the various song metadata associated with a MIDI file that is described below. This metadata is pertinent for analysis of the final outputted MIDI file.

Figure 117:
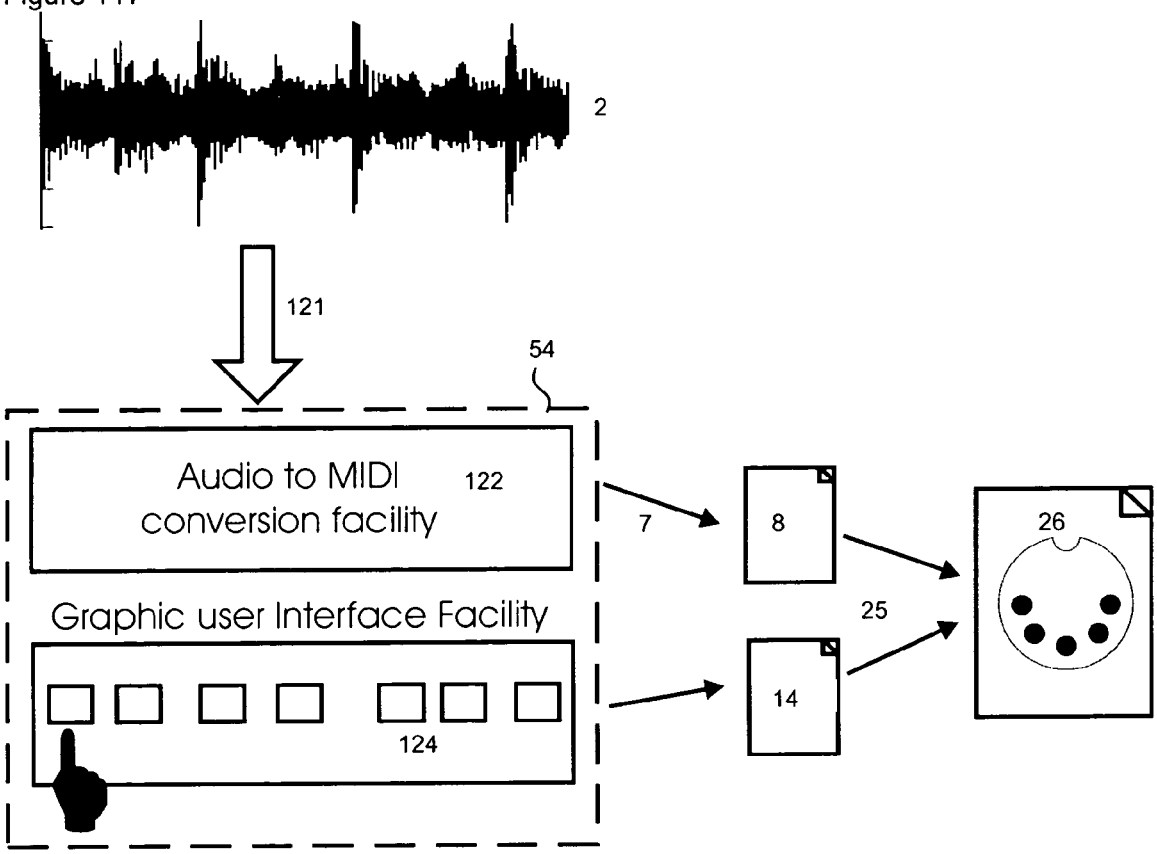
FIG. 117 is a diagram of the Audio to MIDI conversion application facilities.

The conversion computer program (54) of FIG. 117 uses the following inputs, in one embodiment thereof: audio files (of standard length with a common synchronization point) and Song Metadata (such as tempo, key, and respective time signatures). Song Metadata is used to create the Musical structure framework for the musical composition. Additionally, Performance metadata may be required to supplement the analyzed data of individual instrument tracks.

The Audio to MIDI conversion application output is a Type 1 MIDI file that is specifically formatted for the Translation Engine (56).

FIG. 117 visualizes the component elements that constitute the Audio to MIDI conversion application (54). The following processing steps illustrate the operation of the Audio to MIDI conversion application (54). First, a multi-track audio file (2) is played through (121) an audio to MIDI conversion facility (122) to create (7) system-generated data (8). Second, a user supplements the system-generated data with additional performance metadata (14) as required, by entering values into the graphic user interface facility (124). The user-generated data (14) is converted into MIDI data and merged (25) with the existing system-generated data into a MIDI file (26). The Audio to MIDI conversion application functionality is further illustrated in the Background.

The Translation Engine, in another aspect thereof, is a known file processor that takes a prepared MIDI File and creates a proprietary Song Framework Output XML file.

Figure 118:
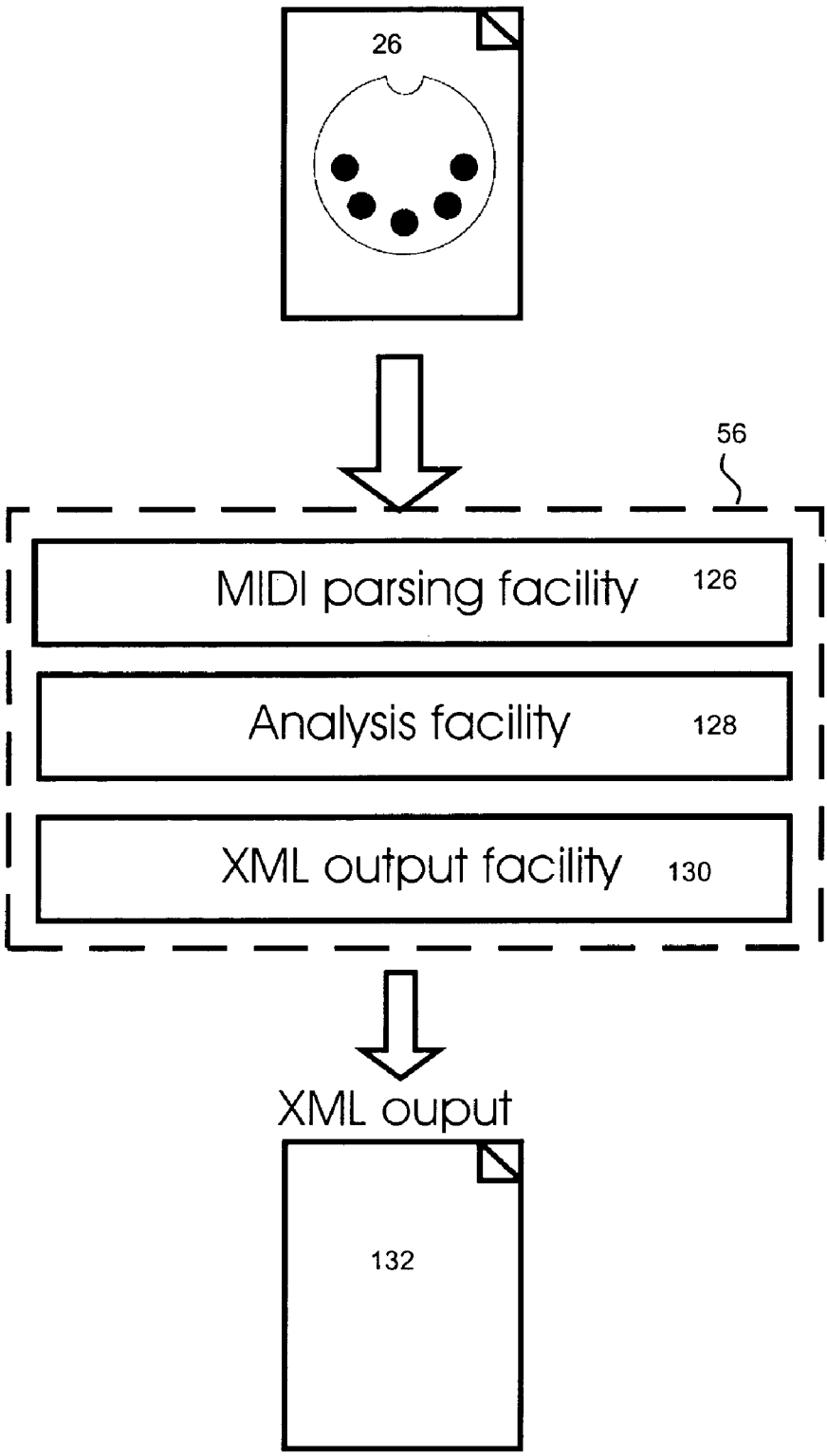
FIG. 118 is a diagram of the Translation Engine facilities.

FIG. 118 shows a representation of the Translation Engine (56). First, a MIDI Parsing facility (126) parses a prepared MIDI file (26) to identify MIDI events in various tracks and their respective timings. Next, an Analysis facility (128) translates the MIDI data into data format of the musical representation of the current invention. Finally, a XML Construction facility (130) packages the translated data into a Song Framework Output XML file (132).

Figure 119:
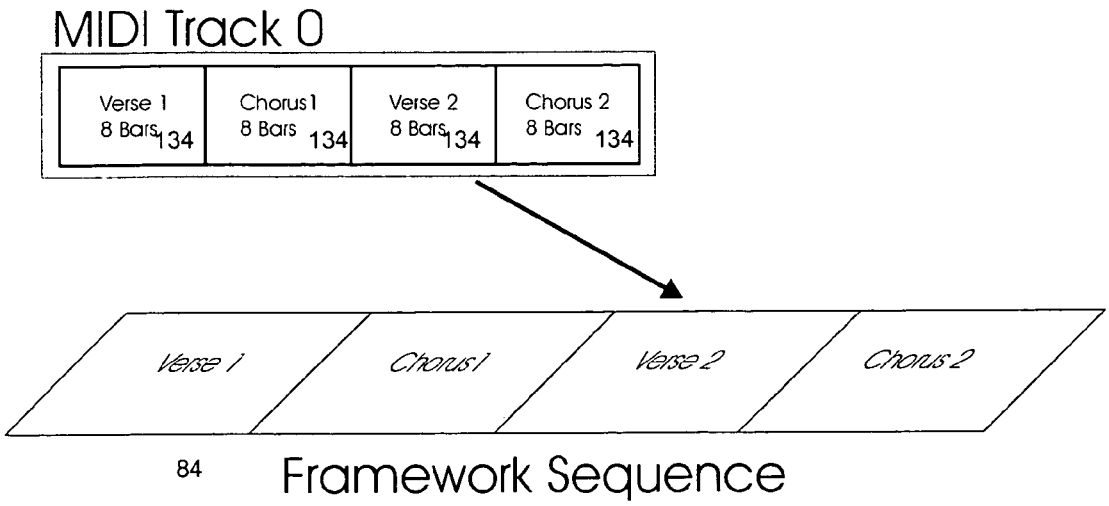
Figure 120:
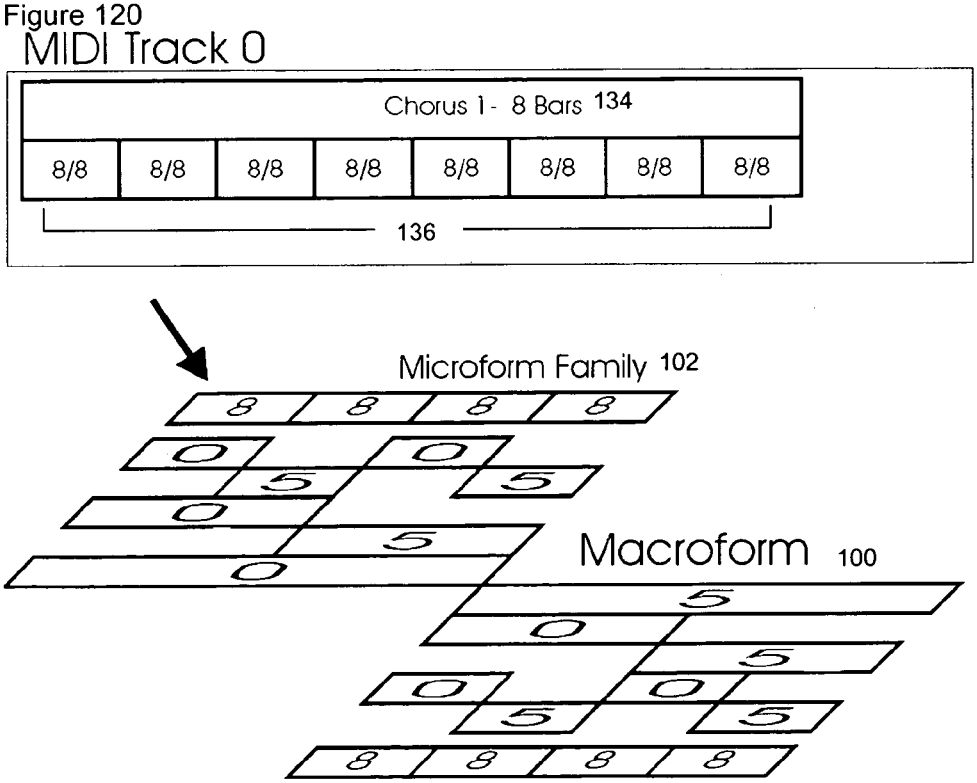
Figure 121:
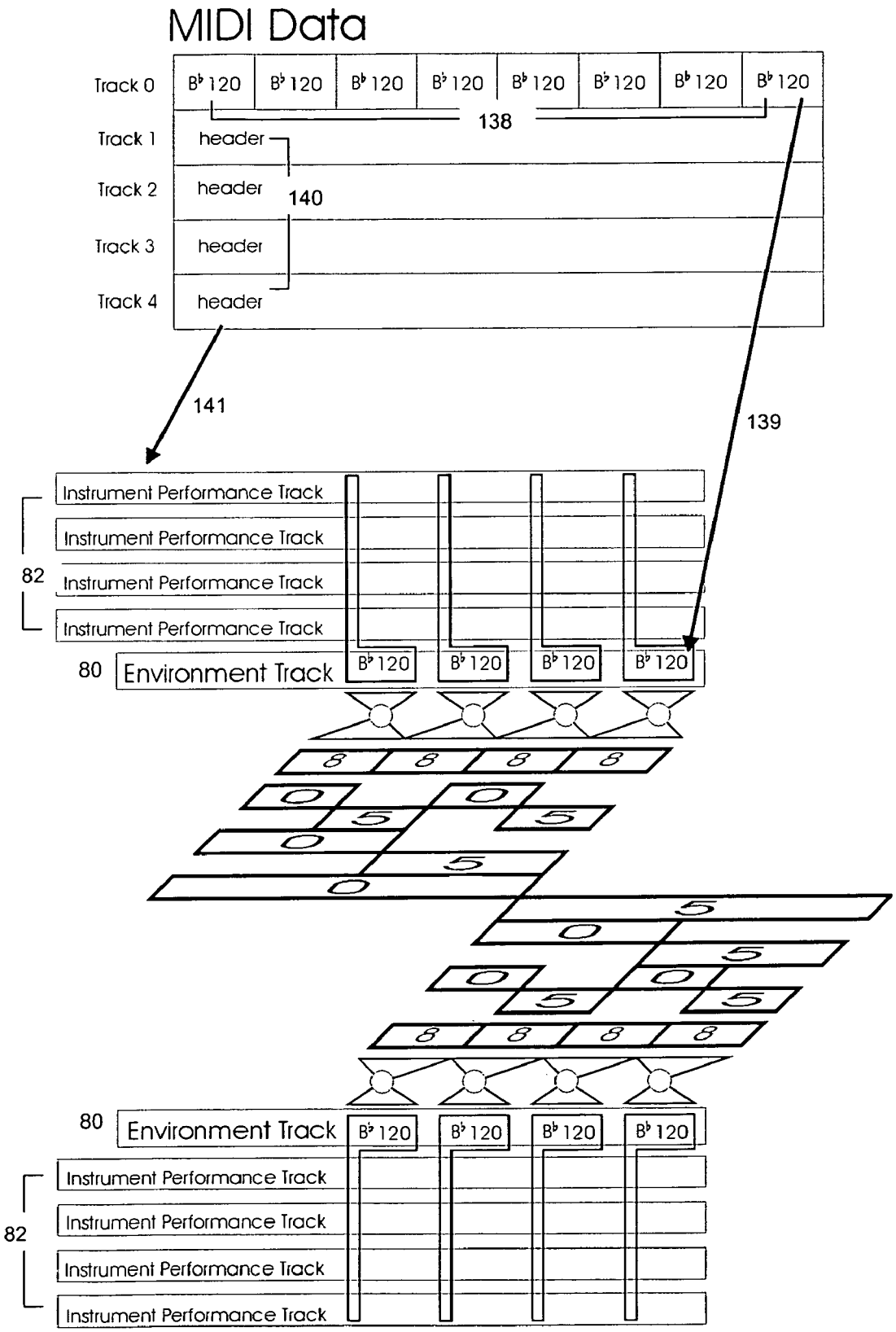

Process to Create Framework Elements and Instrument Performance Tracks from MIDI File Data The first function of the Song Framework, as seen in (113) of FIG. 116, is to define the Framework Sequence and Framework Elements as required. FIG. 119 illustrates that the Framework Sequence (84) is defined from song structure marker events (134) in MIDI Track 0. FIG. 120 illustrates the Carrier construction of a Framework Element. The Macroform Carrier (100), is defined by song structure marker events (134) defined in Track 0, and the Microform Carrier classes (102) are defined by time signature events (136) in Track 0. FIG. 121 illustrates the Modulator construction of a Framework Element. The Environment Track (80) is populated (139) by the key events and tempo events (138) in MIDI Track 0.

The second function of the Song Framework, as seen in (115) of FIG. 116 is to create empty Instrument Performance Tracks on each of the required Framework Elements. FIG. 121 also illustrates that Instrument Performance Tracks (82) are created from header data (140) in MIDI Tracks 1-n.

The following code fragment shows an XML result of the Framework Element creation.

```
<Nucleus>
<ENS_SEQ>
<Ensemble_Chromatin name='Verse1' id='ens1' />
<Ensemble_Chromatin name='Chorus1' id='ens2' />
<Ensemble_Chromatin name='Verse2' id='ens3' />
<Ensemble_Chromatin name='Chorus2' id='ens4' />
. . .
</ENS_SEQ>
<ENS_CONTENT>
    <Ensemble_Chromatin_Content id='ens1'>
    <Macroform carrier='8B+BbbBbb'>
        <Macroform_Node hsn=000 microform_class='8'>
            <Environment_Partial tempo='120' key='B'/>
            <Channel_Partial inst_id='inst1' comp=" mech="/>
            <Channel_Partial inst_id ='inst2' comp=" mech="/>
            <Channel_Partial inst_id ='inst3' comp=" mech="/>
            <Channel_Partial inst_id ='inst4' comp=" mech="/>
        </Macroform_Node>
        <Macroform_Node hsn=005 microform_class='8'>
            <Environment_Partial tempo='120' key='B'/>
            <Channel_Partial inst_id ='inst1' comp=" mech="/>
            <Channel_Partial inst_id ='inst2' comp=" mech="/>
            <Channel_Partial inst_id ='inst3' comp=" mech="/>
            <Channel_Partial inst_id ='inst4' comp=" mech="/>
        </Macroform_Node>
        <Macroform_Node hsn=050 microform_class='8'>
            <Environment_Partial tempo='120' key='B'/>
            <Channel_Partial inst_id ='inst1' comp=" mech="/>
            <Channel_Partial inst_id ='inst2' comp=" mech="/>
            <Channel_Partial inst_id ='inst3' comp=" mech="/>
            <Channel_Partial inst_id ='inst4' comp=" mech="/>
        </Macroform_Node>
            . . .
    </Ensemble_Chromatin_Content>
    . . .
</ENS_CONTENT/>
    <Instruments>
    <Instrument name='Bass' inst_id='inst1' />
    <Instrument name='Guitar' inst_id='inst2' />
    <Instrument name='Piano' inst_id='inst3' />
    <Instrument name='Trumpet' inst_id='inst4' />
</Instruments>
</Nucleus>
```

Process to Create a Performance Element from a Bar of MIDI Data

The third function of the Song Framework is the population of the Instrument Performance Tracks through a performance analysis, as seen in (19) of FIG. 116. One processing step in the performance analysis is the Performance Element creation Process, as seen in (111) of FIG. 116.

Figure 122:
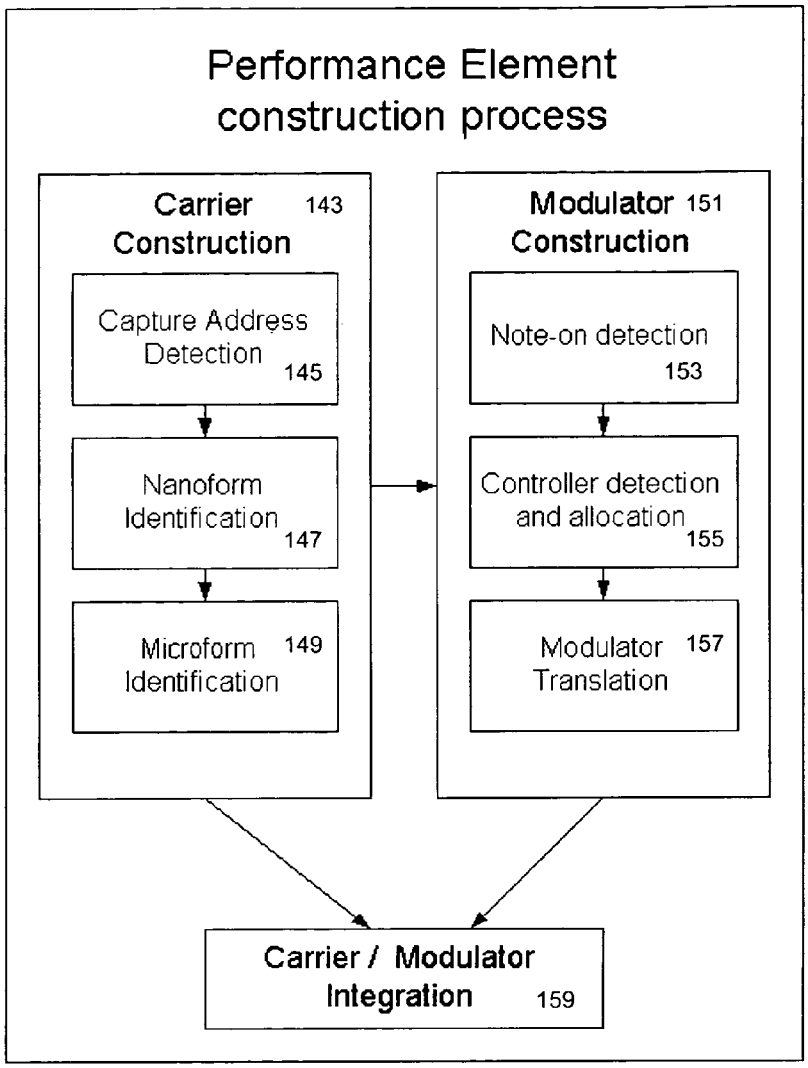

FIG. 122 illustrates in greater particularity the Performance Element creation process. The Performance Element creation from MIDI data, in on embodiment thereof, can be described as a three-step procedure. First, Carrier construction (143) is achieved by identifying "capture addresses" within a beat (145), determining the most salient Nanoform Carrier Structure to represent each beat (147), and then determining the most salient Microform Carrier to represent the metric structure of the Performance Element (149). Second, Modulator construction (151) is achieved by the detection of note-on data (153), detection and allocation controller events (155), and a subsequent translation into Modulator data (157). Finally, Modulators are associated with their respective Micro/Nanoform Carriers (159) through Note Events ID's. This completes the definition of a Performance Element.

The Carrier Construction process, as seen in (143) of FIG. 122 has three steps: capture address detection, Nanoform carrier identification, and Microform Carrier identification.

Figure 123:
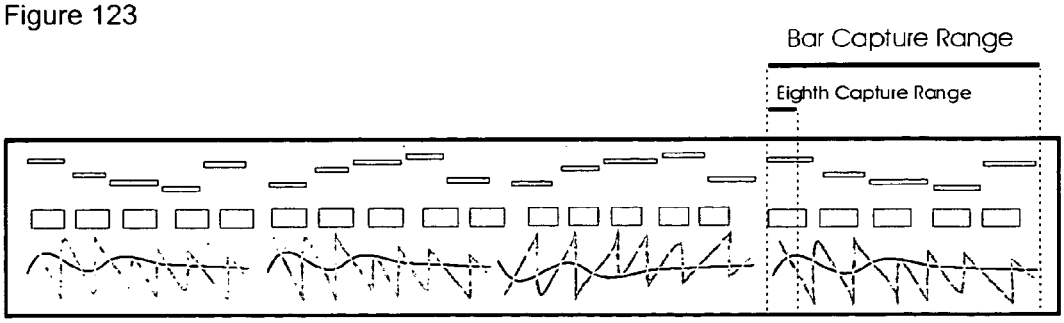

The first step in capture address detection, as seen in (145) of FIG. 122 is to determine the number of beats in the detected bar. The Microform Carrier Class is used to determine the number of eighths to capture for bar analysis. FIG. 123 visualizes the bar capture range, (and the eighth capture ranges) set by Microform Carrier class. For example, an eighth contains 480 ticks. In practice this number can increases depending on system capability.

Every eighth note has twelve capture addresses of 40 ticks each (at the 480 ticks/eighth quantize). Capture ranges for an eighth note would be, in one particular embodiment of the present invention, as follows:

| Tick Offset | Capture Address |
|---|---|
| −39-0 | 1 |
| 1-40 | 2 |
| 41-80 | 3 |
| 81-120 | 4 |
| 121-160 | 5 |
| 161-200 | 6 |
| 201-240 | 7 |
| 241-280 | 8 |
| 281-320 | 9 |
| 321-360 | 10 |
| 361-400 | 11 |
| 401-440 | 12 |

Each eighth is examined on a tick-by-tick basis to identify note-on activity in the capture addresses.

Figure 124:
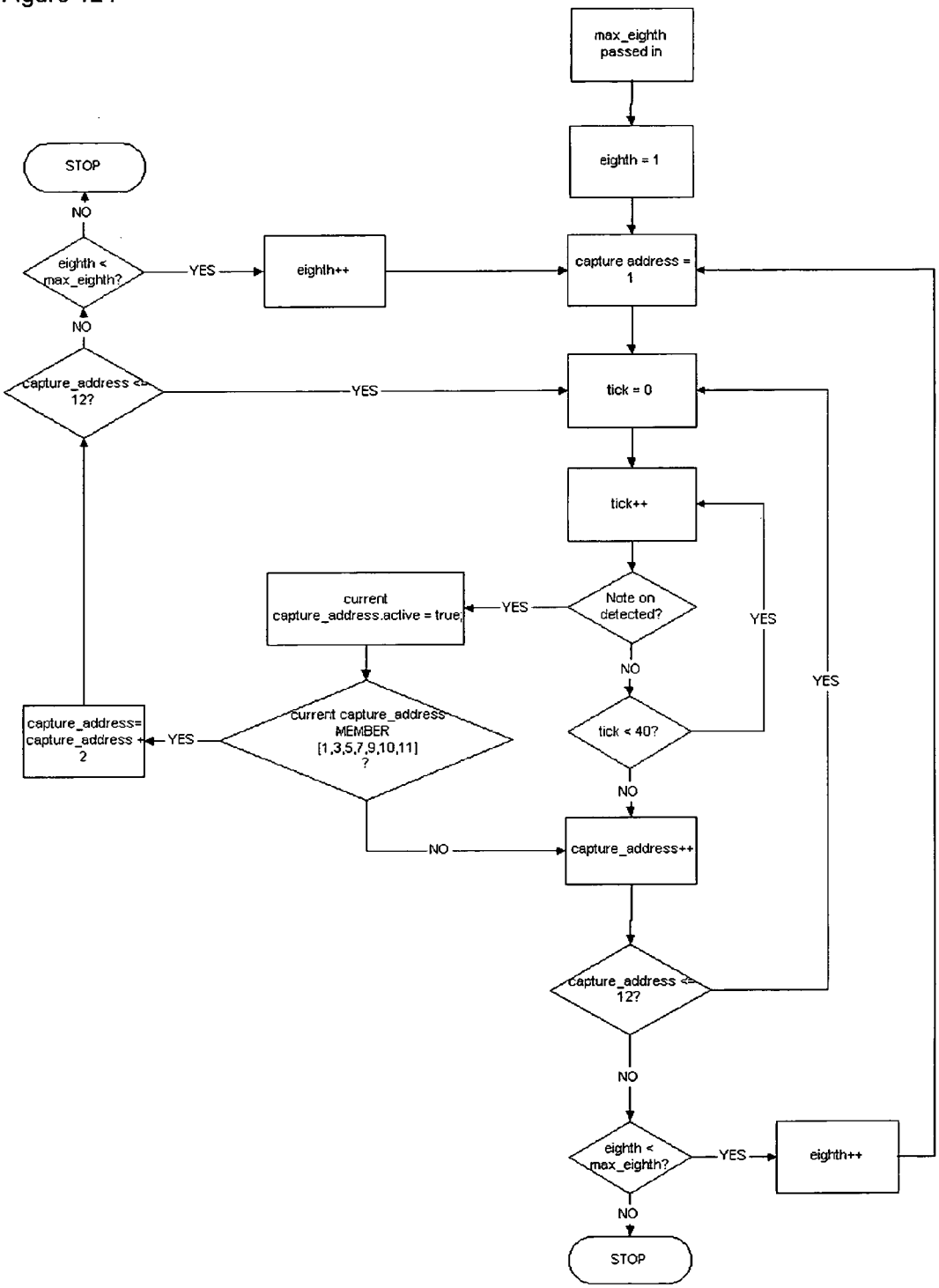

FIG. 124 illustrates one particular aspect of the Translation Engine, namely the Capture address detection algorithm. If MIDI note-on events are detected at capture addresses 1, 3, 5, 7, 9, 10, 11, then the adjacent capture addresses are bypassed for MIDI note-on event detection. Subsequent MIDI note-on events in the adjacent capture range will be interpreted as polyphony within a Note Event—which is 80 ticks in length. Note-on polyphony detection is introduced in the Modulator Construction Process, as seen in (153) of FIG. 122. If MIDI note-ons are detected in capture addresses 2, 4, 6, 8, 10, 12 then adjacent capture addresses are not skipped because MIDI note-on activity in the adjacent capture ranges can be associated with a separate Note Event. The following representative code fragment illustrates a particular XML rendering of the Capture Address analysis:

```
<Detect_Bar eigths=8>
    <eighth>
        <capture_address_1 active=" />
        <capture_address_2 active=" />
        <capture_address_3 active=" />
        <capture_address_4 active='true' />
        <capture_address_5 active=" />
        <capture_address_6 active=" />
        <capture_address_7 active=" />
        <capture_address_8 active=" />
        <capture_address_9 active='true' />
        <capture_address_10 active=" />
        <capture_address_11 active=" />
        <capture_address_12 active='true' />
```

-continued

```
    </eighth>
    . . .
</Detect_Bar>
```

A second step in Carrier construction is Nanoform identification, as seen in (147) of FIG. 122. Nanoform structures can be identified based on the most effective representation (highest salient value) of active capture addresses in the eighth. If none of the capture ranges are active the Nanoform Carrier structure is null. FIG. 125 shows the mapping of capture addresses to Nanoform structures.

The following text outlines the Nanoform identification process through example.

In this example, capture ranges 2, 5, and 10 are flagged as active. FIG. 126 shows the Nanoforms that can accommodate all of the active capture ranges and FIG. 127 shows the salient weight of the active capture addresses in each candidate Nanoform.

The Nanoform with the highest salient weight is the most efficient representation of the active capture addresses. Harmonic state notation is assigned and Note Event ID's are mapped to the Nanoform nodes. The following code fragment shows a representative XML rendering of Nanoform identification process:

```
<Microform_Node index=1 hsn=" node_salience="
nanoform_carrier='3t' nano_salience_mult=1.0>
<Nanoform_Node hsn=0 neid=1>
    <Nanoform_Node hsn=3 neid=2>
    <Nanoform_Node hsn=6 neid=3>
</Microform_Node >
```

The final step in Carrier construction is Microform identification, as seen in (149) of FIG. 122. After Nanoform nodes and Nanoform Carrier structures are defined for each microform node, it is possible to calculate the most efficient microform carrier (based on the highest salient value).

The following text outlines the Microform identification process through example. In this 8 Microform class example the following nodes active. Salient Multipliers are also included.

| Node | Salient Multiplier |
|---|---|
| 1 | 1.0 |
| 4 | 1.0 |
| 7 | 1.0 |
| 8 | 0.33 |

FIG. 128 shows the salient weight of the nodes in the Microforms of the 8 Microform Class.

The Microform with the highest salient weight is the most efficient representation of the active nodes. The end results of Microform Identification are that the Microform Carrier is identified, the Harmonic state notation is provided for the microform nodes, and total salience is calculated for the Microform carrier structure.

The following code fragment illustrates a particular aspect of the present invention, namely an XML Carrier representation before the Microform is identified:

```
<Carrier microform_carrier=" total_salience=">
<Microform_Node index=1 hsn=" node_salience="
nanoform_carrier='thru' nano_salience_mult=1.0>
<Nanoform_Node hsn=0 neid=1 />
</Microform_Node >
<Microform_Node index=2 hsn=" node_salience="
nanoform_carrier='null' nano_salience_mult=0>
</Microform_Node >
<Microform_Node index=3 hsn=" node_salience="
nanoform_carrier='null' nano_salience_mult=0>
</Microform_Node >
<Microform_Node index=4 hsn=" node_salience="
nanoform_carrier='thru' nano_salience_mult=1.0>
<Nanoform_Node hsn=0 neid=2 />
</Microform_Node >
<Microform_Node index=5 hsn=" node_salience="
nanoform_carrier='null' nano_salience_mult=0>
</Microform_Node >
<Microform_Node index=6 hsn=" node_salience="
nanoform_carrier='null' nano_salience_mult=0>
</Microform_Node >
<Microform_Node index=7 hsn=" node_salience="
nanoform_carrier='thru' nano_salience_mult=1.0>
<Nanoform_Node hsn=0 neid=3 />
</Microform_Node >
<Microform_Node index=7 hsn=" node_salience="
nanoform_carrier='thru' nano_salience_mult=0.33>
<Nanoform_Node hsn=0 neid=4 />
</Microform_Node >
</Carrier>
```

The following code fragment shows an illustrative XML Carrier representation after the Microform Carrier is identified:

```
<Carrier microform_carrier='8 Tttb' total_salience=224.33>
<Microform_Node index=1 hsn='00' node_salience=128
nanoform_carrier='thru' nano_salience_mult=1.0>
<Nanoform_Node hsn=0 neid=1 />
</Microform_Node >
<Microform_Node index=2 hsn='03' node_salience=0
nanoform_carrier='null' nano_salience_mult=0>
</Microform_Node >
<Microform_Node index=3 hsn='06' node_salience=0
nanoform_carrier='null' nano_salience_mult=0>
</Microform_Node >
<Microform_Node index=4 hsn='30' node_salience=64
nanoform_carrier='thru' nano_salience_mult=1.0>
<Nanoform_Node hsn=0 neid=2 />
</Microform_Node >
<Microform_Node index=5 hsn='33' node_salience=0
nanoform_carrier='null' nano_salience_mult=0>
</Microform_Node >
<Microform_Node index=6 hsn='36' node_salience=0
nanoform_carrier='null' nano_salience_mult=0>
</Microform_Node >
<Microform_Node index=7 hsn='60' node_salience=32
nanoform_carrier='thru' nano_salience_mult=1.0>
<Nanoform_Node hsn=0 neid=3 />
</Microform_Node >
<Microform_Node index=7 hsn='65' node_salience=0.33
nanoform_carrier='thru' nano_salience_mult=0.33>
<Nanoform_Node hsn=5 neid=4 />
</Microform_Node >
</Carrier>
```

Exceptions in the salient ordering of Microforms exist. FIG. 129 shows cases where the salient weighting for active nodes will result in the same weighting. In order to resolve this ambiguity, the highest ordered Microform from the Microform index is used. The following table illustrates selection of the highest order Microform within a Microform class.

| 8 Microform Class |
|---|
| >8 B+BbbBbb |
| 8 Tttb |
| 8 Ttbt |
| 8 Tbtt |

The Modulator construction process, as seen in (151) of FIG. 122 generally has three steps: note-on detection, controller stream detection, and translation of MIDI data into modulator data.

Figure 130:
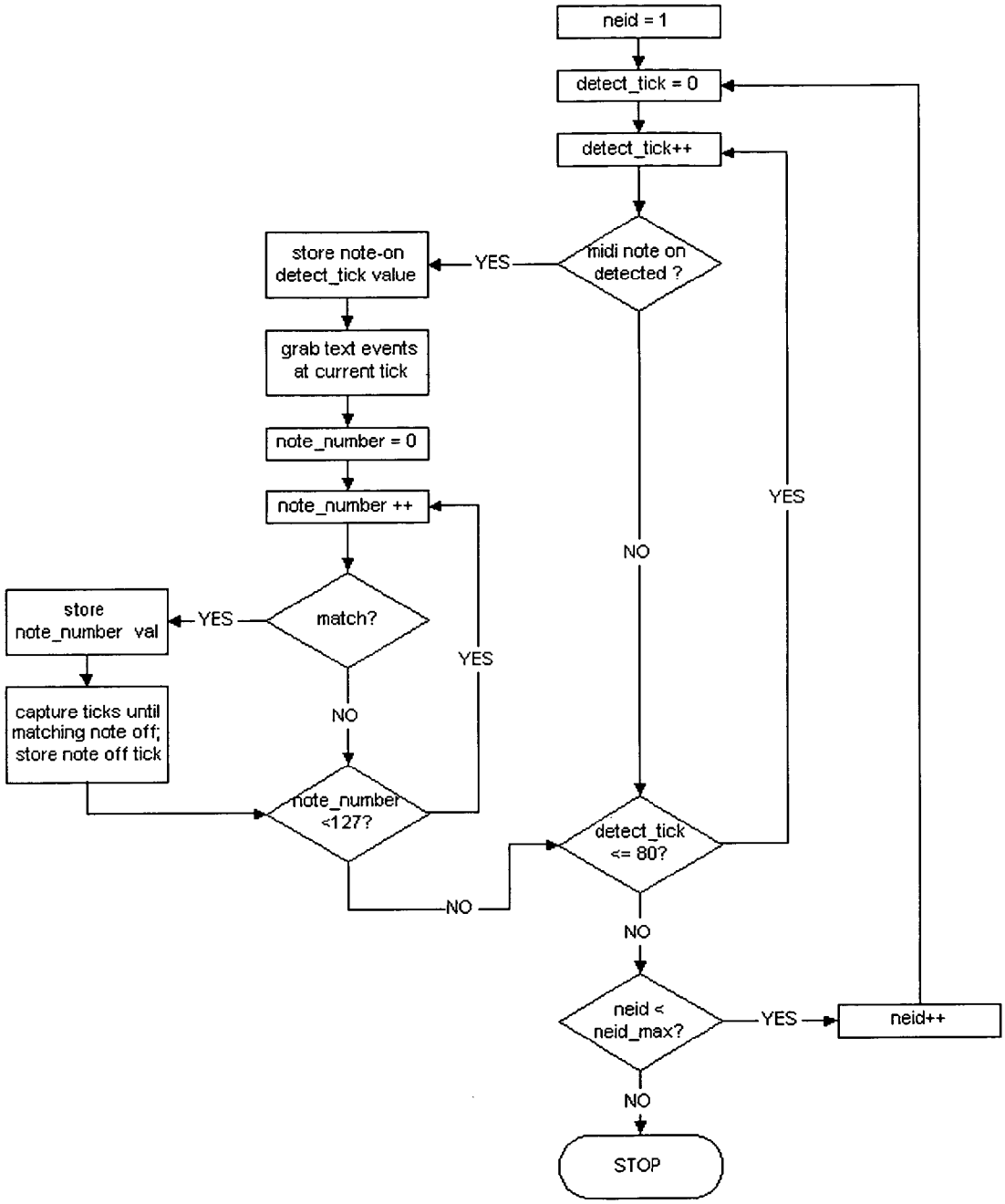

The first step in Modulator construction is note-on detection, as seen in (153) of FIG. 122. FIG. 130 shows a note-on detection algorithm that detects monophonic and polyphonic Note Events.

The second step in Modulator construction is controller stream detection, as seen in (155) of FIG. 122. Controllers such as volume, brightness, and pitchbend produce a stream of values that are defined on a tick-by-tick basis. FIG. 131 illustrates a particular aspect of the Translation Engine of the present invention, namely a MIDI control stream detection algorithm. FIG. 132 illustrates the control stream association logic. MIDI control streams (160) are associated with a Note Event (64) for the duration of the Note Event (64), or until a new Note Event (64) is detected.

The final stage in Modulator construction is translation of detected MIDI data into Modulator data, as seen in (157) of FIG. 122. The following code fragment shows illustrates a particular processing method for arriving at the resulting data from note-on and control stream detection in a Modulator construction:

```
neid1
        midi_note, start_tick, duration
        (text events)
        [0,vol_val,pb_val, bright_val]
[1,vol_val,pb_val, bright_val]
[2,vol_val,pb_val, bright_val]
[3,vol_val,pb_val, bright_val]
[4,vol_val,pb_val, bright_val]
[5,vol_val,pb_val, bright_val]
[6,vol_val,pb_val, bright_val]
        . . .
neid2
        midi_note, start_tick, duration
        midi_note, start_tick, duration
        (text events)
[0,vol_val,pb_val, bright_val]
[1,vol_val,pb_val, bright_val]
[2,vol_val,pb_val, bright_val]
[3,vol_val,pb_val, bright_val]
[4,vol_val,pb_val, bright_val]
        . . .
. . .
```

FIG. 133 illustrates Modulator translation from detected note and control stream data.

The compositional partial (68) is assembled in the following manner: Relative pitch (162) and delta octave (164) are populated by the passing the MIDI note number and environment Key to a relative pitch function (165). Passing the detected note event tick duration (167) to a greedy function which populates eighth, sixteenth and 32nd coarse duration values (168). The greedy function is similar to a mechanism that calculates the change due in a sale. Finally, lyric (170) and timbre (172) information are populated by MIDI text events (173).

The temporal partial (70) is assembled in the following manner: Pico position offset (174) is populated by start tick minus 40 (175). Pico duration offset (176) is populated by the tick remainder minus 40 (177) of the greedyDuration function.

The event expression stream (72) is populated (179) by the MIDI controller array associated with the Note Event.

In the Final Output, Note Variants are ordered by ascending MIDI note number, in one particular implementation. Temporal partials are replicated for each Note Variant (based on current technology). The following code fragment illustrates the modulator structure in an XML format:

```
<Modulator_Content>
    <Compositional_Content>
        <Compositional_Event neid=1>
<Comp_Partial id=1 octave=mid rel_pitch=tnc dur8=1 dur16=1 dur32=0
lyric=" timbre="/>
        </Compositional_Event>
        <Compositional_Event neid=2>
            <Comp_Partial id=1 octave=mid rel_pitch=+3
dur8=1 dur16=1 dur32=0 lyric=" timbre="/>
        </Compositional_Event>
        <Compositional_Event neid=3>
            <Comp_Partial id=1 octave=mid rel_pitch=p4
dur8=1 dur16=2 dur32=0 lyric=" timbre="/>
        </Compositional_Event>
        <Compositional_Event neid=4>
            <Comp_Partial id=1 octave=mid rel_pitch=+2
dur8=1 dur16=1 dur32=0 lyric=" timbre="/>
        </Compositional_Event>
    </Compositional_Content>
    <Mechanical_Content>
        <Mechanical_Event neid=1>
            <Temp_Partial id=1 pico_position=−5
            pico_duration=−10 />
            <Expression_Stream>
                <tick=0 vol=64 pitch_bend=45 bright=20>
                <tick=1 vol=70 pitch_bend=42 bright=22>
                <tick=2 vol=73 pitch_bend=48 bright=24>
                . . .
            </Expression_Stream>
```

-continued

```
        </Mechanical_Event>
        <Mechanical_Event neid=2>
            <Temp_Partial id=1 pico_position=−7
            pico_duration=+2 />
            <Expression_Stream>
                <tick=0 vol=64 pitch_bend=45 bright=20>
                <tick=1 vol=70 pitch_bend=42 bright=22>
                . . .
            </Expression_Stream>
        </Mechanical_Event>
        <Mechanical_Event neid=3>
            <Temp_Partial id=1 pico_position=+10
            pico_duration=−15 />
            <Expression_Stream>
                <tick=0 vol=64 pitch_bend=45 bright=20>
                <tick=1 vol=70 pitch_bend=42 bright=22>
                <tick=2 vol=73 pitch_bend=48 bright=24>
                . . .
            </Expression_Stream>
        </Mechanical_Event>
        <Mechanical_Event neid=4>
            <Temp_Partial id=1 pico_position=+3
            pico_duration=+7 /
            <Expression_Stream>
                <tick=0 vol=64 pitch_bend=45 bright=20>
                <tick=1 vol=70 pitch_bend=42 bright=22>
                <tick=2 vol=73 pitch_bend=48 bright=24>
                . . .
            </Expression_Stream>>
        </Mechanical_Event>
    </Mechanical_Content>
</Modulator_Content>
```

The final stage of Performance Element Creation is Carrier/Modulator integration as seen in (159) of FIG. 122. FIG. 134 illustrates Carrier/Modulator integration. The Carrier structure is detected and identified. Modulators are detected and constructed. Modulators are then associated to carrier nodes through Note Event IDs. The following code fragment illustrates the complete XML structure for a detected Performance Element:

```
<Detected_Performance_Gene>
<Carrier microform_carrier='8 Tttb' total_salience=224.33>
<Microform_Node index=1 hsn='00' node_salience=128 nanoform_carrier='thru'
nano_salience_mult=1.0>
<Nanoform_Node hsn=0 neid=1 />
</Microform_Node >
<Microform_Node index=2 hsn='03' node_salience=0 nanoform_carrier='null'
nano_salience_mult=0>
</Microform_Node >
<Microform_Node index=3 hsn='06' node_salience=0 nanoform_carrier='null'
nano_salience_mult=0>
</Microform_Node >
<Microform_Node index=4 hsn='30' node_salience=64 nanoform_carrier='thru'
nano_salience_mult=1.0>
<Nanoform_Node hsn=0 neid=2 />
</Microform_Node >
<Microform_Node index=5 hsn='33' node_salience=0 nanoform_carrier='null'
nano_salience_mult=0>
</Microform_Node >
<Microform_Node index=6 hsn='36' node_salience=0 nanoform_carrier='null'
nano_salience_mult=0>
</Microform_Node >
<Microform_Node index=7 hsn='60' node_salience=32 nanoform_carrier='thru'
nano_salience_mult=1.0>
<Nanoform_Node hsn=0 neid=3 />
</Microform_Node >
<Microform_Node index=7 hsn='65' node_salience=0.33
nanoform_carrier='thru' nano_salience_mult=0.33>
<Nanoform_Node hsn=5 neid=4 />
```

-continued

```
</Microform_Node >
</Carrier>
continued . . .
<Modulator_Content>
    <Compositional_Content>
        <Compositional_Event neid=1>
<Comp_Partial id=1 octave=mid rel_pitch=tnc dur8=1 dur16=1 dur32=0 lyric=''
timbre=''/>
        </Compositional_Event>
        <Compositional_Event neid=2>
            <Comp_Partial id=1 octave=mid rel_pitch=+3 dur8=1
dur16=1 dur32=0 lyric='' timbre=''/>
        </Compositional_Event>
        <Compositional_Event neid=3>
            <Comp_Partial id=1 octave=mid rel_pitch=p4 dur8=1
dur16=2 dur32=0 lyric='' timbre=''/>
        </Compositional_Event>
        <Compositional_Event neid=4>
            <Comp_Partial id=1 octave=mid rel_pitch=+2 dur8=1
dur16=1 dur32=0 lyric='' timbre=''/>
        </Compositional_Event>
    </Compositional_Content>
    <Mechanical_Content>
        <Mechanical_Event neid=1>
            <Temp_Partial id=1 pico_position=−5 pico_duration=−10 />
            <Expression_Stream>
                <tick=0 vol=64 pitch_bend=45 bright=20>
                <tick=1 vol=70 pitch_bend=42 bright=22>
                <tick=2 vol=73 pitch_bend=48 bright=24>
                . . .
            </Expression_Stream>
        </Mechanical_Event>
        <Mechanical_Event neid=2>
            <Temp_Partial id=1 pico_position=−7 pico_duration=+2 />
            <Expression_Stream>
                <tick=0 vol=64 pitch_bend=45 bright=20>
                <tick=1 vol=70 pitch_bend=42 bright=22>
                . . .
            </Expression_Stream>
        </Mechanical_Event>
        <Mechanical_Event neid=3>
            <Temp_Partial id=1 pico_position=+10 pico_duration=−15 />
            <Expression_Stream>
                <tick=0 vol=64 pitch_bend=45 bright=20>
                <tick=1 vol=70 pitch_bend=42 bright=22>
                . . .
            </Expression_Stream>
        </Mechanical_Event>
        <Mechanical_Event neid=4>
            <Temp_Partial id=1 pico_position=+3 pico_duration=+7 />
            <Expression_Stream>
                <tick=0 vol=64 pitch_bend=45 bright=20>
                <tick=1 vol=70 pitch_bend=42 bright=22>
                <tick=2 vol=73 pitch_bend=48 bright=24>
                . . .
            </Expression_Stream>>
        </Mechanical_Event>
    </Mechanical_Content>
</Modulator_Content>
</Detected_Performance_Gene>
```

Classification and Mapping of Performance Elements

The third function of the Song Framework is the population of the Instrument Performance Tracks through a performance analysis, as seen in (119) of FIG. 116. The second process within performance analysis is the classification and mapping of Performance Elements Process, as seen in (117) of FIG. 116.

FIG. 135 illustrates the classification of Performance Elements. The newly detected Performance Element (74) is introduced to the Performance Element Collective (34) for a particular Instrument Performance Track. The Performance Element Collective (34) compares the candidate Performance Element (74) against the existing Performance Elements in the Collective, by subjecting it to a series of equivalence tests. The compositional equivalences tests consist of a context summary comparison (195), and a compositional partial comparison (197). The mechanical equivalences tests consist of a temporal partial comparison (199), and a event expression stream comparison (201).

The first equivalence test is the context summary comparison, as seen in (195) of FIG. 135. The context summary comparison looks for a match in the Microform Carrier Signature, and total salience value. FIG. 136 illustrates the context summary comparison flowchart.

The second equivalence test is the compositional partial comparison, as seen in (197) of FIG. 135. The compositional partial comparison looks for a match in the delta octave and relative pitch parameters of the compositional partial. FIG. 137 illustrates the compositional partial comparison.

If the candidate Performance Element returns positive results for the first two equivalence tests, then the candidate Performance Element is compositionally equivalent to a pre-existing Performance Element in the Performance Element Collective. If the candidate Performance Element returns a negative result to either of the first two equivalence tests, then the candidate Performance Element is compositionally unique in the Performance Element Collective.

If the candidate Performance Element is compositionally unique, then the mechanical data of the newly detected Performance Element is used to create a new mechanical index within the newly created compositional group.

However, if the candidate Performance Element is determined to be compositionally equivalent to a pre-existing Performance Element in the Performance Element Collective, then the following tests are performed to determine if the mechanical data is equivalent to any of the pre-existing mechanical indexes in the compositional group.

The third equivalence test is the temporal partial comparison, as seen in (199) of FIG. 135. The temporal partial comparison accumulates a total variance between the pico position offsets in the candidate Performance Element, and pico position offsets in a pre-existing Performance Element in the compositional group. FIG. 138 illustrates the temporal partial comparison.

The fourth equivalence test is the event expression stream comparison, as seen in (201) of FIG. 135. The event expression stream comparison accumulates a total variance, between pico tuning, volume, and brightness in the candidate Performance Element, and pico tuning, volume, and brightness in a pre-existing Performance Element in the compositional group. FIG. 139 illustrates the event expression stream comparison.

If the candidate Performance Element returns a total variance within the accepted threshold for the third and fourth equivalence tests, then the candidate Performance Element is mechanically equivalent to a pre-existing mechanical index within the compositional group.

If the candidate Performance Element returns a total variance that exceeds the accepted threshold for either of the third or fourth equivalence tests, then the candidate Performance Element is mechanically unique within the compositional group.

FIG. 140 visualizes population and mapping of the classification result to the current analysis location. If the candidate Performance Element is found to be compositionally equivalent (180) or mechanically equivalent (182) to a pre-existing entry in the Performance Element Collective (34), the indexes of the matching Performance Elements are identified (183) and the classification result is populated (185) with the matching Performance Element indexes. If the candidate Performance Element is determined to be compositionally unique (186) or mechanically unique (188), new indexes are created (189) in the Performance Element Collective (34), and the classification result is populated (185) with the newly created Performance Element indexes. The index results of the classification process are mapped (191) to the current analysis location in the Instrument Performance Track (82), and the analysis location is incremented (193) to the next bar.

Song Framework Repository Functionality

FIG. 141 illustrates an overview of the Song Framework Repository functionality. The Song Framework Repository is best understood as a known database and associated utilities such as database management utilities, for storing and retrieving music file representations of the present inventions, and further, analyzing such music file representations.

The first function of the Song Framework Repository is the insertion and normalization (37) of Performance Elements (74) within the local Song Framework Output to the universal compositional Performance Element Collective (202) and the mechanical Performance Element Collective (204). The second function of the Song Framework Repository functionality is the re-mapping (41) of Framework Elements (32) of the local Song Framework Output (30) with newly acquired universal Performance Element indices. The third function of the Song Framework Repository is the insertion (39) of the re-mapped Song Framework Output (30) into the Framework Output Store (206).

"Song Framework Repository functionality" utilizes the functionality of the Song Framework Repository database. The Song Framework Repository database accepts a Song Framework Output XML file as input.

FIG. 142 visualizes the components of the Song Framework Repository database, in one particular implementation thereof. A comparison facility (208) analyzes the new Song Framework Output XML file (132) in order to normalize and re-map its components against the pre-existing Song Framework Outputs in the Song Framework Repository database (38). The database management facility (60) then allocates the components of the new Song Framework Output XML file (132) into the appropriate database tables within the Song Framework Output Repository database (38).

FIG. 143 illustrates the insertion and normalization of local Performance Elements, as seen in (37) of FIG. 141. Upon introduction to the Song Framework Repository database (38), all of the compositional Performance Elements (94) and mechanical Performance Elements (96) of the local Song Framework Output are re-classified (37) by the universal compositional Performance Element Collective (202) and the mechanical Performance Element Collective (204). The re-classification process is generally the same process employed by the Song Framework, as seen in FIG. 135 for the initial classification of the Performance Elements in the local Performance Element Collectives.

FIG. 144 illustrates the re-mapping of Framework Elements within the Local Song Framework Output, as seen in (41) of FIG. 141. All of the local Instrument Performance Tracks (82) in all of the Framework Elements of the local Song Framework Output are re-mapped (41) with the newly acquired universal Performance Element indexes.

FIG. 145 illustrates insertion of the re-mapped Song Framework Output into the Framework Output store, as seen in (39) of FIG. 141. The re-mapped Song Framework Output (30) is inserted (39) into the Framework Output store (206) and the Song Framework Output (30) reference is then added (209) to all the newly classified Performance Elements in the universal Performance Element Collectives.

Reporting

The Reporting Facility of the current invention is generally understood as a known facility for accessing the Song Framework Repository Database and generating a series of reports based on analysis of the data thereof.

The Reporting Facility, in a particular implementation thereof, generates three types of reports. The Song Framework Output checksum report generates a unique identifier for every Song Framework Output inserted into the Song Framework Repository. The originality report indicates common usage of Performance Elements in the Song Framework Repository. Third, the similarity report produces a detailed content and contextual comparison of two Song Framework Outputs.

FIG. 146 illustrates the reporting functionality of the current invention. Currently the report facility (58) queries (211) the Song Framework Repository database (38), and translates (213) the Song Framework Output XML data (132) into Structure Vector Graphics (SVG) and HTML pages (214). The reporting facility will be expanded in the future to generate various output formats.

A Song Framework Output checksum will be generated from the following data. The total number of bars multiplies by total number of Instrument Performance Tracks, total number of compositional Performance Elements in Song Framework Output, total number of Mechanical Performance Elements in Song Framework Output, and accumulated total salient value for all compositional Performance Elements in the Song Framework Output. A representative Song Framework Output Checksum example would be: 340.60.180.5427.

An originality report is generated for every Song Framework Output inserted into the Song Framework Repository. FIG. 147 shows the elements of the originality report. A histogram is created for each compositional and mechanical Performance Element in the Song Framework Output. The histogram indicates the complete usage of the Performance Element in the entire Song Framework Repository database. The number of Song Framework Outputs that share a variable amount of Performance Elements with the current Song Framework Output is also indicated.

The originality report will grow in accuracy as more Song Framework Output files are entered into the Song Framework Repository database. The comparisons in the originality report will form the basis of an automated infringement detection process as detailed in the "Content Infringement Detection" application below.

Similarity reporting is performed to compare the content and contextual similarities of two specific Song Framework Outputs. FIG. 148 illustrates the three content comparison reports and three context comparison reports. The content comparison reports consist of a total similarity comparison (215), a compositional content distribution comparison (217), and a mechanical content comparison (219). The context comparison reports consist of a full Framework Element comparison (221), a compositional context comparison (223), and a mechanical context comparison (225).

The total compositional similarity report as seen in (215) of FIG. 148 indicates the following: The number of compositionally similar (shared) Performance Elements between the two Song Framework Outputs, the total number of Performance Elements for both Song Framework Outputs are determined, and the content percentage of the common material is determined for each Song Framework Output.

The following table illustrates this comparison:

| Common Performance Elements | Total Performance Elements | Common Percentage of Total |
|---|---|---|
| 5 | 42 | 11.9% |
| | 33 | 15.1% |

FIG. 149 illustrates the compositional content distribution report as seen in (217) of FIG. 148. The compositional content distribution report indicates the distribution of similar compositional Performance Elements (94) in the Performance Element Collectives (34).

FIG. 150 illustrates the mechanical similarity report as seen in (219) of FIG. 148. For each compositionally similar Performance Element (94), an ordered comparison of the mechanical Performance Elements (96) is performed. The number of mechanical comparisons will be limited to the smallest number of Mechanical Performance Elements (96). The degree of mechanical similarity will be colour coded according to total variance.

FIG. 151 illustrates the full Framework Element comparison report as seen in (221) of FIG. 148. Framework Elements (32) of both Song Framework Outputs (30) are compared sequentially.

FIG. 152 illustrates the compositional context distribution report as seen in (223) of FIG. 148. The compositional context distribution report indicates the isolated distribution of similar compositional Performance Elements (94) in Framework Elements (32).

FIG. 153 illustrates the mechanical context distribution report as seen in (225) of FIG. 148. The mechanical context distribution report indicates the isolated distribution of similar mechanical Performance Elements (96) in Framework Elements (32).

Applications of the System of the Current Invention

FIG. 154 illustrates one particular embodiment of the system of the present invention. A known computer is illustrated. The computer program of the present invention is linked to the computer. It should be understood that the present invention contemplates the use of a server computer, personal computer, web server, distributed network computer, or any other form of computer capable of computing the processing steps described herein.

The computer (226), in one particular embodiment of the system, will generally link to audio services to support the Audio to MIDI conversion application (54) functionality. The Translation Engine (56) of the present invention, in this embodiment, is implemented as a CGI-like program that would process a local MIDI file. The Song Module Repository database (38) stores the Song Framework Output XML files, and a Web Browser (228) or other application that enables viewing is used to view the reports generated by the Reporting Application (58).

FIG. 155 illustrates a representative client/server deployment of the system of the current invention. The system of the current invention can also be deployed in a client/server environment. The Audio Conversion application (54) would be distributed on multiple workstations (230) with audio services in a secure LAN/WAN environment. The Translation Engine (56) would be implemented on a server (232), and would be accessed by the workstations (230), for example, through a secure logon process. The Translation Engine (56) would upload the XML files described above to the Song Framework Repository database (38) through a secure connection. A server (232) would host the Song Framework Repository database (38) and the Reporting application (58) to generate SVG and HTML pages. A Web Browser (228) would access the reporting functionality through a secure logon process. The Translation Engine (56), Song Framework Repository (38), and Reporting application (58) could alternatively share a single server (232), depending on the scale of the deployment. Otherwise, a distributed server architecture could be used, in a manner that is known.

FIG. 156 illustrates a client/server hierarchy between satellite Song Framework Repository servers (234) and a Master Song Framework Repository server (236). The satellite Song Framework Repository servers (234) would incrementally upload their database contents to a Master Song Framework Repository server (236) through a secure connection. The Master Song Framework Repository (236) would normalize the data from all of the satellite Song Framework Repositories (234).

The Reporting functionality of the system of the current invention can be accessed through the Internet via a secure logon to a Song Framework Repository Server. An Electronic Billing/Account System would be implemented to track and charge client activity.

A number of different implementations of the system of the present invention are contemplated. For example, (1) a musical content registration system; (2) musical content infringement detection system; and (3) musical content verification system. Other application or implementations are also possible, using the musical content Translation Engine of the present invention.

There are two principal aspects to the musical content registration system of the present invention. The first is a relatively small-scale Song Framework Output Registry service that is made available to independent recording artists. The second is an Enterprise-scale Song Framework Output Registry implementation made available to large clients, such as music publishers or record companies. The details of implementation of these aspects, including hardware/software implementations, database implementations, integration with other system, including billing systems etc. are can all be provided by a person skilled in the art.

FIG. 157 illustrates the small-scale Song Framework Output Registry process. The small-scale content registration involves generally the following steps: First, the upload technician (18) uploads (21) multi-track audio files (2) to the Audio to MIDI conversion workstation (20) in order to perform an environment setup, as described in the "Preparation of multi-track audio for analysis section". Following the environment setup, the content owner (16) supplements (23) the required user data (14) for the appropriate tracks. Alternatively, the satellite technician sends (27) audio tracks (2) to an analysis specialist (24) through a secure network. The specialist supplies user data (14) for the requested audio tracks (2). Once the audio analysis process is complete, a client package (238) is prepared (239) for upload to a central processing station (240). At the central processing station (240), the client package (238) is reviewed (241) for quality assurance purposes, and the intermediate MIDI file (26) is then uploaded (31) to the Translation Engine (56) to create a Song Framework Output XML file (132). The Song Framework Output XML file (132) is then inserted (39) into the Song Framework Registry database (38), and the appropriate reports (242) are generated. Finally, the reports (242) are sent back (243) to the content owner (16).

FIG. 158 illustrates the Enterprise-scale Song Framework Output Registry process. The Enterprise-scale content registration process involves the following steps. First, multi-track audio files (2) are prepared to initial specification and uploaded to an Audio to MIDI conversion workstation (20). Next, an upload technician (18) performs an environment setup, as described in the "Preparation of multi-track audio for analysis section". At this point, analysis specialists (24) examine the audio tracks (2) and supplement all of the required user data (14). Once the audio analysis is complete, an intermediate MIDI file (26) is uploaded (31) to a local Translation Engine (56) to create a Song Framework Output XML file (132). The Song Framework Output XML file (132) is inserted (39) to a local Song Framework Repository (234). Finally, the local Song Framework Repository (234) updates its contents (245) to a master Song Framework Repository (236), through a secure batch communication process.

The Content registration services would be implemented using the Client/Server deployment strategy.

A second application of the system of the current invention is a content infringement detection system.

The process for engaging in compositional analysis of music to identify copyright infringement is currently as follows. Initially, a musicologist may transcribe the infringing sections of each musical composition to standard notation. The transcription is provided as a visual aid for an auditory comparison. Subsequently, the musicologist will then perform the isolated infringing sections (usually on a piano) in order to provide the court with an auditory comparison of the two compositions. The performed sections of music are rendered at the same key and tempo to ease comparison of the two songs.

In order to test for a mechanical copyright infringement, audio segments of the infringing recordings are played for a jury. Waveform displays may also be used as a visual aid for the auditory comparison.

In both types of infringement, the initial test is auditory. The plaintiff has to be exposed to the infringing material, and then be able to recognize their copyrighted material in the defendant's work.

The system of the current invention provides two additional inputs to content infringement detection. The infringement notification service would automatically notify copyright holders of a potential infringement between two songs (particularized below). Also, the similarity reporting service described above would provide a fully detailed audio-visual comparison report of two songs, to be used as evidence in an infringement case. This report could be used FIG. 159 shows a comparison of Standard Notation vs. the Musical representation of the current invention.

FIG. 160 shows the automated infringement detection notification process. The infringement notification service is triggered automatically whenever a new Song Framework Output XML file (132) is entered (39) into the Song Framework Repository database (38). If the new Song Framework Output XML file (132) has exceeded a threshold of similarity with an existing Song Framework Output in the Song Framework Repository database (38), Content owners (16) and legal advisors (246) are notified (247). The infringement notification (247) serves only as a warning of a potential infringement.

FIG. 161 shows the similarity reporting process. The similarity reporting service provides an extensive comparison of two Song Framework Output XML files (132) in the case of an alleged infringement. The content owners (16) upload (39) their Song Framework Output XML files (132) into the Song Framework Repository database (38). The generated similarity report (248) not only indicates content similarity of compositional and mechanical Performance Elements, but also indicates the usage context of the similar elements within both Song Framework Outputs.

The content infringement detection services could be implemented using the standalone deployment strategy. Alternatively, this set of services could be implemented using the client/server deployment strategy.

A third application of the system of the current invention is content verification. Before content verification is discussed, a brief review of existing content verification methods is useful for comparison.

The IRMA anti piracy program requires that a replication rights form be filled out by the by a recording artist who wants to manufacture a CD. This form requires the artist to certify their ownership, or to disclose all of the copyright information for songs that will be manufactured. Currently there is no existing recourse for the CD manufacturer to verify the replication rights form against the master recording.

FIG. 162 visualizes the content verification process. The system of the current invention's content verification process is as follows: First, the content owner (16) presents the Song Framework Output reports (242) of analyzed songs to the music distributor such as a CD manufacturer (250). Next, The CD manufacturer (250) loads the Song Framework Output report (242) into reporting workstation (252) and the song status is queried (251) using checksum values through a secure internet connection. In response to the CD manufacturer query (251), the Master Song Framework Registry (236) returns (253) a status report (254) to the CD manufacturer (250). The status report (254) verifies song content (samples and sources), authorship, creation date, and litigation the status of the song. Upon confirmation of the master recording (256) content, the CD manufacturer (250) can accept the master recording (256) at a lower risk of copyright infringement.

The content verification process can also be used by large-scale content licensors/owners to verify a new submission for use. Music publishers, advertising companies that license music, and record companies would also be able to benefit from the content verification process The content verification services could be implemented using the remote reporting deployment strategy.

It should be understood that the various processes and functions described above can be implemented using a number of different utilities, or one or lesser number of utilities than is described, in a manner that is known. The particular hardware or software implementations are for illustration purposes only. A person skilled in the art can adapt the invention described to alternate hardware or software implementations. For example, the present invention can also be implemented to a wireless network.

It should also be understood that the present invention involves an overall method, and within the overall method a series of sub-sets of steps. The ordering of the steps, unless specifically stated is not essential. One or more of the steps can be incorporated into a lesser number of steps than is described, or one or more of the steps can be broken into a greater number of steps, without departing from the invention. Also, it should be understood that other steps can be added to the method described without diverging from the essence of the invention.

Numerous extensions of the present inventions are possible.

For example, the Song Framework Registry could be used to identify common patterns within a set of Song Framework Outputs. This practice would be employed to establish a set of metrics that could identify a set of "best practices" or "design patterns" of the most popular songs within a certain genre. The information can be tied to appeal of specific design patterns to specific demographics. This content could be used as input, for example, to a music creation tool to improve the mass appeal of music, including to specific demographics.

As a further example, performance Elements can be stored in the Song Framework Repository with software synthesizer data and effects processor data allocated to the Instrument. The synthesizer data and effects processor data would allow a consistent playback experience to be transported along with the performance data. This practice would be useful for archival purposes, in providing a compact file format and a consistent playback experience.

As a still further example, the system of the current invention can be used to construct new Performance Elements, or create a new song out of existing Performance Elements within the Song Framework Registry. Alternatively, the system of the current invention would be used to synthesize new Performance Elements, based on seeding a generator with existing Performance Elements. This practice would be useful in developing a set of "rapid application development" tools for song construction.

The system of the current invention could be extended to use a standardized notation export format, such as MusicXML as an intermediate translation file. This would be useful in extending the input capabilities of the Translation Engine.

For the sake of clarity, it should also be understood that the present invention contemplates application of the invention to one or more music libraries to generate the output described.

The invention claimed is:

1. A computer implemented method of converting one or more electronic music files into an electronic musical representation, the computer implemented method comprising the steps of:

(a) providing a song framework including a plurality of song framework rules and associated processing steps for converting a one or more track electronic music file into a song framework output, the song framework output defining:

(i) one or more framework elements;

(ii) one or more performance elements, being bar-level representations of one track of the one or more track electronic music file comprising a structure incorporating at least one of the following:

(A) metric information;

(B) non-metric information being one or more compositional elements and one or more mechanical elements; and (C) expressive information being one or more mechanical performance elements; and (iii) a performance element collective, that functions to perform the further steps of:

(A) maintaining a collection of performance elements within a song framework out put, such performance elements being non-matching to other performance elements in the collection;

(B) identifying performance elements according to at least metric information and pitch sequence equivalence; and (C) grouping mechanical performance elements within a grouping structure consisting of performance elements that have common compositional performance elements; and (b) applying the plurality of song framework rules to each track of the one or more track electronic music file, thereby:

(i) detecting the one or more performance elements of each track of the one or more track electronic music file;

(ii) classifying each of the detected one or more performance elements as matching or non-matching, involving a comparison of the metric information, mechanical performance elements, and compositional performance elements of the performance elements to other performance elements stored in the performance element collective; and (iii) mapping each of the one or more performance elements to the corresponding framework elements.

2. The computer implemented method claimed in claim 1, whereby each of the one or more framework elements is comprised of:

(a) phrase-level metric hierarchy;

(b) an environment track, comprising one or more environment partials mapped across the one or more performance events for the one or more framework elements, said environment partials comprising tempo and key vectors; and (c) a plurality of instrument performance tracks.

3. The computer implemented method claimed in claim 2, whereby:

(a) the function of the environment track is to provide tempo and tonality parameters for each of the one or more performance elements mapped to a particular framework element; and (b) the function of each instrument performance track is to associate a sequence of performance elements with a particular instrument, over the course of the framework element.

4. The computer implemented method claimed in claim 3, whereby the function of each of the one or more performance elements is to map a sequence of note events to a bar-level metric hierarchy, in order to create a bar of music.

5. The computer implemented method claimed in claim 1, whereby the framework elements are derived from one or more environmental parameters defined by the one or more electronic music files, including one or more of: time signature; tempo; key; or song structure.

6. The computer implemented method claimed in claim 1, whereby the one or more electronic music files consist of one or more MIDI files.

7. The computer implemented method claimed in claim 1, comprising the further step of preparing the one or more electronic music files by performing the following functions:

(a) digitizing each track of the one or more electronic music files, being one or more track electronic music files, to define a single continuous wave file having a substantially consistent length, each wave file being referenced to a common audio marker;

(b) determining audio parameters of the electronic music file, the audio parameters including one or more of the following:

(ii) an audio format; and (ii) a source and time index;

for sampled material included in the one or more electronic music files;

(c) determining song environment data for the one or more electronic music files;

(d) defining parameters for an environment track linked to the one or more electronic music files, said environment track comprising one or more environment partials mapped across the one or more performance events for the one or more framework elements, said environment partials comprising tempo and key vectors;

(e) analyzing each track of the one or more electronic files to determine the musical parameters of said track, said musical parameters including whether the track is: pitched; pitched vocal; percussion or complex; includes a single voice instrument; solo vocal; or multiple vocals;

(f) based on (e) analyzing each track of the one or more electronic files to determine which one of a plurality of operations for converting audio data to MIDI data should be applied to a particular track of the one or more electronic files; and (g) applying the corresponding conversion operation to each track of the one or more electronic files, based on (f).

8. The computer implemented method claimed in claim 1, comprising the further step of applying the plurality of song framework rules in sequence so as to:

(a) construct a framework sequence defining the main sections of a song, and further construct the one or more framework elements;

(b) define instrument performance tracks for the one or more framework elements; and (c) apply a performance analysis operable to:

(i) generate performance elements from the one or more electronic music files; and (ii) map indexes corresponding to the performance elements to the corresponding instrument performance tracks, thereby populating the instrument performance tracks.

9. The computer implemented method claimed in claim 8, whereby the one or more performance elements are generated by:

(a) construction of a carrier structure by:

(i) identifying capture addresses within each beat;

(ii) determining a most salient nanoform carrier structure to represent each beat, being configured to represent metric patterns and variations within note event windows of each measure; and (iii) determining a most salient microform carrier to represent a metric structure of the particular performance element, being configured to represent containing structures for sequences of one or more of the nanoform carrier structures across a bar-length even window of an electronic music stream of the one or more track electronic music file;

(b) construction of a performance element modulator by:

(i) detecting note-on data;

(ii) detecting and allocating controller events; and (iii) translation of (i) and (ii) into performance element modulator data; and (c) associating performance element modulator data with corresponding microform carriers or nanoform carrier structures through note event identifiers, thereby defining the particular performance element.

10. The computer implemented method of claim 8, whereby the application of the performance analysis consists of the further steps of:

(a) introducing the generated performance elements into the performance element collective for a particular instrument performance track; and (b) comparing the performance elements against existing performance elements in the performance element collective based on a series of equivalence tests.

11. The computer implemented method claimed in claim 1, comprising the further step of applying the plurality of song framework rules to a MIDI file by operation of a translation engine, and thereby creating a song framework output file.

12. The computer implemented method of claim 1, comprising the further step of configuring a computer to apply the plurality of rules and associated processing steps to the one or more electronic music files.

13. The computer implemented method claimed in claim 1, comprising the further step of defining the one or more performance elements by way of a performance element modulator operable to determine for each bar of a track of the one or more track electronic music file:

(a) one or more compositional performance elements, representing a theoretical layer and being capable of capturing an abstracted or quantized container level representation of pitch, duration and meter information; and (b) one or more mechanical performance elements, representing a performance reproductive layer and serving to capture expressive information contained in continuous controller data of the one or more track electronic music file as input media and the event variance in pitch, duration and meter information from the quantized compositional performance element.

14. The computer implemented method claimed in claim 1, comprising the further step of generating one or more reports by way of a reporting facility that is operable to generate originality reports in regard to one or more electronic music files selected by a user, said originality reports detailing whether performance elements of one or more of the electronic files are matching the one or more performance elements stored in the performance element collective.

15. A computer system for converting one or more electronic music files into an electronic musical representation comprising:

(a) a computer; and (b) a computer application including computer instructions for configuring one or more computer processors to apply or facilitate the application of the computer instructions defining a music analysis engine on the computer, the music analysis engine being operable to define a song framework that includes a plurality of song framework rules and associated processing steps for converting the one or more electronic music files into a song framework output, the song framework output defining:

(i) one or more framework elements;

(ii) one or more performance elements, being bar-level representations of one track of a one or more track electronic music file comprising a structure incorporating at least one of the following:

(A) metric information;

(B) non-metric information being one or more compositional elements and one or more mechanical elements; and (C) expressive information being one or more mechanical performance elements; and (iii) a performance element collective that functions to:

(A) maintain a collection of performance elements within a song framework output, such performance elements being non-matching to other performance elements in the collection;

(B) identify performance elements according to at least metric information and pitch sequence equivalence; and (C) group mechanical performance elements within a grouping structure consisting of performance elements that have common compositional performance elements; and wherein the music analysis engine is operable to apply the plurality of rules of the song framework to each track of the one or more track electronic music file, thereby being operable to:

(iv) detect the one or more performance elements of each track of the one or more track electronic music file;

(v) classify each of the detected one or more performance elements as matching or non-matching, involving a comparison of the metric information, mechanical performance elements, and compositional performance elements of the performance elements to other performance elements stored in the performance element collective; and (vi) map each of the one or more performance elements to the corresponding framework elements.

16. The computer system claimed in claim 15, wherein the computer application includes computer instructions for further defining on the computer a conversion engine that is operable to convert audio files into MIDI files.

17. The computer system claimed in claim 15, wherein the computer system is linked to a database and a database management utility, wherein the computer system is operable to store a plurality of electronic musical representations, including at least performance elements, to the database, the computer system thereby defining an electronic music registration system.

18. The computer system claimed in claim 15, wherein the computer system is linked to a database and a database management utility, wherein the computer system is operable to:

(a) store a plurality of electronic musical representations to a database;

(b) normalize a song framework output's performance element collective against a universal performance element collective stored to the database; and (c) re-map and insert the electronic musical representations of the electronic music file into a master framework output store;

wherein the computer system defines a song framework repository.

19. A computer program product for converting one or more electronic music files into an electronic musical representation, for use on a computer, the computer program product comprising:

(a) a computer useable medium; and (b) computer instructions stored on the computer useable medium, said instructions for configuring one or more computer processors to apply, or facilitate the application of the computer instructions defining a computer application on the computer, and for configuring one or more processors to perform the computer application defining a music analysis engine, the music analysis engine defining a song framework that includes a plurality of rules and associated processing steps for converting the one or more electronic music files into a song framework output, the song framework output defining:

(i) one or more framework elements;

(ii) one or more performance elements, being bar-level representations of one track of the one or more electronic music files comprising a structure incorporating at least one of the following:

(A) metric information;

(B) non-metric information being one or more compositional elements and one or more mechanical elements; and (C) expressive information being one or more mechanical performance elements; and (iii) a performance element collective that functions to:

(A) maintain a collection of performance elements within a song framework output, such performance elements being non-matching to other performance elements in the collection;

(B) identify performance elements according to at least metric information and pitch sequence equivalence; and (C) group mechanical performance elements within a grouping structure consisting of performance elements that have common compositional performance elements; and wherein the music analysis engine is operable to apply the plurality of rules of the song framework to each track included in one or more electronic music files, thereby being operable to:

(iv) detect the one or more performance elements of each track of the electronic music files;

(v) classify each of the detected one or more performance elements as matching or non-matching, involving a comparison of the metric information, mechanical performance elements, and compositional performance elements stored in the performance element collective; and (vi) map each of the one or more performance elements to the corresponding framework elements.

20. The computer program product claimed in claim 19, wherein the computer application further defines on the computer a comparison facility that is operable to compare the electronic musical representations of at least two of the one or more electronic music files, by way of a series of equivalence tests, and establish whether any of the one or more electronic music files include original performance elements of another of the one or more electronic music files.

21. The computer program product claimed in claim 19, wherein the computer application further defines a reporting facility that is operable to generate originality reports, reporting matching performance elements, in regard to one or more electronic music files selected by a user.

* * * * *